US006467557B1

(12) United States Patent
Krueger et al.

(10) Patent No.: US 6,467,557 B1
(45) Date of Patent: Oct. 22, 2002

(54) LONG REACH ROTARY DRILLING ASSEMBLY

(75) Inventors: R. Ernst Krueger, Houston, TX (US); N. Bruce Moore, Aliso Viejo, CA (US); Ronald E. Beaufort, Laguna Niguel, CA (US); Duane T. Bloom, Anaheim, CA (US)

(73) Assignee: Western Well Tool, Inc., Houston, TX (US)

( * ) Notice: Subject to any disclaimer, the term of this patent is extended or adjusted under 35 U.S.C. 154(b) by 0 days.

(21) Appl. No.: 09/629,493

(22) Filed: Jul. 31, 2000

Related U.S. Application Data

(63) Continuation-in-part of application No. 09/549,326, filed on Apr. 13, 2000, and a continuation-in-part of application No. 09/453,996, filed on Dec. 3, 1999, now Pat. No. 6,347,674.

(60) Provisional application No. 60/146,701, filed on Jul. 30, 1999, provisional application No. 60/112,733, filed on Dec. 18, 1998, and provisional application No. 60/168,790, filed on Dec. 2, 1999.

(51) Int. Cl.[7] ..... E21B 47/024; E21B 4/02; E21B 4/04

(52) U.S. Cl. ..... 175/45; 175/51; 175/98; 175/104; 166/255 R

(58) Field of Search ..... 175/51, 97, 98, 175/99, 45, 61, 320, 40, 74, 26, 50, 73; 299/31; 73/152.43, 152.45, 152.46, 152.51; 166/250.01, 255.1, 255.2, 65.1, 50, 117.5, 153

(56) References Cited

U.S. PATENT DOCUMENTS

| | | | | |
|---|---|---|---|---|
| 3,285,350 A | 11/1966 | Henderson | ..... | 175/57 |
| 4,076,084 A | 2/1978 | Tighe | ..... | 175/73 |
| 4,454,598 A | 6/1984 | Claycomb | ..... | 367/83 |
| 4,462,469 A | 7/1984 | Brown | ..... | 175/40 |

(List continued on next page.)

FOREIGN PATENT DOCUMENTS

| | | |
|---|---|---|
| EP | 0 204 474 A1 | 12/1986 |
| EP | 0 209 217 A2 | 1/1987 |

(List continued on next page.)

*Primary Examiner*—David Bagnell
*Assistant Examiner*—Jennifer H Gay
(74) *Attorney, Agent, or Firm*—Christie, Parker & Hale, LLP

(57) ABSTRACT

A long reach rotary drilling assembly comprises an elongated conduit extending through a bore in an underground formation, a drill bit for being rotated to drill the bore, a 3-D steering tool on the conduit for steering the drill bit, and a tractor on the conduit for applying force to the drill bit. The steering tool includes a telemetry section, a rotary section, and a flex section assembled as an integrated system in series along the length of the tool. The flex section comprises a flexible drive shaft to which a bending force is applied when making inclination angle adjustments. The rotary section includes a deflection housing which rotates for making azimuth angle adjustments. The telemetry section receives inclination and azimuth angle steering commands together with actual inclination and azimuth angle feedback signals for controlling operation of the flex section and rotary section to steer the drilling assembly along a desired course. The tractor includes a gripper which can assume a first position that engages an inner surface of the bore and limits relative movement of the gripper relative to the inner surface. The gripper can also assume a second position that permits substantially free relative movement between the gripper and the inner surface of the bore. A propulsion assembly moves the tractor with respect to the gripper while the gripper portion is in the first position. The tractor applies force to the drill bit for drilling the bore along a desired course the direction of which is controlled by the 3-D steering tool.

48 Claims, 95 Drawing Sheets

U.S. PATENT DOCUMENTS

| | | | | | |
|---|---|---|---|---|---|
| 4,597,454 | A | | 7/1986 | Schoeffler | 175/61 |
| 4,612,987 | A | | 9/1986 | Cheek | 166/212 |
| 4,828,050 | A | | 5/1989 | Hashimoto | 175/45 |
| 4,854,397 | A | | 8/1989 | Warren et al. | 175/26 |
| 4,928,776 | A | | 5/1990 | Falgout, Sr. | 175/45 |
| 5,096,003 | A | | 3/1992 | Kinnan | 175/61 |
| 5,139,094 | A | | 8/1992 | Prevedel et al. | 175/61 |
| 5,163,521 | A | | 11/1992 | Pustanyk et al. | 175/40 |
| 5,172,765 | A | * | 12/1992 | Sas-Jaworsky et al. | 166/384 |
| 5,220,963 | A | | 6/1993 | Patton | 175/24 |
| 5,332,048 | A | * | 7/1994 | Underwood et al. | 175/26 |
| 5,341,886 | A | * | 8/1994 | Patton | 175/24 |
| 5,343,964 | A | | 9/1994 | Leroy | 175/61 |
| 5,410,303 | A | | 4/1995 | Comeau et al. | 340/853.3 |
| 5,421,421 | A | | 6/1995 | Appleton | 175/76 |
| 5,439,064 | A | | 8/1995 | Patton | 175/24 |
| 5,443,129 | A | | 8/1995 | Bailey et al. | 175/45 |
| 5,458,208 | A | | 10/1995 | Clarke | 175/45 |
| RE35,790 | E | | 5/1998 | Pustanyk et al. | 415/40 |
| 5,752,572 | A | | 5/1998 | Baiden et al. | 175/26 |
| 5,758,732 | A | | 6/1998 | Liw | 175/230 |
| 5,806,615 | A | | 9/1998 | Appleton | 175/325.7 |
| 6,003,606 | A | | 12/1999 | Moore et al. | 166/381 |
| 6,082,461 | A | | 7/2000 | Newman | 166/381 |
| 6,088,294 | A | | 7/2000 | Leggett, III et al. | 367/25 |
| 6,089,332 | A | | 7/2000 | Barr et al. | 175/45 |
| 6,092,610 | A | | 7/2000 | Kosmala et al. | 175/61 |
| 6,105,690 | A | | 8/2000 | Biglin, Jr. et al. | 175/48 |
| 6,109,370 | A | | 8/2000 | Gray | 175/61 |
| 6,109,372 | A | | 8/2000 | Dorel et al. | 175/61 |
| 6,158,529 | A | * | 12/2000 | Dorel | 175/61 |
| 6,206,108 | B1 | | 3/2001 | MacDonald et al. | 175/24 |
| 6,241,031 | B1 | * | 6/2001 | Beaufort et al. | 175/99 |
| 6,244,361 | B1 | | 6/2001 | Comeau et al. | 175/61 |

FOREIGN PATENT DOCUMENTS

| | | |
|---|---|---|
| EP | 0 209 318 B1 | 1/1987 |
| EP | 0 256 796 B1 | 2/1988 |
| EP | 0 377 373 B1 | 7/1990 |
| EP | 0 497 420 A1 | 8/1992 |
| EP | 0 594 418 A1 | 4/1994 |
| EP | 0 624 706 A2 | 11/1994 |
| EP | 0 677 640 A1 | 10/1995 |
| EP | 0 774 563 A2 | 5/1997 |
| EP | 0 775 802 A2 | 5/1997 |
| EP | 0 806 542 A2 | 11/1997 |
| WO | WO 92/14027 | 8/1992 |
| WO | WO 92/14905 | 9/1992 |
| WO | WO 92/21848 | 12/1992 |
| WO | WO 93/12318 | 6/1993 |
| WO | WO 93/12319 | 6/1993 |
| WO | WO 96/31679 | 10/1996 |
| WO | WO 96/37678 | 11/1996 |
| WO | WO 97/49889 | 12/1997 |

* cited by examiner

COMPUTER AND SOFTWARE
SURFACE CONTROLS
IBM PS/2
CONTROLLER
I/O DEVICE
VOLTAGE CONTROLLER
V+
C+
GND
$V_{OUT}$
C−
VOLTAGE CONVERTER AND REGULATOR
P
FORCE SENSOR
2
L
POSITION SENSOR
SENSOR/ALARM
MEASUREMENT WHILE DRILLING SENSORS AND ALARMS
TRACTOR MOTORIZED VALVES
3-D STEERING MOTORIZED VALVES
P
FORCE SENSOR
WEIGHT ON BIT SENSOR 1280
1278
1276
1256
53
53

1286
1282
1284
1254
54
54

1256
1260
1254
1240
1155
1204
1242
1236
1258
1244
1234
1252
1246
1238
1202
52
52
51
51

1274
1272
1270
1258

1252
1262
1264
1266
1268

LONG REACH ROTARY DRILLING ASSEMBLY

CROSS-REFERENCE TO RELATED APPLICATIONS

This application claims the priority of U.S. Provisional Application No. 60/146,701, filed Jul. 30, 1999, incorporated herein by reference, and is a continuation-in-part of U.S. application Ser. No. 09/549,326, filed Apr. 13, 2000, incorporated herein by reference, and a continuation-in-part of U.S. Pat. No. 6,347,674, issued Feb. 19, 2002 Ser No. 09/453,996 filed Dec. 3, 1999 which claims benefit of prov. app. No. 60/112,733 filed Dec. 18, 1998 which claims benefit of prov. app. No. 60/168,790 filed Dec. 2, 1999.

BACKGROUND

Of increasing importance in the oil well drilling industry is the ability to drill longer and deeper wells at inclined angles, commonly called extended reach drilling (ERD). This technology is of great economic importance as current estimates are that 20% of the wells to be drilled in the year 2000 will be ERD wells. Currently, the majority of these wells are rotary drilled wells.

However, many technological problems are encountered in drilling long ERD well depths. One of the greatest current limitations is to overcome the friction incurred by the drill string rotating and sliding on the casing or formation. Because of frictional losses along the drill string, the maximum drilling depth for an ERD well is frequently limited by the power of the top drive system to provide torque to the bit, or the resistance of the drill string to slide down the hole, both of which limit the weight on the bit and hence the penetration rate of the drill bit or the maximum well depth.

A second major limitation is the need to steer the tool in three dimensional space through the rock formations; however, use of the existing technology results in frequent "trips" to the surface for changes in equipment or equipment failures. One common problem is the short life of a downhole motor with bent sub (used for changing drilling direction). The short life requires additional trip time because of downhole failures. Also with the use of downhole motors comes the relatively low allowable weight-on-bit, which limits the overall drilling penetration rate. Of particular financial importance is the need to "trip" to the surface to install or remove the motor. Another associated problem is the need for frequent trips when using existing three-dimensional steering tools that have short times between downhole failures, high costs, and poor reliability.

Recent developments with coiled tubing (CT) drilling have focused on the ability to drill longer and more deviated holes with coiled tubing, rather rotary drill pipe. At least one configuration of CT drilling assembly is believed to use a tractor and a 3-D steering device; however, the use of coiled tubing prevents the ability to rotate the drill string while drilling, thus increasing the potential for differential sticking. Rotary drilling circumvents this potential problem by allowing continuous rotation of the drill string; and as will be discussed below, an improved 3-D steering device that uses a deflected pipe approach potentially improves system reliability. The present invention also can avoid use of a downhole motor which is a necessary component of a coiled tubing drilling system.

In summary, with ERD rotary drilled wells of greater length comes the increasing need for the combination of controllable steering that is not interrupted by equipment change outs or failures and the need for controllable weight-on-bit on very long drill strings.

This invention provides a means to overcome the several existing difficulties and limitations with an efficient, reliable rotary long reach drilling assembly.

SUMMARY OF THE INVENTION

One objective of this invention is to combine various well drilling components into a novel drilling assembly that will allow greater rotary drilling depths and steering ability than current methods involving use of the individual elements. In terms of today's drilling objectives, the aim is to facilitate drilling to depths of at least 10,000 meters (31,000 feet) to beyond 12,000–18,000 meters (50,000 feet).

One embodiment of the long reach drilling assembly comprises the following elements:

(1) Means for cutting rock (drill bit), (2) Three-dimensional (3-D) steering tool (Interceptor) with controls and means for communicating with various types of telemetry, and (3) Tractor with Weight-On-Bit (WOB) sensor.

In addition, the following components are optional to the system:

(4) Mud pulse telemetry sub, (5) Differential pressure regulator sub, (6) Measurement-While-Drilling (MWD) sub, (7) Logging-While Drilling (LWD) sub, (8) Composite pipe with integral electrical line telemetry, and (9) Surface telemetry system.

The combination of a 3-D steering tool with a tractor and a weight-on-bit device facilitates drilling of longer extended reach (ER) wells. In long reach boreholes where sliding the drill string is limited, the present invention uses the tractor to put more weight-on-bit while continuing steering along the desired course.

Briefly, another embodiment of the invention comprises a long reach drilling assembly which delivers continuous torque from the surface to the drill bit via a rotary drill string. This embodiment comprises an elongated rotary drill pipe extending from the surface through the bore, a drill bit mounted at a forward end of the drill pipe for drilling the bore through the formation, and a 3-D steering tool secured to the drill pipe for making inclination angle adjustments and azimuth angle adjustments at the drill bit during steering. The 3-D steering tool includes an onboard telemetry section to receive inclination angle and azimuth angle commands together with actual inclination angle and azimuth angle feedback signals during steering for use in controlling steering of the drill bit along a desired course. The assembly also includes a drilling tractor secured to the drill pipe, the tractor comprising a body, and a gripper secured to the body, including a gripper portion having a first position which limits movement of the gripper portion relative to the inner surface of the bore and a second position in which the gripper portion permits relative movement between the gripper portion and the inner surface of the bore. The tractor also includes a propulsion assembly for selectively continuously pulling and thrusting the body with respect to the gripper portion in the first position, and an onboard controller for controlling thrust or pull or speed of the tractor in the bore. The tractor applies force to the drill bit for drilling the bore along the desired course the direction of which is controlled by the steering tool. Rotary torque for driving the drill bit is transmitted from the surface through the drill pipe and structural components of, the 3-D steering tool and the drilling tractor.

These and other aspects of the invention will be more fully understood by referring to the following detailed description and the accompanying drawings.

DETAILED DESCRIPTION

Figure 1A:
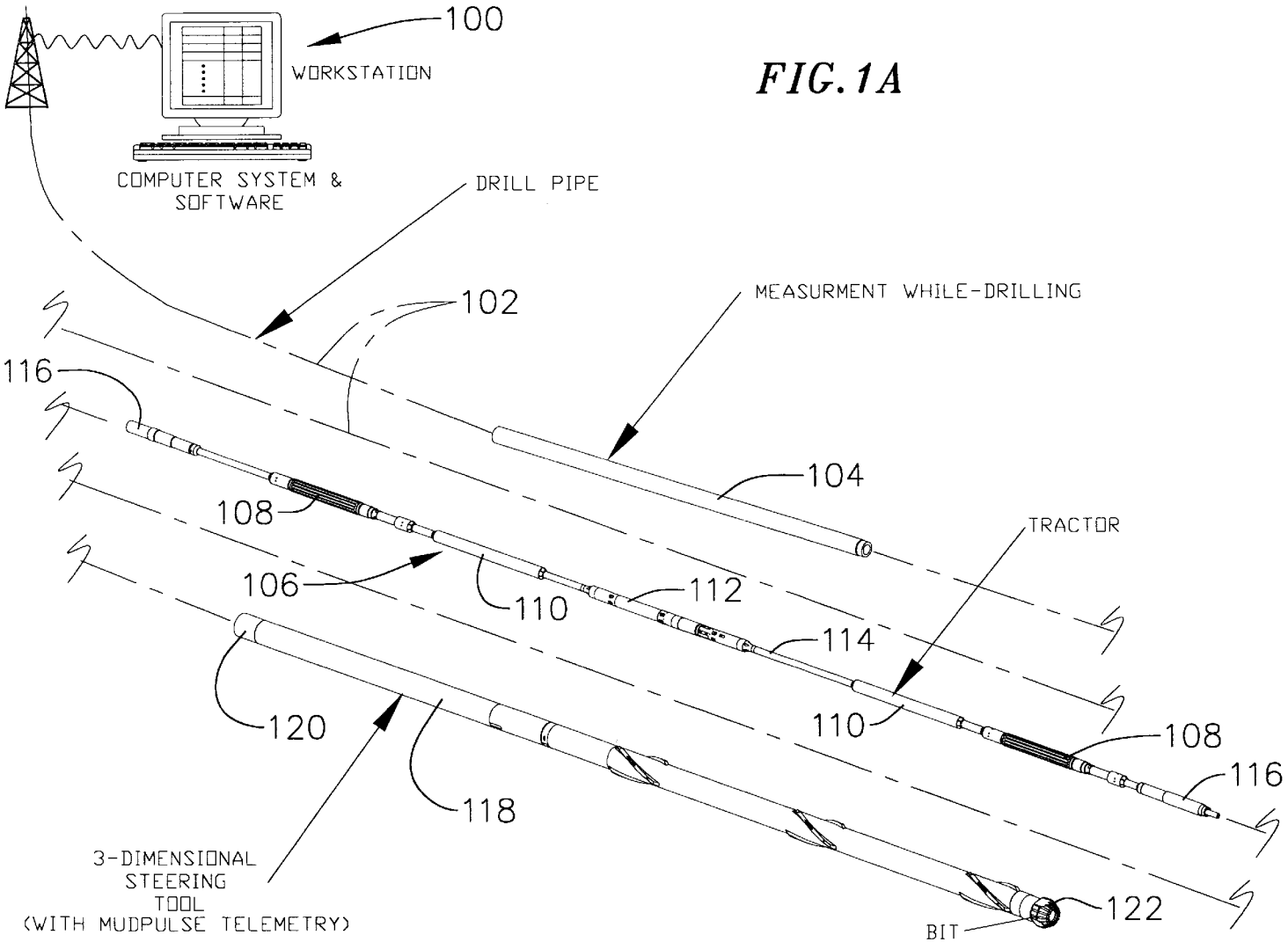
FIG. 1A is a semi-schematic exploded perspective view illustrating components of a long reach rotary drilling assembly, with a mud pulse telemetry system, according to principles of this invention.
Figure 1B:
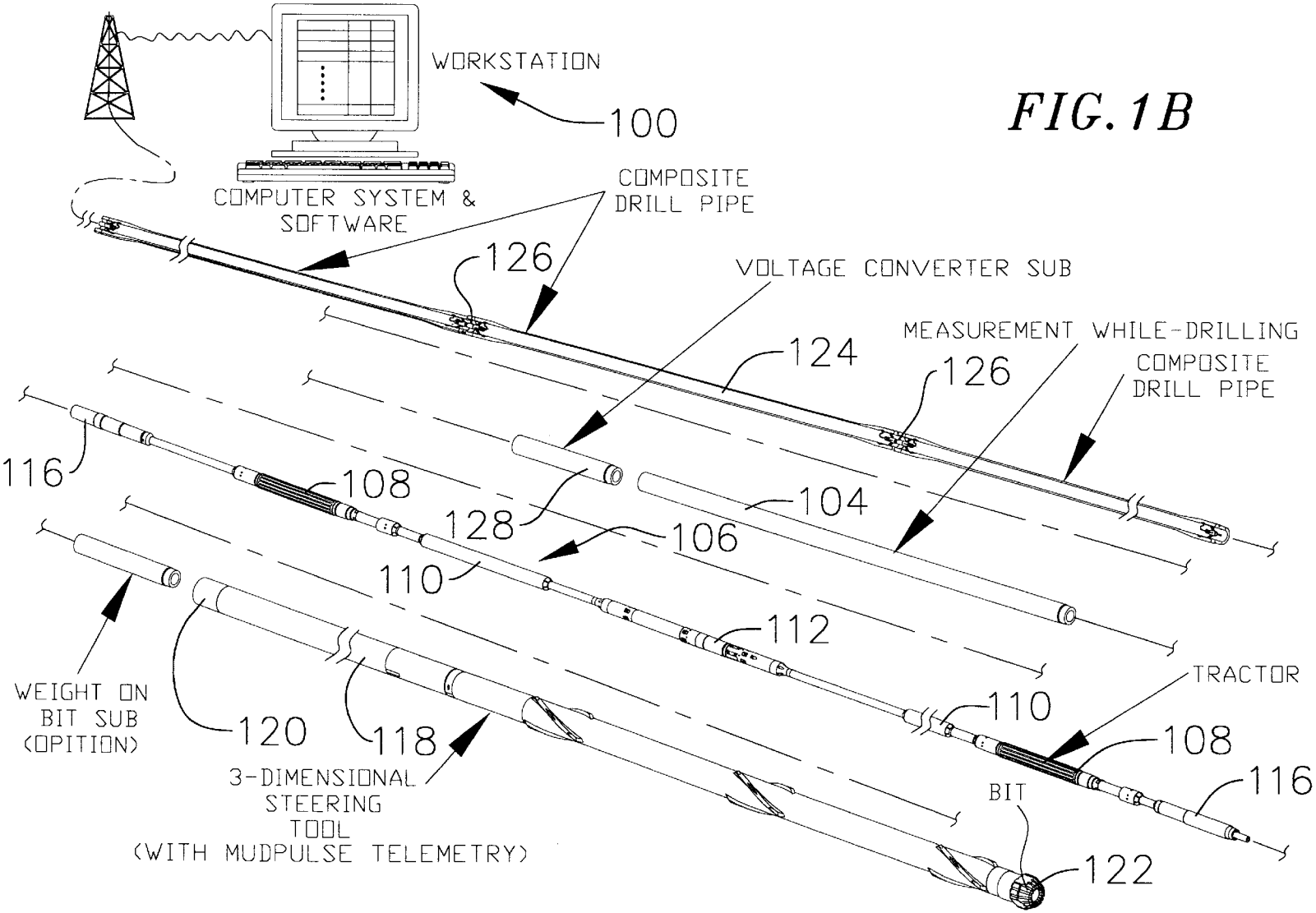
FIG. 1B is a semi-schematic exploded perspective view illustrating components of a long reach rotary drilling assembly with integral electrical communication lines contained in a composite drill pipe.

Referring to the drawings, FIG. 1A illustrates one embodiment of the invention in which a long reach drilling assembly is incorporated into a rotary drill string with a mud pulse telemetry system used in controlling components of the assembly. FIG. 1B illustrates another embodiment of the invention in which a long reach drilling assembly is incorporated into a rotary drill string with electrical communication lines integrated into a composite drill pipe.

Referring to FIG. 1A, the assembly includes a computer system and software 100 at the surface, an elongated conduit in the form of a conventional rotary drill pipe (shown schematically at 102) which is rotated about its axis from the surface in the well-known manner, a measurement-while-drilling tool 104 secured to the string of drill pipe, and a drilling tractor 106 connected to the string of drill pipe, in which the tractor includes borehole wall grippers 108, pistons 110 for operating the grippers, a valve control assembly 112 providing the control functions to the tractor, and a rotary shaft 114 internal to the tractor. Tool joints in the form of rotatable connectors 116 at opposite ends of the tractor couple the tractor to the drill string at one end and to a 3-dimensional steering tool 118 with integral mud pulse telemetry at the other end. The 3-dimensional steering tool has a connector at 120 for connecting to the tool joint 116 and is connected adjacent to a drill rotary drill bit 122 at the forward end of the drill string.

The embodiment of FIG. 1B contains similar components to the system of FIG. 1A, including the measurement-while-drilling device with mud pulse telemetry at 104, the tractor 106 and 3-dimensional steering tool 118, together with the drill bit 122. However, in this embodiment, the drill bit is rotated by a drill string comprising sections of conduit in the form of composite drill pipe 124 containing integral electrical lines for transmission of electrical power and communications. The sections of composite drill pipe are interconnected by stab connections 126. In addition, this embodiment includes a voltage converter sub 128 in the form of a transformer for converting electrical signals to communicate to the surface.

Figure 2:
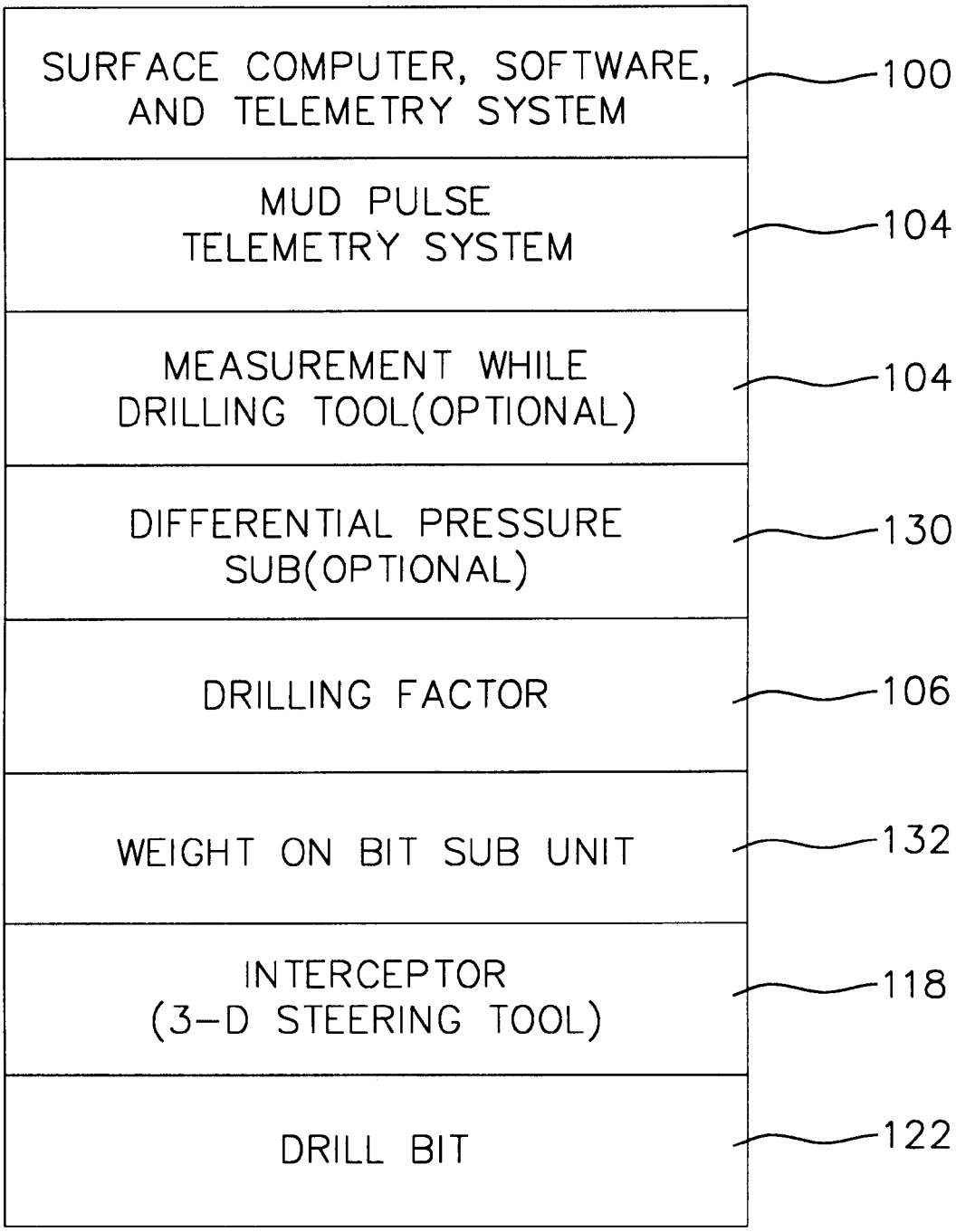
FIG. 2 is a schematic block diagram illustrating one embodiment of the long reach rotary drilling assembly.

FIG. 2 is a schematic block diagram illustrating each of the components in the FIG. 1A embodiment of the long reach rotary drilling assembly. FIG. 2 also illustrates an optional differential pressure sub 130 and a weight-on-bit sub 132.

Figure 3:
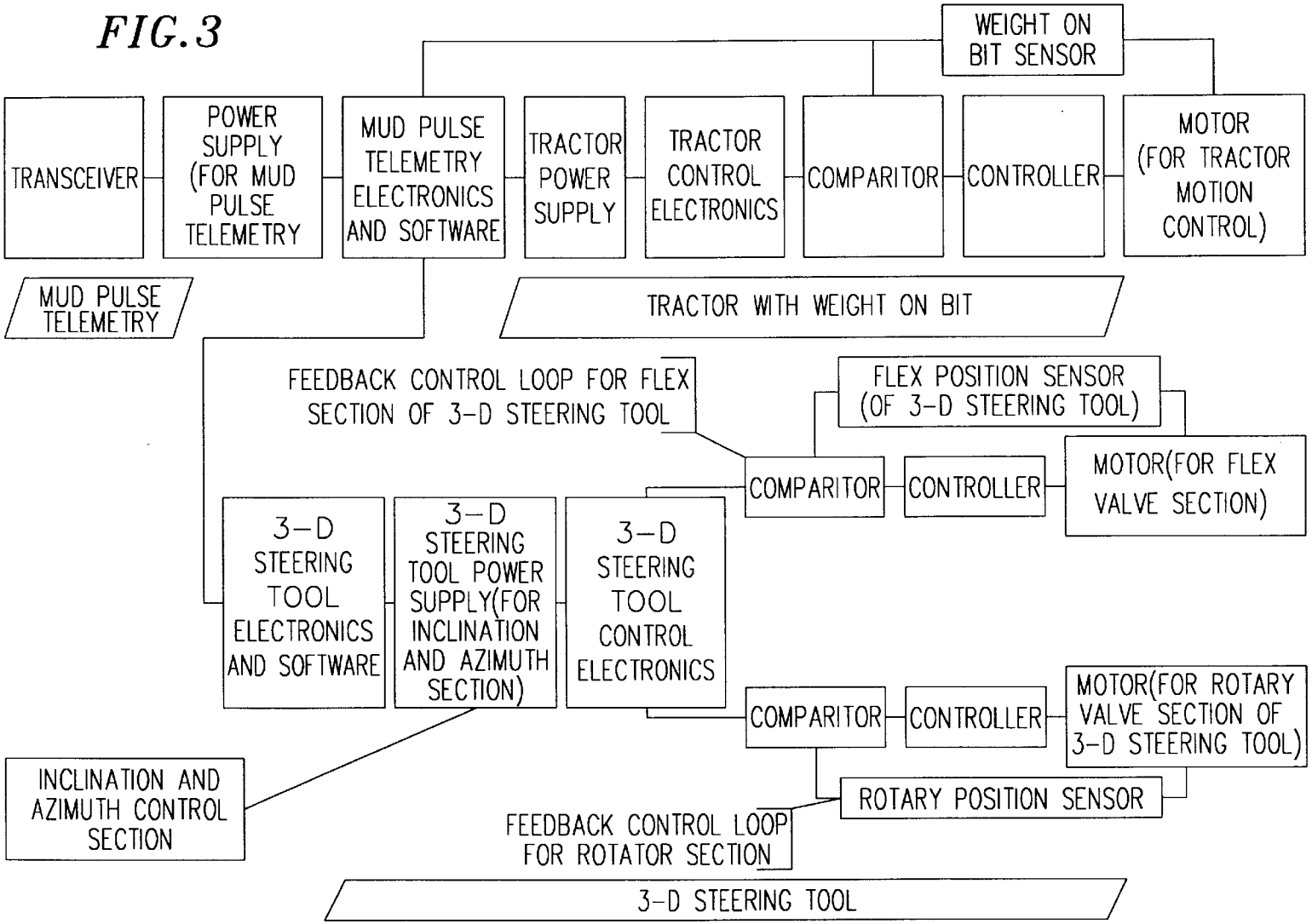
FIG. 3 is a functional block diagram illustrating components of a long reach rotary drilling assembly which includes functional block diagrams of a tractor with weight-on-bit system and a 3-dimensional steering tool with mud pulse telemetry.

FIG. 3 is a functional block diagram illustrating components of one embodiment of the long reach assembly, including the 3-D steering tool, the tractor with weight-on-bit system and mud pulse telemetry. FIG. 3 also shows functional block diagrams for the feedback control loops for a flex section and a rotator section of the 3-D steering tool. These control loops are described in greater detail below. FIG. 3 further shows functional block diagrams of the feedback control loop for the drilling tractor and weight-on-bit sensor. These control loops also are described in greater detail below.

The 3-D steering tool has a control loop from the tractor transmitting weight-on-bit information. A feedback loop in the tractor from the weight-on-bit sensor controls pull on the drill string and thrust on the drill bit and provides weight-on-bit information to the 3-D steering tool. The mud pulse telemetry section provides communication to and from the surface. There is an electrical wire connection between elements in the drill string, including the tractor, 3-D steering tool and measurement-while-drilling sensors and an optional logging-while-drilling device.

Figure 4:
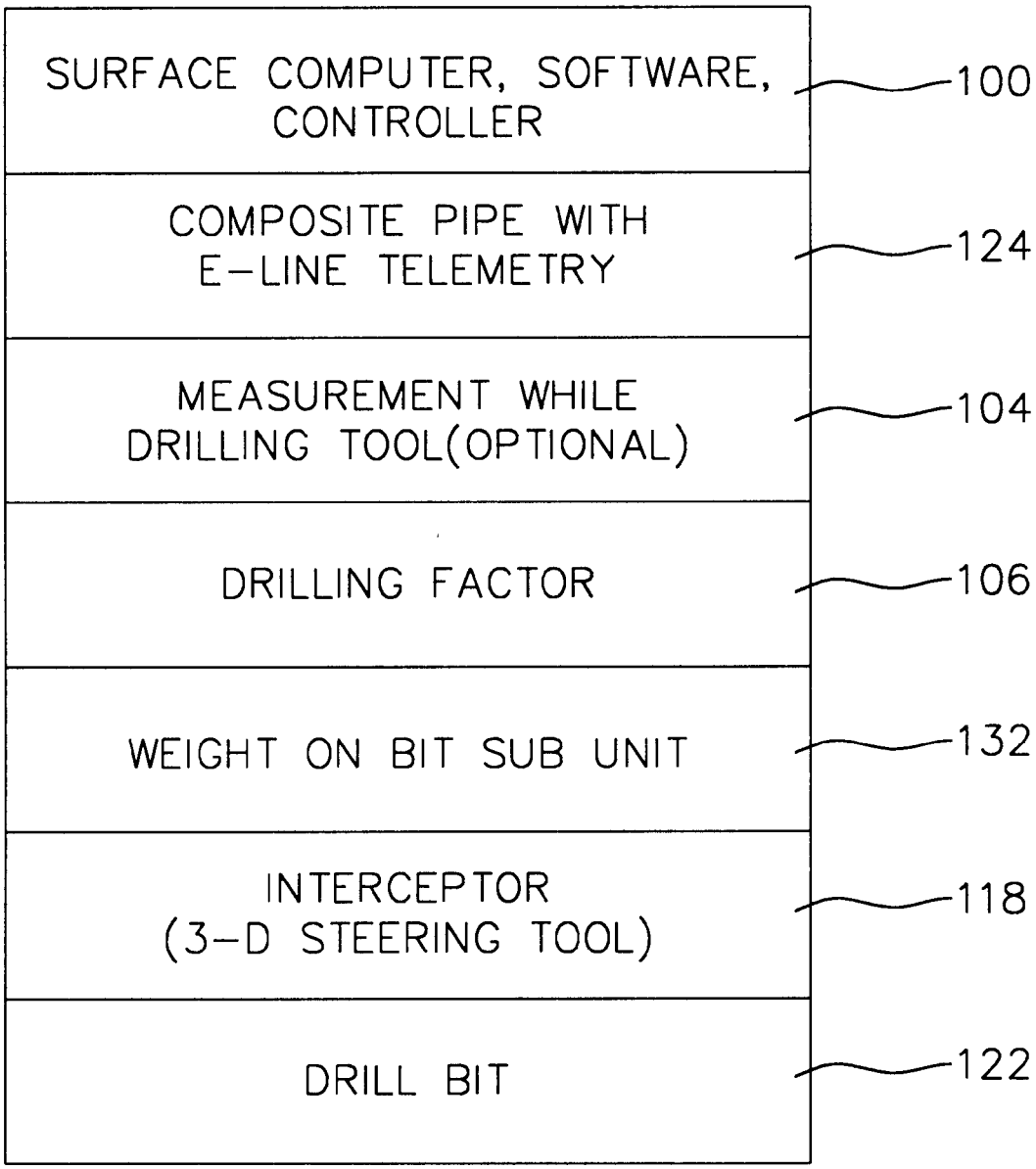
FIG. 4 is a schematic block diagram illustrating an embodiment of a long reach rotary drilling assembly which includes a composite drill pipe having an integral electrical hardwire telemetry system.

FIG. 4 is a schematic block diagram illustrating each of the components of the long reach rotary drilling assembly in the embodiment of FIG. 1B, including the tractor 106, 3-dimensional steering tool 118, the composite drill pipe 124 with integral electrical line telemetry, and a weight-on-bit sub 132.

Figure 5:
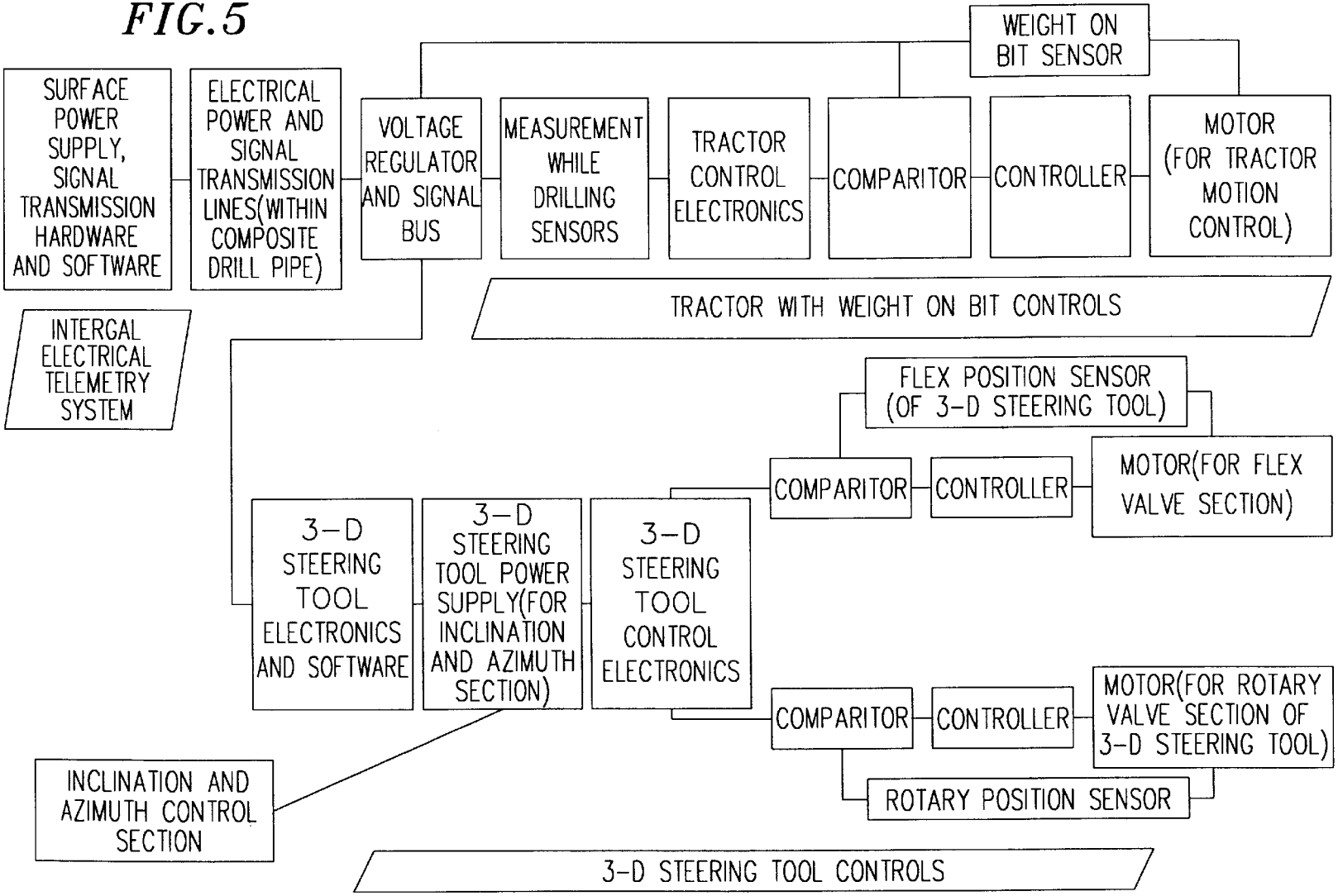
FIG. 5 is a functional block diagram illustrating components of one embodiment of a long reach rotary drilling assembly which includes functional block diagrams of a tractor with weight-on-bit system, a 3-dimensional steering tool, and a composite drill pipe with integral electrical hardwired telemetry.

FIG. 5 is a block diagram showing one embodiment of the long reach assembly of FIG. 4 with functional block diagrams of each component of the long reach system. FIG. 5 also shows functional block diagrams of the 3-D steering tool controls, the tractor with weight-on-bit controls and an integral electrical system. The feedback control loops for a flex section and a rotator section of the 3-D steering tool are described in more detail below. The feedback control loop for the tractor and weight-on-bit sensor also is described in more detail below.

In the embodiment of FIG. 5, the 3-D steering tool has a control loop from the tractor to communicate weight-on-bit information to the steering tool controls. The feedback loop in the tractor from the weight-on-bit sensor controls pull on the drill string and controls thrust on the drill bit and provides information to the 3-D steering tool. An integral electrical telemetry system communicates to and from the surface via wire connections within a composite drill pipe (described below) and via hardwire connections within the drill string, including the tractor and 3-D steering tool, measurement-while-drilling tool and optional logging-while-drilling tool.

Figure 6:
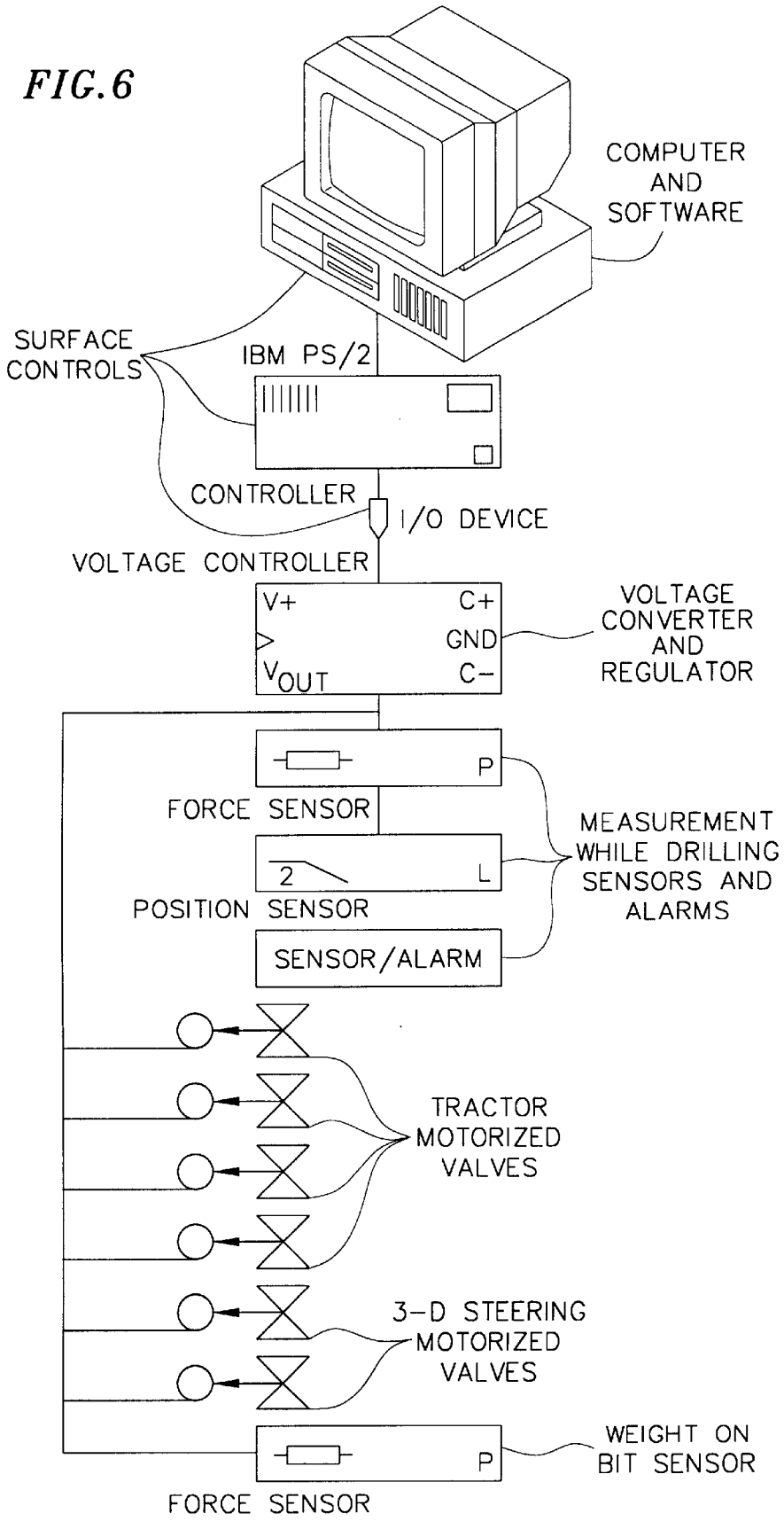
FIG. 6 is a schematic functional block diagram illustrating components of a long reach rotary drilling assembly which includes components of a composite drill pipe with integral electrical telemetry lines.
Figure 7:
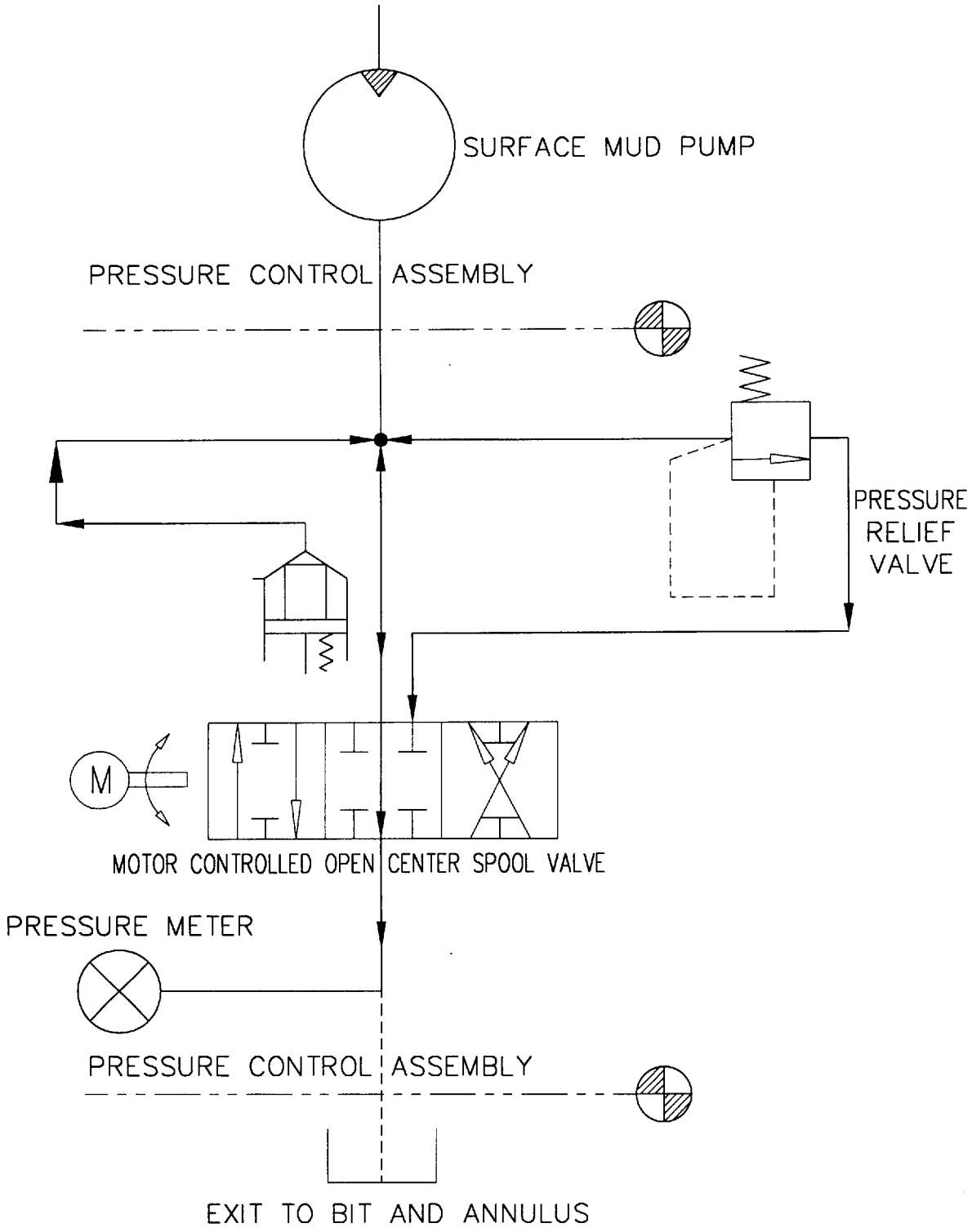
FIG. 7 is a schematic illustration of a pressure control sub for a tractor and 3-D steering tool of the long reach rotary drilling assembly.

FIG. 6 shows one embodiment of the long reach system component configuration for an assembly which includes the composite drill pipe and integral electrical telemetry lines. There are several components that are the same as those used with the mud pulse telemetry system. These include the tractor with weight-on-bit controls, the 3-D steering tool controls, and measurement-while-drilling sensors.

An alternative to the mud pulse telemetry system of controls for the long reach assembly is the use of a composite pipe with integral electrical transmission lines. The composite pipe is described in detail below. In summary, the composite pipe includes electrical connectors (wet stab) that allow connection during the make-up of the drill pipe. Electrical lines are run the length of the composite drill pipe, allowing both power and signal information to travel from the bottom hole assembly to the surface control equipment and then return.

Referring to the block diagram of FIG. 6, the surface controls are resident in the computer, software, controller, and I/O device. Commercially available computer, software, controller and I/O devices from National Instruments or IO Tech or other sources may be used.

The surface components, electrical lines within the composite pipe, and the bottom hole assembly will comply with EIA standard RS-485 for such devices. Suitable commercially available protocols are OptoMux, ModBus ASCII serial protocols or HART (Highway Addressable Remote Transducer) protocol. Software packages such as commercially available LabView, Lookout, or BridgeView (all by National Instruments) or others provide data logging, alarms, even database, graphics, networking, recipe building (formulae), report generation, security, statistical process control, supervisory control, telemetry, trending, all within the operating system Windows or Window NT.

The bottom hole assembly comprises a voltage converter (and regulator) that transforms the power from the surface to instrument and component usable power. The measurement-while-drilling (MWD) component is commercially available from several sources. The tractor and 3-D steering tool (which are described in detail below) are shown in one sequence of positioning on the drill string, however, their positions on the drill string can be reversed.

The system of FIG. 6 functions as follows. At the surface the drill string is rotated and weight is released on the drill hook load for applying increasing load on the drill bit. (This may be from no load to a pre-defined maximum load.) A command signal and power are sent via the computer and software through the controller and I/O device, through the voltage converter, through the MWD, to the tractor and 3-D steering tool. Power to the tractor operates a motorized on-off valve (not shown) and the tractor begins to move in a programmed sequence. Power is sent to motorized valves of the 3-D steering tool to control the motion of the 3-D steering tool in the desired direction. As weight is applied to the bit via weight release from the surface and the tractor (note that in many situations the tractor would not be powered but the 3-D steering tool would be), the drill bit begins to drill forward. The weight on the bit is monitored by the weight-on-bit (optional) sensor. For extended reach drilling, the tractor can be activated or it may be activated for other specialized operations. The position of the drill string is monitored by the MWD system. Monitoring of the actions of both the tractor and 3-D steering tool and other components is performed intermittently or continuously. The information from the several monitoring components is conveyed up the system, through the composite drill pipe's electrical signal lines, through the I/O device, to the controller, and to the computer. This process continues until drilling is stopped, or an intervention or change in drilling parameters is needed as decided by the operator, or by a pre-programmed computer in response to sensors with alarms or control formulae.

A difference between use of the mud pulse telemetry system and the composite pipe electrical signal wire system for this long reach assembly is the means of communication. With the hard wire electrical lines within the composite drill pipe, more power and greater quantity and better quality of information are possible. This increased amount of information can allow for a better means of controlling the drilling process.

3-D Steering Tool

The 3-D steering tool is described below with reference to FIGS. 11 to 27. Briefly, the 3-D steering tool comprises three major sections—control, inclination and rotation sections. The inclination section controls the inclination angle of the steering tool; the rotation section controls the azimuthal orientation of the tool; and the control section provides the commands, feedback signals and communications. The entire tool has an internal bore that allows drilling fluid to flow through the tool, through the drill bit, and up the annulus. All components of the assembly have this feature. The 3-D steering tool is powered by differential pressure of the drilling fluid that is taken from the bore and discharged to the annulus. A small portion (approximately 5% or less of the bore flow rate) is used to power the tool and is then discharged into the annulus.

Control systems for the steering tool are of different types depending upon whether the tool is a discrete or integrated tool. The integrated tool is controlled via mud pulse telemetry unit and surface equipment. The mud pulse telemetry at the surface consists of a transmitter and receiver, electronic amplification, software for pulse discrimination and transmission, display, diagnostics, printout, control of downhole hardware, power supply and PC computer. Within the tool are a receiver and transmitter, mud pulser, power supply (battery), discrimination electronics, and internal software. From the mud pulse telemetry appropriate signals are sent to operate electric motors that control valves to power the rotation and inclination sections. Rotation is achieved through the valves to a piston that is on a threaded shaft.

For the discrete tool, control information is accomplished by mud pump pulses that operate pistons that rotate the tool; the inclination is pre-set within the tool to operate at specific differential pressures.

The steering tool is equipped with standard tool joint threaded connections to allow easy connection to conventional downhole equipment such as the bit, MWD, or drill collars.

In one embodiment the 3-D steering tool is a short (18-ft), stiff, hollow bore tool with an external non-rotating, non-load carrying skin and an internal torque-and-load carrying rotating shaft; mud is conveyed through the hollow shaft to the bit. The three sections of the tool—control (communication and feedback), flex (inclination control), and rotary (azimuth control) act in unison to steer the bit.

The flex section comprises multiple coaxial elements that act a unit that bend an internal rotating hollow shaft, thus controlling a desired inclination from 0–22 degrees (for 6–8 inch diameter hole).

The rotary section comprises a double acting piston that drives a helical gear that rotates the housing of the rotating shaft, thus controlling a desired azimuthal position in increments of less than one degree.

The control section comprises a battery-powered mud pulse telemetry system, control valves, sensors, and feedback system that monitors and commands the flex and rotary sections and communicates to the surface.

Power for both azimuth and inclination angle changes is provided by the differential pressure of a 1–2 gpm differential mud pressure taken from the hollow shaft and discharged to the annulus.

Operation consists of commands to change inclination, drilling ahead a few feet, commands to change of azimuth, drilling ahead a few feet.

A further detailed description of the 3-D steering tool which is presented below is contained in U.S. patent application Ser. No. 09/549,326, filed Apr. 13, 2000, which is incorporated herein by reference.

Drilling Tractor

Figure 106:
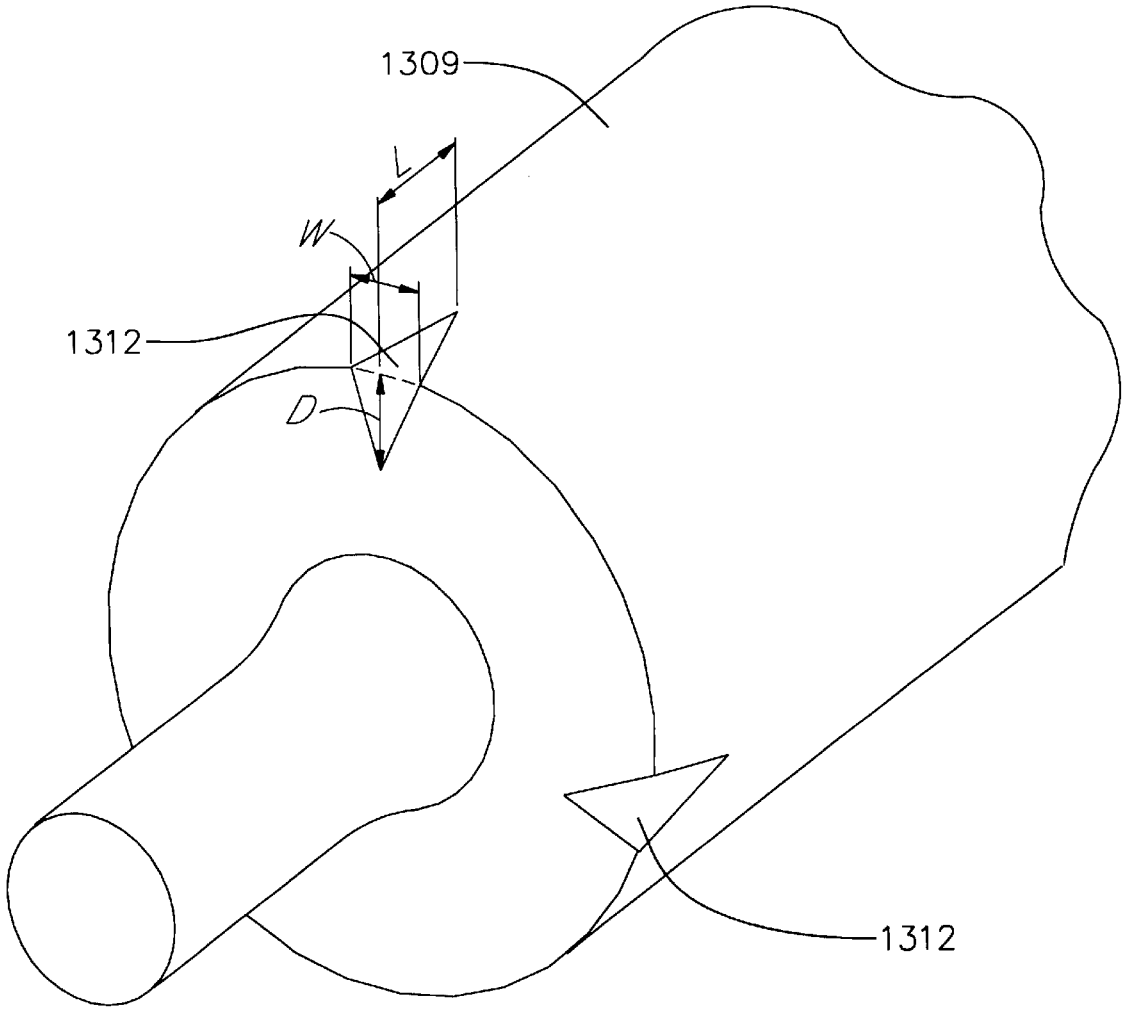
FIG. 106 is a perspective view of a notch of a propulsion valve spool of the EST.

The tractor component of the long reach drilling assembly is described below with reference to FIGS. 28 to 106. Briefly, the tractor comprises apparatus for propelling a drilling tool along a passage. The tool body includes a gripper having a gripper portion which can assume a first position that engages an inner surface of the passage and limits relative movement of the gripper portion between the gripper portion and the inner surface of the passage. The tool includes a propulsion assembly for selectively continuously moving the body of the tool with respect to the gripper portion while the gripper portion is in the first position. This allows the tool to move different types of equipment within the passage. For example, the tool may be used in drilling to apply continuous force on the drill bit. A further detailed description of one embodiment of a tractor useful for this invention which is presented below is contained in U.S.

patent application Ser. 09/453,996, filed Dec. 3, 1999, incorporated herein by reference.

A preferred embodiment of the tractor comprises a tractor body, two packerfeet, two aft propulsion cylinders, and two forward propulsion cylinders. The body comprises aft and forward shafts and a central control assembly. The packerfeet and propulsion cylinders are slidably engaged with the tractor body. Drilling fluid can be delivered to the packerfeet to cause the packerfeet to grip onto the borehole wall. Drilling fluid can be delivered to the propulsion cylinders to selectively provide downhole or uphole hydraulic thrust to the tractor body. The tractor receives drilling fluid from a drill string extending to the surface. A system of spool valves in the control assembly controls the distribution of drilling fluid to the packerfeet and cylinders. The valve positions are controlled by motors. A programmable electronic logic component on the tractor receives control signals from the surface and feedback signals from various sensors on the tool. The feedback signals may include pressure, position, and load signals. The logic component also generates and transmits command signals to the motors, to electronically sequence the valves. The logic component operates according to a control algorithm for sequencing the valves to control the speed, thrust, and direction of the tractor.

Weight-on-Bit Sensor

The weight-on-bit (WOB) sensor measures the thrust (weight-on-bit) delivered to the drill bit. With this information delivered to the surface, the WOB system provides for thrust control (via mud pulse telemetry) over rate of drilling in addition to or in combination with any speed of movement provided by surface means.

The WOB system is incorporated into the forward end connector of the tractor. It comprises an encapsulated strain gage style bi-directional (compression and tension) load cell mounted within the end connector or other convenient location on the front of the tractor. (The load cell configuration would be qualified for use through testing to survive the temperatures and vibration of the drilling environment.) In one embodiment, encapsulated insulated wires from the load cell run along the body of the tractor through conduits in the forward cylindrical shaft, through the control assembly via electrical connectors and wires, and through the aft cylindrical shaft to an electrical connector within the aft connector assembly. The information is then electrically or magnetically delivered to the mud pulse telemetry system. Two-way communications from tractor, 3-D steering tool, and other components are conveyed to the surface and back via the mud pulse telemetry system. The information is processed by user intervention or with specially designed software. With the load determined at the end of the tractor, the surface operator can directly control the drill bit's penetration rate via tractor thrust while rotating and applying weight from the surface.

Mud Pulse Telemetry

The following component option may be included in the drill string of the long reach drilling assembly. An electronic and mechanical (sonic) 2-way communication system in a separate tool or integrated into the long reach drilling system from the tool to the surface provides commands and delivers information. This is a commercially available assembly available from several vendors in the oil industry. The signal information is transmitted to the surface via mud pulses from the mud pulse telemetry transmitter-receiver in the bore of the drill pipe. The information is converted to digitized signals and the pressure pulses carry encoded information.

The long reach mud pulse telemetry system includes conventional metal drill pipe. Drill pipe strength, collapse, burst, end connections, class and other characteristics are well known in the industry and standardized by the American Petroleum Institute.

It is significant that for the long reach mud pulse telemetry system, the drill string should be metallic. Because the drill string is metallic, use of electrical lines within the drill pipe is not possible, thereby necessitating use of mud pulse telemetry for information transfer.

In an alternative embodiment, composite drill pipe with integral electrical communication lines (described below) replaces metallic drill pipe. Composite drill pipe comprises drill pipe made of a composite construction of metal, glass, carbon, or other fiber; epoxy or other polymeric materials; and/or rubber. Use of such a composite structure allows inclusion of electrical wires to carry electrical power or signals.

Pressure Control Sub

An electronically controlled throttle valve regulates the pressure drop through the bore of the long reach drilling assembly, thus facilitating control of the differential pressure of the string and hence the power available to the tractor. FIG. 6 shows one configuration of the pressure control sub assembly, in which an open-center valve is used in the open-circuit flow. (The pump provides flow to the components with return flow to the mud pit.) The supply flow has almost unrestricted flow through the system and ultimately to the mud pit. The pressure drop is small and therefore the power loss is small. Wear elements within the assembly are made from hard materials such as tungsten carbide, to extend operational life. In use, with electrical signals from the surface via mud pulse telemetry driving the motorized control open center spool valve, the spool starts to stroke. The center of the spool begins to restrict flow, thereby raising pressure and providing more differential pressure to the tractor and hence more power.

As spool motion continues, inlet pressure is restricted at the inlet edge. The other inlet pressure becomes large while the return land of the spool within the body restricts the return-pressure. Further spool movement closes off the open-center spool section and does not allow flow to have a direct route from supply to return.

The system also contains a pressure relief valve to prevent damage to the system if a failure occurs, such as a motor failure in closed position.

A pressure gage monitors the pressure generated by the motorized control open center spool valve.

It is expected that as load (other pressure drops in the mud system) changes, the profile of the output flow will change. That is, output flow will change with load. Altering the open center section to blend into actual output flow can minimize these changes.

In general, it is expected that it would take 20–30% of the stroke of the valve length before significant pressure drop would occur. Typical pressure drops could be from 100–3000 psid and would be controllable via the electric motor of the valve and monitorable via the internal pressure gage.

By using the pressure gage reading in conjunction with the electric motor controls, the pressure drop across the assembly can be controlled, and hence the power delivered to the tractor and 3-D steering tool.

Alternatively, valve configurations other than spool valves can be used (such as a metered throttle valve).

The entire assembly is housed in a separate assembly, commonly called a "sub" or pup joint. This sub will include male and female connections to allow incorporation into the drill string with threads (typically API threads). The housing can be made of non-magnetic materials such as copper-beryllium, monel, or similar high strength and non-magnetic substances. The system can communicate to the mud-pulse telemetry system to convey information and commands to and from the surface. It may have its own power supply or it may share power from another tool in the long reach drilling assembly. Surfaces and components (such as spools or valve housings) are made from hard materials such as tungsten carbide. The entire assembly can be approximately 4 to 6 feet in length. The sub can direct flow through the tool to allow continuous delivery of mud through it and delivery to the drill bit. The pressure gage can be of several different types such as a strain gage that allows rugged use in the high temperature (to 300° F.), high pressure (to 16,000 psi) and high vibration (to 30 G's)environments.

Measurement-While Drilling Sub

A measurement-while-drilling (MWD) sub comprises a commercially available stand-alone system, or is integrated into a logging-while-drilling (LWD) assembly (described below) to locate the drilling assembly (drill bit) with respect to inclination, azimuth, and measured depth. The MWD communicates to the surface (via mud pulse telemetry or other means) to provide periodic updated positional information. This is a commercially available assembly available from several vendors in the oil industry.

Logging-While-Drilling Sub

A logging-while-drilling (LWD) sub comprises a commercially available stand-alone system, or is integrated into a measurement-while-drilling assembly to measure and transmit information about rock formation characteristics, including neutron and gamma absorption, electrical resistivity and other types of information that indicates the presence of hydrocarbons. This is a commercially available assembly available from several vendors in the oil industry.

Sliding Non-Rotating Drill Pipe Protectors

Sliding non-rotating drill pipe protectors comprise assemblies specially manufactured by Western Well Tool, Inc. that enhance the sliding of the drill pipe down the casing while simultaneously reducing drilling torque. These drill pipe protectors are described in U.S. patent application Ser. No. 09/473,782, filed Dec. 29, 1999, incorporated herein by reference.

Composite Drilling Pipe with Integral Electrical Line Telemetry System

Figure 8:
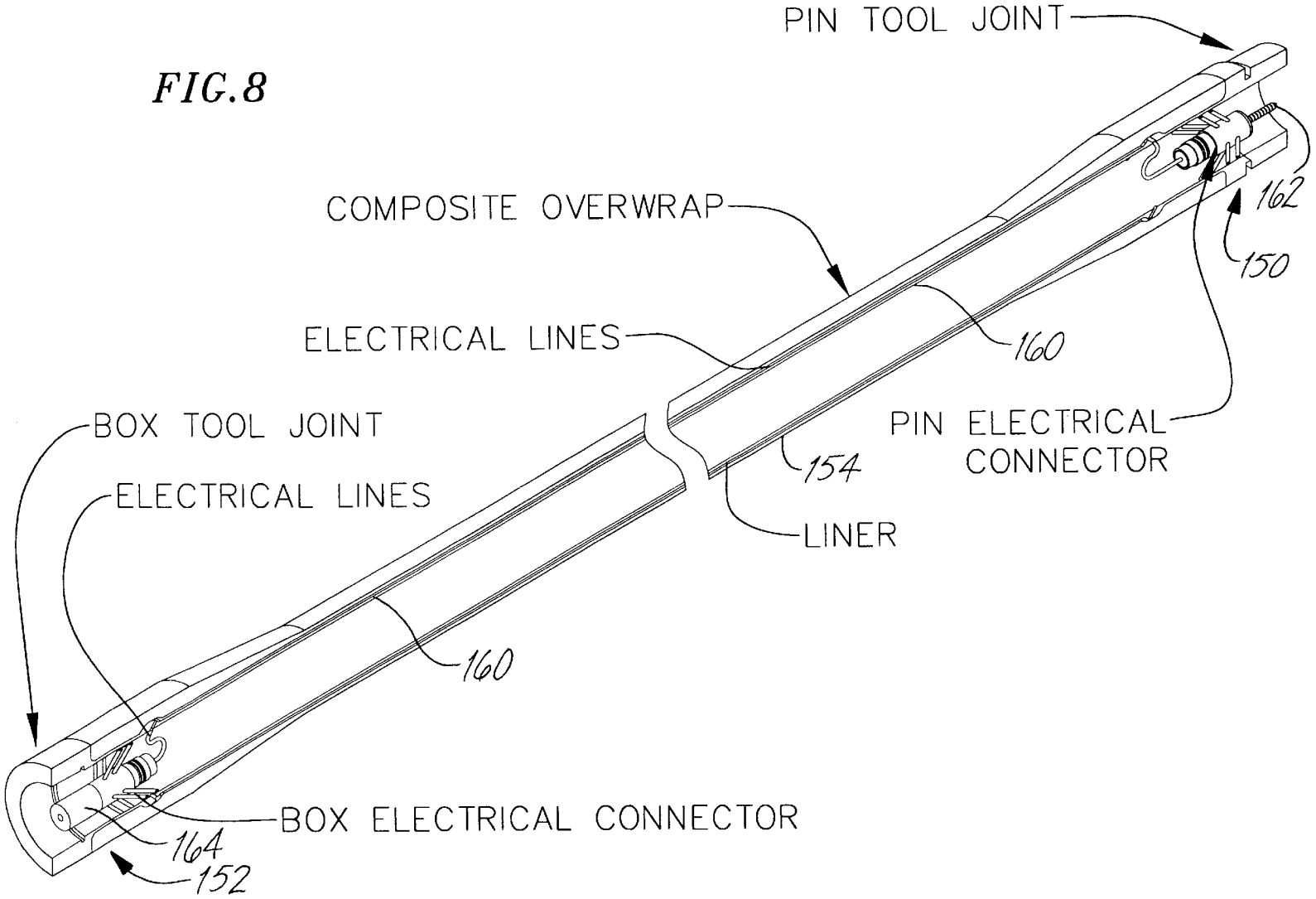
FIG. 8 is a fragmentary cross-sectional perspective view schematically illustrating a composite drill pipe with integral electrical lines.
Figure 9:
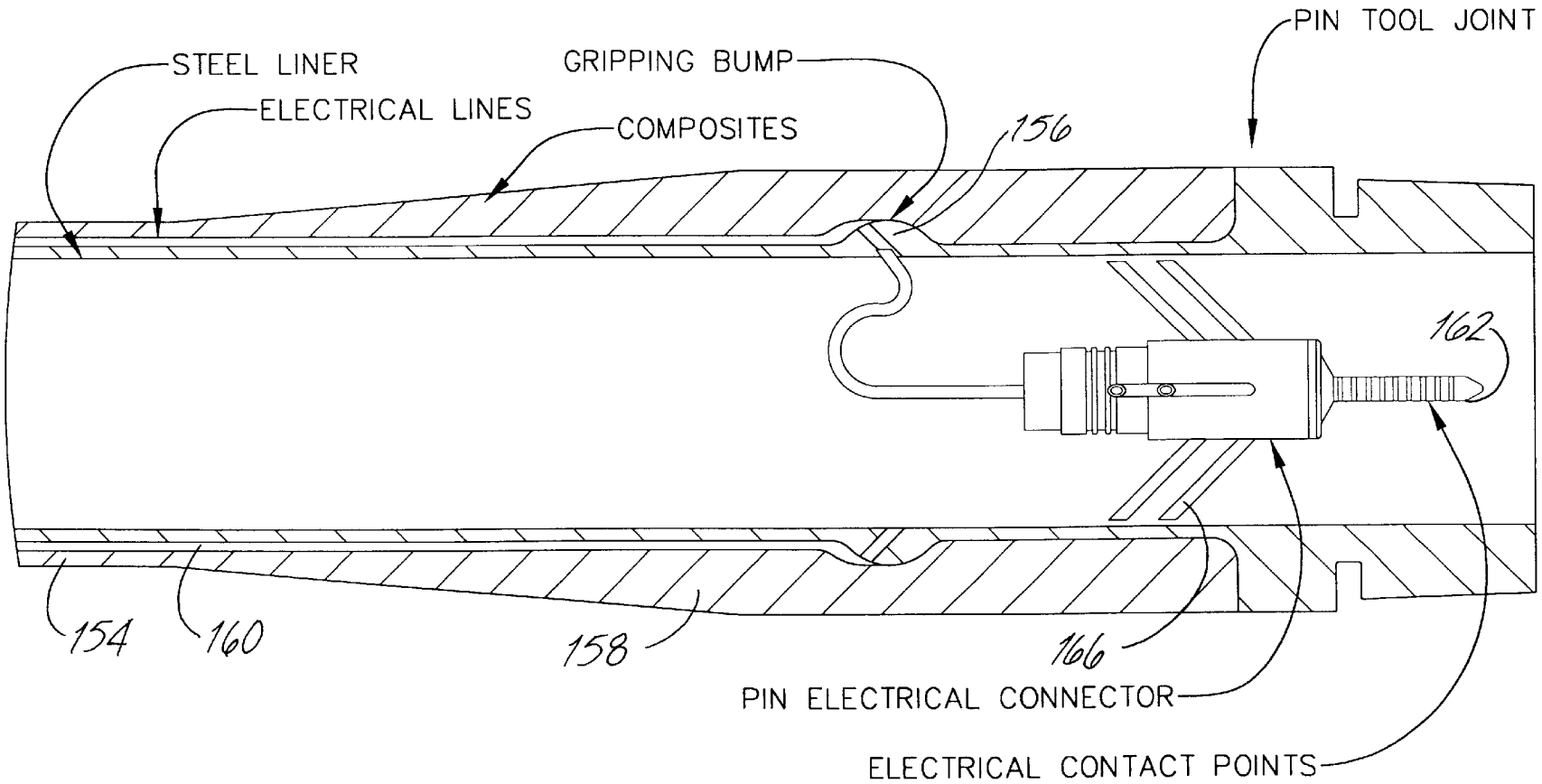
FIG. 9 is a fragmentary cross-sectional view showing a pin end portion of the composite drill pipe.
Figure 10:
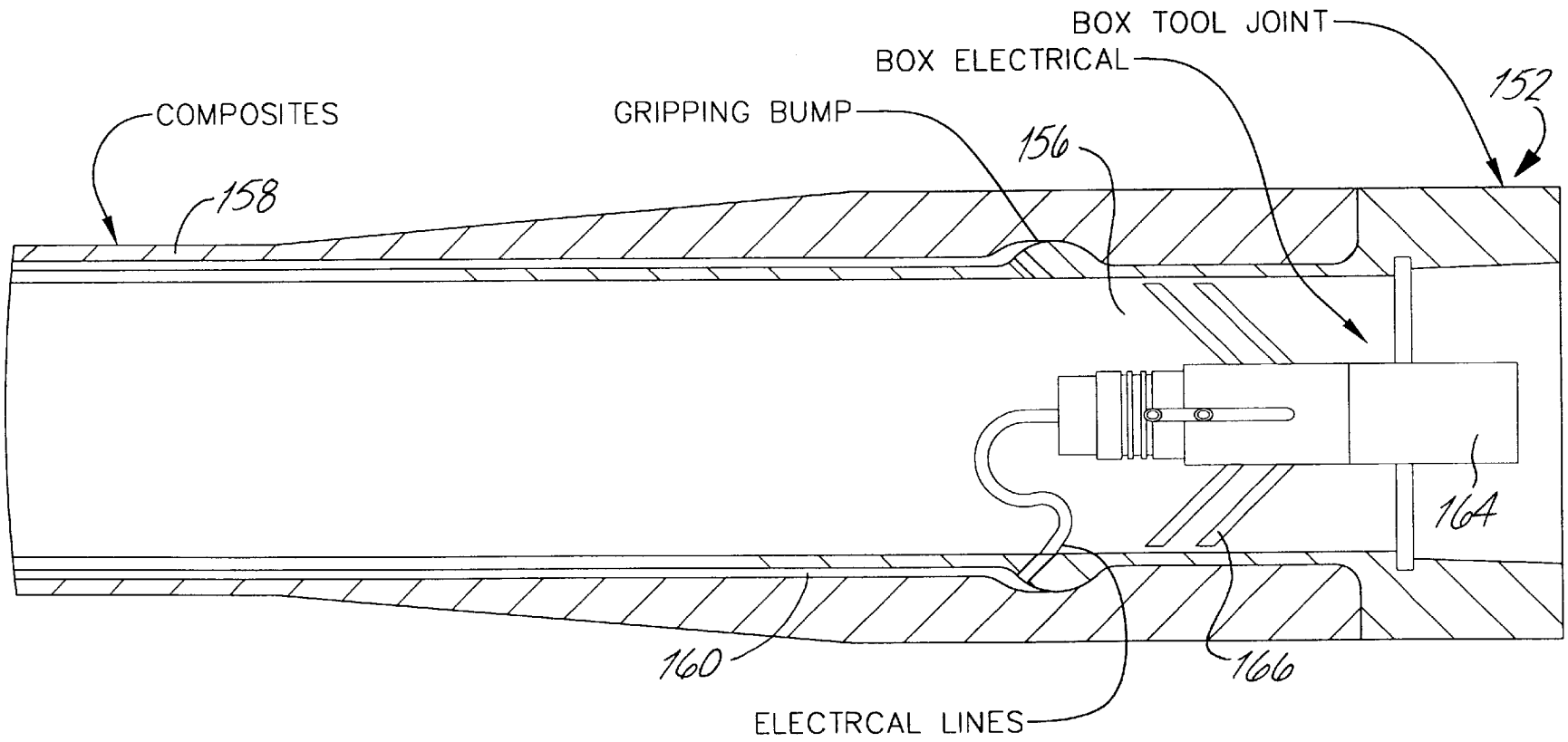
FIG. 10 is a fragmentary cross-sectional view illustrating a receptacle end portion of the composite drill pipe with integral electrical lines.

FIGS. 8, 9 and 10 show a composite drill pipe with integrated electrical lines.

Parts of the composite drill pipe are similar to conventional metallic drill pipe. Specifically, the composite drill pipe (CDP) has a pin connector 150 and receptacle connector 152 that can be threaded with various thread forms, including American Petroleum Institute (API) approved threads. The interior of the CDP is a metal-lined bore 154. Thus, the physical configuration with respect to tool joint diameter and bore diameter is the same as conventional drill pipe. Drill string hydraulics (used to clean the bottom of the hole, lift the cuttings to the surface, and maintenance of mud cake on hole wall) are the same as with conventional systems.

However, CDP has significant differences in design that add functional characteristics essential for long and very long reach drilling. FIG. 8 shows the entire composite pipe (not to scale) in cross-section. FIG. 9 shows the partial cross-section of the pin end of the composite drill pipe. FIG. 10 shows a partial cross-section of the box end of the composite drill pipe with electrical lines. Included within the CDP are:

(1) Threaded metallic tool joints 150 and 152;

(2) Metallic (or other material such as urethane) liner 154;

(3) Gripping bump 156 (on the extended tool joint);

(4) Fiber (carbon, glass, boron, aramid, and other) and matrix (epoxy, rubber-epoxy, polymeric and other) reinforcement 158;

(5) Electrical lines 160 (signal and power) of various sizes and types;

(6) Wet-stab electrical connectors (pin 162 and receptacle 164); and (7) Stabilizer blades 166 of composite and low friction material (not shown).

The threaded metallic tool joints along with the wet-stab electrical connectors allow the nearly simultaneous and rapid assembly of both the mechanical load-carrying portion and the electrical portion of the CDP. The load carrying capacity of the CDP is through the tool joint to the liner and the fiber-matrix reinforcement. The liner can be designed with a range of capabilities. For example, in one embodiment the liner can be made very thin so that its primary function is containment of the fluids in the bore, up to more thick construction where is becomes a significant load-carrying component of the CDP. This embodiment provides a flexible drill string capable of high drilling radius of curvature (60+ degrees/100 feet drilled), but it tends to have less tensile and pressure capability (depending upon the winding sequence) while allowing electrical line power and communication. In another embodiment, the liner can approach the thickness of conventional steel drill pipe. This embodiment has high tensile and pressure capability, reduced drilling radius of curvature (20-degrees) and continues to possess electrical line power and communication capability.

The CDP has fiber-matrix reinforcement over the liner. The fiber can be a continuous wrapping of continuous filaments or woven glass fibers (S-glass or E-glass), carbon (Hercules IM-6 or others), aramid (Dupont Kevlar 29 or Kevlar 49), or other combinations of fibers. The layers of fibrous material are impregnated in a resinous matrix which is typically epoxy, or epoxy-rubber, or other polymeric material, or combinations of such materials manufactured by Shell Chemical or others. The properties of the epoxy can be selected for specific performance such as resistance to water or chemicals, ductility, strength, bonding affinity to the fiber, and pot life (time from manufacture to incorporation into the component). The fiber-matrix reinforcement can be made with various methods including hand lay-up of individual layers, continuous filament winding, or other process; in this embodiment, the preferred manufacturing method is filament winding. The fibers can be oriented in various schemes for optimization of structural performance. For example, one embodiment is a 3½-inch composite pipe, 0.1-inch thick steel S-135 liner, and 0.3-inch thick carbon-epoxy over wrap at +/−10 degrees, 90 degrees and +/−45 degrees relative to the longitudinal axis of the pipe. This configuration allows the capacity of 400,000-lbs tensile load; 24,500 psi burst pressure, and an armor coating to resist handling damage and torque to 12,000 ft-lbs.

The tool joint has a "gripping bump" which facilitates winding of the fiber-matrix material over the liner and allows a convenient point for continuous fiber-matrix (typically epoxy) to change direction during the winding process. The gripping bump is especially contoured to facilitate the load distribution within the CDP. In addition, the gripping bump facilitates the exit of the electrical line (via wire or connector) to the exterior of the pipe.

As an option, integral stabilizer blades (not shown) can be incorporated into the CDP. The preferred embodiment is to use a polyurethane reinforcement (commercially available from several sources including Dupont) with overwraps or lay-ups of fiber-matrix reinforcement to secure the blade assembly. The outer-most surfaces can incorporate various low-friction materials including Rulon (bronze particle Teflon composite). The outer surfaces coated with the low friction material facilitate the sliding of the pipe down the hole with minimum drag. Alternatively, the stabilizer blade can be constructed of honeycomb material (Hexcel Corporation) with Teflon material (Rulon by Dupont).

The electrical signals and power for the system are carried through the wet-stab connector, providing continuous connection from the surface to the several downhole components such as the tractor and 3-D steering tool. There can be a multiplicity of electrical lines for different purposes such as power, ground, and signal. In this embodiment, it is anticipated that eight electrical lines would be required including power, ground, signal, and motor control lines.

The wet stab connector comprises several components, including the electrical contacts which are a bronze ring material electrically isolated from the other contacts. Sealed areas, typically separated by O-ring seals, accomplish external electrical isolation.

Multiplicities of contacts are possible, but for the preferred configuration shown, eight contacts are used. The electrical wires lead through the wet stab connector and through the body of the liner to the exterior of the CDP. The electrical wire is laid between the liner and the fiber-matrix reinforcement, thus providing both mechanical protection and electrical isolation.

Each electrical contact from the wet stab connector is attached to an electrical wire. The multiplicity of wires may be separate, wound together (to reduce electrical interference), or wrapped in a shield.

The design of the composite drill pipe (CDP) is such that the tool joint is started to make-up when the wet stab connector begins to make contact. In this process, the mechanical strength of the joint is established, followed by the electrical connection. This facilitates make up of the drill pipe on the drill string floor.

The length of the CDP is of significance. Specifically, the pipe can be made in Type 2 length (typically 41–45 feet) rather than Type 1 (typically 30–33 feet). By lengthening the CDP, fewer electrical connections are required.

Principles of Operation

The long reach drilling assembly is specifically designed for (but not limited to) extended reach drilling and horizontal drilling. When extended reach drilling or horizontal drilling with rotary equipment becomes limited by the ability to travel further because of frictional forces between the drill string and the casing/and or formation, the long reach drilling assembly provides a new means of drilling further. The principles of operation of the long reach drilling assembly are as follows:

(1) Drill string rotation and a portion of the weight-on-bit are delivered via the rotary drill string from a top drive or rotary table through the drill string to the drill bit. The drill bit is driven by the rotary drill string with torque transmitted all the way through the drill string. All components have means to deliver torque through them to the drill bit. This includes the rotary drill string sections themselves, the measurement-while-drilling tool, the tractor, and the 3-D steering tool and its connection to the drill bit. Torque is delivered by the measurement-while-drilling tool either by an internal rotary shaft or the outer tubing. Torque is delivered through the tractor via its internal rotating shaft and its rotary connections at its tool joints. Torque is delivered through the 3-D steering tool via its rotary internal shaft and its rotational connections at the tool joint of the tractor at one end and to the drill bit at the other end.

(2) The tractor provides traction against the hole wall and produces force through pressurized pistons in an internally controlled loop that communicates to the surface via a mud pulse telemetry system and provides an additional portion of the weight-on-bit. (The tractor may also provide pull to the end of the drill string in some applications as well as weight-on-bit depending upon the application.)

(3) A multiplicity of tractors may be installed into the drill string at different locations to assist the drilling process. In one embodiment, one tractor can be located as part of the bottom hole assembly. (BHA), followed by a length of drill pipe (or composite drill pipe), then another tractor. This combination can allow greater versatility and capacity in the system. For example, a drilling tractor and a "tripping" tractor can be used. In this embodiment, the drilling tractor provides needed thrust at drilling speeds (1–100 feet per hour) and the "tripping" tractor can provide fast wiping trips (at 100–1000 feet per hour). Alternatively, two tractors can be used (with proper electrical timing) to operate such that the maximum thrust is the sum of the thrust of the two tractors. In another embodiment, the tractors can be separated by a length of CDP in order to allow the system to traverse a damaged hole section (washout). This can be accomplished by the first tractor walking to the washout, then when it is unable to provide thrust, the second tractor provides the trust until the assembly has crossed the washout. Then, the first tractor can pull the second tractor across the washout until the second tractor reaches firm rock. Other combinations are possible.

(4) The 3-D steering assembly accomplishes steering of the long reach drilling assembly via an internal control loop that controls movement of the inclination (flex) section or the azimuth (rotary) section and communicates through in mud pulse telemetry system to the surface and back to the tool.

(5) Power for operation of both the 3-D steering tool and the tractor are provided via drilling mud differential pressure from the bore to the annulus of each tool and/or the assembly.

(6) Communication, command and control to both the tractor and the 3-D steering tool are provided by a common mud pulse telemetry system that may also command other components.

(7) The combination of both the tractor and the 3-D steering tool allows a control circuit (automatic feedback or with manual intervention) that maximizes control of direction and rate of penetration into the formation while maintaining a specific drilling trajectory. Information about position (MWD) and weight-on-bit (from the tractor) and internal operational state of the 3-D steering tool are combined with 3-dimensional position information (provided MWD system) to allow directional control of the drilling trajectory and control of the rate of penetration.

(8) Drilling fluid transfer is conventional in that mud moves down the drill string, through the long reach drilling assembly (tractor +3D steering) and other components, through the drill bit, and up the annulus.

(9) The optional pressure control sub can increase the differential pressure between the bore and the annulus, thus providing additional power to either the tractor or the 3-D steering tool, or both.

(10) The measurement-while-drilling and logging-while-drilling provide the option to know the drill string position continuously and the formation characteristics when desired to further facilitate drilling with the long reach assembly. This information is used in conjunction with information from the long reach drilling assembly (tractor and 3-D steering) to monitor and control the rate of penetration and trajectory of the system.

(11) The optional sliding non-rotating drill pipe protectors on the drilling pipe can enhance the sliding characteristics and torque transmission to a long reach drilling assembly, allowing greater drilling distance to be achieved.

Improvements provided by the combined 3-D steering and tractor, with mud pulse telemetry communications, are as follows:

(1) The combination of an electronically controlled differentially mud powered tractor with an electronically controlled differentially mud powered 3-dimensional steering tool, both controlled by internal feedback control loops and tools communicating to the surface via a common mud pulse telemetry system that allows closed loop control and maximization of the rate of penetration into the formation while simultaneously maintaining a specific drilling trajectory.

(2) An assembly that is adaptable to specific options that further improve operation via position feedback from the measurement-while-drilling assembly, formation information via the logging while drilling assembly, maximizing the length of drilled hole with a pressure control sub, and further maximizing the length of drilling hole with specially designed sliding non-rotating drill pipe protectors.

(3) Use of mud pulse telemetry to control the long reach system.

Improvements provided by the combined 3-D steering and tractor, with composite drill pipe and its integral electrical communication lines, are as follows:

(1) Same improvements as with mud pulse telemetry system with respect to mud powered tractor.

(2) Same improvements as with operation via feedback control systems from MWD or weight-on-bit components to the tractor or 3-D steering device.

(3) Use of composite drill pipe to control the long reach system. The composite drill pipe sections principally comprise a metal liner, an electrically insulated electrical line and non-metallic filament wound resinous matrix overlap. This composite structure provides a drill string which is more flexible and lighter in weight than the conventional metallic drill pipe. One advantage is a shorter turning radius when compared with metallic drill pipe.

(4) Composite drill pipe that allows electrical communication to the surface along with enhanced structural and operational performance. The composite material also facilitates use of the embedded O-ring style electrical wire connectors to the internal rotor contact of the composite drill pipe section.

(5) The combination of metal tool joints at the ends of the composite drill pipe sections for transmitting torque, a metal liner in the drill pipe section, composite (principally non-metallic) body for structural strength, more flexibility and lighter weight, and an integral electrical conductor for transmitting electrical power and electrical communication signals.

3-D STEERING TOOL—DETAILED DESCRIPTION

The description to follow is a detailed description of a presently preferred embodiment of a 3-D steering tool the principles of which are useful with the assembly of this invention. Although the description to follow may focus on rotary drilling applications, the steering tool also can be used in coiled tubing applications. In addition, the description to follow focuses on a mud pulse telemetry means of communicating steering signals and information to and from the steering tool; however, electrical power and control signals to the steering tool also can be sent down the integrated electrical line embodiments described herein.

Briefly, the three-dimensional steering tool is mounted on a conduit near a drill bit for drilling a borehole. The steering tool comprises an integrated telemetry section, rotary section and flex section. The steering tool includes an elongated drive shaft coupled between the conduit and the drill bit. The flex section includes a deflection actuator for applying a lateral bending force to the drive shaft for making inclination angle adjustments at the drill bit. The rotary section includes a rotator actuator for applying a rotational force transmitted to the drive shaft for making azimuth angle adjustments at the drill bit. The telemetry section measures inclination angle and azimuth angle during drilling and compares them with desired inclination and azimuth angle information, respectively, to produce control signals for operating the deflection actuator to make steering adjustments in inclination angle and for operating the rotator actuator for making steering adjustments in azimuth angle.

In another embodiment of the invention, the flex section includes an elongated drive shaft coupled to the drill bit, and a deflection actuator for hydraulically applying a lateral bending force lengthwise along the drive shaft for making changes in the inclination angle of the drive shaft which is transmitted to the drill bit as an inclination angle steering adjustment. The rotary section is coupled to the drive shaft and includes a rotator housing for transmitting a rotational force to the drive shaft to change the inclination angle of the drive shaft which is transmitted to the drill bit as an azimuth angle steering adjustment. The telemetry section includes sensors for measuring the inclination angle and azimuth angle of the steering tool while drilling. Command signals proportional to the desired inclination angle and azimuth angle of the steering tool are fed to a feedback loop for processing measured and desired inclination angle and azimuth angle data for controlling operation of the deflection actuator for making inclination angle steering adjustments and for controlling operation of the rotator actuator for making azimuth angle steering adjustments.

In an embodiment of the invention directed to rotary drilling applications, a rotary drill string extends from the surface through the borehole, and the steering tool is coupled between the rotary drill string and a drill bit at the end for drilling the borehole. The steering tool includes an elongated drive shaft coupled between the drill string and the drill bit for rotating with rotation of the drill string when drilling the borehole. The flex section comprises a deflection actuator which includes a deflection housing surrounding the drive shaft and an elongated deflection piston movable in the deflection housing for applying a lateral bending force lengthwise along the drive shaft during rotation of the drill string for changing the inclination angle of the drive shaft to thereby make inclination angle steering adjustments at the drill bit. The rotary section includes a rotator housing surrounding the drive shaft and coupled to the deflection housing. A rotator piston contained in the rotator housing applies a rotational force to the deflection housing to change the azimuth angle of the drive shaft during rotation of the drill string to thereby make azimuth angle steering adjustments at the drill bit. The telemetry section measures present inclination angle and azimuth angle during drilling and compares it with desired inclination and azimuth angle information to produce control signals for operating the deflection piston and the rotator piston to make steering adjustments in three dimensions.

The description to follow discloses an embodiment of the telemetry section in the form of a closed loop feedback control system. One embodiment of the telemetry section is hydraulically open loop and electrically closed loop although other techniques can be used for automatically controlling inclination and azimuth steering adjustments. Other control techniques such as open hydraulic and open electrical as well as closed hydraulic and closed electrical are other embodiments.

Although the description to follow focuses on an embodiment in which the steering tool is used in rotary drilling applications, the invention can be used with both rotary and coiled tubing applications. With coiled tubing a downhole mud motor precedes the steering tool for rotating the drill bit and for producing rotational adjustments when changing azimuth angle, for example.

In one embodiment in which inclination and azimuth angle changes are made simultaneously, the steering tool can include a packerfoot (gripper) for contacting the wall of the borehole to produce a reaction point for reacting against the internal friction of the steering tool, not the rotational torque of the drill string. A packerfoot suitable for use in long reach rotary drilling is described below.

Figure 11:
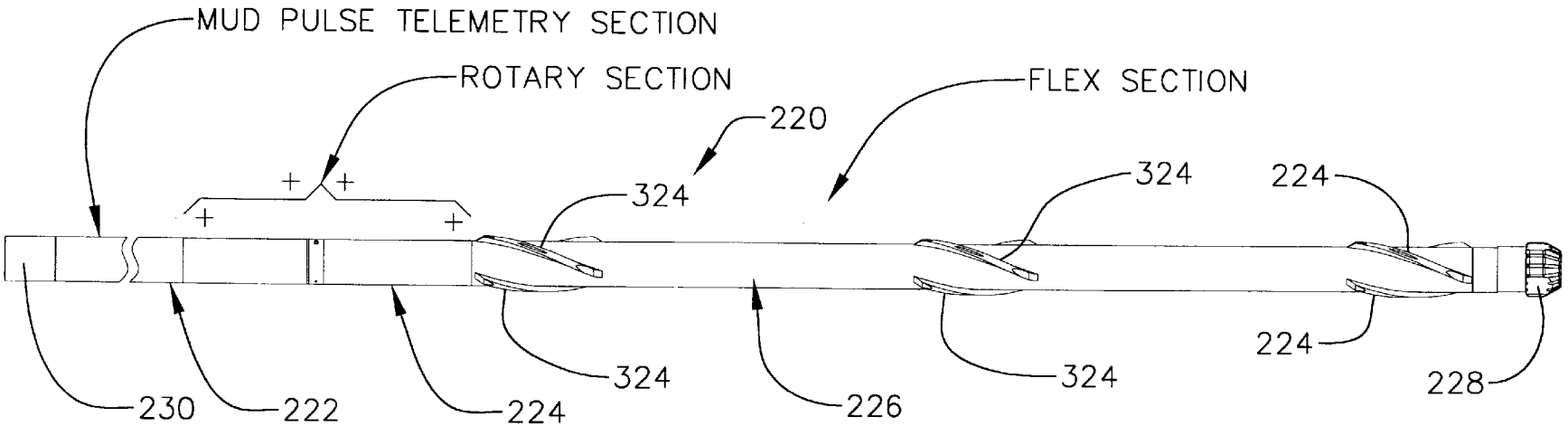
FIG. 11 is an elevational view showing the three dimensional steering tool component of this invention.
Figure 12:
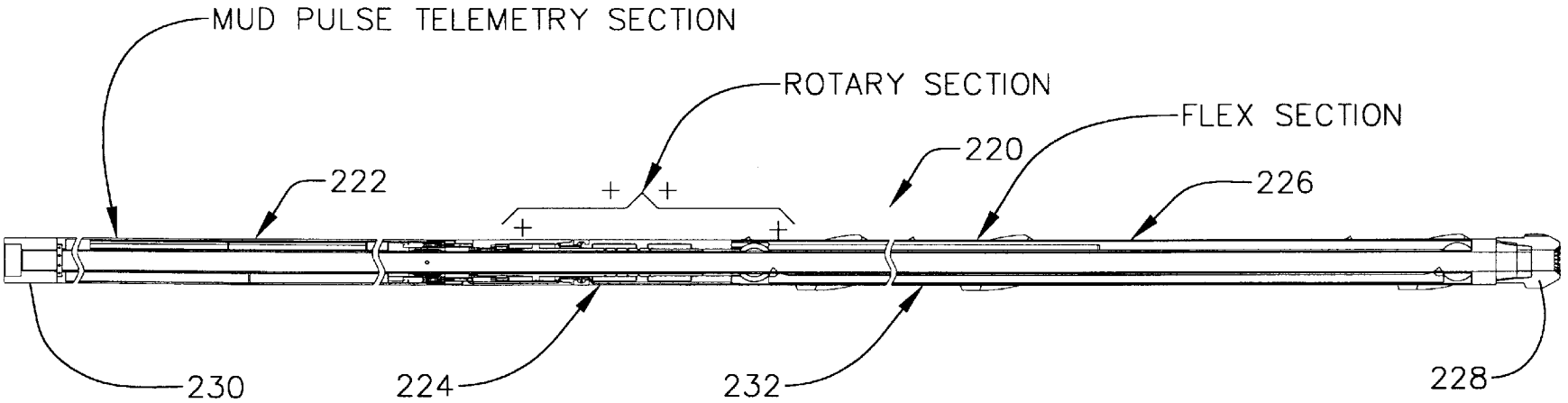
FIG. 12 is a view of the three dimensional steering tool similar to FIG. 1, but showing the steering tool in cross-section.

Referring to FIGS. 11 and 12, an integrated three dimensional steering tool 220 comprises a mud pulse telemetry section 222, a rotary section 224, and an inclination or flex section 226 connected to each other in that order in series along the length of the tool. The steering tool is referred to as an "integrated" tool in the sense that the flex section and rotary section of the tool, for making inclination angle and azimuth angle adjustments while drilling, are assembled on the same tool, along with a steering control section (the mud pulse telemetry section) which produces continuous measurements of inclination and azimuth angles while drilling and uses that information to control steering along a desired course. A drill bit 228 is connected to the forward end of the flex section. A coupling 230 at the aft end of the tool is coupled to an elongated drill string (not shown) comprising sections of drill pipe connected together and extending through the borehole to the surface in the well known manner. The inclination or flex section 226 provides inclination angle adjustments for the steering tool. The rotary section 224 provides azimuth orientation adjustments to the tool. The mud pulse telemetry section 222 provides command, communications, and control to the tool to/from the surface. The entire tool has an internal drilling bore 232, shown in FIG. 12, which allows drilling fluid (also referred to as "drilling mud" or "mud") to flow through the tool, through the drill bit, and up the annulus between the tool and the inside wall of the borehole. In the embodiment illustrated in FIGS. 11 and 12, a 6.5 inch diameter tool is used in an 8.5 inch diameter hole, and the tool is 224 inches long. Three dimensional steering is powered by differential pressure of the drilling fluid that is taken from the drill string bore and discharged into the annulus. A small portion (approximately 5% or less of the bore flow rate) is used to power the tool and is then discharged into the annulus.

The steering tool is controlled by the mud pulse telemetry section 222 and related surface equipment. The mud pulse telemetry section at the surface includes a transmitter and receiver, electronic amplification, software for pulse discrimination and transmission, displays, diagnostics, printout, control of downhole hardware, power supply and a PC computer. Within the tool are a receiver and transmitter, mud pulser, power supply (battery), discrimination electronics and internal software. Control signals are sent from the mud pulse telemetry section to operate onboard electric motors that control valves that power the rotary section 224 and the inclination or flex section 226. The steering tool is equipped with standard tool joint threaded connections to allow easy connection to conventional downhole equipment such as the drill bit 228 or drill collars.

Figure 13:
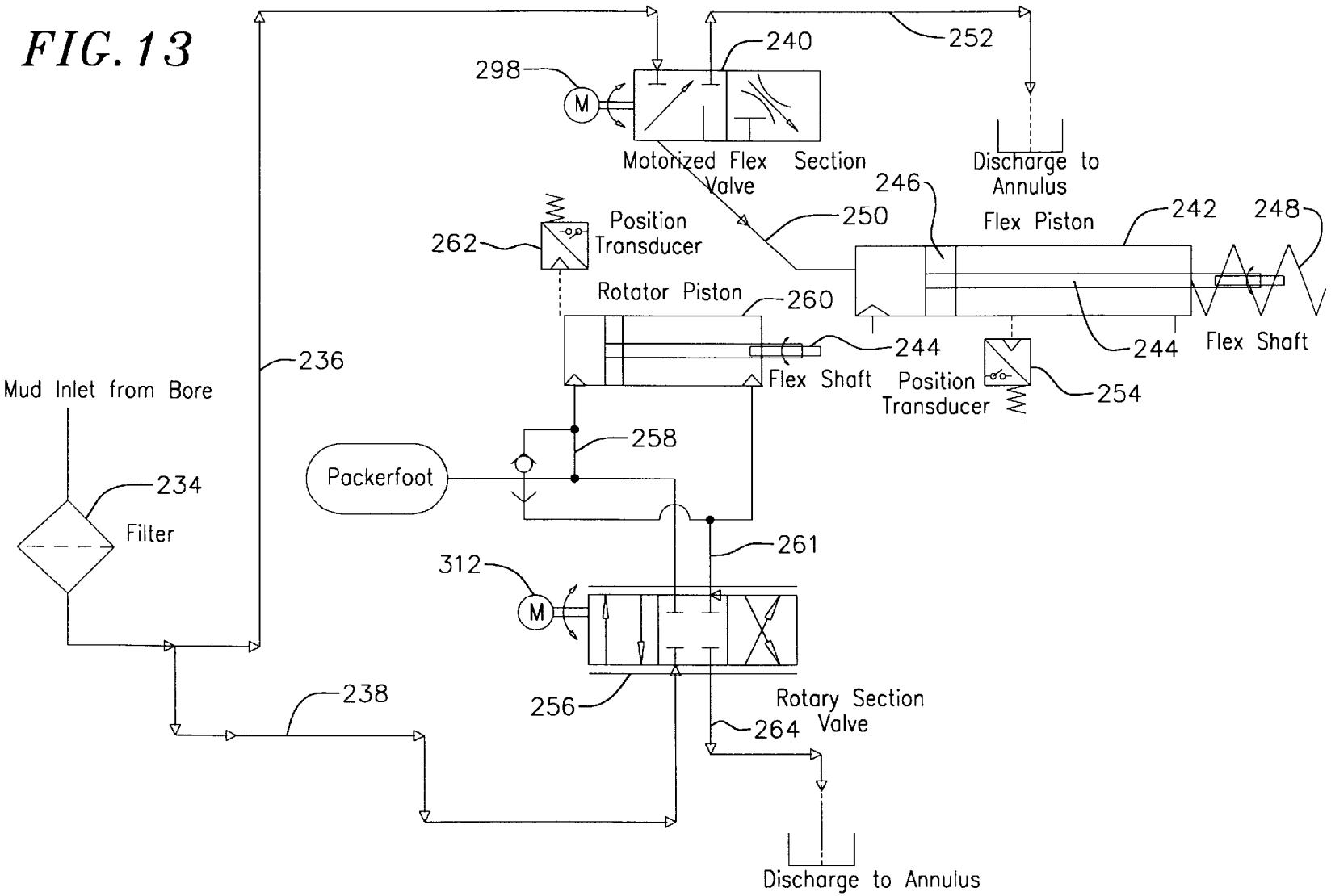
FIG. 13 is a schematic functional block diagram illustrating electrical and hydraulic components of the integrated control system for the steering tool.

FIG. 13 is a schematic functional block diagram illustrating one embodiment of an electro-hydraulic system for controlling operation of the flex section 226 and the rotary section 224 of the steering tool. Differential pressure of the drilling fluid between the drill string bore and the returning annulus is used to power the rotary and flex sections of the three-dimensional steering tool. This drilling fluid is brought into the drilling fluid control system from the annulus through a filter 234 and is then split to send the hydraulic fluid under pressure to the flex section 226 through an input line 236 and to the rotary section 224 through an input line 238. Drilling fluid from the flex section input line 236 enters an inlet side of a motorized flex section valve 240, preferably a three port/two position drilling fluid valve. When the flex section is operated to change the inclination angle of the steering tool the valve 40 opens to pass the drilling fluid to a deflection housing 42 schematically illustrated in FIG. 13. The deflection housing contains a flex shaft 244 which functions like a single-acting piston 46 with a return spring 248 as schematically illustrated. Drilling fluid passes through a line 250 from the inlet side of the valve 240 to a side of the deflection housing which applies fluid pressure to the piston section of the flex shaft for making adjustments in the inclination angle of the steering tool. After the tool has achieved the desired inclination, the flex section valve is shifted to allow drilling fluid to pass through a discharge section of the valve and drain to the annulus through a discharge line 252. Flex piston travel is measured by a position transducer 254 that produces instantaneous position measurements proportional to piston travel. These position measurements from the transducer are generated as a position feedback signal for use in a closed loop feedback control system (described below) for producing desired inclination angle adjustments during operation of the steering tool. The feedback loop from the flex position transducer to the flex valve's motor either maintains or modifies the valve position, thus maintaining or modifying the inclination angle of the tool.

For the rotary section, the drilling fluid in the input line 238 enters the inlet side of a rotary control valve 256, preferably a three position, four port drilling fluid valve. When the rotary section is operated to produce rotation of the steering tool, for adjustments in azimuth angle, the control valve 256 opens to pass drilling fluid through a line 258 to a rotator piston 260 schematically illustrated in FIG. 13. The rotator piston functions like a double-acting piston; it moves linearly but is engaged with helical gears to produce rotation of the deflection housing containing the flex piston. Drilling fluid enters the rotator piston which travels on splines to prevent the piston's rotation. The piston drives splines that rotate the deflection housing 242 and thus, the orientation of the flex shaft, which causes changes in the azimuth angle of the steering tool. Drilling fluid from the rotator piston is re-circulated back to the rotary section valve 256 through a return line 261. Piston travel of the rotator piston is measured by a rotary position transducer 262 that produces a position signal measuring the instantaneous position of the rotator piston. The rotary position signal is provided as a position feedback signal in a closed loop feedback control system described below. The feedback signal is proportional to the amount of travel of the rotator piston for use in producing desired rotation of the steering tool for making azimuth angle adjustments. After the steering tool has achieved the desired azimuth adjustment, the rotary section valve is shifted to allow the fluid to drain through a discharge line 264 to the annulus.

Figure 14:
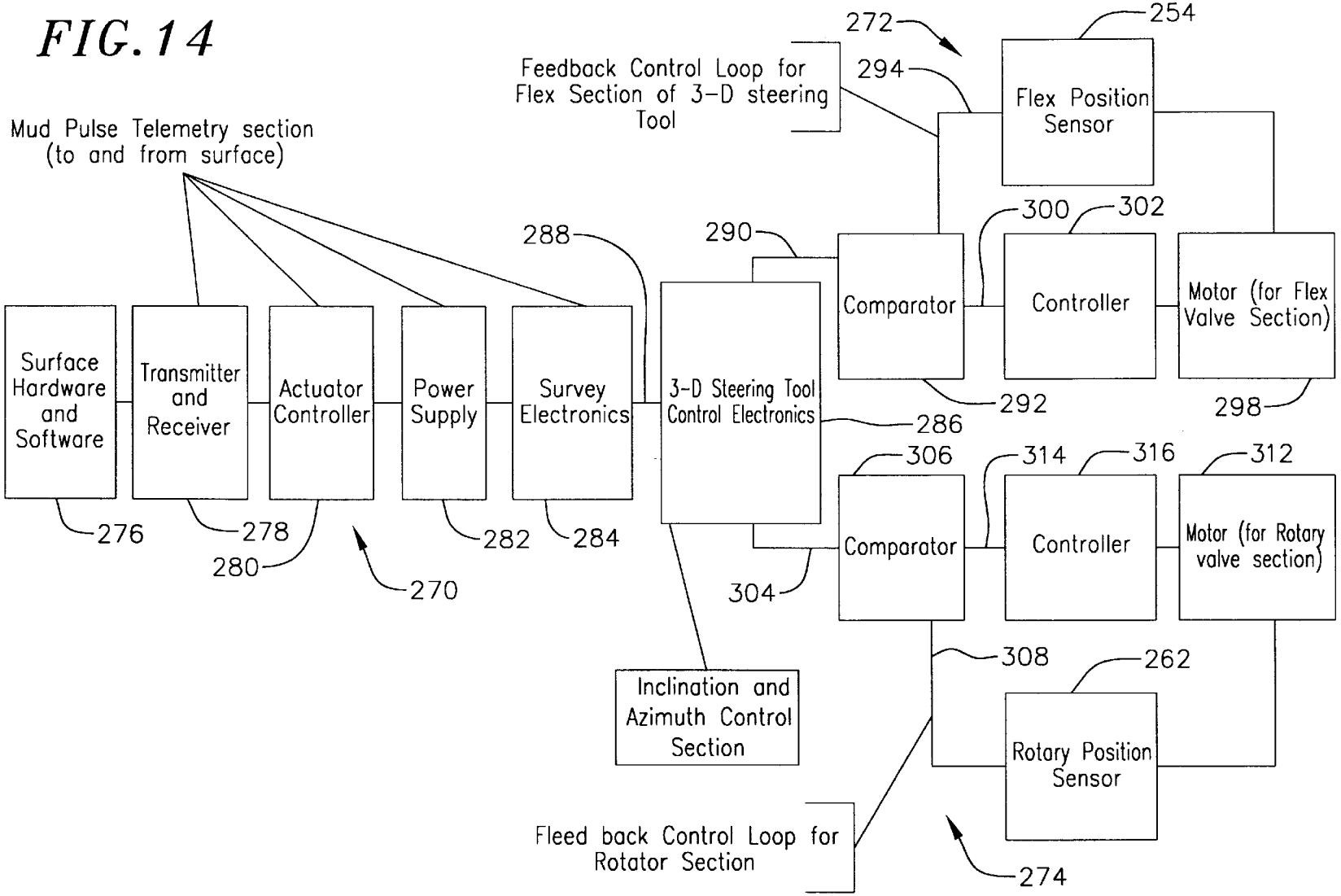
FIG. 14 is a functional block diagram showing the electronic components of an integrated inclination and azimuth control system for the steering tool.

FIG. 14 is a functional block diagram illustrating the electronic controls for operating the flex section and the rotary section of the steering tool. The control system is divided into three major sections—a mud pulse telemetry section 270, a feedback control loop 272 for the flex section of the steering tool, and a feedback control loop 274 for the rotator section of the tool.

The mud pulse telemetry section 270 includes surface hardware and software 276, a transmitter and receiver 278, an actuator controller 280, a power supply (battery or turbine generator) 282, and survey electronics with software 284. The survey equipment uses a inclinometer or accelerometer for measuring inclination angle and a magnetometer for measuring azimuth angle. The mud pulse telemetry receives inclination and azimuth data periodically, and the controller translates this information to digital signals which are then sent to the transmitter which comprises a mud pulse device which exhausts mud pressure into the annulus and to the surface. Standpipe pressure variations are measured (with a pressure transducer) and computer software is used to produce input signal information proportional to desired inclination and azimuth angles. The position of the tool is measured in three dimensions which includes inclination angles (tool face orientation and inclination) and azimuth angle. Tool depth is also measured and fed to the controller to produce the desired inclination and azimuth angle input data.

The mud pulse telemetry section includes 3-D steering tool control electronics 286 which receive data inputs 288 from the survey electronics 284 to produce steering input signals proportional to the desired inclination angle and azimuth angle. In the flex section controller 272, a desired inclination angle signal 290 is fed to a comparator 292 along with an inclination angle feedback signal 294 from the flex position transducer 254. This sensor detects positional changes from the flex section piston, as described above, and feeds that data back to the comparator 292 which periodically compares the feedback signal 294 with the desired inclination angle input signal 290 to produce an inclination angle error signal 300. This error signal is fed to a controller 302 which operates the flex section valve motor 98 for making inclination angle adjustments.

In the rotary section control loop 274 a desired azimuth angle signal 304 is fed to a comparator 306 along with a rotary position feedback signal 308 from the rotary position transducer 262. This sensor detects positional changes from the rotator section piston described above and feeds that position data back to the comparator 306 which compares the feedback signal 308 with the azimuth angle input signal 304 to produce an error signal 314 for controlling azimuth. The error signal 314 is fed to a controller 316 which controls operation of the rotary valve section motor 312 for making azimuth angle adjustments.

The flex position sensor 254, which is interior to the steering tool, measures how much the flex shaft is deflected to provide the position feedback information sent to the comparator. The rotary position sensor 262 measures how much the rotator piston is rotated. This sensor is located on the rotator piston and includes a magnet which moves relative to the sensor to produce an analog output which is fed back to the comparator 106.

A packerfoot 318 is actuated to expand into the annulus and make contact with the wall of the borehole in situations where changes in inclination angle and azimuth angle are made simultaneously. The packerfoot is described in more detail below. An alternative gripper mechanism can be used to assist the rotary section. One of these is the Flextoe Packerfoot, which has a multiplicity of flexible members (toes) that are deflected onto the hole wall by different mechanisms, including inflating a bladder, or lateral movement of a wedge-shaped element into the toe. These are described in U.S. patent application Ser. No. 09/453,996, incorporated herein by reference. These gripping elements may incorporate the use of a mandrel and splines that allow the gripper to remain in contact to the hole wall while the tool advances forward. Alternatively, the component can remain in contact with the hole wall and be dragged forward by the weight of the system. The design option to drag or allow the tool to slide relative to the gripper depends upon the loads expected within the tool for the range of operating conditions of azimuth and inclination angle change.

Figure 15:
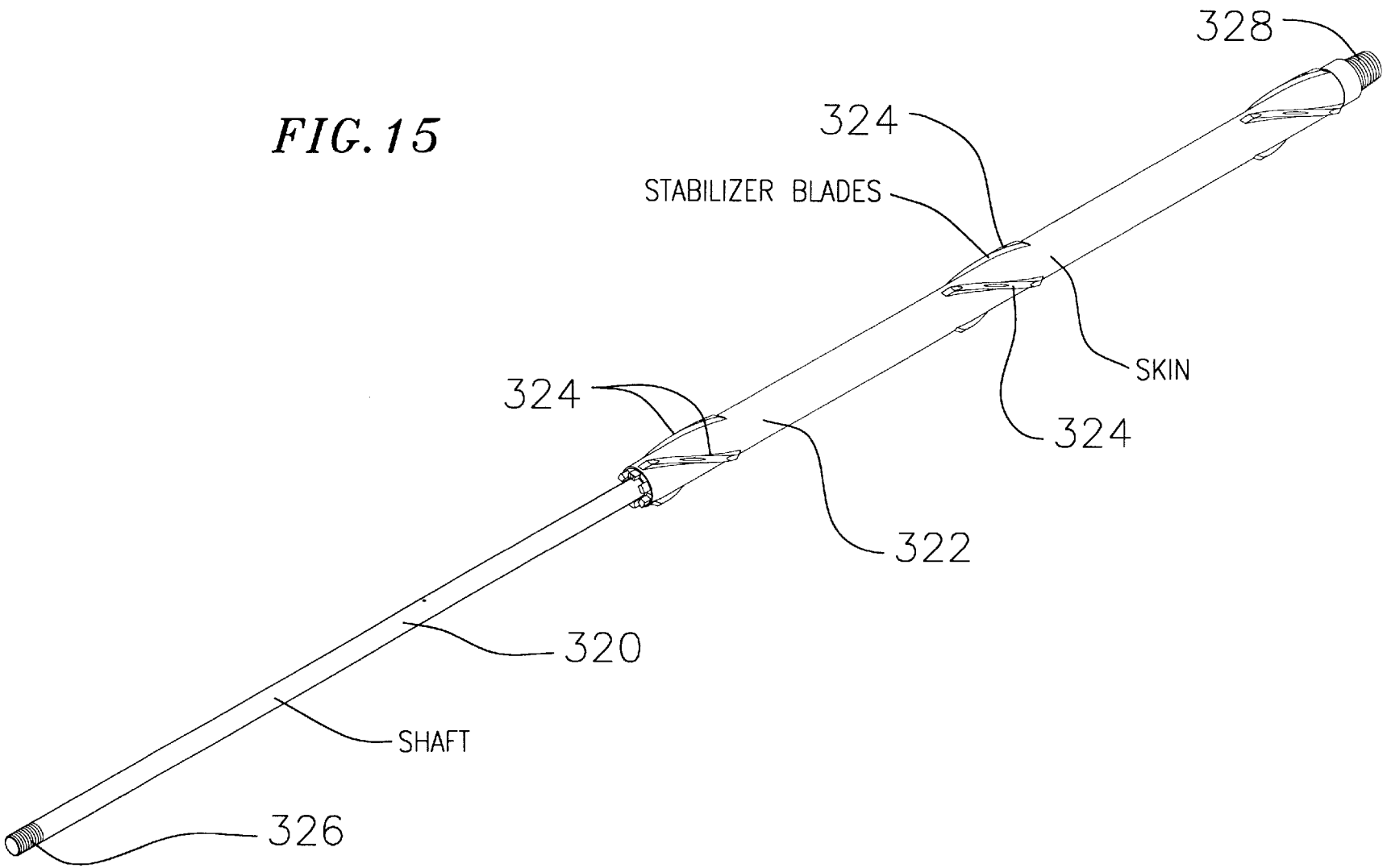
FIG. 15 is a perspective view showing a flex shaft component of the steering tool.

FIGS. 15 through 20 illustrate components of the flex section 226 of the steering tool. FIG. 15 is an external perspective view of the flex section which includes an elongated, cylindrical, axially extending hollow drive shaft 320 extending the length of the flex section. The major components of the flex section are mounted to an aft section of the drive shaft and extend for about three-fourths the length of the shaft 320. In the external view of FIG. 15 the components include an elongated external skin 322 mounted concentrically around the shaft. The flex section components contained within the outer skin are described below. Helical stabilizer blades 324 project outwardly from the skin for contact with the wall of the borehole. A threaded connection 326 at the forward end of the drive shaft is adapted for connection to the drill bit 228 or to drill collars adjacent a drill bit. At the aft end of the flex section, a threaded connection 328 is adapted for connection to the rotary section of the steering tool.

Figure 16:
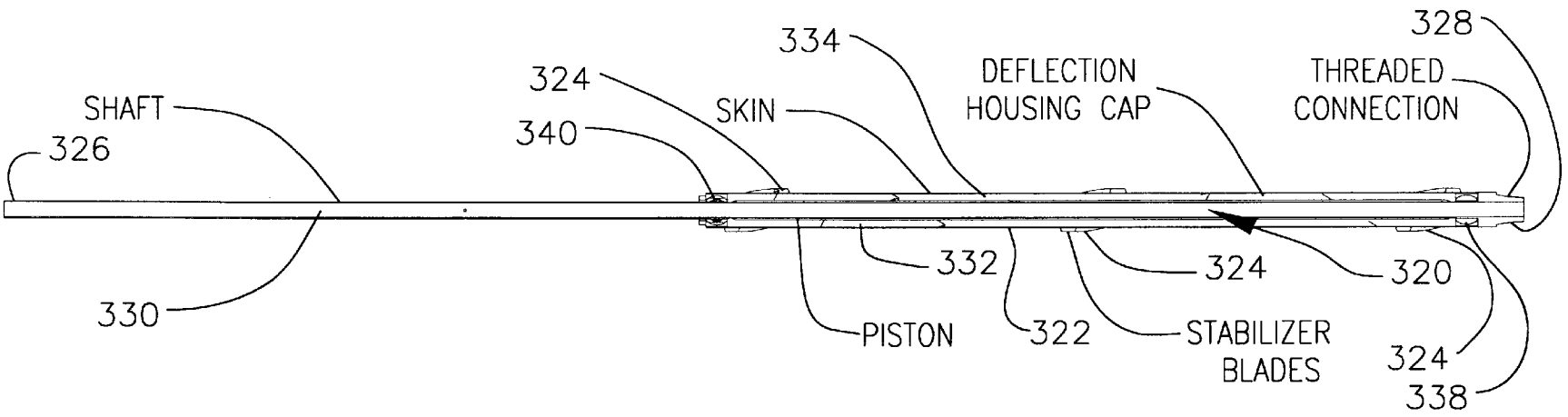
FIG. 16 is a cross-sectional view of the flex shaft shown in FIG. 15.

The cross-sectional view of FIG. 16 shows the drive shaft 320 running the length of the flex section, with a forward end section 330 of the drive shaft projecting axially to the exterior of the flex section components contained within the outer skin 322. This assembly of parts comprises a deflection actuator which includes an elongated deflection housing 332 extending along one side of the drive shaft, and an elongated deflection housing cap 334 extending along an opposite side of the drive shaft. The deflection housing and the deflection housing cap surround the drive shaft. An elongated deflection piston 336 is contained in the annulus between the drive shaft and the combined deflection housing and deflection housing cap. A forward end hemispherical bearing 340 and an aft end hemispherical bearing 338 join corresponding ends of the flex section components contained within the outer skin to the drive shaft. Alternatively, the hemispherical bearing on the aft end can be a constant velocity joint, either of commercially available type or specially designed.

Figure 17:
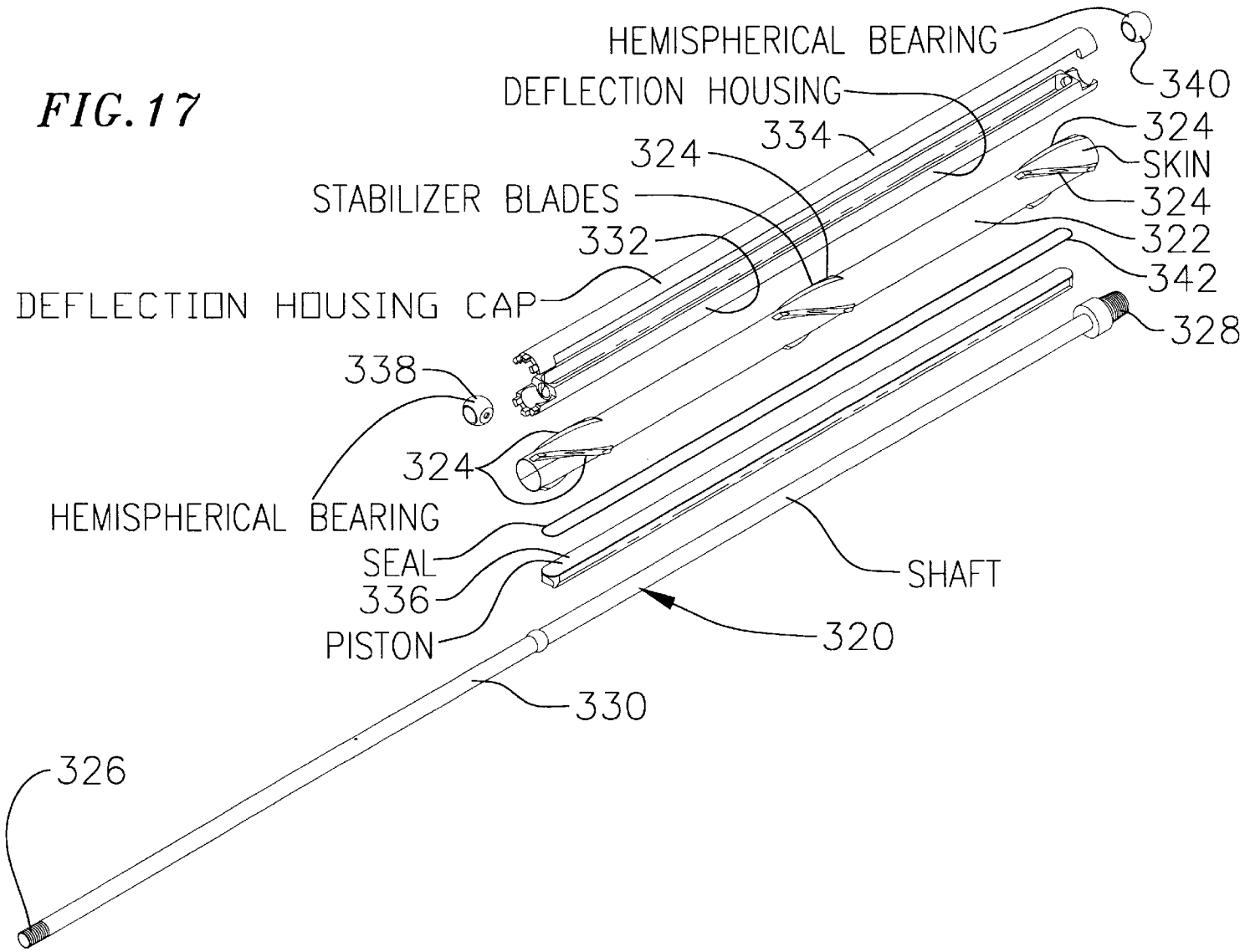
FIG. 17 is an exploded view shown in perspective to illustrate various components of a flex section of the steering tool.

The exploded perspective view of FIG. 17 illustrates internal components of the flex section. The deflection housing 132 has an upwardly opening generally U-shaped configuration extending around but spaced from the flex shaft. The deflection housing cap 334 is joined to the outer edges of the deflection housing to completely encompass the flex shaft 320 in an open space within the combined deflection housing and cap. The deflection piston 336 is mounted along the length of the flex shaft 320 to surround the flex shaft inside the deflection housing, but in some configurations may extend only over a portion of the length and its cap. The deflection piston extends essentially the entire length of the portion of the flex shaft contained in the deflection housing. A flat bottom surface of the deflection housing cap 332 joins to a cooperating flat top surface extending along the length of the deflection piston 336. FIG. 17 also shows one of two elongated seals 342 which seal outer edges of the deflection piston 336 to corresponding inside walls of the deflection housing.

Figure 18:
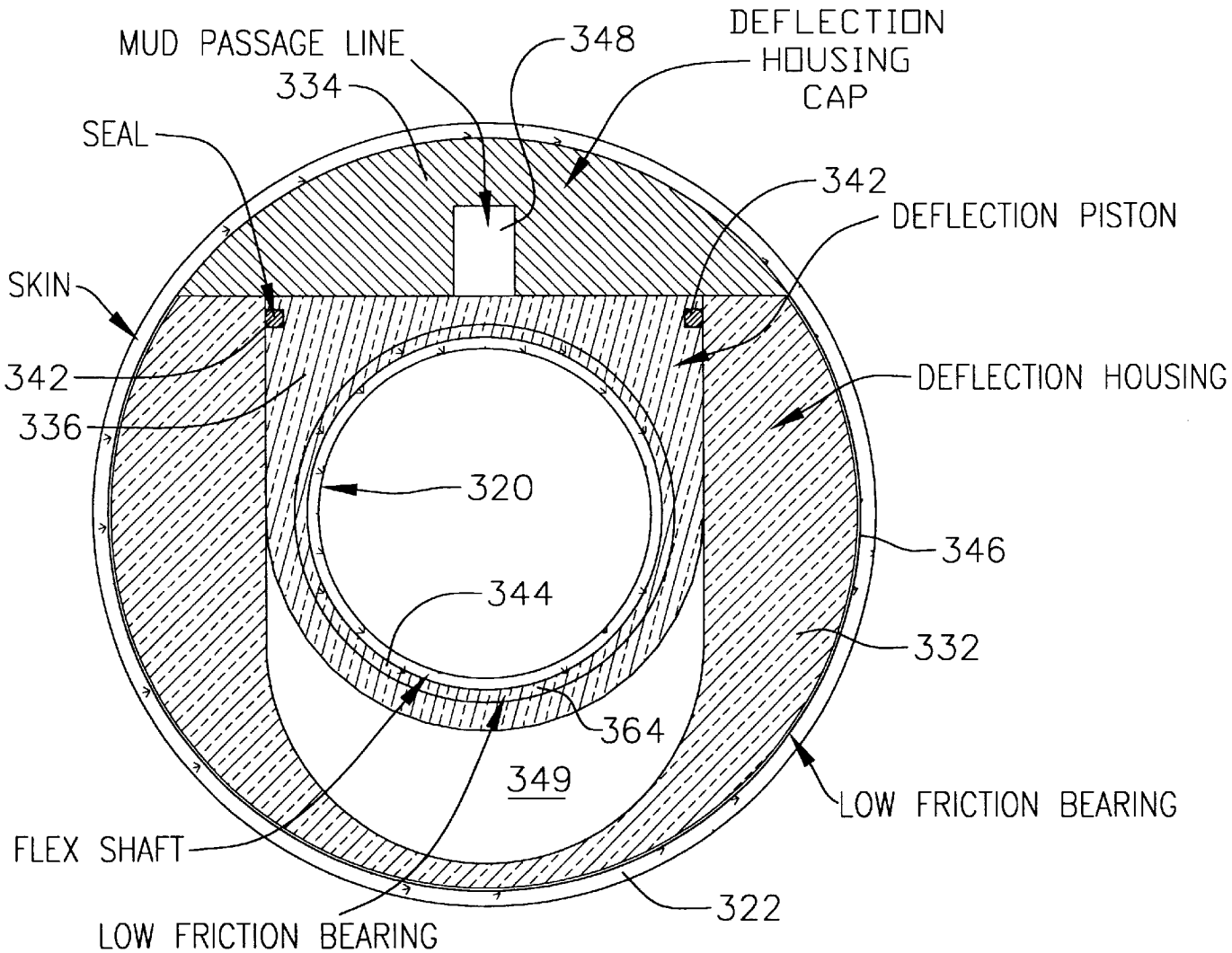
FIG. 18 is a cross-sectional view of the flex section of the steering tool in which the various components are assembled.

The cross-sectional view of FIG. 18 best illustrates how the components of the flex section are assembled. The hollow flex shaft 320 extends concentrically inside the outer skin 322 along a concentric longitudinal axis of the flex section. The deflection piston 336 surrounds the flex shaft in its entirety and is mounted on the flex shaft via an aligned cylindrical low-friction bearing 344. The U-shaped deflection housing 332 surrounds a portion of the flex shaft 320 and its piston 336, with flat outer walls of the piston bearing against corresponding flat inside walls of the U-shaped deflection housing. The longitudinal seals 342 seal opposite outer faces of the deflection piston to the inside walls of the deflection housing. The fixed deflection housing is mounted to the inside of the skin via an elongated low-friction bearing 346. A mud passage line 348 is formed internally within the deflection housing cap adjacent the top of the deflection piston. Drilling fluid under pressure in the passage is applied as a large pushing force to the top of the piston for deflecting the piston downwardly into the deflection housing. The passage extends the length of the piston to distribute the hydraulic pushing force along the length of the piston. Alternatively, the deflection piston may be used over a portion of the flex shaft. Deflection of the piston is downwardly into a void space 349 located internally below the piston and within the interior of the deflection housing. Deflection of the piston 336 has the effect of bending the flex shaft and thereby changing the angle of inclination at the end of the shaft. This adjusts the inclination angle of the drill bit at the end of the steering tool. The region between the outer skin and both the deflection housing and the deflection housing cap has a low friction material that acts as a bearing.

The relatively stiff deflection housing provides a structural reaction point for the internal flex shaft. The internal support structure provides a means for allowing the flex shaft to react against. As mentioned, the deflection piston runs the length of the flex section and the pressure is applied to the top of the piston to displace the flex shaft. The amount of this displacement of the deflection piston is greatest at its mid section between the hemispherical bearings at the ends of the flex section. The space provided to allow the deflection piston to move within the deflection housing varies along the length of the tool and is greatest at the midpoint between the hemispherical end bearings.

The flex shaft 320 rotates within the deflection piston 336. The region between the deflection housing and the flex shaft has its hydraulic bearing 364 lubricated either by mud (if in an open system which is preferred) or hydraulic oil (if sealed) and may include Teflon low friction materials. Pressure delivered between the deflection housing and the deflection piston (through the line 348) moves both the deflection piston and the flex shaft, while the flex shaft rotates with the drill string.

The reaction points for the skin and deflection housing are the multiple stabilizers 324 located on the forward and aft ends of the tool, although in one configuration a third set of stabilizers is located at the center, as shown in the drawings. The stabilizers may be either fixed or similar to a non-rotating style hydraulic bearing. The stabilizers cause the skin and the deflection housing to be relatively rigid compared to the flex shaft.

In one embodiment, the deflection housing and deflection housing cap are both made from rigid materials such as steel. The flex shaft, in order to facilitate bending, is made from a moderately high tensile strength material such as copper beryllium.

Figure 19:
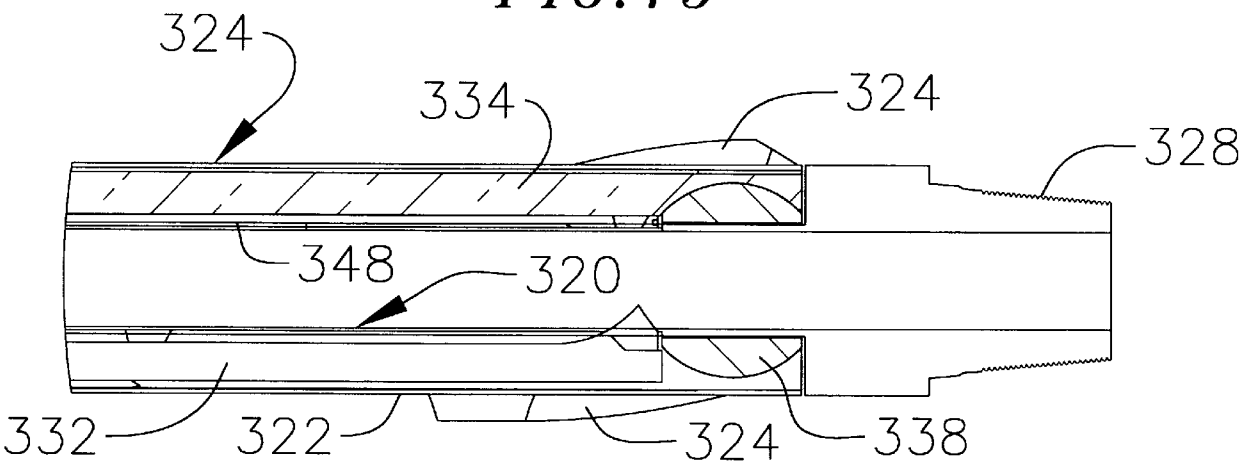
FIG. 19 is a fragmentary cross-sectional view showing a bearing arrangement at the forward end of the flex shaft component of the flex section.
Figure 20:
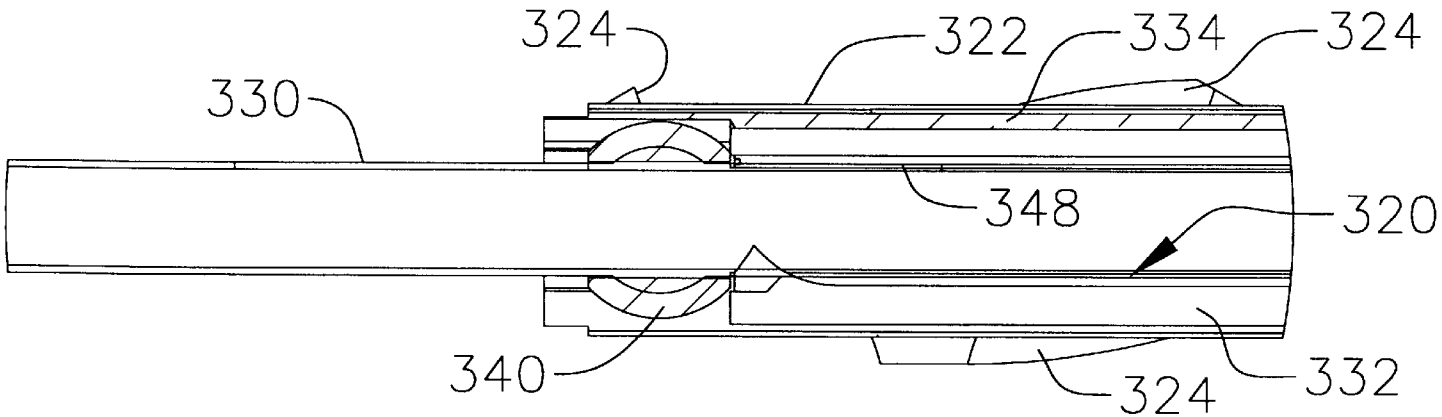
FIG. 20 is a fragmentary cross-sectional view showing a bearing arrangement at the aft end of the flex shaft component of the flex section.

FIGS. 19 and 20 show the aft and forward ends of the flex section, respectively, including the flex shaft 320, deflection piston, stabilizers 324, the outer skin 322 and the hemispherical bearings. FIG. 9 shows the hemispherical bearing 338 at the aft end of the flex section, and FIG. 20 shows the hemispherical bearing 340 at the forward end of the flex section. The bearings used to support the flex shaft can be various types, and preferably, the bearings rotate in a manner similar to a wrist joint. The hemispherical bearings shown can be sealed and lubricated or open to drilling fluid. The hemispherical bearings can be limited in deflection to less than 15 degrees (from horizontal) of deflection. Alternatively, constant velocity joints can be used. RMZ Inc. of Sterling Heights, Mich. produce a constant velocity joint with smooth uniform rotary motion with deflection capability up to 25 degrees. CV joints are low cost and efficiently transfer torque but will require that sealing from the drilling fluid.

Control for the flex section may be located in either the flex section or the rotary section but preferably in the rotary section. Again, the mud pulse telemetry is used to provide controls to the steering tool. Mud pulses are sent down the bore of the drill string, received by the mud pulse telemetry section, and then commands are sent to the flex and rotary sections. The flex section's electrical controls operate the electrical motor in a pressure compensated environment which controls the valve that delivers a desired drilling fluid pressure to the deflection housing, producing a desired change in inclination. The inclination angle changes produced by flexing the flex shaft and transmitted to the steering tool are at the end of the flex shaft.

The transducer used to measure deflection of the flex shaft or deflection housing provides feedback signals measuring the change in inclination of the tool as described previously. Other means of measuring flex shaft deflection can be used. Different types of displacement transducers can be used to determine the displacement of the shaft.

Significantly, because of this system design, the steering tool can be operated to change either inclination or azimuth separately and incrementally, or inclination or azimuth continuously and simultaneously, thus avoiding the downhole problem of differential sticking.

The aft end of the deflection housing is equipped with teeth that mesh into matching teeth in the rotary section. The joining of the deflection housing to the rotary section allows the rotary section to rotate the deflection housing to a prescribed location. The size and number of teeth can be varied depending upon tool size and expected deflection range of the flex section. The construction and operation of the rotary section is described as follows.

Figure 21:
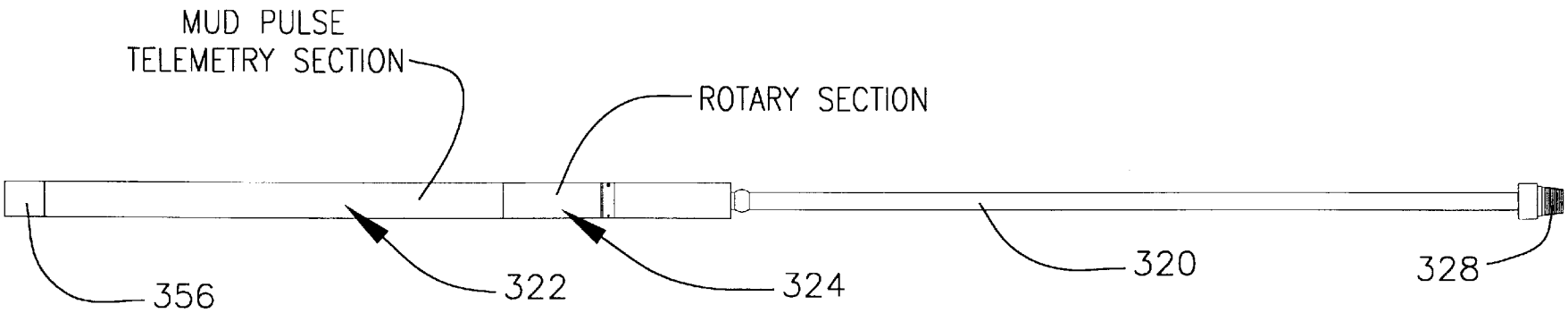
FIG. 21 is an elevational view showing a rotary section of the steering tool.
Figure 22:
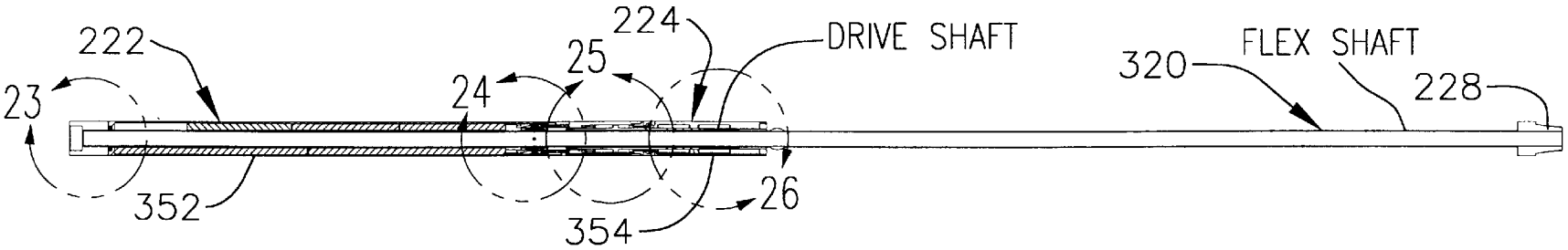
FIG. 22 is a cross-sectional view similar to FIG. 21 and showing the rotary section.

FIGS. 21 and 22 show external and longitudinal cross-section views of the rotary section 224 of the steering tool, in its alignment between the flex shaft 320 and the mud pulse telemetry section 222. The cross-sectional view of FIG. 22 shows a mud pulse telemetry housing 352 concentrically aligned along the steering tool with the flex shaft 320 and a rotary section housing 354. The housing 354 is joined to the mud pulse telemetry housing 352 and is also aligned concentrically with the flex shaft 320. FIGS. 23 to 26 show detailed cross-sectional views of the rotary section from the aft end to forward end of the steering tool.

Figure 23:
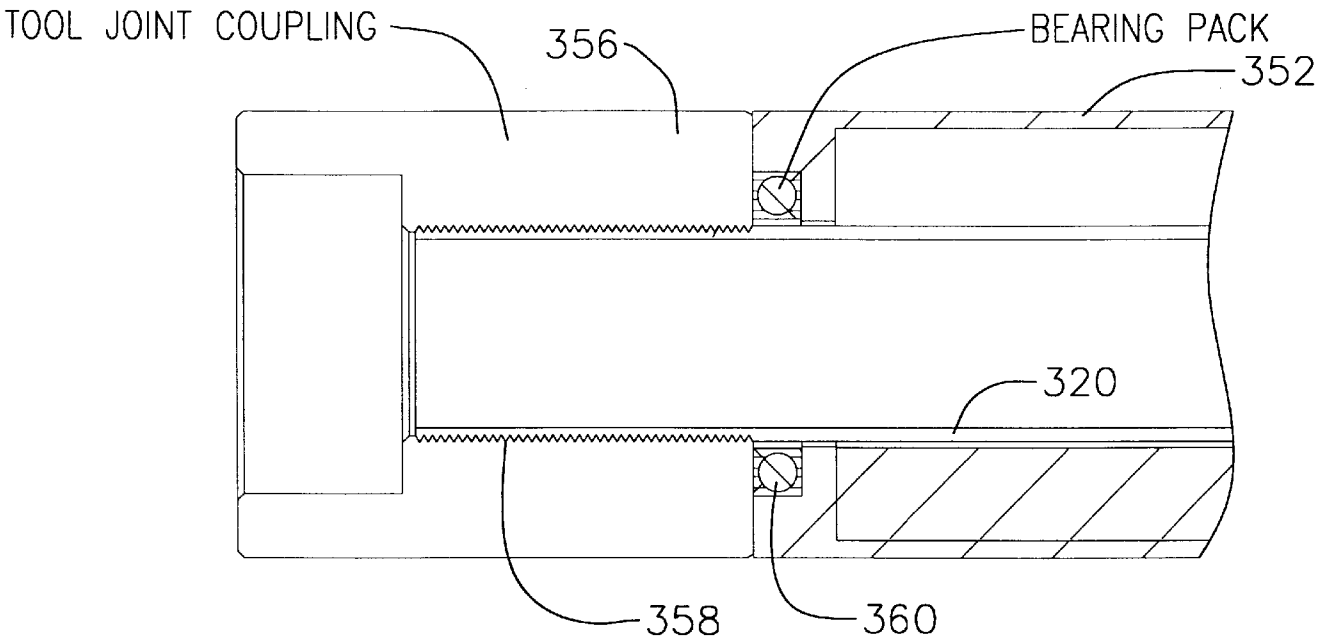
FIG. 23 is an enlarged fragmentary cross-sectional view taken within the circle 23—23 of FIG. 22.

Referring to FIG. 23, a tool joint coupling 356 connects to the drill string and delivers rotary motion to the flex shaft 320. A threaded end coupling 358 at the end of the flex shaft connects to the tool joint coupling 356. The tool joint coupling delivers rotary motion to the drive shaft and then through the hemispherical (or constant velocity) bearings to the flex shaft, the end of which is connected to the drill bit 228. A bearing pack 360 juxtaposed to the tool joint coupling prevents rotation from being delivered to the mud pulse telemetry housing 352 in response to rotation of the drill pipe and the flex shaft.

Figure 24:
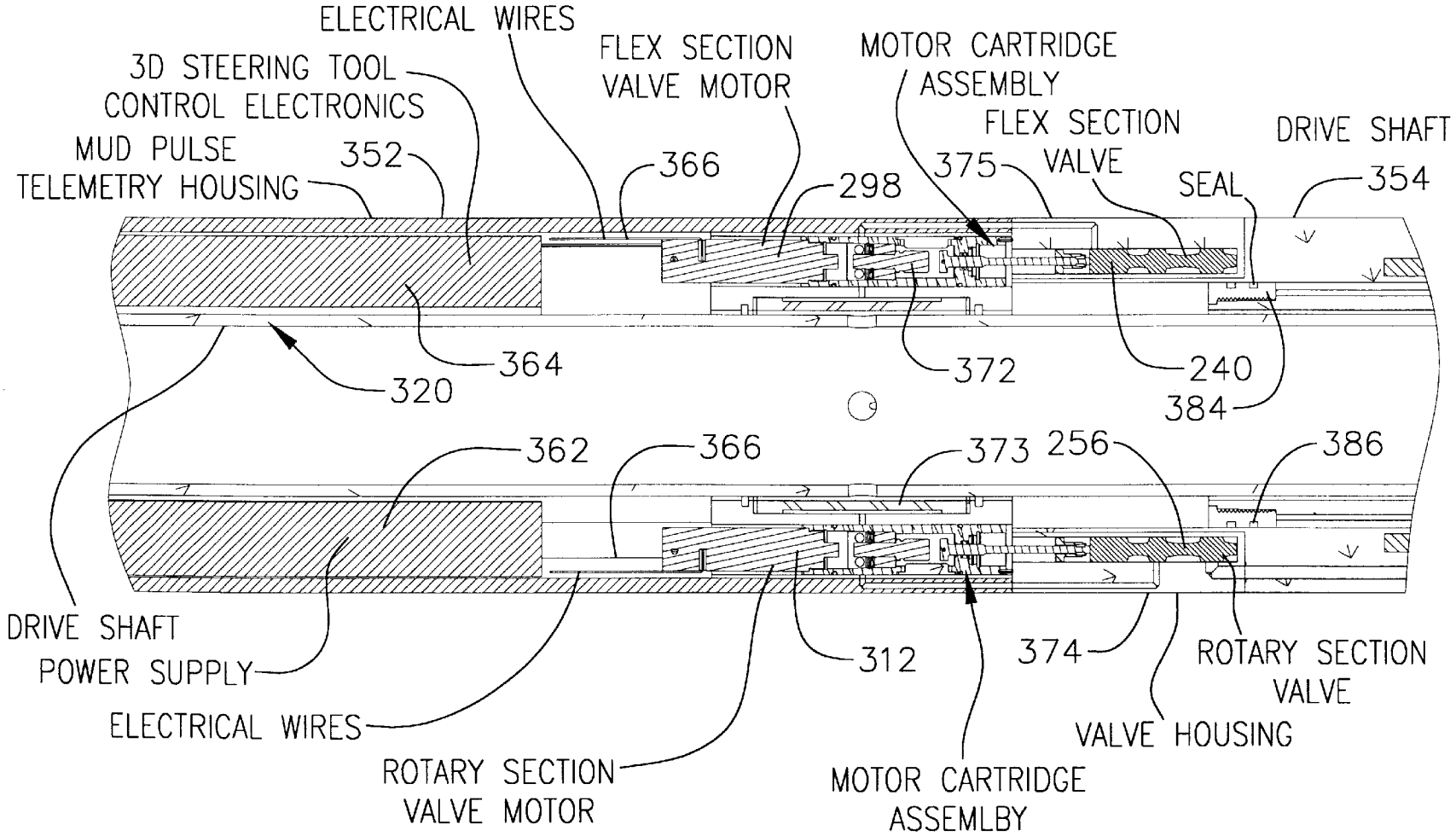
FIG. 24 is an enlarged fragmentary cross-sectional view taken within the circle 24—24 of FIG. 22.

Referring to FIG. 24, the mud pulse telemetry housing 352 contains the mud pulse telemetry transmitter, actuator/controller and survey electronics. The power supply 362 and steering tool electronics 364 are schematically shown in FIG. 24. These components are contained within an atmospherically sealed environment. Electrical lines 366 feed through corresponding motor housings and house the electric motors for the flex section control valve and the rotary section control valve. The electrical motors include the flex section valve motor 298 and the rotary section motor 312. The electrical motors may be either DC stepper or DC brushless type as manufactured by CDA Intercorp., Deerfield Beach, Fla. The motors are housed in a region containing hydraulic fluid, such as Royco 756 oil, from Royco of Long Beach, Calif. Electrical connectors, such as those manufactured by Greene Tweede & Co., Houston, Tex., connect the motors to the atmospheric chamber of the mud pulse telemetry electronics. The hydraulic fluid surrounding the motors is separated from the drilling fluid by a piston (not shown) for providing a pressure compensated environment to ensure proper function of the motors at extreme subterranean depths. The electric motors are connected to either the flex section control valve or to the rotary section control valve via a Western Well Tool-designed motor cartridge assembly 372. Drilling fluid is delivered to either the rotary section valve or to the flex section valve via fluid channels in each motor housing and valve housing. The rotary section valve 256 is contained within a valve housing 374 mounted in a recess in the rotary section. The rotary section valve comprises a spool type valve with both the spool and the valve housing constructed of tungsten carbide to provide long life. This rotary section valve and its related components for applying rotational forces when making changes in azimuth angle are referred to herein as a rotator actuator.

A filter/diffuser 373 is contained within the motor housing, and drilling fluid passes through the drive shaft via a multiplicity of holes and into the filter/diffuser. Drilling fluid from the flex section valve 40 moves through flow passages through a valve housing 375 to the deflection housing 332, thereby pressurizing the flex piston 336. The flex valve housing is mounted in a recess in the rotary section opposite from the rotary valve housing. The flex section valve 240 is a spool type valve made tungsten carbide. Fluid returning from the deflection housing is discharged to the annulus between the steering tool and the wall of the borehole.

Figure 25:
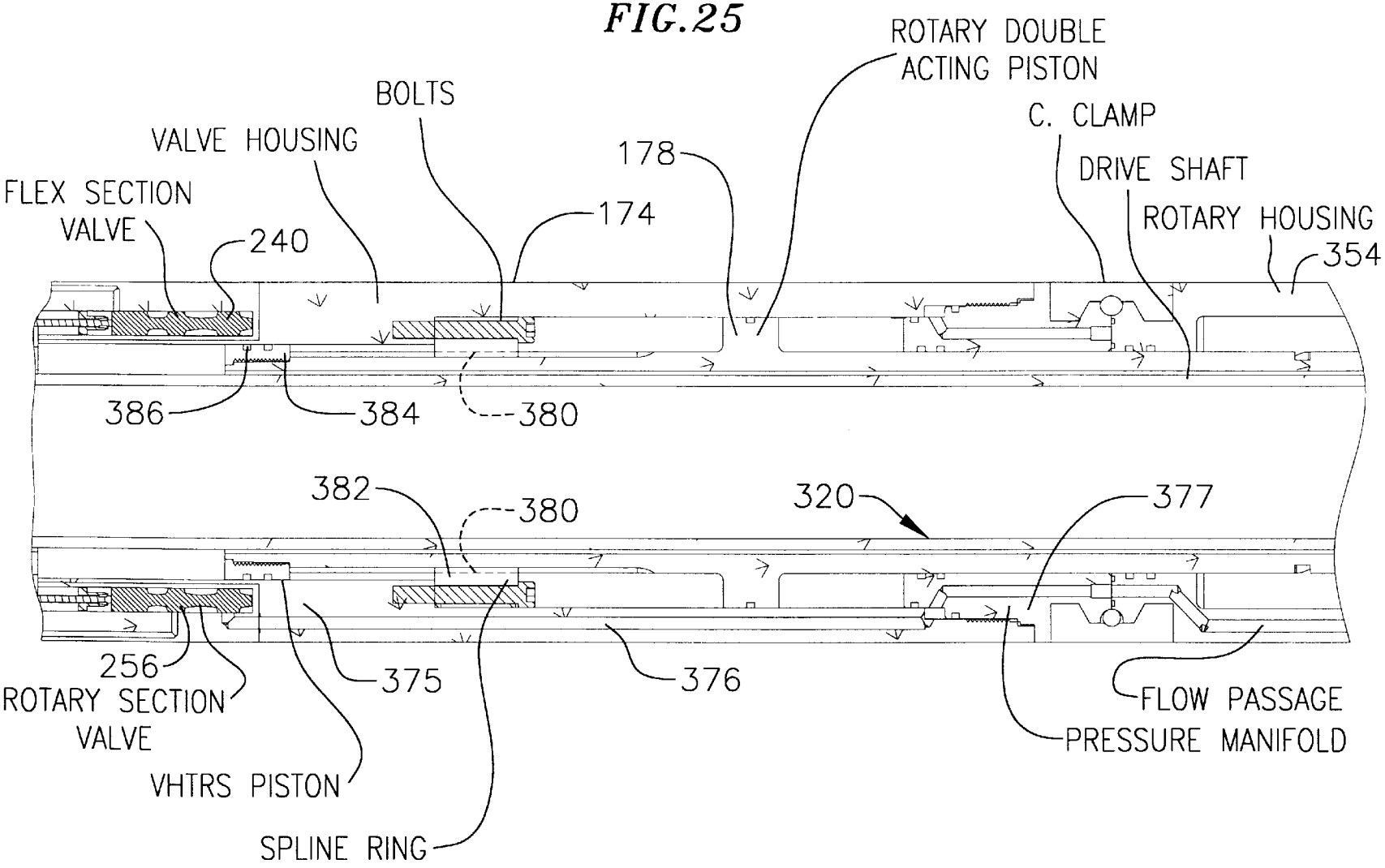
FIG. 25 is an enlarged fragmentary cross-sectional view taken within the circle 25—25 of FIG. 22.
Figure 26:
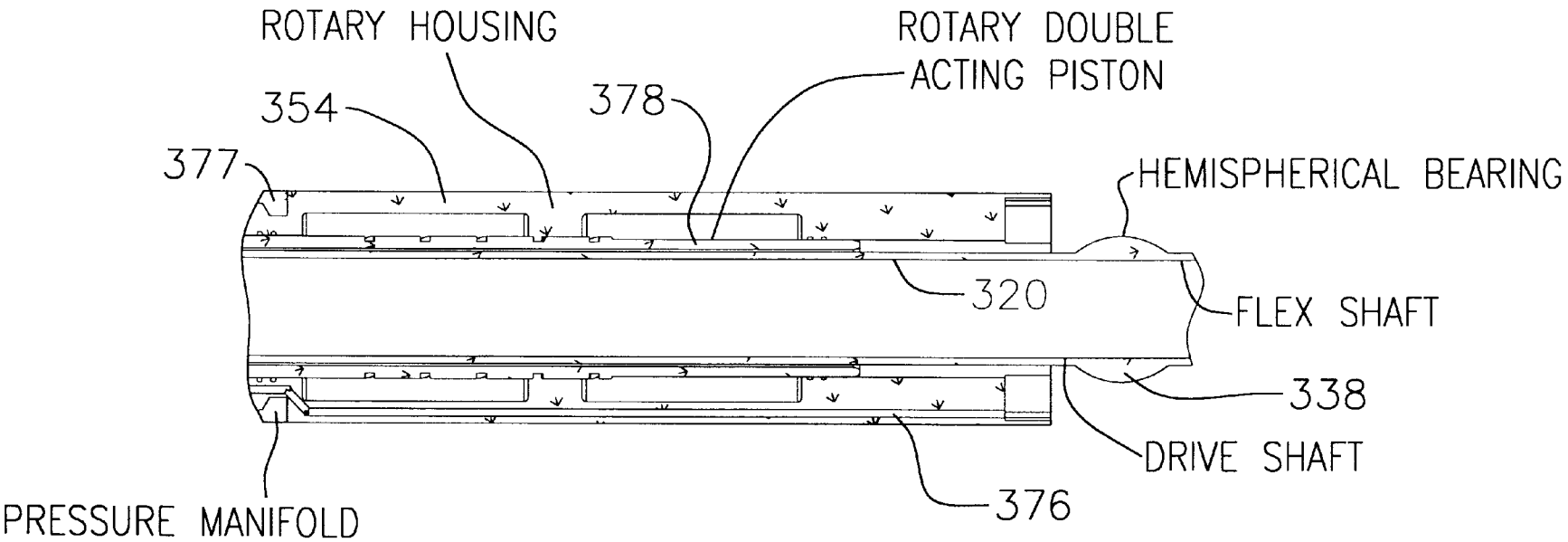
FIG. 26 is an enlarged fragmentary cross-sectional view taken within the circle 26—26 of FIG. 22.

Referring to FIGS. 25 and 26, drilling fluid from the rotary section valve 240 passes via fluid flow passages 376 through the rotary valve housing 375 and into either side (as directed by the valve) of the region of a rotary double-acting piston 378. Drilling fluid from the other side of the piston 378 returns via fluid passageways to the rotary valve 256 and is discharged to the annulus. Drilling fluid also passes through flow passages 176 via a pressure manifold 377 to the rotary housing and then to the deflection housing. The aft end of the rotary double-acting piston has splines 380 connected to a spline ring 382. The splines restrict motion of the rotary double-acting piston (and its shaft) to strictly linear motion. The aft end of the rotary double-acting piston is sealed from the drilling fluid by a piston 384 (referred to as valve housing to rotary section piston or VHTRS piston). The VHTRS piston includes piston seals 386, and this piston provides a physical closure for the area between the valve housing and the rotary section. As the rotary double-acting piston 378 moves forward linearly, its helical teeth engage matching helical grooves in the rotary housing 354. The helical teeth or gears on the rotary double-acting piston are shown at 388 in FIG. 27. The rotary housing is connected via recessed teeth to the deflection housing and the deflection housing cap. Pressurized drilling fluid delivered to the rotary double-acting piston results in rotation of the deflection housing, thus changing the steering tool's azimuth position.

Figure 27:
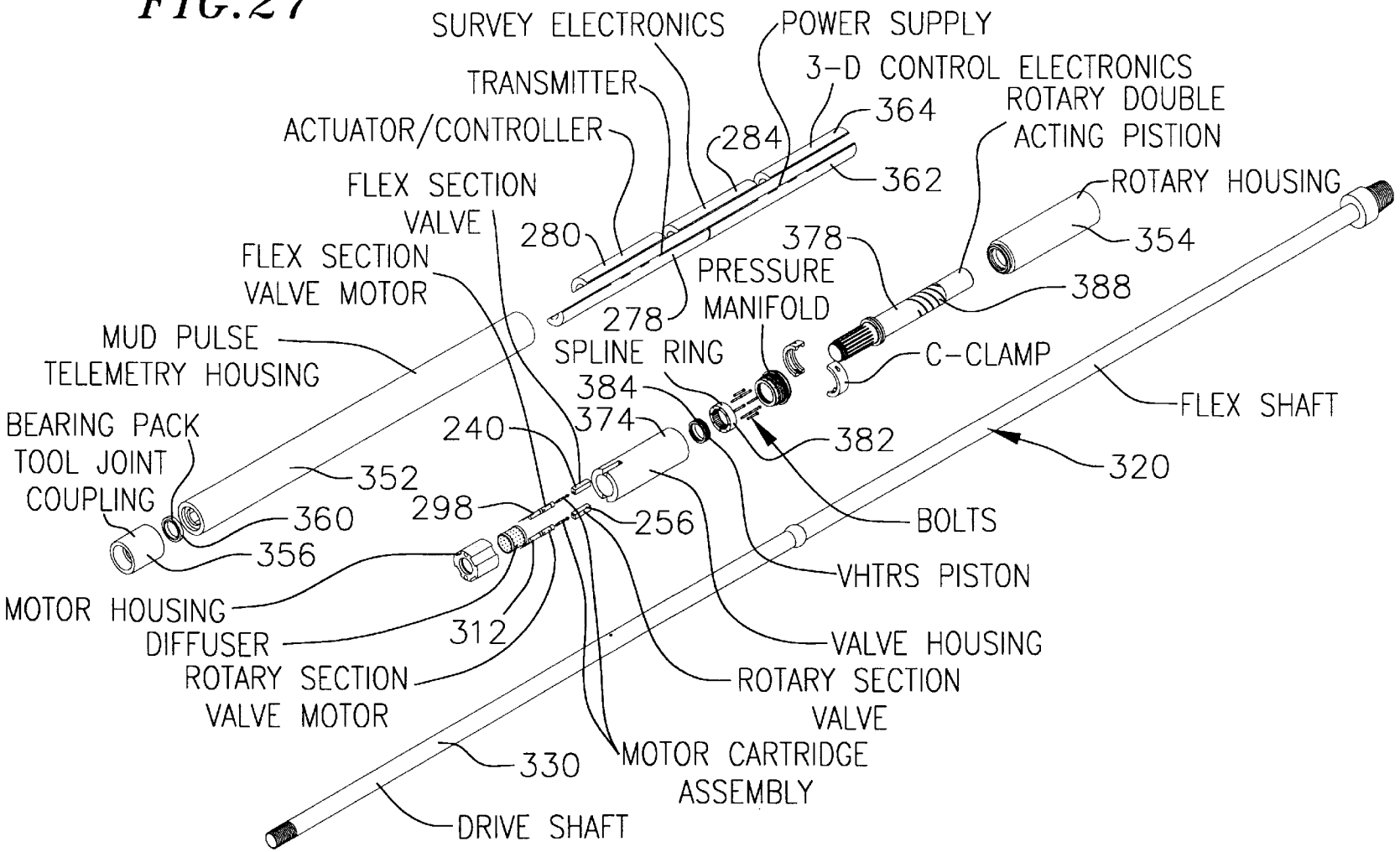
FIG. 27 is an exploded perspective view illustrating internal components of an onboard telemetry section, flex section and rotary section of the steering tool.

The perspective view of FIG. 27 shows components of the three-dimensional steering tool as described above to better illustrate the means of assembling them into an integrated unit.

The rotary section achieves changes in the azimuth by the following method. At the surface, a signal is sent to the tool via the mud pulse telemetry section. The mud pulse telemetry section receives the mud pulse, translates the pulse into electrical instructions and provides an electrical signal to the 3-D control electronics. (Pressurization and actuation of the flex piston has been described previously. Both the rotary and flex sections are pressurized and actuated simultaneously for the steering tool to produce both azimuth and inclinational changes.) The 3-D electrical controls provide an electrical signal to either or both of the electric motors for the rotary and the flex section valves. When the rotary valve is actuated, fluid from the bore passes through the filter and into the valve that delivers drilling fluid to the double-acting piston. The double-acting piston is moved forward for driving the helical gears connected via a coupling to the deflection housing, which rotates relative to the flex shaft. The position of the double-acting piston allows positioning from zero to 360 degrees in clockwise or counter-clockwise rotation, thus changing the orientation of the deflection housing relative to the skin (which is resting on the hole wall thus providing a reaction point). Drilling fluid under pressure is delivered to the flex section and azimuthal change begins as follows. (Drilling fluid under pressure can be applied via the method described to the reverse side of the double-acting piston to re-position the housing in a counter-clockwise orientation.)

After the tool has drilled ahead enough to allow the drill string to follow the achieved azimuth, the valve changes position, the double-acting piston receives drilling fluid, the flex piston is returned to neutral, and straight drilling resumes.

The present invention can be applied to address a wide range of drilling conditions. The steering tool can be made to operate in all typical hole sizes from 2⅞ inch slim holes up to 30-inch holes, but is particularly designed to operate in the 3¾-inch up to 8¾-inch holes. The tool length is variable, but typically is approximately 20 feet in length. The tool joint coupling and threaded end of the flex shaft can have any popular oil field equipment thread such as various American Petroleum Institute (API) threads. Threaded joints can be made up with conventional drill tongs or similar equipment. The tool can withstand a range of weight-on-bit up to 60,000 pounds, depending upon tool size. The inside diameter of the drive shaft/flex shaft can be range from 0.75 to 3.0 inches to accommodate drilling fluid flow rates from 75–650 gallons per minute. The steering tool can operate at various drilling depths from zero to 32,000 feet. The steering tool can operate over a typical operational range of differential pressure (the difference of pressure from the ID of the steering tool to outside diameter of the tool) of about 600 to 3,500 PSID, but typically up to about 2,000 PSID. The size of the drive shaft/flex shaft can be adjusted to accommodate a range of drilling torque from 300 to 8,000 ft-lbs. depending upon tool size. The steering tool has sufficient strength to survive impact loads to 400,000 lbs. and continuous absolute overpull loads to 250,000 lbs. The tool's drive shaft can operate over the typical range of rotational speeds up to 300 rpm.

In addition, the rotary section and flex section require little drilling fluid. Because the rotary section drilling fluid system is of low volume, the operation of the rotary section requires from less than 4 GPM to operate. The flex section is also a low volume system and can operate on up to 2 GPM. Thus, the steering tool can perform its function with up to 6 GPM, which is from 1 to 5% of the total drilling fluid flowing through the tool.

For the rotary section, the velocity of the rotary double-acting piston can range from 0.002 inches per minute to up to 8 inches per minute depending upon the size of the piston, flow channel size, and helical gear speed.

The steering tool control section includes a helical screw position sensor or potentiometer (not shown), as well as the previously described mud pulse telemetry actuator/controller electronics, survey electronics, 3-D control electronics, power supply, and transmitter.

One type of flex position transducer can be a MIDIM (mirror image differential induction-amplitude magetometer). With this design, a small magnetic source is placed on the flex piston or the rotary double acting piston and the MIDIM (manufactured by Dinsmore Instrument Company, 1814 Remell St. Flint, Mich. 48503) within the body of the deflection housing or the rotary housing, respectively. As the magnetic source moves as a result of the pressure on the piston, a calibrated analog output provides continuous reading of displacement. Other acceptable transducers that use the method described above include a Hall effect transducer and a fluxgate magnetometer, such as the ASIC magnetic sensor available from Precision Navigation Inc., Santa Rosa, Calif.

The mud pulse telemetry section provides the control information to the surface. These systems are commercially available from such companies as McAllister-Weatherford Ltd. of Canada and Geolink, LTD, Aberdeen, Scotland, UK as do several others. Typically these systems are housed in 24 to 60-inch long, 2⅞ to 6¾-inch outside diameter, 1 to 2 inch inside diameter packages.

Included in the telemetry section is a mud pulse transmitter assembly that generates a series of mud pulses to the surface. The pulses are created by controlling the opening and closing of an internal valve for allowing a small amount of drilling fluid volume to divert from the inside the drill string to the annulus of the borehole. The bypassing process creates a small pressure loss drop in the standpipe pressure (called negative mud pulse pressure telemetry). The transmitter also contains a pressure switch that can detect whether the mud pumps are switched on or off, thus allowing control of the tool.

The actuator/controller regulate the time between transmitter valve openings and the length of the pulse according to instructions from the survey electronics. This process encodes downhole data to be transmitted to the surface. The sequence of the data can be specified from the surface by cycling the mud pumps in pre-determined patterns.

The power supply contains high capacity lithium thionyl chloride batteries or similar long life temperature resistance batteries (or alternatively a downhole turbine and electrical generator powered by mud).

The survey electronics contain industry standard tri-axial magnetometers and accelerometers for measuring inclination (zero to 180 degrees), and azimuth (zero to 360 degrees) and tool face angle (zero to 360 degrees). Tool face angle is the orientation of the tool relative to the cross-section of the hole at the tool face. Included are typically microprocessors linked to the transmitter switch that control tool functions such as on-off and survey data. Other types of sensors may also be placed in the assembly as optional equipment. These other sensors include resistivity sensors for geological formation information or petroleum sensors.

The data are transmitted to the surface computer system (not shown). At the surface, a transmitter and receiver transmits and receives mud pulses, converts mud pulses to electrical signals, discriminates signal from noise of transmissions, and with software graphically and numerically presents information.

The surface system can comprise a multiplexed device that processes the data from the downhole tool and also directs the information to and from the various peripheral hardware, such as the computer, graphics screen, and printer. Also included can be signal conditioning and intrinsic safety barrier protections for the standpipe pressure transducer and rig floor display. The necessary software and other hardware are commercially available equipment.

Instructions from the mud pulse telemetry section are delivered to the 3-D control electronics, (the electrical control and feedback circuits described in the block diagrams). The 3-D control electronics receive and transmit instructions to and from the actuator/controller to provide communication and feedback to the surface. The 3-D steering electronics also communicate to the rotary position sensor and the flex position sensor. A feedback circuit (as described in the block diagram of FIG. 14) provides position information to the 3-D steering tool electronics.

Thus, changes in direction are sent from the surface to the steering tool through the surface system, to the actuator/controller, to the 3-D steering electronics, and to the electric motors of the rotary and flex section valves that move either the flex piston or rotary double-acting piston. The new position of the piston is measured by the sensor, compared to the desired position, and corrected if necessary. Drilling continues with periodic positional measurements made by the survey electronics, sent to the actuator/controller to the transmitter, and then to the surface, where the operator can continue to steer the tool.

The electrical systems are designed to allow operation within downhole pressures (up to 16,000 PSI). This is typically accomplished with atmospheric isolation of electrical components, specially designed electrical connectors that operate in the drilling environments, and thermally hardened electronics and boards.

The steering tool can include an optional flex toe gripper whose purpose is to ensure a fixed location of the tool to an azimuth orientation. When the flex toe is activated it grips the wall of the borehole for making changes in inclination and/or azimuth. The flex toe design includes flex elements that are pinned at one end and slide on the opposite end. Underneath the flex elements are inflatable bladders that are filled with drilling fluid when pressurized and collapse when depressurized. Drilling fluid is delivered to the bladder via a motorized valve, typically the rotary valve described previously. The valve is controlled in a manner similar to the motorized valves for the flex section or rotary section via mud pulse telemetry or similar means.

The flex toe is optional depending upon the natural tendency for the 3-D steering tool's skin not to rotate; it can be provided as an option to resist minor twisting of the drill string and maintain a constant reference for the tool motion.

In a similar manner to the flex toe, a packerfoot (shown schematically in FIG. 13) can be utilized in the steering tool as a mechanism to provide a reaction point for the rotary section when simultaneously changing inclination and azimuth while drilling. The packerfoot developed by Western Well Tool is described in U.S. Pat. No. 6,003,606, the entire disclosure of which is incorporated herein by reference. The packerfoot can be either rigidly mounted or can be allowed to move on a mandrel. When connected to a mandrel the packerfoot provides resistance to rotation but without dragging the packerfoot over the hole wall.

Specific types of materials are required for parts of the steering tool. Specifically, the shaft and flex piston must be made of long fatigue life material with a modulus lower than the skin and housing. Suitable materials for the shaft and flex piston are copper-beryllium alloys (Young's modulus of 19 million PSI) The tool's skin and housing can be various steel (Young's modulus of 29 Million psi) or similar material.

Specialized sealing materials may be required in some applications. Numerous types of drilling fluids are used in drilling. Some of these, especially oil-based mud or Formate muds are particularly damaging to some types of rubbers such as NBR, nitrile, and natural rubbers. For these applications, use of specialized rubbers such as tetrafluoroethylene/propylene elastomers provides greater life and reliability.

The tool operates by means of changes in inclination or by changes of azimuth in separate movements, but not necessarily both simultaneously. Typical operation includes drilling ahead, telemetry to the 3-D steering tool, and changes in the orientation of the drill bit, followed by change in the inclination of the bore hole. The amount of straight hole drilled before changes in inclination can be as short as the length of the 3-D steering tool.

For azimuthal changes, drilling ahead continues (with no inclination), telemetry from the surface to the tool with instruction for changes in azimuth, internal tool actions, followed by change in the azimuth of the bore hole.

Other instruments can be incorporated into the steering tool, such as weight-on-bit, torque-on-tool, bore pressure, or resistivity or other instrumentation.

DRILLING TRACTOR—DETAILED DESCRIPTION

The description to follow is a detailed description of a presently preferred embodiment of a drilling tractor, the principles of which are useful in the long reach drilling assembly of this invention. Although the description to follow may focus on coil tubing drilling applications, the drilling tractor can also be used in rotary drilling applications as described herein. In addition, the description to follow, with respect to the drilling tractor, describes a mud pulse telemetry means of communicating tractor control signals; however, the electrical power and control signals to the drilling tractor also can be sent down the integrated electrical line embodiments described herein.

The tractor component of the extended reach drilling system is able to move a wide variety of types of equipment within a borehole, and in a preferred embodiment, use of the tractor solves many of the problems presented by prior art methods of drilling inclined and horizontal boreholes. For example, conventional rotary drilling methods and coiled tubing drilling methods are often ineffective or incapable of producing a horizontally drilled borehole or a borehole with a horizontal component because sufficient weight cannot be maintained on the drill bit. Weight on the drill bit is required to force the drill bit into the formation and keep the drill bit moving in the desired direction. For example, in rotary drilling of long inclined holes, the maximum force that can be generated by prior art systems is often limited by the ability to deliver weight to the drill bit. Rotary drilling of long inclined holes is limited by the resisting friction forces of the drill string against the borehole wall. For these reasons, among others, current horizontal rotary drilling technology limits the length of the horizontal components of boreholes to approximately 4,500 to 5,500 feet because weight cannot be maintained on the drill bit at greater distances.

Coiled tubing drilling also presents difficulties when drilling or moving equipment within extended horizontal or inclined holes. For example, as described above, there is the problem of maintaining sufficient weight on the drill bit. Additionally, the coiled tubing often buckles or fails because frequently too much force is applied to the tubing. For instance, a rotational force on the coiled tubing may cause the tubing to shear, while a compression force may cause the tubing to collapse. These constraints limit the depth and length of holes that can be drilled with existing coiled tubing drilling technology. Current practices limit the drilling of horizontally extending boreholes to approximately 1,000 feet horizontally.

The drilling tractor component of the present invention (also referred to as a puller-thruster downhole tool) solves these problems by generally maintaining the drill string in tension and providing a generally constant force on the drill bit. The problem of tubing buckling experienced in conventional drilling methods is no longer a problem with the present invention because the tubing is pulled down the borehole rather than being forced into the borehole. Additionally, the current invention allows horizontal and inclined holes to be drilled for greater distances than by methods known in the art. The 500 to 1,500 foot limit for horizontal coiled tubing drilled boreholes is no longer a problem because the tractor can force the drill bit into the formation with the desired amount of force, even in horizontal or inclined boreholes. In addition, the preferred apparatus allows faster, more consistent drilling of diverse formations because force can be constantly applied to the drill bit.

One embodiment of the present invention provides a method for propelling a conduit and drilling tool within a passage in which the movement of the assembly is controlled from the surface. The surface controls can preferably be manually or automatically operated. The tool may be in communication with the surface by a line which allows information to be communicated from the surface to the tool. This line, for example, may be an electrical line (generally known as an "E-line"), an umbilical line, or the like. In addition, the tool may have an electrical connection on the forward and aft ends of the tool to allow electrical connection between devices located on either end of the tool. This electrical connection, for example, may allow connection of an E-line to a measurement-while-drilling system located between the tool and the drill bit. Alternatively, the tool and the surface may be in communication by down-linking in which a pressure pulse from the surface is transmitted through the drilling fluid within the fluid channel to a transceiver. The transceiver converts the pressure pulse to electrical signals which are used to control the tool. This aspect of the invention allows the tool to be linked to the surface, and allows measurement-while-drilling systems, for example, to be controlled from the surface.

In another preferred aspect, the apparatus may be equipped with directional control to allow the tool to move in forward and backward directions within the passage. This allows equipment to be placed in desired locations within the borehole, and eliminates the removal problems associated with known apparatuses. It will be appreciated that the tool in each of the preferred aspects may also be placed in an idle or stationary position with the passage. Further, it will be appreciated that the speed of the tool within the passage may be controlled. Preferably, the speed is controlled by the power delivered to the tool.

The tractor is compatible with various drill bits, motors, MWD systems, downhole assemblies, pulling tools, lines and the like. The tool is also preferably configured with connectors which allow the tool to be easily attached or disconnected to the drill string and other related equipment. Significantly, the tool allows selectively continuous force to be applied to the drill bit, which increases the life and promotes better wear of the drill bit because there are no shocks or abrupt forces on the drill bit. This continuous force on the drill bit also allows for faster, more consistent drilling. It will be understood that the present invention can also be used with multiple types of drill bits and motors, allowing it to drill through different kinds of materials.

It will also be appreciated that two or more tractors, in each of the preferred embodiments, may be connected in series. This may be used, for example, to move a greater distance within a passage, move heavier equipment within a passage, or provide a greater force on a drill bit. Additionally, this could allow a plurality of pieces of equipment to be moved simultaneously within a passage. Advantageously, the present invention can be used to pull the drill string down the borehole. This eliminates many of the compression and rotational forces on the drill string, which cause known systems to fail.

In one preferred aspect the tractor is self-contained and can fit entirely within the borehole. Further, the gripping structures of the present invention do not damage the borehole walls as do the anchoring structures known in the art.

As shown in FIG. 28A, an apparatus and method for moving equipment within a passage is configured in accordance with a preferred embodiment of the present invention. In the embodiments shown in the accompanying drawings, the apparatus and methods of the present invention are used in conjunction with a coiled tubing drilling system 400. It will be appreciated that the present invention may be used to move a wide variety of tools and equipment withing a borehole, and the present invention can be used in conjunction with numerous types of drilling, including rotary drilling and the like. Additionally, the tractor may be used in many areas including petroleum drilling, mineral deposit drilling, pipeline installation and maintenance, communications, and the like.

Figure 28:
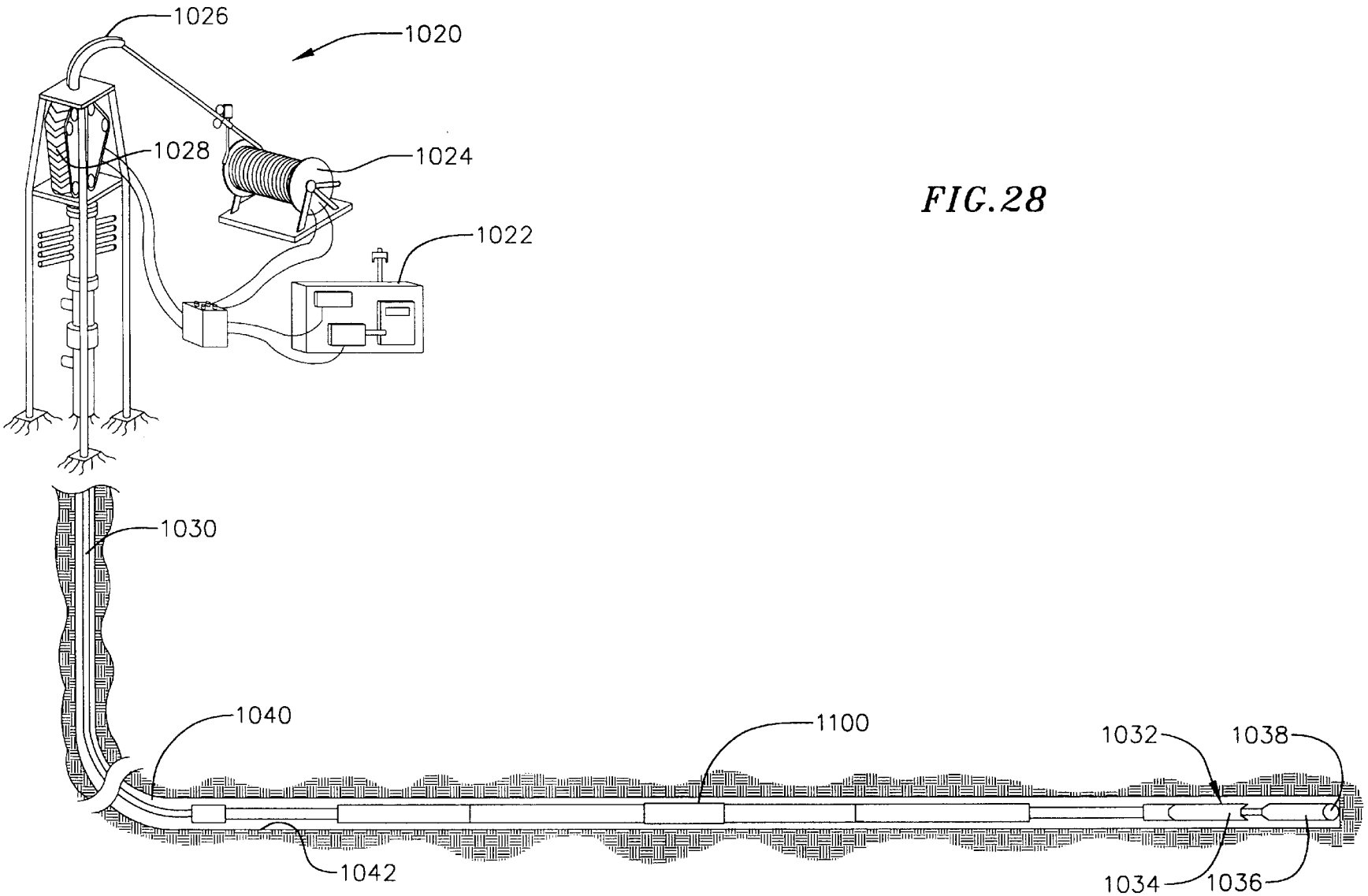
FIG. 28 is a schematic diagram of the major components of a drilling tractor component of the invention in which the tractor is used in a coiled tubing drilling system.

FIG. 28 shows an electrically sequenced tractor (EST) 1100 for moving equipment within a passage, configured in accordance with a preferred embodiment of the present invention. In the embodiments shown in the accompanying figures, the electrically sequenced tractor (EST) of the present invention may be used in conjunction with a coiled tubing drilling system 1020 and a bottom hole assembly 1032. System 1020 may include a power supply 1022, tubing reel 1024, tubing guide 1026, tubing injector 1028, and coiled tubing 1030, all of which are well known in the art. Assembly 1032 may include a measurement while drilling (MWD) system 1034, downhole motor 1036, and drill bit 1038, all of which are also known in the art. The EST is configured to move within a borehole having an inner surface 1042. An annulus 1040 is defined by the space between the EST and the inner surface 1042.

Figure 29:
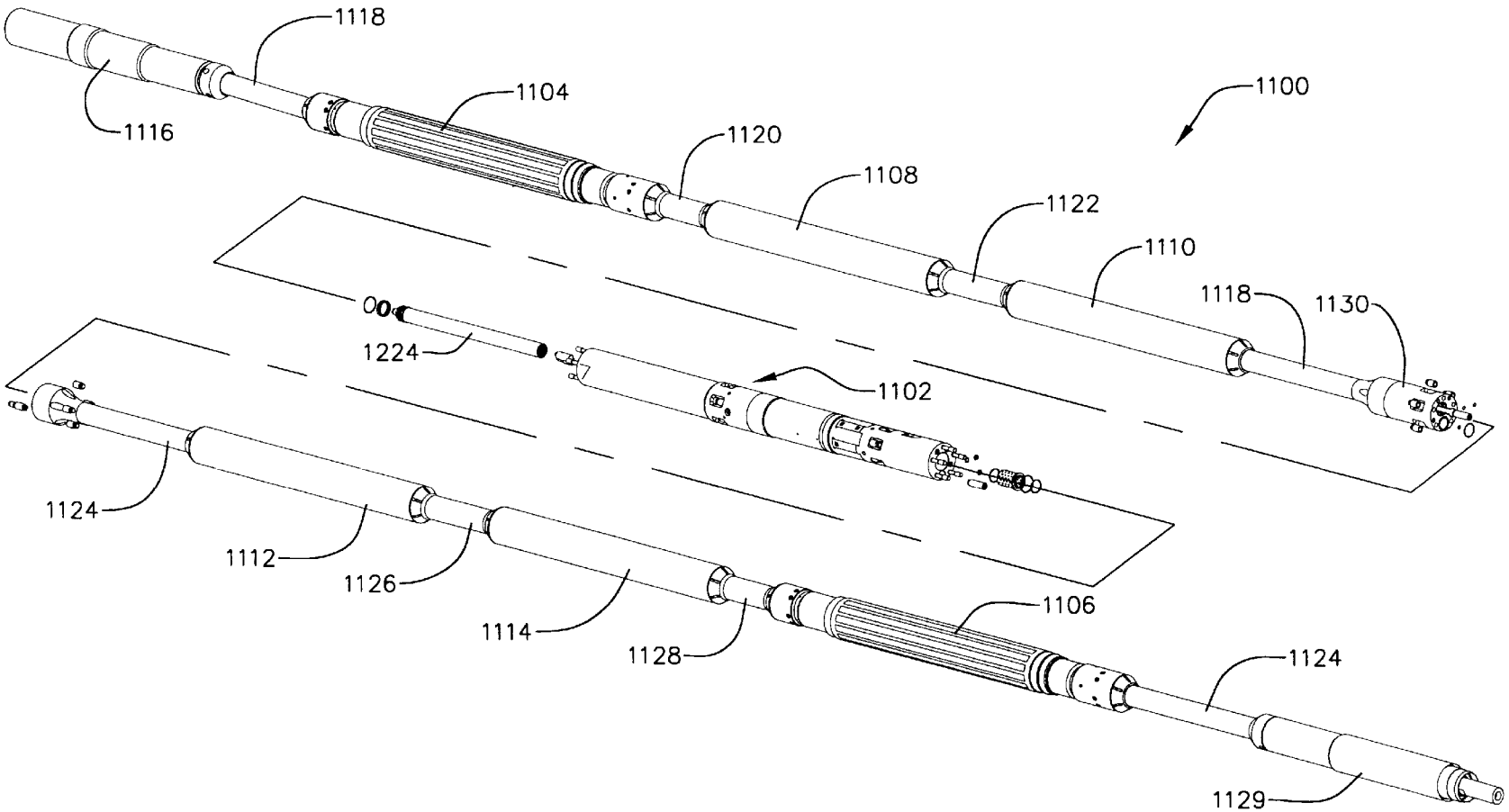
FIG. 29 is a front perspective view of an electrically sequenced tractor (EST) embodiment.

FIG. 29 shows a preferred embodiment of an electrically sequenced tractor (EST) of the present invention. The EST 1100 comprises a central control assembly 1102, an uphole or aft packerfoot 1104, a downhole or forward packerfoot 1106, aft propulsion cylinders 1108 and 1110, forward propulsion cylinders 1112 and 1114, a drill string connector 1116, shafts 1118 and 1124, flexible connectors 1120, 1122, 1126, and 1128, and a bottom hole assembly connector 1130. Drill string connector 1116 connects a drill string, such as coiled tubing, to shaft 1118. Aft packerfoot 1104, aft propulsion cylinders 1108 and 1110, and connectors 1120 and 1122 are assembled together end to end and are all axially slidably engaged with shaft 1118. Similarly, forward packerfoot 1106, forward propulsion cylinders 1112 and 1114, and connectors 1126 and 1128 are assembled together end to end and are slidably engaged with shaft 1124. Connector 1130 provides a connection between EST 1100 and downhole equipment such as a bottom hole assembly. Shafts 1118 and 1124 and control assembly 1102 are axially fixed with respect to one another and are sometimes referred to herein as the body of the EST. The body of the EST is thus axially fixed with respect to the drill string and the bottom hole assembly.

FIGS. 31A–F schematically illustrate a preferred configuration and operation of the EST. Aft propulsion cylinders 1108 and 1110 are axially slidably engaged with shaft 1118 and form annular chambers surrounding the shaft. Annular pistons 1140 and 1142 reside within the annular chambers formed by cylinders 1108 and 1110, respectively, and are axially fixed to shaft 1118. Piston 1140 fluidly divides the annular chamber formed by cylinder 1108 into a rear chamber 1166 and a front chamber 1168. Such rear and front chambers are fluidly sealed to substantially prevent fluid flow between the chambers or leakage to annulus 1140. Similarly, piston 1142 fluidly divides the annular chamber formed by cylinder 1110 into a rear chamber 1170 and a front chamber 1172.

The forward propulsion cylinders 1112 and 1114 are configured similarly to the aft propulsion cylinders. Cylinders 1112 and 1114 are axially slidably engaged with shaft 1124. Annular pistons 1144 and 1146 are axially fixed to shaft 1124 and are enclosed within cylinders 1112 and 1114, respectively. Piston 1144 fluidly divides the chamber formed by cylinder 1112 into a rear chamber 1174 and a front chamber 1176. Piston 1146 fluidly divides the chamber formed by cylinder 1114 into a rear chamber 1178 and a front chamber 1180. Chambers 1166, 1168, 1170, 1172, 1174, 1176, 1178, and 1180 have varying volumes, depending upon the positions of pistons 1140, 1142, 1144, and 1146 therein.

Although two aft propulsion cylinders and two forward propulsion cylinders (along with two corresponding aft pistons and forward pistons) are shown in the illustrated embodiment, any number of aft cylinders and forward cylinders may be provided, which includes only a single aft cylinder and a single forward cylinder. As described below, the hydraulic thrust provided by the EST increases as the number of propulsion cylinders increases. In other words, the hydraulic force provided by the cylinders is additive. Four propulsion cylinders are used to provide the desired thrust of approximately 10,500 pounds for a tractor with a maximum outside diameter of 3.375 inches. It is believed that a configuration having four propulsion cylinders is preferable, because it permits relatively high thrust to be generated, while limiting the length of the tractor. Alternatively, fewer cylinders can be used, which will decrease the resulting maximum tractor pull-thrust. Alternatively, more cylinders can be used, which will increase the maximum output force from the tractor. The number of cylinders is selected to provide sufficient force to provide sufficient force for the anticipated loads for a given hole size.

The EST is hydraulically powered by a fluid such as drilling mud or hydraulic fluid. Unless otherwise indicated, the terms "fluid" and "drilling fluid" are used interchangeably hereinafter. In a preferred embodiment, the EST is powered by the same fluid which lubricates and cools the drill bit. Preferably, drilling mud is used in an open system. This avoids the need to provide additional fluid channels in the tool for the fluid powering the EST. Alternatively, hydraulic fluid may be used in a closed system, if desired. Referring to FIG. 1, in operation, drilling fluid flows from the drill string 30 through EST 100 and down to drill bit 38. Referring again to FIGS. 31A–F, diffuser 1148 in control assembly 1102 diverts a portion of the drilling fluid to power the EST. Preferably, diffuser 1148 filters out larger fluid particles which can damage internal components of the control assembly, such as the valves.

Fluid exiting diffuser 1148 enters a spring-biased failsafe valve 1150. Failsafe valve 1150 serves as an entrance point to a central galley 1155 (illustrated as a flow path in FIGS. 31A–F) in the control assembly which communicates with a relief valve 1152, packerfoot valve 1154, and propulsion valves 1156 and 1158. When the differential pressure (unless otherwise indicated, hereinafter "differential pressure" or "pressure" at a particular location refers to the difference in pressure at that location from the pressure in annulus 40) of the drilling fluid approaching failsafe valve 1150 is below a threshold value, failsafe valve 1150 remains in an off position, in which fluid within the central galley vents out to exhaust line E, i.e., to annulus 40. When the differential pressure rises above the threshold value, the spring force is overcome and failsafe valve 1150 opens to permit drilling fluid to enter central galley 1155. Failsafe valve 1150 prevents premature starting of the EST and provides a fail-safe means to shut down the EST by pressure reduction of the drilling fluid in the coiled tubing drill string. Thus, valve 1150 operates as a system on/off valve. The threshold value for opening failsafe valve 1150, i.e., for turning the system on, is controlled by the stiffness of spring 1151 and can be any value within the expected operational drilling pressure range of the tool. A preferred threshold pressure is about 500 psig.

Drilling fluid within central galley 1155 is exposed to all of the valves of EST 1000. A spring-biased relief valve 1152 protects over-pressurization of the fluid within the tool. Relief valve 1152 operates similarly to failsafe valve 1150. When the fluid pressure in central galley 1155 is below a threshold value, the valve remains closed. When the fluid pressure exceeds the threshold, the spring force of spring 1153 is overcome and relief valve 1152 opens to permit fluid in galley 1155 to vent out to annulus 40. Relief valve 1152 protects pressure-sensitive components of the EST, such as the bladders of packerfeet 1104 and 1106, which can rupture at high pressure. In the illustrated embodiment, relief valve 1152 has a threshold pressure of about 1600 psig.

Packerfoot valve 1154 controls the inflation and deflation of packerfeet 1104 and 1106. Packerfoot valve 1154 has three positions. In a first extreme position (shown in FIG. 31A), fluid from central galley 1155 is permitted to flow through passage 1210 into aft packerfoot 1104, and fluid from forward packerfoot 1106 is exhausted through passage 1260 to annulus 40. When valve 1154 is in this position aft packerfoot 1104 tends to inflate and forward packerfoot 1106 tends to deflate. In a second extreme position (FIG. 31D), fluid from the central galley is permitted to flow through passage 1260 into forward packerfoot 1106, and fluid from aft packerfoot 1104 is exhausted through passage 1210 to annulus 40. When valve 1154 is in this position aft packerfoot 1104 tends to deflate and forward packerfoot 1106 tends to inflate. A central third position of valve 1154 permits restricted flow from galley 1155 to both packerfeet. In this position, both packerfeet can be inflated for a double-thrust stroke, described below.

In normal operation, the aft and forward packerfeet are alternately actuated. As aft packerfoot 1104 is inflated, forward packerfoot 1106 is deflated, and vice-versa. The position of packerfoot valve 1154 is controlled by a packerfoot motor 1160. In a preferred embodiment, motor 1160 is electrically controllable and can be operated by a programmable logic component on EST 1000, such as in electronics housing 1130 (FIGS. 31–49), to sequence the inflation and deflation of the packerfeet. Although the illustrated embodiment utilizes a single packerfoot valve controlling both packerfeet, two valves could be provided such that each valve controls one of the packerfeet. An advantage of a single packerfoot valve is that it requires less space than two valves. An advantage of the two-valve configuration is that each packerfoot can be independently controlled. Also, the packerfeet can be more quickly simultaneously inflated for a double thrust stroke.

Propulsion valve 1156 controls the flow of fluid to and from the aft propulsion cylinders 1108 and 1110. In one extreme position (shown in FIG. 31B), valve 1156 permits fluid from central galley 1155 to flow through passage 1206 to rear chambers 1166 and 1170. When valve 1156 is in this position, rear chambers 1166 and 1170 are connected to the drilling fluid, which is at a higher pressure than the rear chambers. This causes pistons 1140 and 1142 to move toward the downhole ends of the cylinders due to the volume of incoming fluid. Simultaneously, front chambers 1168 and 1172 reduce in volume, and fluid is forced out of the front chambers through passage 1208 and valve 1156 out to annulus 40. If packerfoot 1104 is inflated to grip borehole wall 142, the pistons move downhole relative to wall 1142. If packerfoot 1104 is deflated, then cylinders 1108 and 1110 move uphole relative to wall 42.

In its other extreme position (FIG. 31E), valve 1156 permits fluid from central galley 1155 to flow through passage 1208 to front chambers 1168 and 1172. When valve 1156 is in this position, front chambers 1168 and 1172 are connected to the drilling fluid, which is at a higher pressure than the front chambers. This causes pistons 1140 and 1142 to move toward the uphole ends of the cylinders due to the volume of incoming fluid. Simultaneously, rear chambers 1166 and 1170 reduce in volume, and fluid is forced out of the rear chambers through passage 1206 and valve 1156 out to annulus 40. In a central position propulsion valve 1156 blocks any fluid communication between cylinders 1108 and 1110, galley 1155, and annulus 40. If packerfoot 1104 is inflated to grip borehole wall 42, the pistons move uphole relative to wall 42. If packerfoot 1104 is deflated, then cylinders 1108 and 1110 move downhole relative to wall 42.

Propulsion valve 1158 is configured similarly to valve 1156. Propulsion valve 1158 controls the flow of fluid to and from the forward propulsion cylinders 1112 and 1114. In one extreme position (FIG. 31E), valve 1158 permits fluid from central galley 1155 to flow through passage 1234 to rear chambers 1174 and 1178. When valve 1156 is in this position, rear chambers 1174 and 1178 are connected to the drilling fluid, which is at a higher pressure than the rear chambers. This causes the pistons 1144 and 1146 to move toward the downhole ends of the cylinders due to the volume of incoming fluid. Simultaneously, front chambers 1176 and 1180 reduce in volume, and fluid is forced out of the front chambers through passage 1236 and valve 1158 out to annulus 40. If packerfoot 1106 is inflated to grip borehole wall 42, the pistons move downhole relative to wall 42. If packerfoot 1106 is deflated, then cylinders 1108 and 1110 move uphole relative to wall 42.

In its other extreme position (FIG. 31B), valve 1158 permits fluid from central galley 1155 to flow through passage 1236 to front chambers 1176 and 1180 are connected to the drilling fluid, which is at a higher pressure than rear chambers 1174 and 1178. This causes the pistons 1144 and 1146 to move toward the uphole ends of the cylinders due to the volume of incoming fluid. Simultaneously, rear chambers 1174 and 1178 reduce in volume, and fluid is forced out of the rear chambers through passage 1234 and valve 1158 out to annulus 40. If packerfoot 1106 is inflated to grip borehole wall 42, the pistons move uphole relative to wall 42. If packerfoot 1106 is deflated, then cylinders 1108 and 1110 move downhole relative to wall 42. In a central position, propulsion valve 1158 blocks any fluid communication between cylinders 1112 and 1114, galley 1155, and annulus 40.

In a preferred embodiment, propulsion valves 1156 and 1158 are configured to form a controllable variable flow restriction between central galley 1155 and the chambers of the propulsion cylinders. The physical configuration of valves 1156 and 1158 is described below. To illustrate the advantages of this feature, consider valve 1156. As valve 1156 deviates slightly from its central position, it permits a limited volume flowrate from central galley 1155 into the aft propulsion cylinders. The volume flowrate can be precisely increased or decreased by varying the flow restriction, i.e., by opening further or closing further the valve. By carefully positioning the valve, the volume flowrate of fluid into the aft propulsion cylinders can be controlled. The flow-restricting positions of the valves are indicated in FIGS. 31A–F by flow lines which intersect X's. The flow-restricting positions permit precise control over (1) the longitudinal hydraulic force received by the pistons; (2) the longitudinal position of the pistons within the aft propulsion cylinders; and (3) the rate of longitudinal movement of the pistons between positions. Propulsion valve 1158 may be similarly configured, to permit the same degree of control over the forward propulsion cylinders and pistons. As will be shown below, controlling these attributes facilitates enhanced control of the thrust and speed of the EST and, hence, the drill bit.

In a preferred embodiment, the position of propulsion valve 1156 is controlled by an aft propulsion motor 1162, and the position of propulsion valve 1158 is controlled by a forward propulsion motor 1164. Preferably, these motors are electrically controllable and can be operated by a programmable logic component on EST 1000, such as in electronics unit 92 (FIG. 30), to precisely control the expansion and contraction of the rear and front chambers of the aft and forward propulsion cylinders.

Figure 31A:
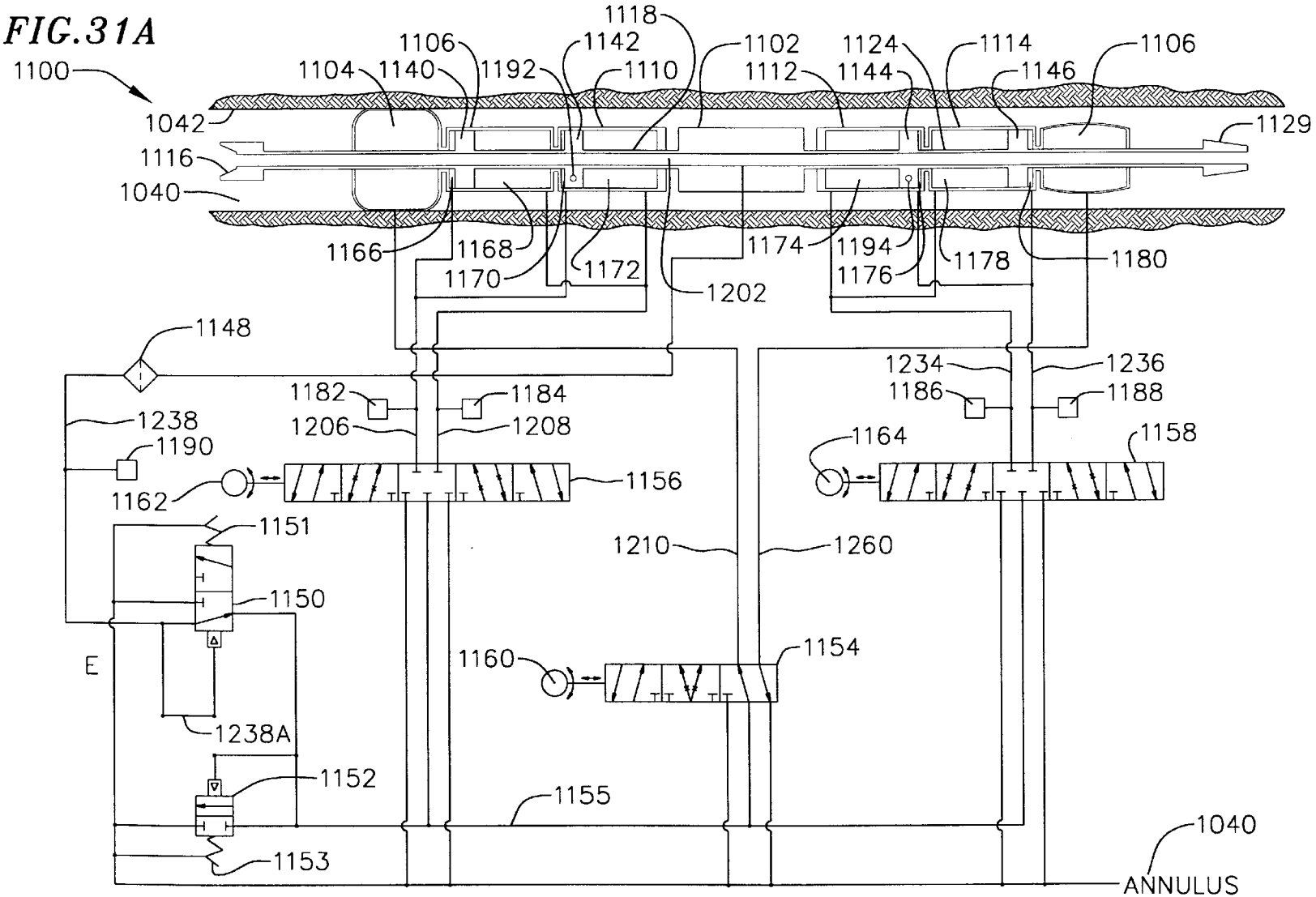
FIGS. 31A–F are schematic diagrams illustrating an operational cycle of the EST.
Figure 31B:
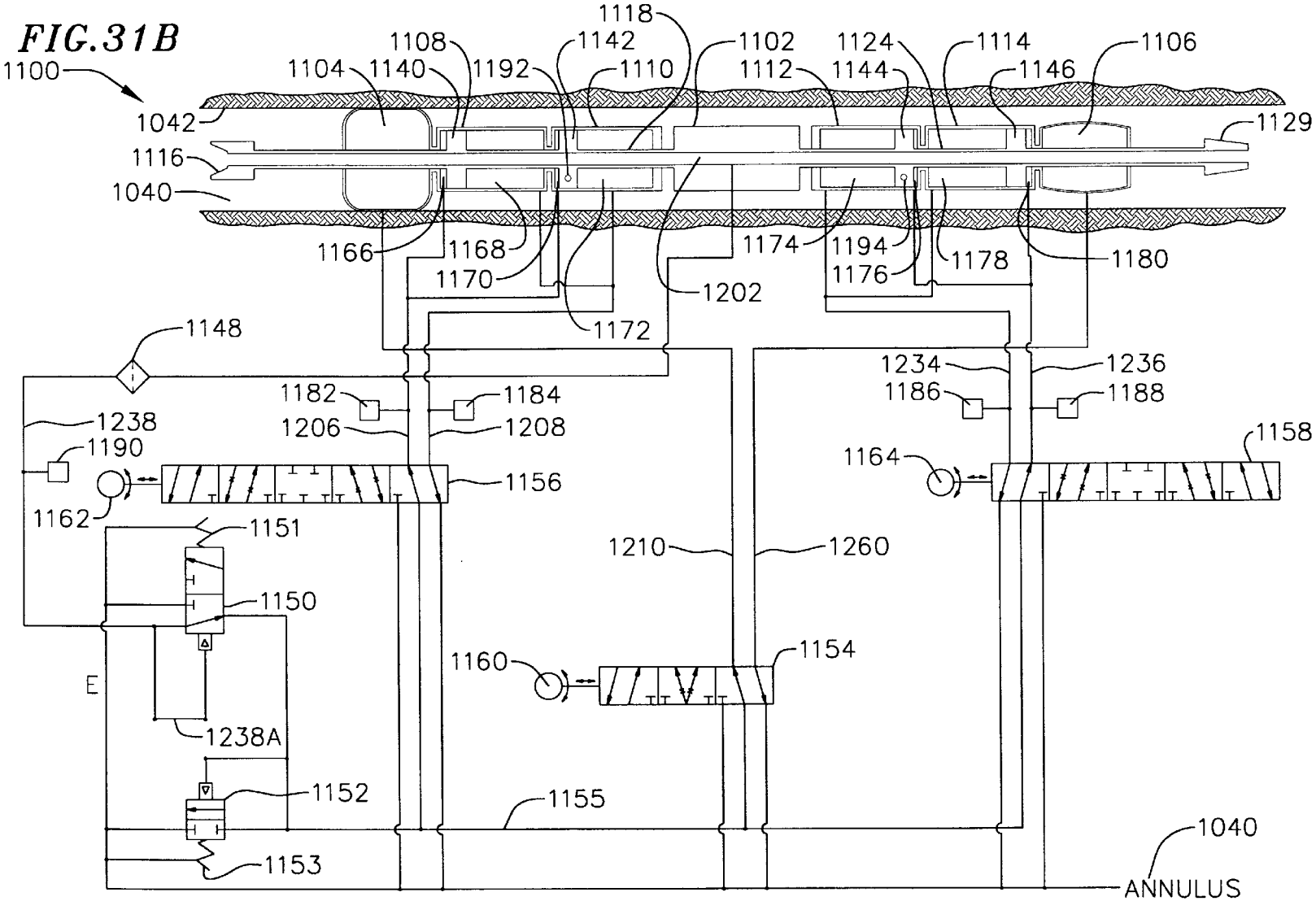
Figure 31C:
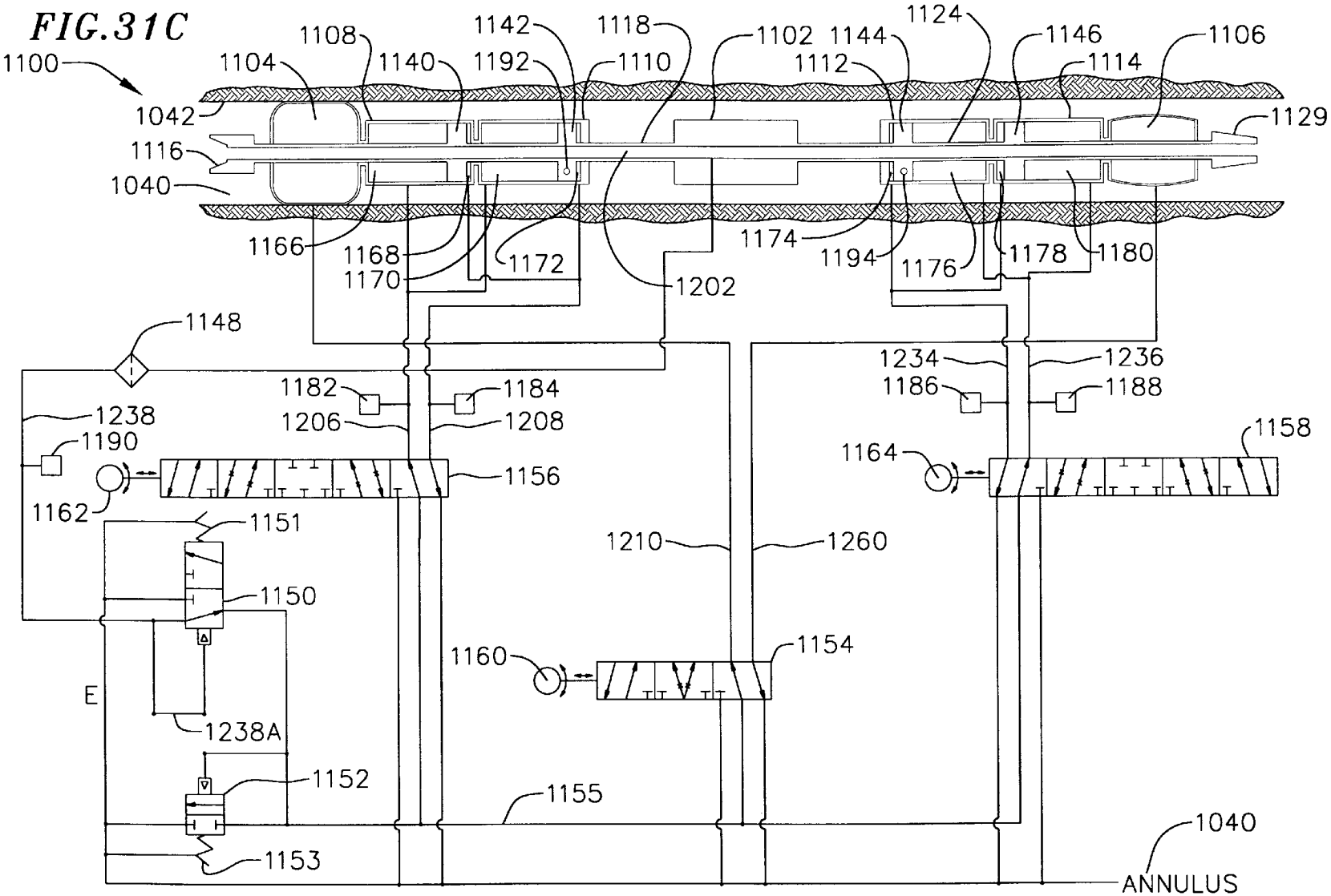

The above-described configuration of the EST permits greatly improved control over tractor thrust, speed, and direction of travel. EST 1000 can be moved downhole according to the cycle illustrated in FIGS. 31A–F. As shown in FIG. 31A, packerfoot valve 1154 is shuttled to a first extreme position, permitting fluid to flow from central galley 1155 to aft packerfoot 1104, and also permitting fluid to be exhausted from forward packerfoot 1106 to annulus 40. Aft packerfoot 1104 inflates and grips borehole wall 42, anchoring aft propulsion cylinders 1108 and 1110. Forward packerfoot 1106 deflates, so that forward propulsion cylinders 1112 and 1114 are free to move axially with respect to borehole wall 42. Next, as shown in FIG. 31B, propulsion valve 1156 is moved toward its first extreme position, permitting fluid to flow from central galley 1155 into rear chambers 1166 and 1170, and also permitting fluid to be exhausted from front chambers 1168 and 1172 to annulus 40. The incoming fluid causes rear chambers 1166 and 1170 to expand due to hydraulic force. Since cylinders 1108 and 1110 are fixed with respect to borehole wall 42, pistons 1140 and 1142 are forced downhole to the forward ends of the pistons, as shown in FIG. 31C. Since the pistons are fixed to shaft 1118 of the EST body, the forward movement of the pistons propels the EST body downhole. This is known as a power stroke.

Simultaneously or independently to the power stroke of the aft pistons 1140 and 1142, propulsion valve 1158 is moved to its second extreme position, shown in FIG. 31B. This permits fluid to flow from central galley 1155 into front chambers 1176 and 1180, and from rear chambers 1174 and 1178 to annulus 40. The incoming fluid causes front chambers 1176 and 1180 to expand due to hydraulic force. Accordingly, forward propulsion cylinders 1112 and 1114 move downhole with respect to the pistons 1144 and 1146, as shown in FIG. 31C. This is known as a reset stroke.

Figure 31D:
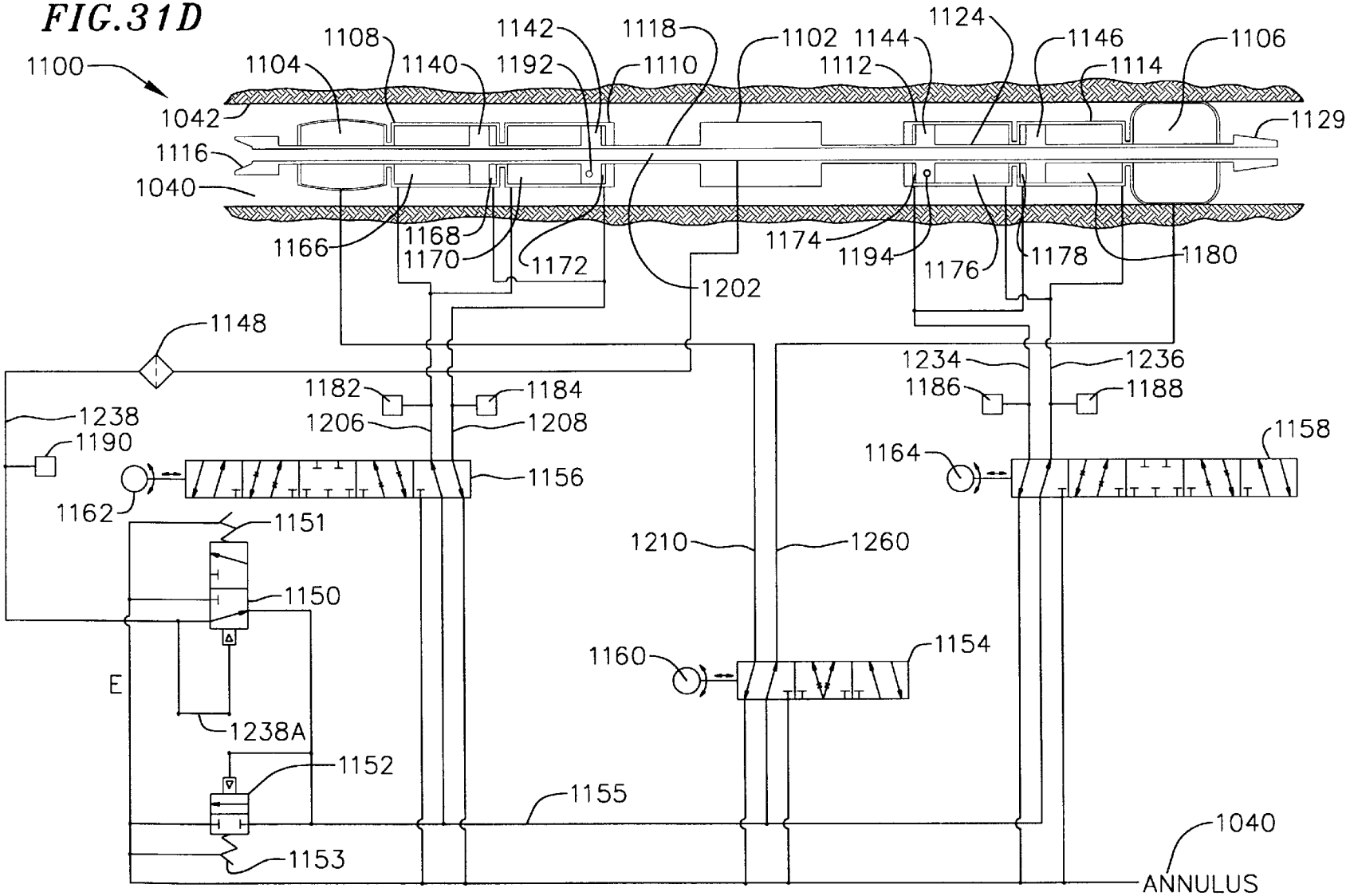
Figure 31E:
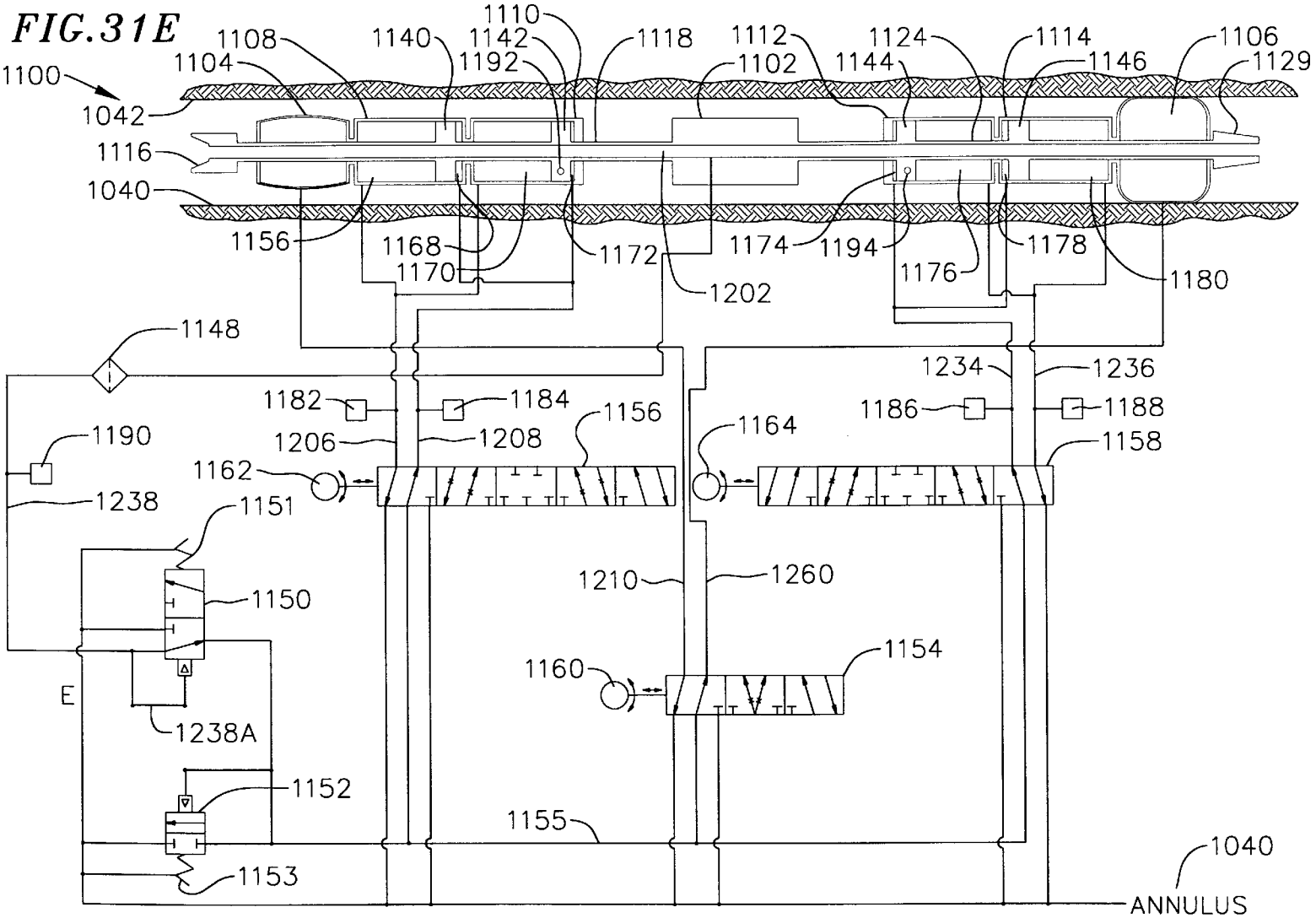
Figure 31F:
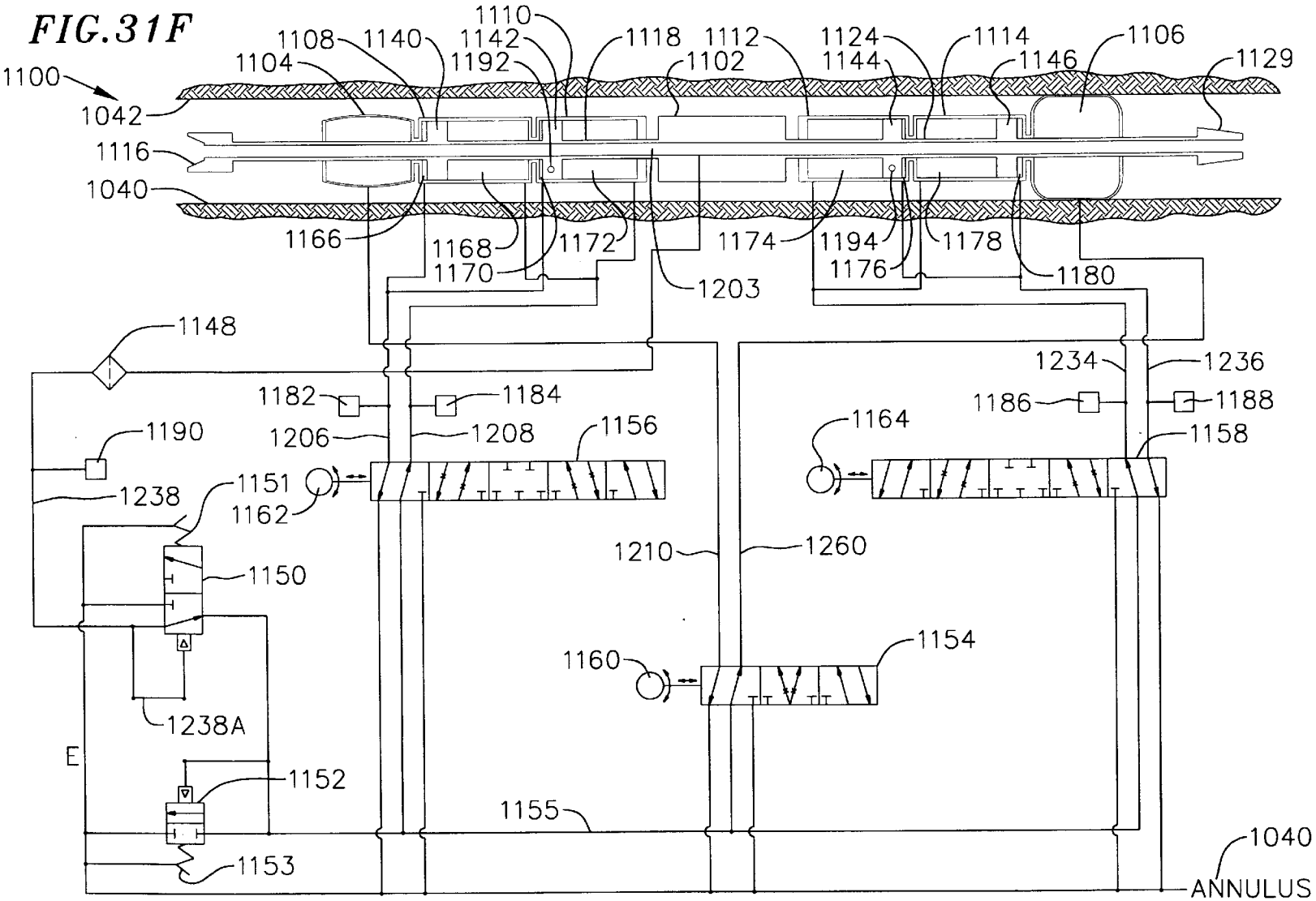

After the aft propulsion cylinders complete a power stroke and the forward propulsion cylinders complete a reset stroke, packerfoot valve 1154 is shuttled to its second extreme position; shown in FIG. 31D. This causes forward packerfoot 1106 to inflate and grip borehole wall 42, and also causes aft packerfoot 1104 to deflate. Then, propulsion valves 1156 and 1158 are reversed, as shown in FIG. 31E. This causes cylinders 1112 and 1114 to execute a power stroke and also causes the cylinders 1108 and 1110 to execute a reset stroke, shown in FIG. 31F. Packerfoot valve 1154 is then shuttled back to its first extreme position, and the cycle repeats.

Those skilled in the art will understand that EST 1000 can move in reverse, i.e., uphole, simply by reversing the sequencing of packerfoot valve 1154 or propulsion valves 1156 and 1158. When packerfoot 1104 is inflated to grip borehole wall 42, propulsion valve 1156 is positioned to deliver fluid to front chambers 1168 and 1172. The incoming fluid imparts an uphole hydraulic force on pistons 1140 and 1142, causing cylinders 1108 and 1110 to execute an uphole power stroke. Simultaneously, propulsion valve 1158 is positioned to deliver fluid to rear chambers 1174 and 1178, so that cylinders 1112 and 1114 execute a reset stroke. Then, packerfoot valve 1154 is moved to inflate packerfoot 1106 and deflate packerfoot 1104. Then the propulsion valves are reversed so that cylinders 1112 and 1114 execute an uphole power stroke while cylinders 1108 and 1110 execute a reset stroke. Then, the cycle is repeated.

Advantageously, the EST can reverse direction prior to reaching the end of any particular power or reset stroke. The tool can be reversed simply by reversing the positions of the propulsion valves so that hydraulic power is provided on the opposite sides of the annular pistons in the propulsion cylinders. This feature prevents damage to the drill bit which can be caused when an obstruction is encountered in the formation.

The provision of separate valves controlling (1) the inflation of the packerfeet, (2) the delivery of hydraulic power to the aft propulsion cylinders, and (3) the delivery of hydraulic power to the forward propulsion cylinders permits a dual power stroke operation and, effectively, a doubling of axial thrust to the EST body. For example, packerfoot valve 1154 can be moved to its central position to inflate both packerfeet 1104 and 1106. Propulsion valves 1156 and 1158 can then be positioned to deliver fluid to the rear chambers of their respective propulsion cylinders. This would result in a doubling of downhole thrust to the EST body. Similarly, the propulsion valves can also be positioned to deliver fluid to the front chambers of the propulsion cylinders, resulting in double uphole thrust. Double thrust may be useful when penetrating harder formations.

As mentioned above, packerfoot valve motor 1160 and propulsion valve motors 1162 and 1164 may be controlled by an electronic control system. In one embodiment, the control system of the EST includes a surface computer, electric cables (fiber optic or wire), and a programmable logic component 1224 (FIG. 96) located in electronics housing 1130. Logic component 1224 may comprise electronic circuitry, a microprocessor, EPROM and/or tool control software. The tool control software is preferably provided on a programmable integrated chip (PIC) on an electronic control board. The control system operates as follows: An operator places commands at the surface, such as desired EST speed, direction, thrust, etc. Surface software converts the operator's commands to electrical signals that are conveyed downhole through the electric cables to logic component 1224. The electric cables are preferably located within the composite coiled tubing and connected to electric wires within the EST that run to logic component 1224. The PIC converts the operator's electrical commands into signals which control the motors.

As part of its control algorithm, logic component 1224 can also process various feedback signals containing information regarding tool conditions. For example, logic component 1224 can be configured to process pressure and position signals from pressure transducers and position sensors throughout the EST, a weight on bit (WOB) signal from a sensor measuring the load on the drill bit, and/or a pressure signal from a sensor measuring the pressure difference across the drill bit. In a preferred embodiment, logic component 1224 is programmed to intelligently operate valve motors 1160, 1162, and 1164 to control the valve positions, based at least in part upon one or both of two different properties—pressure and displacement. From pressure information the control system can determine and control the thrust acting upon the EST body. From displacement information, the control system can determine and control the speed of the EST. In particular, logic component 1224 can control the valve motors in response to (1) the differential pressure of fluid in the rear and front chambers of the propulsion cylinders and in the entrance to the failsafe valve, (2) the positions of the annular pistons with respect to the propulsion cylinders, or (3) both.

The actual command logic and software for controlling the tractor will depend on the desired performance characteristics of the tractor and the environment in which the tractor is to be used. Once the performance characteristics are determined, it is believed that one skilled in the art can readily determine the desired logical sequences and software for the controller. It is believed that the structure and methods disclosed herein offer numerous advantages over the prior art, regardless of the performance characteristics and software selected. Accordingly, while a prototype of the invention uses a particular software program (developed by Halliburton Company of Dallas, Tex.), it is believed that a wide variety of software could be used to operate the system.

Pressure transducers 1182, 1184, 1186, 1188, and 1190 may be provided on the tool to measure the differential fluid pressure in (1) rear chambers 1166 and 1170, (2) front chambers 1168 and 1172, (3) rear chambers 1174 and 1178, (4) front chambers 1176 and 1180, and (5) in the entrance to failsafe valve 1150, respectively. These pressure transducers send electrical signals to logic component 1224, which are proportional to the differential fluid pressure sensed. In addition, as shown in FIGS. 31A–F, displacement sensors 1192 and 1194 may be provided on the tool to measure the positions of the annular pistons with respect to the propulsion cylinders. In the illustrated embodiment, sensor 1192 measures the axial position of piston 1140 with respect to cylinder 1110, and sensor 1194 measures the axial position of piston 1144 with respect to cylinder 1112. Sensors 1192 and 1194 can also be positioned on pistons 1140 and 1146, or additional displacement sensors can be provided if desired.

Rotary accelerometers or potentiometers are preferably provided to measure the rotation of the motors. By monitoring the rotation of the motors, the positions of the motorized valves 1154, 1156, and 1158 can be determined. Like the signals from the pressure transducers and displacement sensors, the signals from the rotary accelerometers or potentiometers are fed back to logic component 1224 for controlling the valve positions.

The major subassemblies of the EST are the aft section, the control assembly, and the forward section. Referring to FIG. 29, the major components of the aft section comprise shaft 1118, aft packerfoot 1104, aft propulsion cylinders 1108 and 1110, connectors 1120 and 1122, and aft transition housing 1131. The aft section includes a central conduit for transporting drilling fluid supply from the drill string to control assembly 1102 and to the drill bit. The aft section also includes passages for fluid flow between control assembly 1102 and aft packerfoot 1104 and aft propulsion cylinders 1108 and 1110. The aft section further includes at least one passage for wires for transmission of electrical signals between the ground surface, control assembly 1102, and the bottom hole assembly. A drill string connector 1116 is attached to the aft end of the aft section, for fluidly connecting a coiled tubing drill string to shaft 1118, as known in the art.

The forward section is structurally nearly identical to the aft section, with the exceptions that the components are inverted in order and the forward section does not include an aft transition housing. The forward section comprises shaft 1124, forward propulsion cylinders 1112 and 1114, connectors 1126 and 1128, and forward packerfoot 1106. The forward section includes a central conduit for transporting drilling fluid supply to the drill bit. The forward section also includes passages for fluid flow between control assembly 1102 and forward packerfoot 1106 and forward propulsion cylinders 1112 and 1114. The forward section further includes at least one passage for wires for transmission of electrical signals between the ground surface, control assembly 1102, and the bottom hole assembly. A connector 1129 is attached to the forward end of the forward section, for connecting shaft 1124 to downhole components such as the bottom hole assembly, as known in the art.

Figure 30:
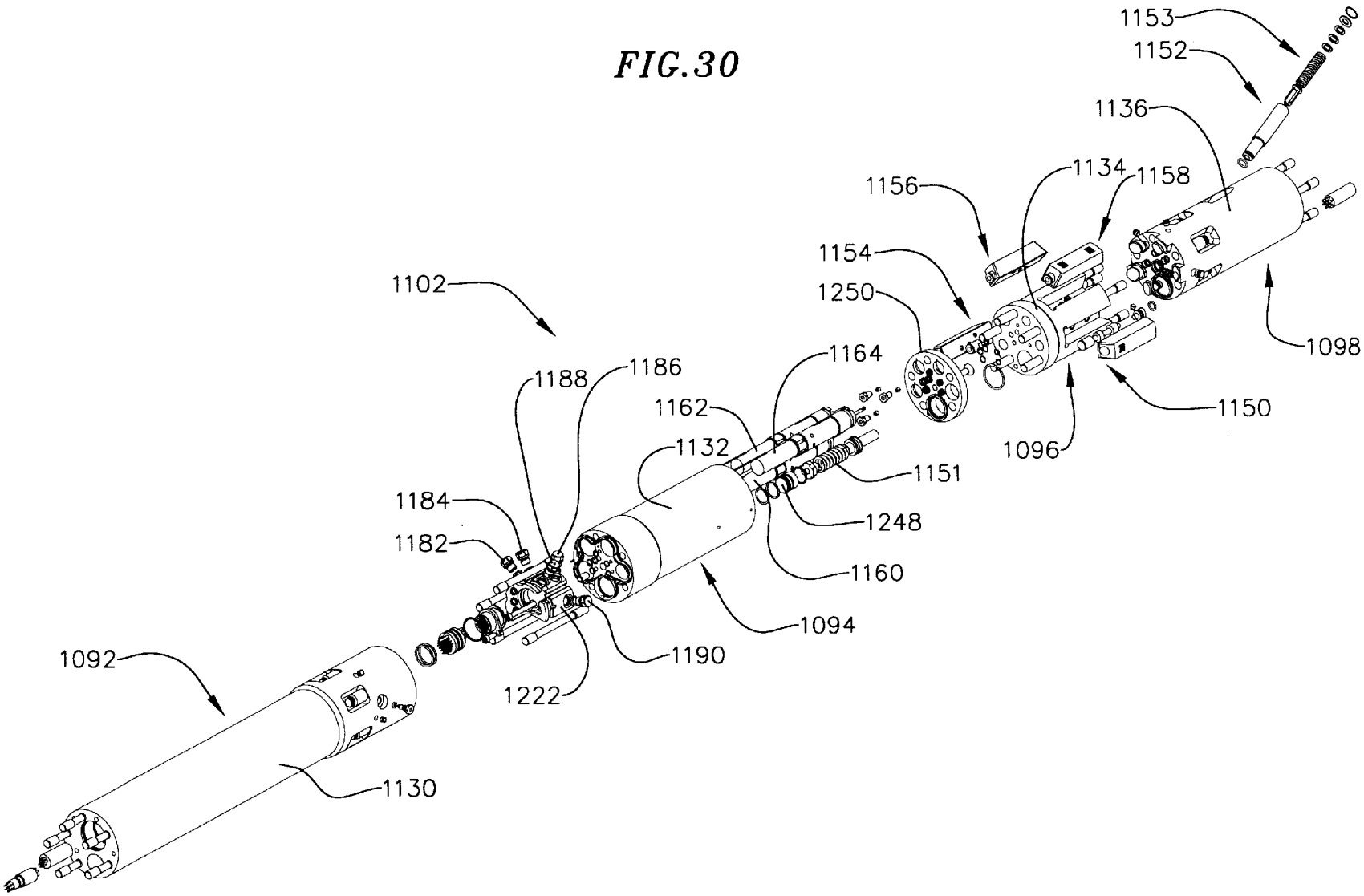
FIG. 30 is a rear perspective view of the control assembly of the EST.

Referring to FIGS. 29 and 30, control assembly 1102 comprises an aft transition housing 1131 (FIG. 2), electronics unit 92, motor unit 94, valve unit 96, and forward transition unit 98. Electronics unit 92 includes an electronics housing 1130 which contains electronic components, such as logic component 1224, for controlling the EST. Motor unit 94 includes a motor housing 1132 which contains motors 1160, 1162, and 1164. These motors control packerfoot valve 1154 and propulsion valves 1156 and 1158, respectively. Valve unit 96 includes a valve housing 1134 containing these valves, as well as failsafe valve 1150. Forward transition unit 98 includes a forward transition housing 1136 which contains diffuser 1148 (not shown) and relief valve 1152.

Figure 32:
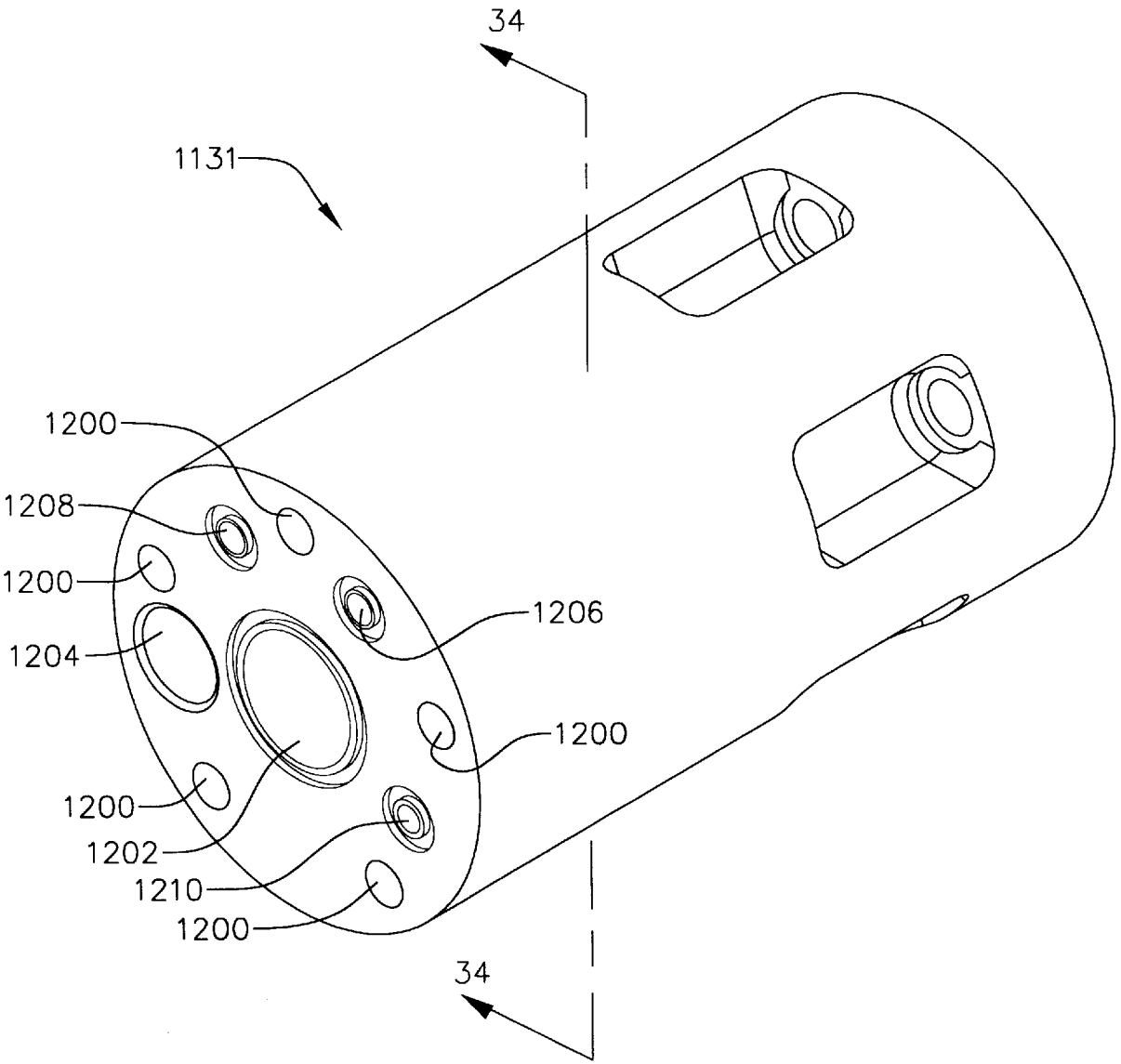
FIG. 32 is a rear perspective view of the aft transition housing of the EST.
Figure 33:
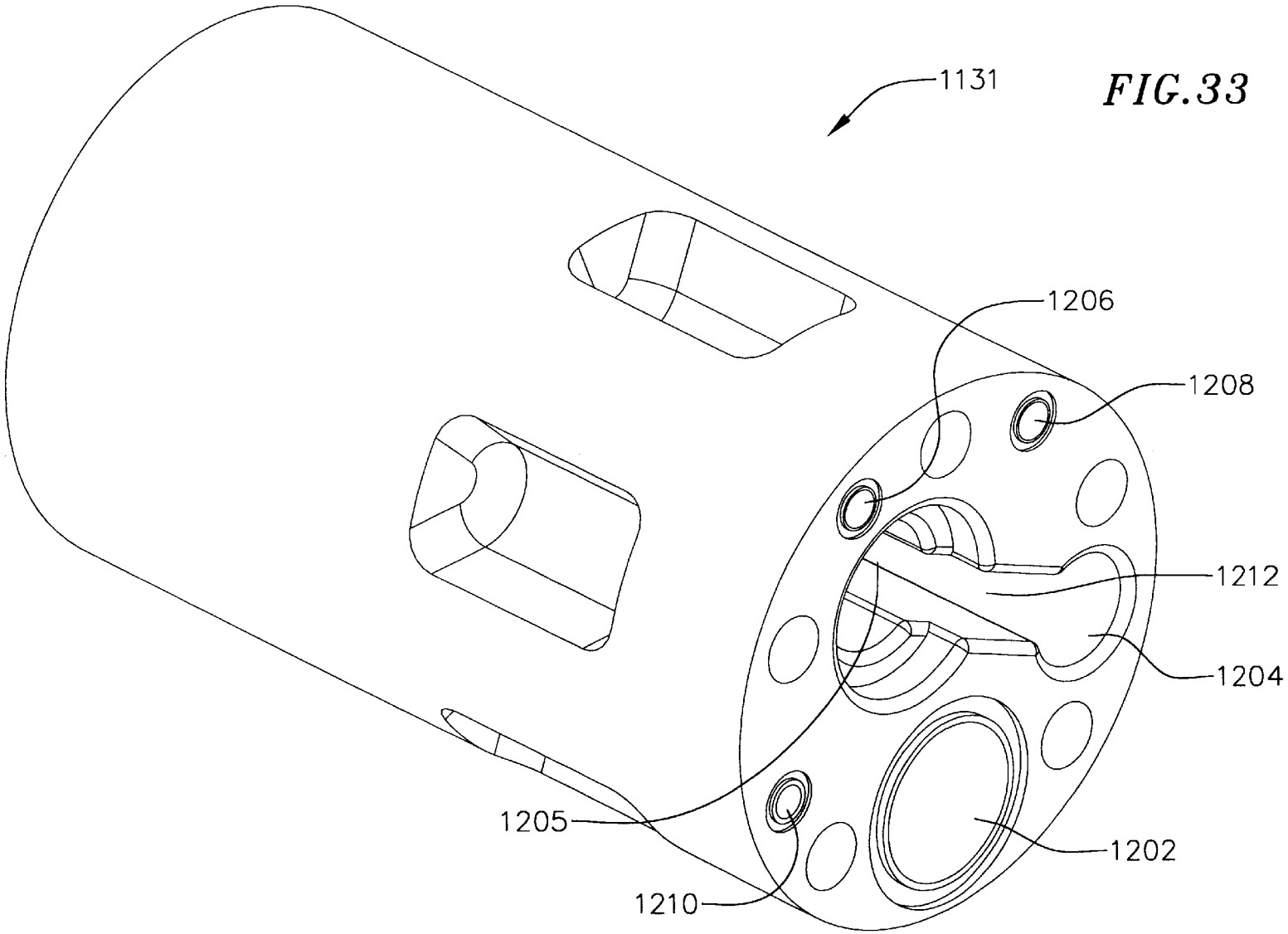
FIG. 33 is a front perspective view of the aft transition housing of FIG. 32.
Figure 34:
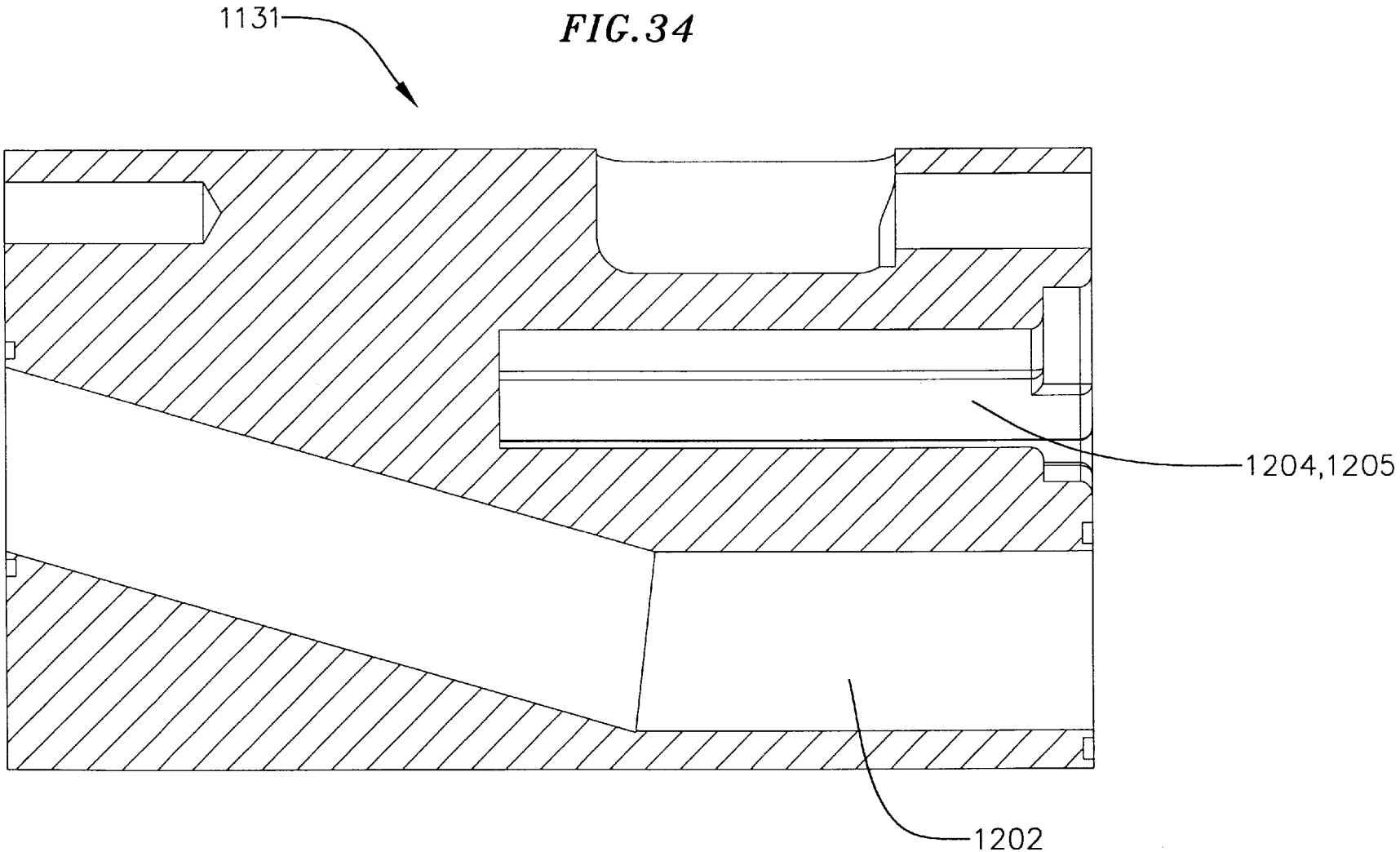
FIG. 34 is a sectional view of the aft transition housing, taken along line 7—7 of FIG. 32.

The first component of control assembly 1102 is aft transition unit 90. Aft transition housing 1131 is shown in FIGS. 32–34. Housing 1131 is connected to and is supplied with drilling fluid from shaft 1118. Housing 1131 shifts the drilling fluid supply from the center of the tool to a side, to provide space for an electronics package 1224 in electronics unit 92. FIG. 32 shows the aft end of housing 1131, and FIG. 33 shows its forward end. The aft end of housing 1131 attaches to flange 1366 (FIGS. 56A–B) on shaft 1118. In particular, housing 1131 has pentagonally arranged threaded connection bores 1200 which align with similar bores 1365 in flange 1366. High strength connection studs or bolts are received within bores 1365 and bores 1200 to secure the flange and housing 1131 together. Flange 1366 has recesses 1367 through which nuts can be fastened onto the aft ends of the connection studs, against surfaces of recesses 1367. Suitable connection bolts are MP33 non-magnetic bolts, which are high in strength, elongation, and toughness. At its forward end, housing 1131 is attached to electronics housing 1130 in a similar manner, which therefore need not be described in detail. Furthermore, all of the adjacent housings may be attached to each other and to the shafts in a like or similar manner and, therefore, also need not be described in detail.

It will be appreciated that the components of the EST include numerous passages for transporting drilling fluid and electrical wires through the tool. Aft transition housing 1131 includes several longitudinal bores which comprise a portion of these passages. Lengthwise passage 1202 transports the drilling fluid supply (from the drill string) downhole. As shown in FIG. 34, passage 1202 shifts from the center axis of the tool at the aft end of housing 1131 to an offcenter position at the forward end. Longitudinal wire passage 1204 is provided for electrical wires. A longitudinal wire passage 1205 is provided in the forward end of housing 1131, extending about half of the length of the housing. Passages 1204 and 1205 communicate through an elongated opening 1212 in housing 1131. In a preferred embodiment, wires from the surface are separated at opening 1212 and connected to a 7-pin boot 1209 (FIG. 96) and a 10-pin boot 1211. Boots 1209 and 1211 fit into passages 1204 and 1205, respectively, at the forward end of housing 1131 and connect to corresponding openings in electronics housing 1132. Passage 1206 permits fluid communication between aft propulsion valve 1156 and rear chambers 1166 and 1170 of aft propulsion cylinders 1108 and 1110. Passage 1208 permits fluid communication between valve 1156 and front chambers 1168 and 1172 of cylinders 1108 and 1110. Passage 1210 permits fluid communication between packerfoot valve 1154 and aft packerfoot 1104.

FIGS. 35–39 show electronics housing 1130 of electronics unit 92, which contains an electronic logic component or package 1224. Housing 1130 includes longitudinal bores for passages 1202, 1204, 1205, 1206, 1208, and 1210. Electronics package 1224 resides in a large diameter portion of passage 1205 inside housing 1130. The abovementioned 10-pin boot 1211 at the forward end of aft transition housing 1131 is connected to electronics package 1224. Passage 1205 is preferably sealed at the aft and forward ends of electronics housing 1130 to prevent damage to electronics package 1224 caused by exposure to high pressure from annulus 40, which can be as high as 16,000 psi. A suitable seal, rated at 20,000 psi, is sold by Green Tweed, Inc., having offices in Houston, Tex. Preferably, housing 1130 is constructed of a material which is sufficiently heat-resistant to protect electronics package 1224 from damage which can be caused by exposure to high downhole temperatures. A suitable material is Stabaloy AG 17.

Figure 36:
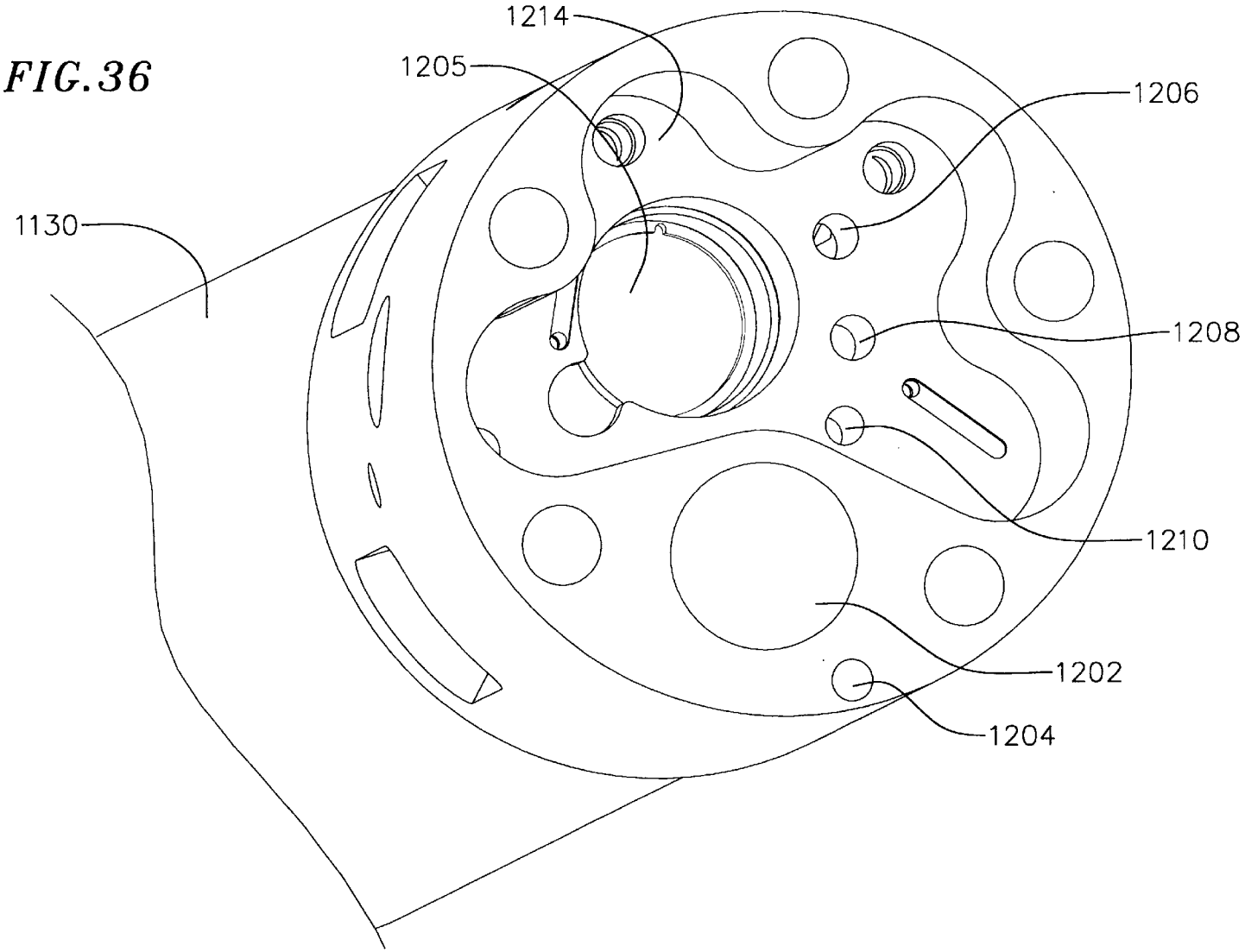
FIG. 36 is a front perspective view of the forward end of the electronics housing of FIG. 35.
Figure 37:
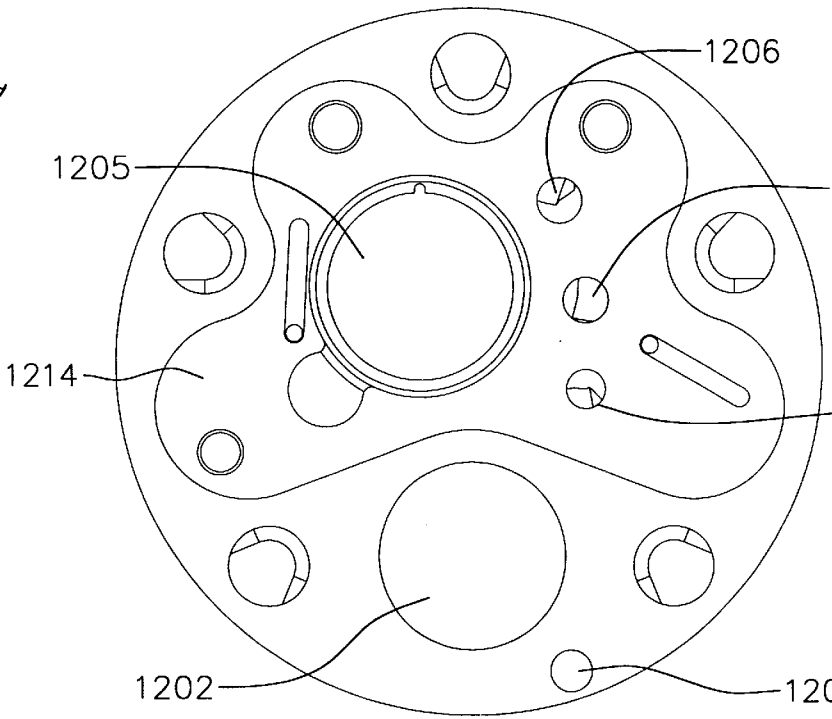
FIG. 37 is a front view of the electronics housing of FIG. 35.
Figure 38:
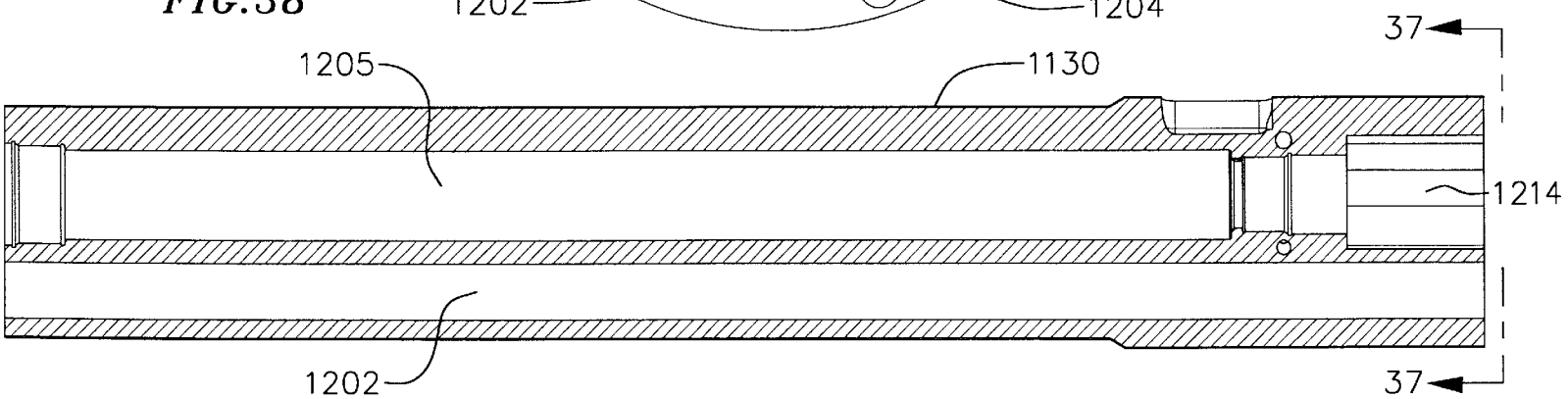
FIG. 38 is a longitudinal sectional view of the electronics housing, taken along line 38—38 of FIG. 35.
Figure 39:
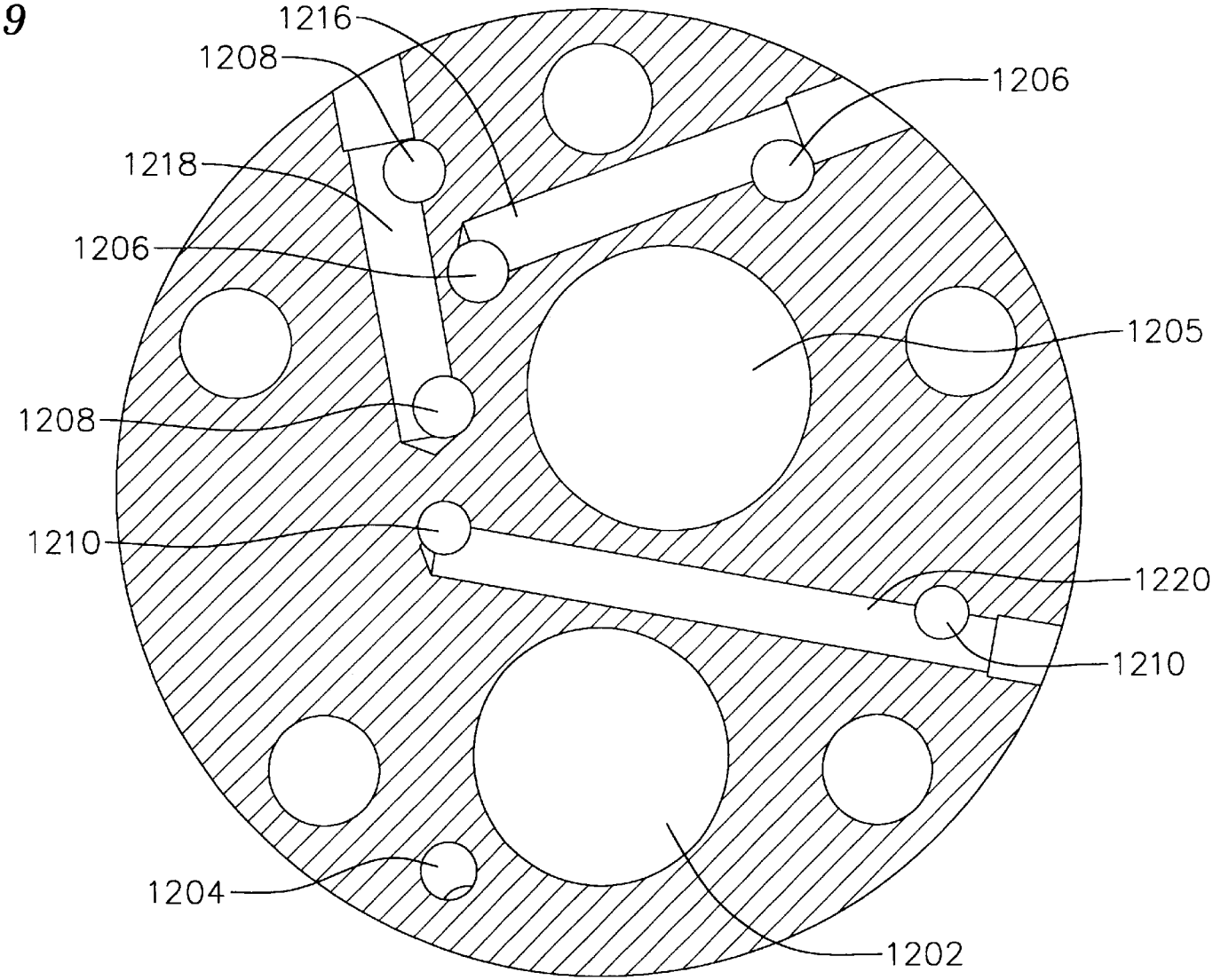
FIG. 39 is a cross-sectional view of the electronics housing, taken along line 39—39 of FIG. 35.
Figure 40:
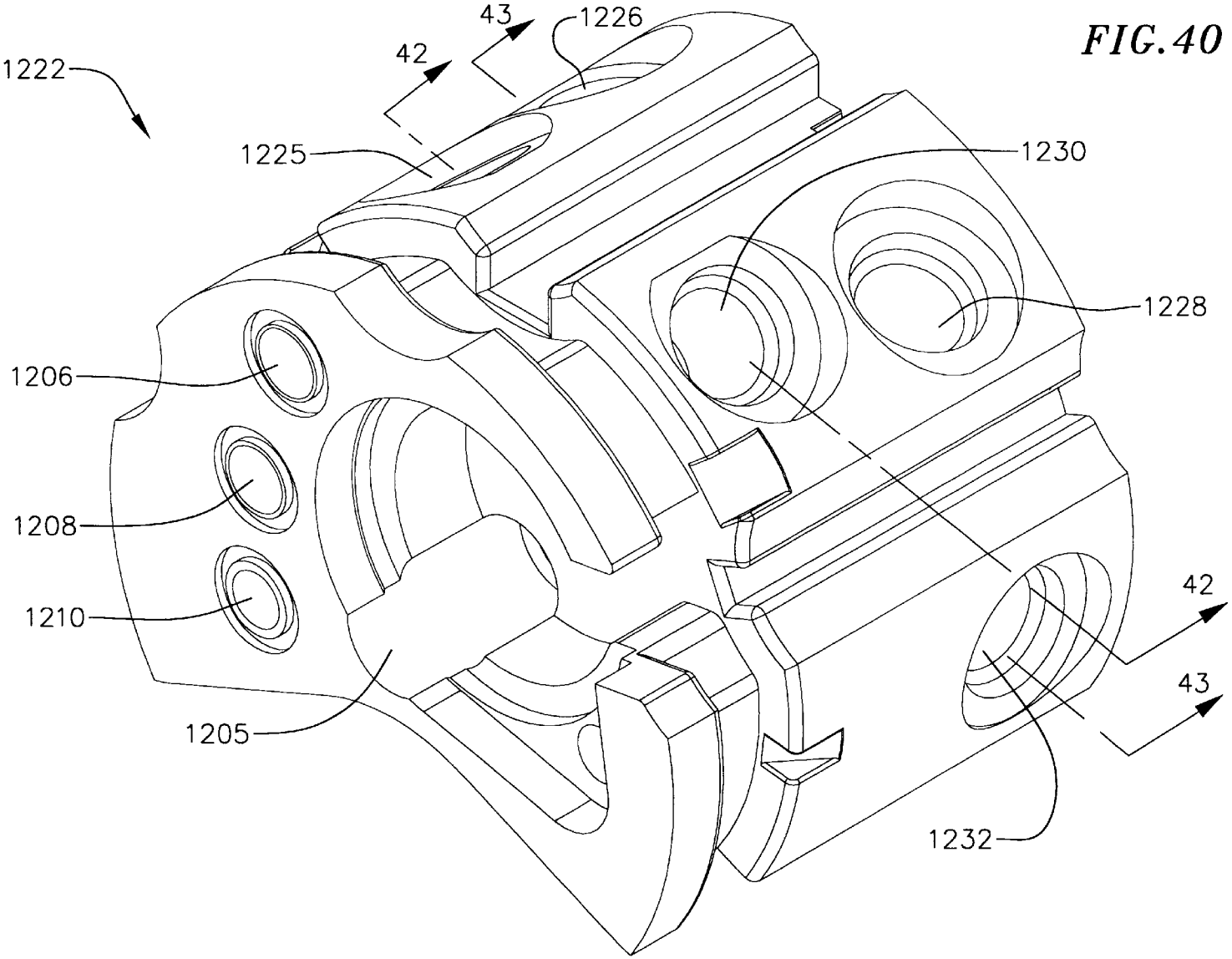
FIG. 40 is a rear perspective view of the pressure transducer manifold of the EST.
Figure 41:
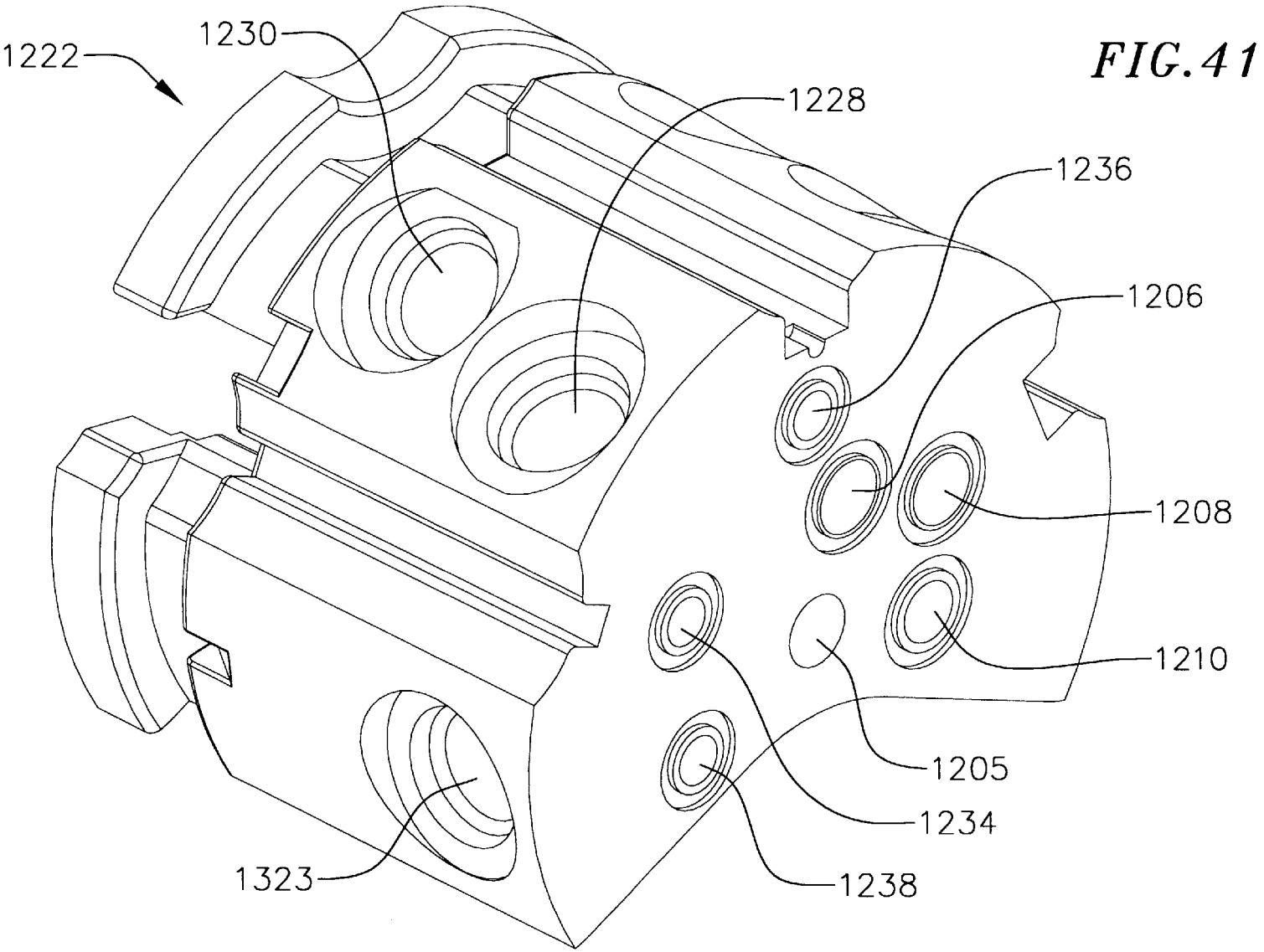
FIG. 41 is a front perspective view of the pressure transducer manifold of FIG. 41.

As shown in FIGS. 36 and 38, a recess 1214 is provided in the forward end of electronics housing 1130, for receiving a pressure transducer manifold 1222 (FIGS. 40–43) which includes pressure transducers 1182, 1184, 1186, 1188, and 1190 (FIG. 30). Passages 1206, 1208, and 1210 are shifted transversely toward the central axis of electronics housing 1130 to make room for the pressure transducers. Referring to FIG. 39, transverse shift bores 1216, 1218, and 1220 are provided to shift passages 1206, 1208, and 1210, respectively, to their forward end positions shown in FIGS. 36 and 37. Shift bores 1216, 1218, and 1220 are plugged at the radial exterior of housing 1130 to prevent leakage of fluid to annulus 40.

Figure 42:
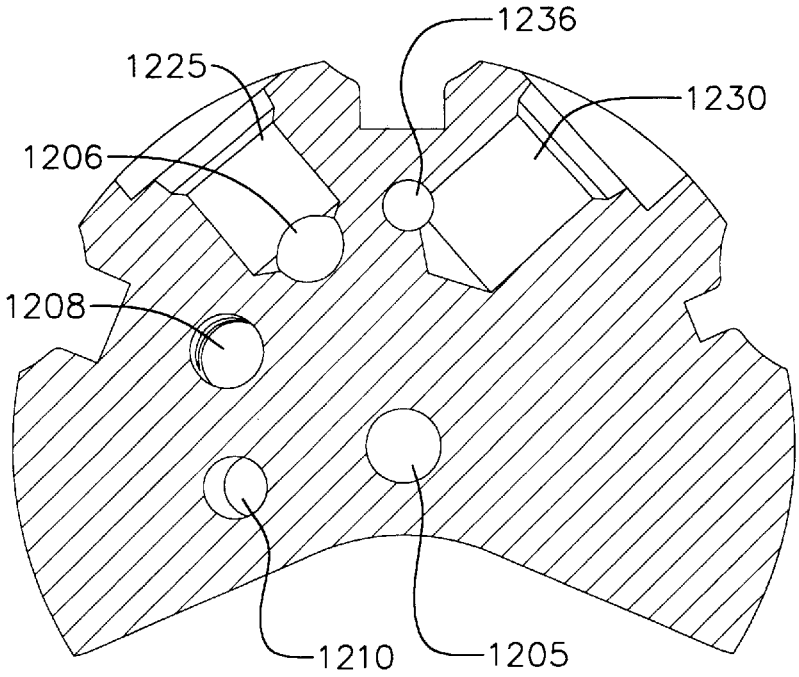
FIG. 42 is a cross-sectional view of the pressure transducer manifold, taken along line 42—42 of FIG. 40.
Figure 43:
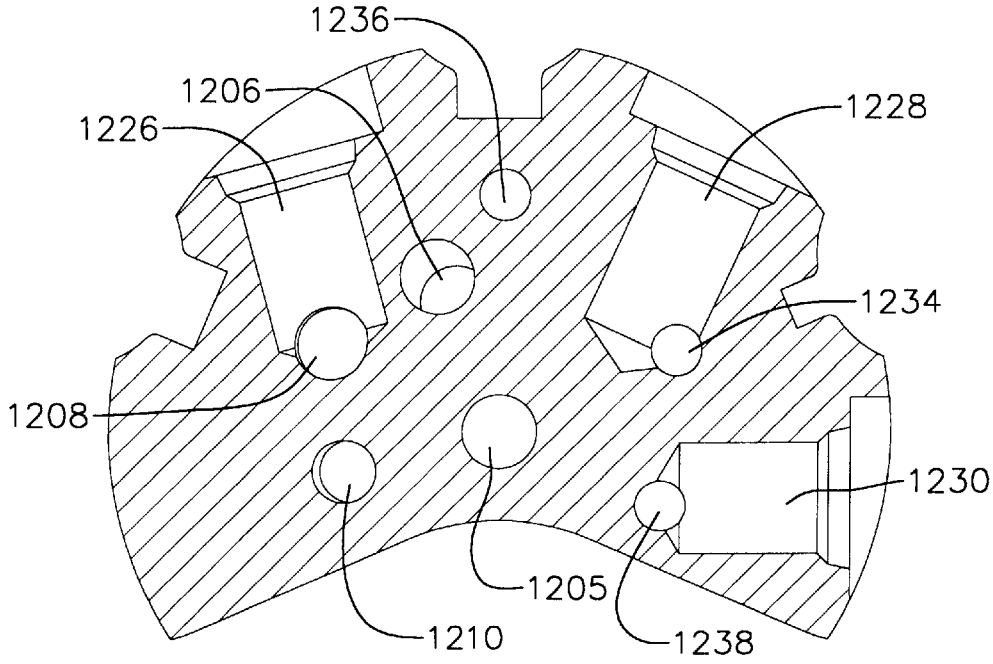
FIG. 43 is a cross-sectional view of the pressure transducer manifold, taken along line 43—43 of FIG. 40.

FIGS. 40–43 show pressure transducer manifold 1222, which is configured to house pressure transducers for measuring the differential pressure of drilling fluid passing through various manifold passages. Pressure transducers 1182, 1184, 1186, 1188, and 1190 are received within transducer bores 1225, 1226, 1228, 1230, and 1232, respectively, which extend radially inward from the outer surface of manifold 1222 to longitudinal bores therein. Longitudinal bores for passages 1205, 1206, 1208, and 1210 extend through the length of manifold 1222 and align with corresponding bores in electronics housing 1130. In addition, longitudinal bores extend rearward from the forward end of manifold 1222 without reaching the aft end, forming passages 1234, 1236, and 1238. Passage 1234 fluidly communicates with rear chambers 1174 and 1178 of forward propulsion cylinders 1112 and 1114. Passage 1236 fluidly communicates with front chambers 1176 and 1180 of cylinders 1112 and 1114. Passage 1238 fluidly communicates with forward packerfoot 1106. As shown in FIGS. 42 and 43, transducer bores 1225, 1226, 1228, 1230, and 1232 communicate with passages 1206, 1208, 1234, 1236, and 1238, respectively. As will be described below, the pressure transducers are exposed to drilling fluid on their inner sides and to oil on their outer sides. The oil is maintained at the pressure of annulus 40 via a pressure compensation piston 1248 (FIG. 72), in order to produce the desired differential pressure measurements.

Figure 35:
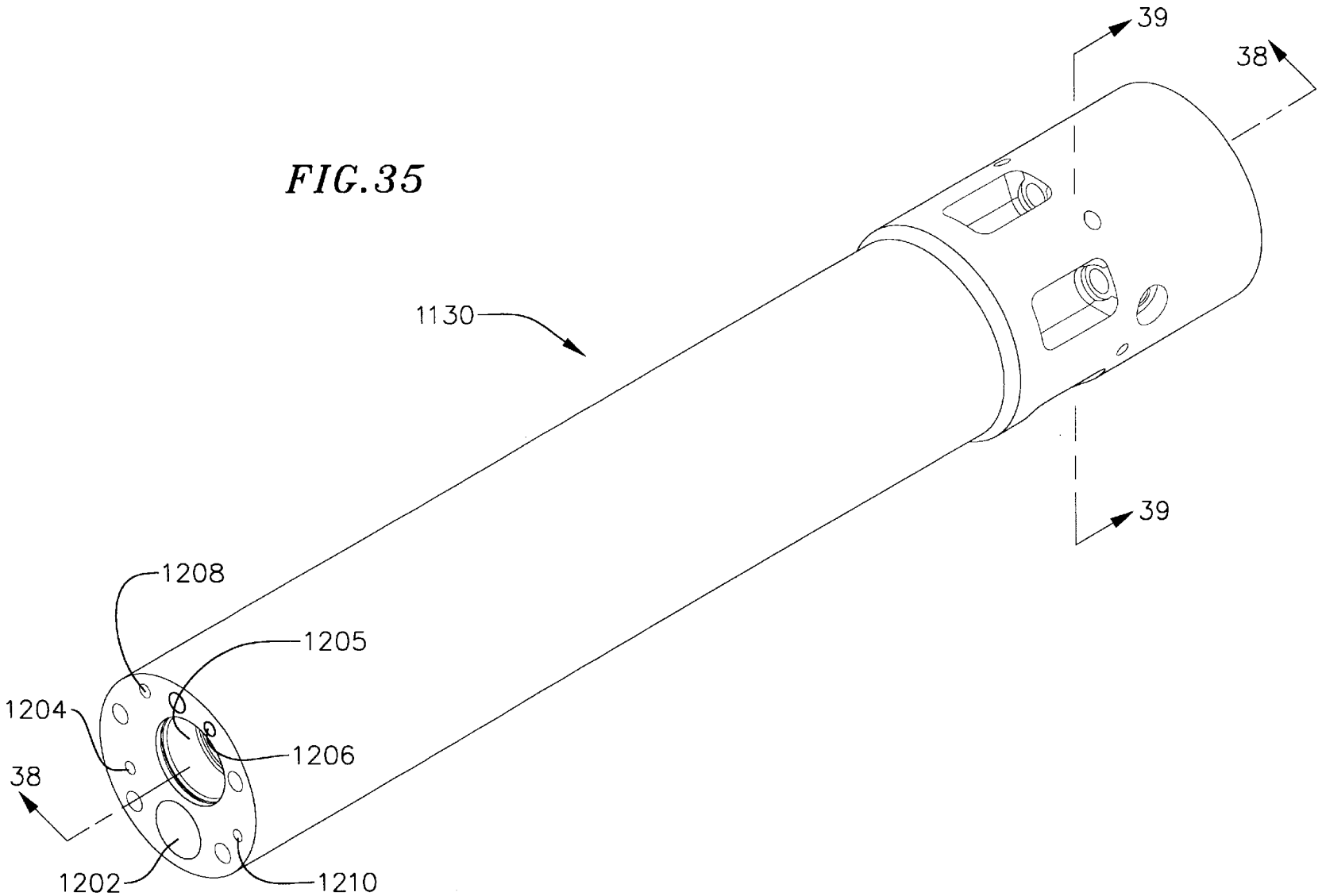
FIG. 35 is a rear perspective view of the electronics housing of the EST.

FIGS. 34 and 35 show motor housing 1132 of motor unit 94. Attached to the forward end of electronics housing 1130, housing 1132 includes longitudinal bores for passages 1202, 1204, 1206, 1208, 1210, 1234, 1236, and 1238 which align with the corresponding bores in electronics housing 1130 and pressure transducer manifold 1222. Housing 1132 also includes longitudinal bores for passages 1240, 1242, and 1244, which respectively house packerfoot motor 1160, aft propulsion motor 1162, and forward propulsion motor 1164. In addition, a longitudinal bore for a passage 1246 houses a pressure compensation piston 1248 on its aft end and failsafe valve spring 1151 (FIG. 72) on its forward end. The assembly and operation of the motors, valves, pressure compensation piston, and failsafe valve spring are described below.

Figure 47:
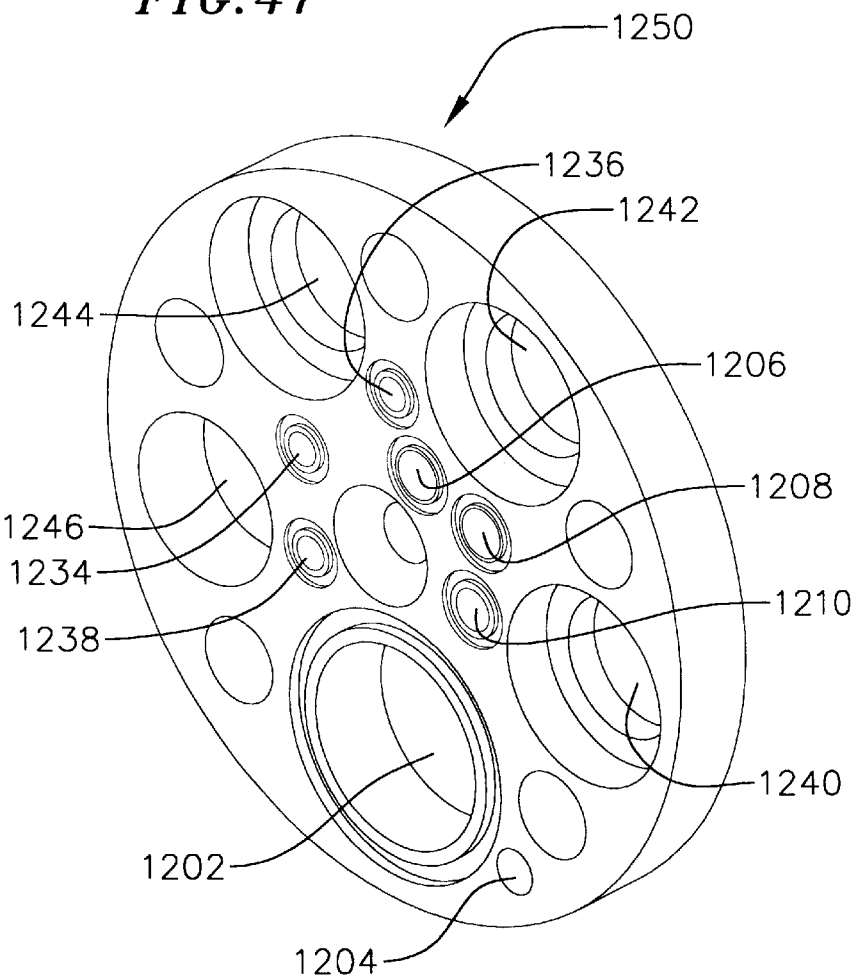
FIG. 47 is a front perspective view of the motor mount plate of FIG. 46.
Figure 46:
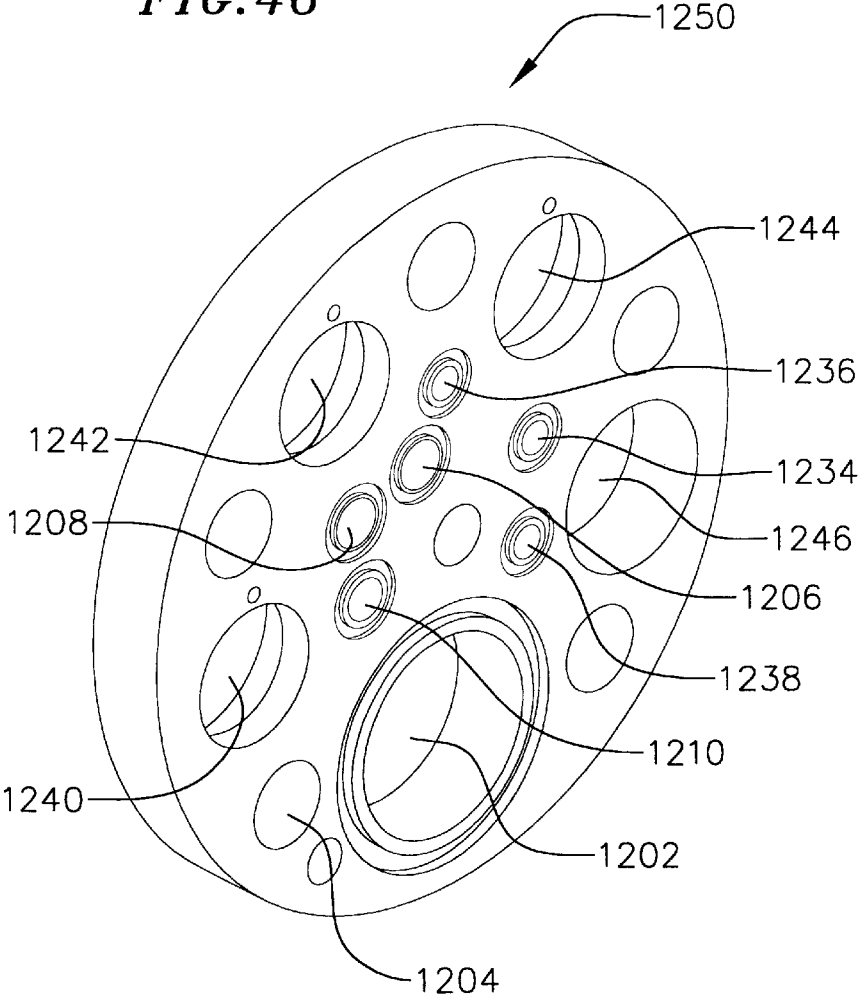
FIG. 46 is a rear perspective view of the motor mount plate of the EST.
Figure 48:
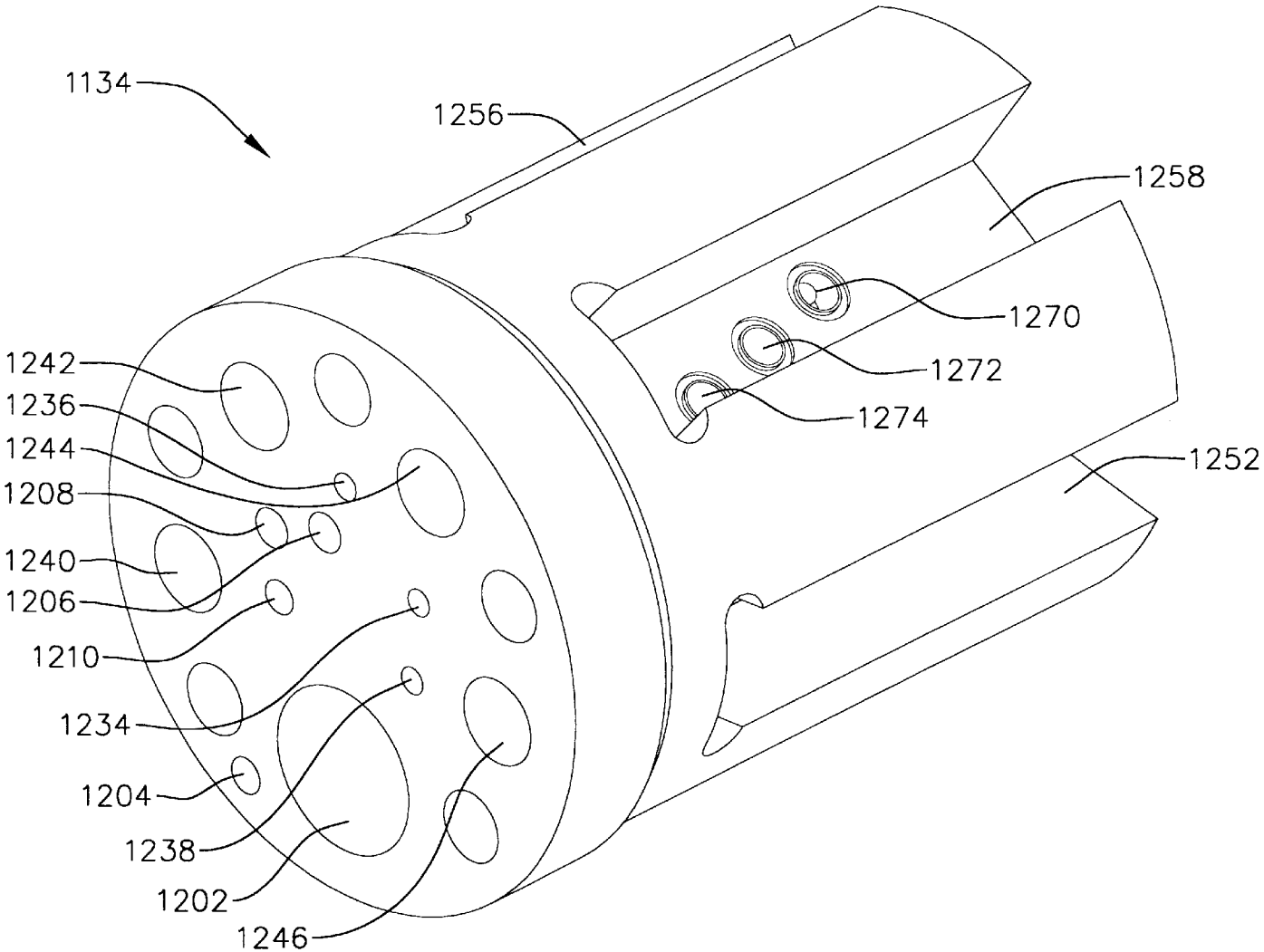
FIG. 48 is a rear perspective view of the valve housing of the EST.
Figure 49:
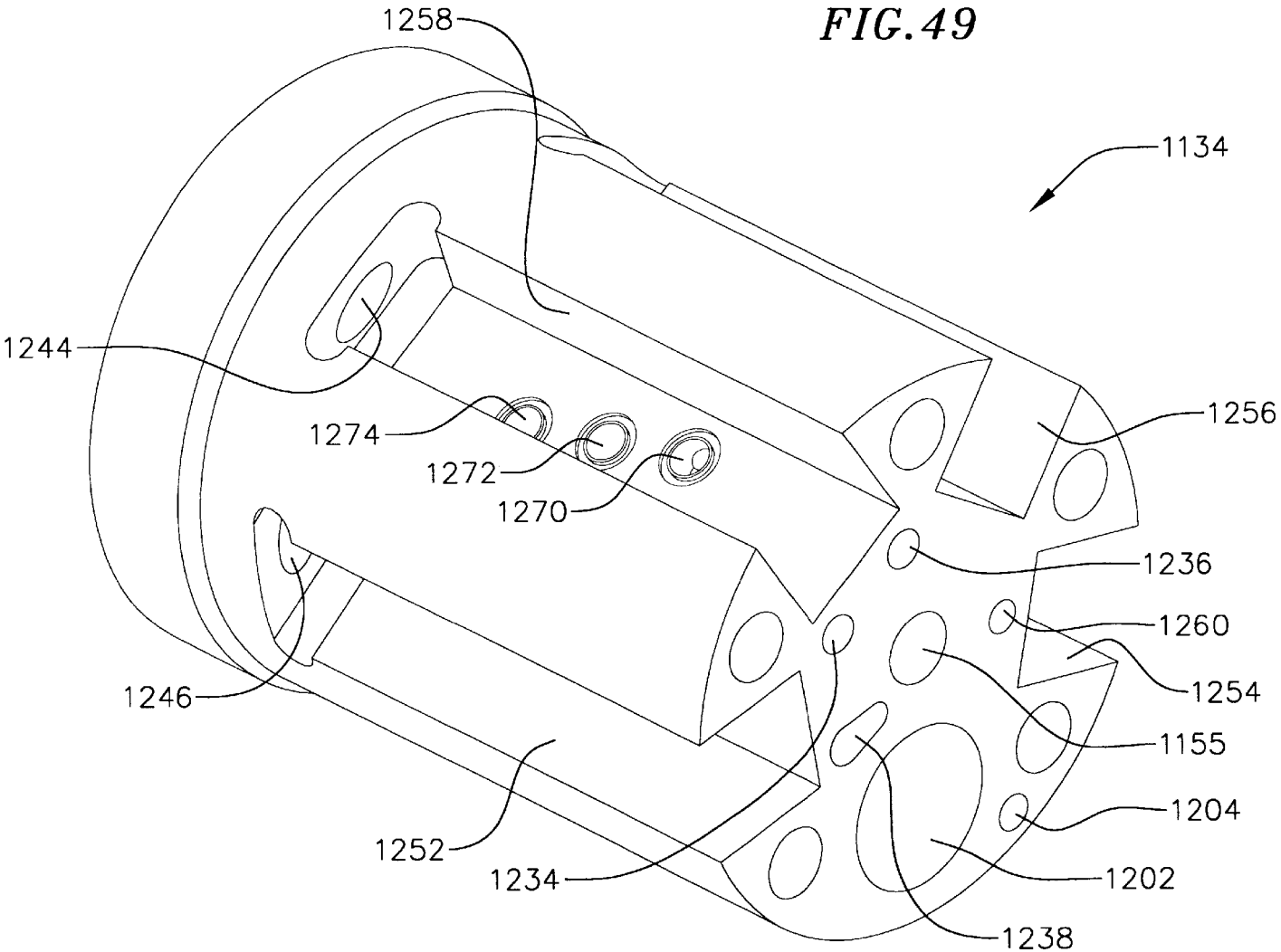
FIG. 49 is a front perspective view of the valve housing of FIG. 21.

A motor mount plate 1250, shown in FIGS. 46 and 47, is secured between the forward end of motor housing 1132 and the aft end of valve housing 1134. The motors are enclosed within leadscrew housings 1318 (described below) which are secured to mount plate 1250. Plate 1250 includes bores for passages 1202, 1204, 1206, 1208, 1210, 1234, 1236, 1238, 1240, 1242, 1244, and 1246 which align with corresponding bores in motor housing 1132 and valve housing 1134. As shown in FIG. 47, on the forward side of plate 1250 the bores for passages 1240 (packerfoot motor), 1242 (aft propulsion motor), and 1244 (forward propulsion motor) are countersunk to receive retaining bolts 1334 (FIG. 71). Bolts 1334 secure leadscrew housings 1318 to the aft side of plate 1250.

FIGS. 48–54 show valve housing 1134 of valve unit 96. Attached to the forward end of motor mount plate 1250, housing 1134 has longitudinal recesses 1252, 1254, 1256, and 1258 in its outer radial surface which house failsafe valve 1150, packerfoot valve 1154, aft propulsion valve 1156, and forward propulsion valve 1158, respectively. Housing 1134 has bores for passages 1202, 1204, 1206, 1208, 1210, 1234, 1236, 1238, 1240, 1242, 1244, and 1246, which align with corresponding bores in motor mount plate 1250. At the forward end of housing 1134, a central longitudinal bore is provided which forms an aft portion of galley 1155. Galley 1155 does not extend to the aft end of housing 1134, since its purpose is to feed fluid from the exit of failsafe valve 1150 to the other valves. In addition, a longitudinal bore is provided at the forward end of housing 1134 for a passage 1260. Passage 1260 permits fluid communication between packerfoot valve 1154 and forward packerfoot 1106.

Figures 50, 51, 52, 53, 54:
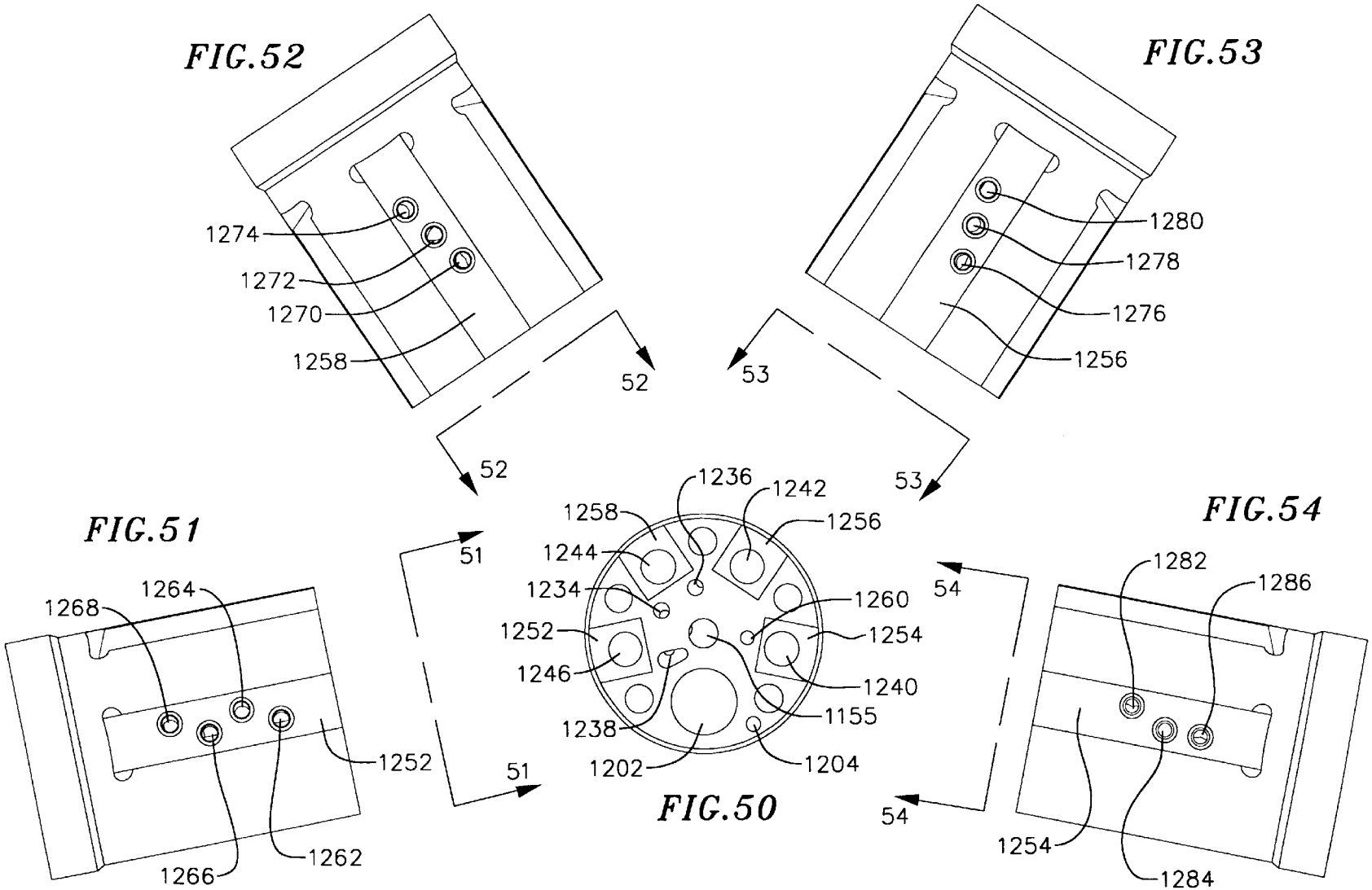
FIG. 50 is a front view of the valve housing of FIG. 48.
FIG. 51 is a side view of the valve housing, showing view 51 of FIG. 50.
FIG. 52 is a side view of the valve housing, showing view 52 of FIG. 50.
FIG. 53 is a side view of the valve housing, showing view 50 of FIG. 50.
FIG. 54 is a side view of the valve housing, showing view 51 of FIG. 50.

As shown in FIGS. 51–54, valve housing 1134 includes various transverse bores which extend from the valve recesses to the longitudinal fluid passages, for fluid communication with the valves. As described below, valves 1150, 1154, 1156, and 1158 are spool valves, each comprising a spool configured to translate inside of a valve body. During operation, the spools translate longitudinally within the bores in the valve bodies and communicate with the fluid passages to produce the behavior schematically shown in FIGS. 31A–F. FIG. 51 shows the openings of transverse bores within failsafe valve recess 1252 which houses failsafe valve 1150. The bores form passages 1262, 1264, 1266, and 1268 which extend inward between failsafe valve 1150 and various internal passages. In particular, passages 1262 and 1266 extend inward to passage 1238 (the exit of diffuser 1148), and passages 1264 and 1268 extend to galley 1155. As will be described below, failsafe valve 1150 distributes fluid from passage 1238 to galley 1155 when the fluid pressure in passage 1238 exceeds the desired "on/off" threshold.

FIG. 52 shows the openings of transverse bores within forward propulsion valve recess 1258. The bores form passages 1270, 1272, and 1274 which extend from forward propulsion valve 1158 to passage 1236, galley 1155, and passage 1234, respectively. FIG. 53 shows the openings of transverse bores within aft propulsion valve recess 1256. The bores form passages 1276, 1278, and 1280 which extend from aft propulsion valve 1156 to passage 1208, galley 1155, and passage 1206, respectively. FIG. 54 shows the openings of transverse bores within packerfoot valve recess 1254. The bores form passages 1282, 1284, and 1286 which extend from packerfoot valve 1154 to passage 1260, galley 1155, and passage 1210, respectively. As mentioned above, propulsion valves 1156 and 1158 distribute fluid from galley 1155 to the rear and front chambers of aft and forward propulsion cylinders 1108, 1110, 1112, and 1114. Packerfoot valve 1154 distributes fluid from galley 1155 to aft and forward packerfeet 1104 and 1106.

Figure 55:
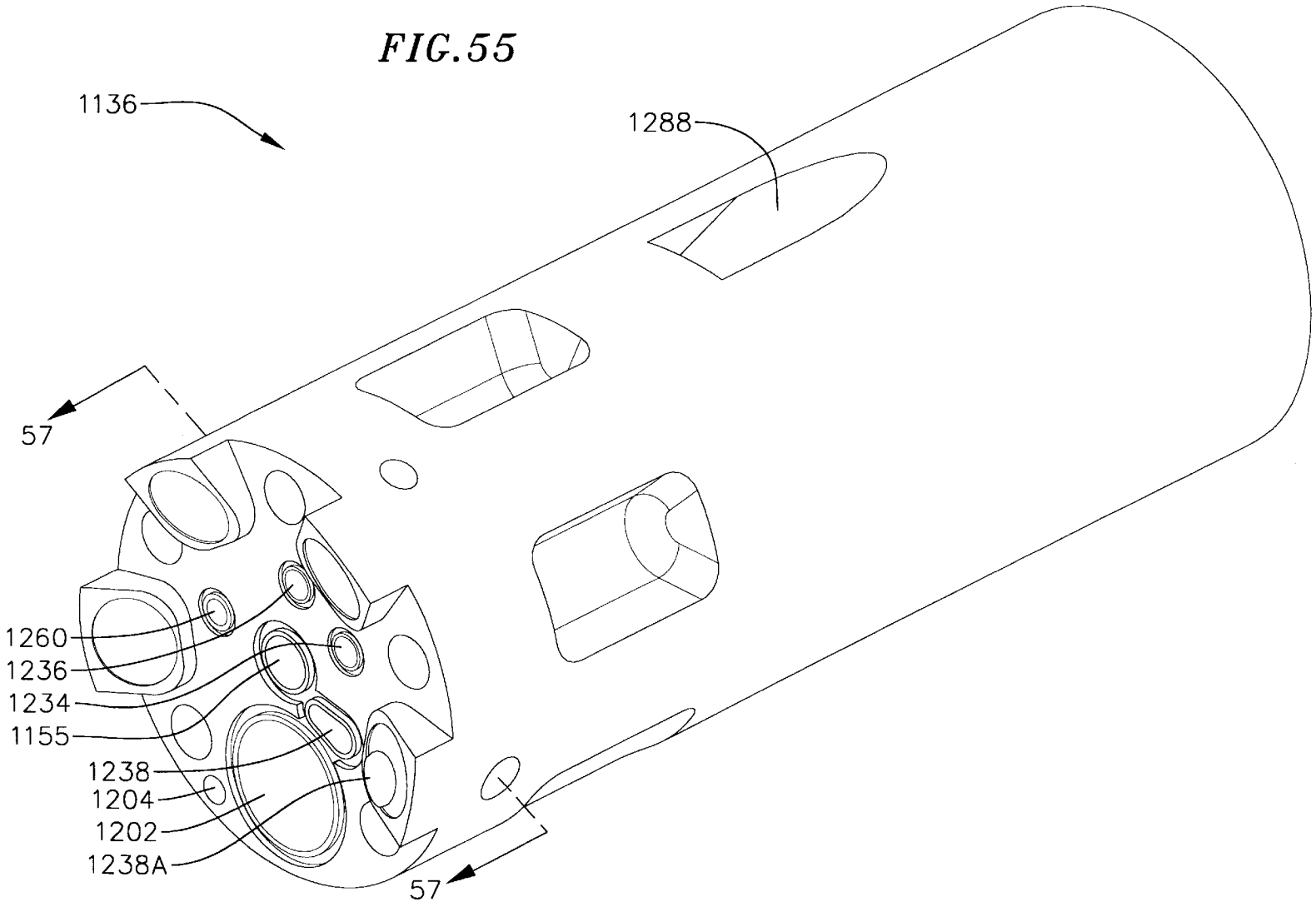
FIG. 55 is a rear perspective view of the forward transition housing of the EST.
Figure 56:
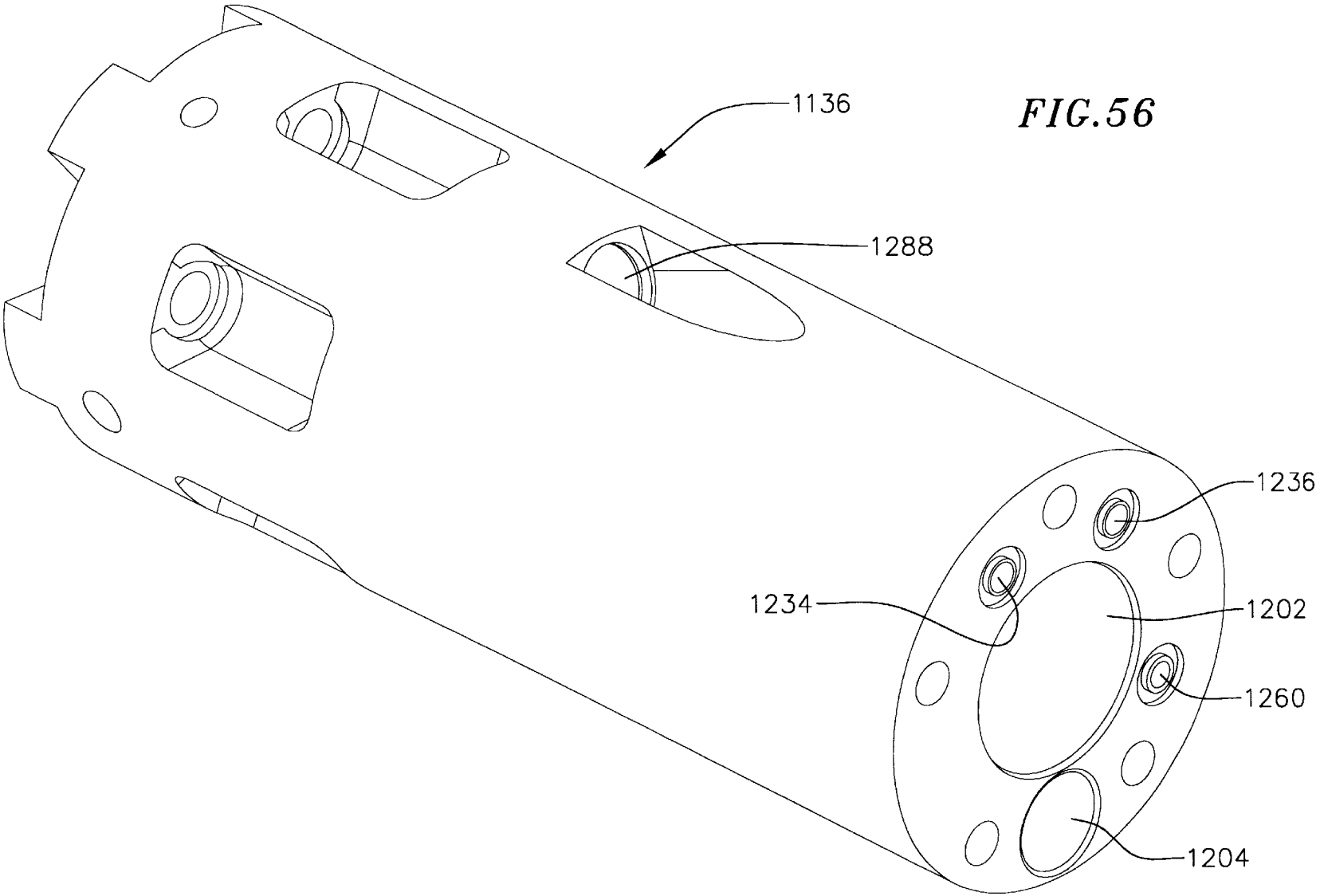
FIG. 56 is a front perspective view of the forward transition housing of FIG. 55.
Figure 57:
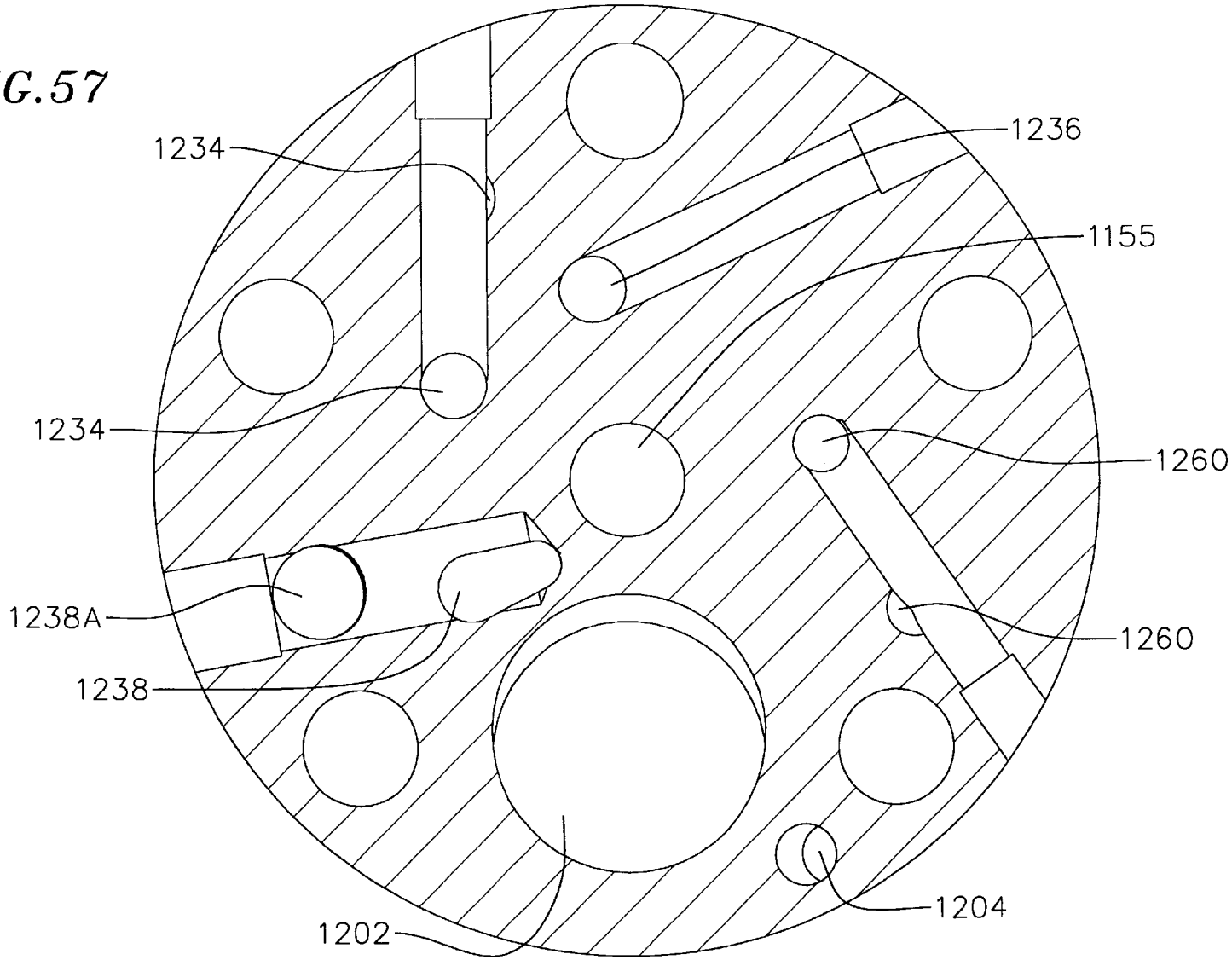
FIG. 57 is a cross-sectional view of the forward transition housing, taken along line 57—57 of FIG. 55.

FIGS. 55–57 show forward transition housing 1136 of forward transition unit 98, which connects valve housing 1134 to forward shaft 1124 and houses relief valve 1152 and diffuser 1148. To simplify manufacturing of the tool, aft and forward shafts 1118 and 1124 are preferably identical. Thus, housing 1136 repositions the various passages passing through the tool, via transverse shift bores (FIG. 57) as described above, to align with corresponding passages in forward shaft 1124. Note that the shift bores are plugged on the exterior radial surface of housing 1136, to prevent leakage of fluid to annulus 40. As seen in the figures, the aft end of housing 1136 has longitudinal bores for passages 1155, 1202, 1204, 1234, 1236, 1238, and 1260, which align with the corresponding bores in valve housing 1134. Supply passage 1202 transitions from the lower portion of the housing at the aft end to the central axis of the housing at the forward end, to align with a central bore in forward shaft 1124. Wire passage 1204 is enlarged at the forward end of housing 1136, to facilitate connection with wire passages in forward shaft 1124. Also, note that passage 1238 does not extend to the forward end of housing 1136. The purpose of passage 1238 is to feed fluid from the diffuser to failsafe valve 1150.

Figure 89:
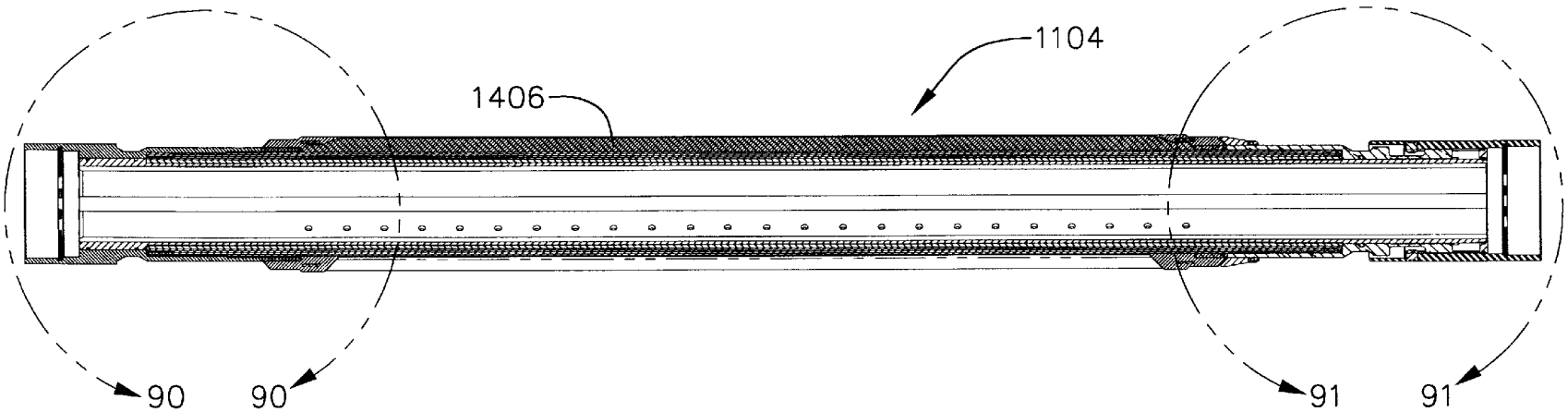
FIG. 89 is a longitudinal sectional view of the aft packerfoot of FIG. 88.
Figure 90:
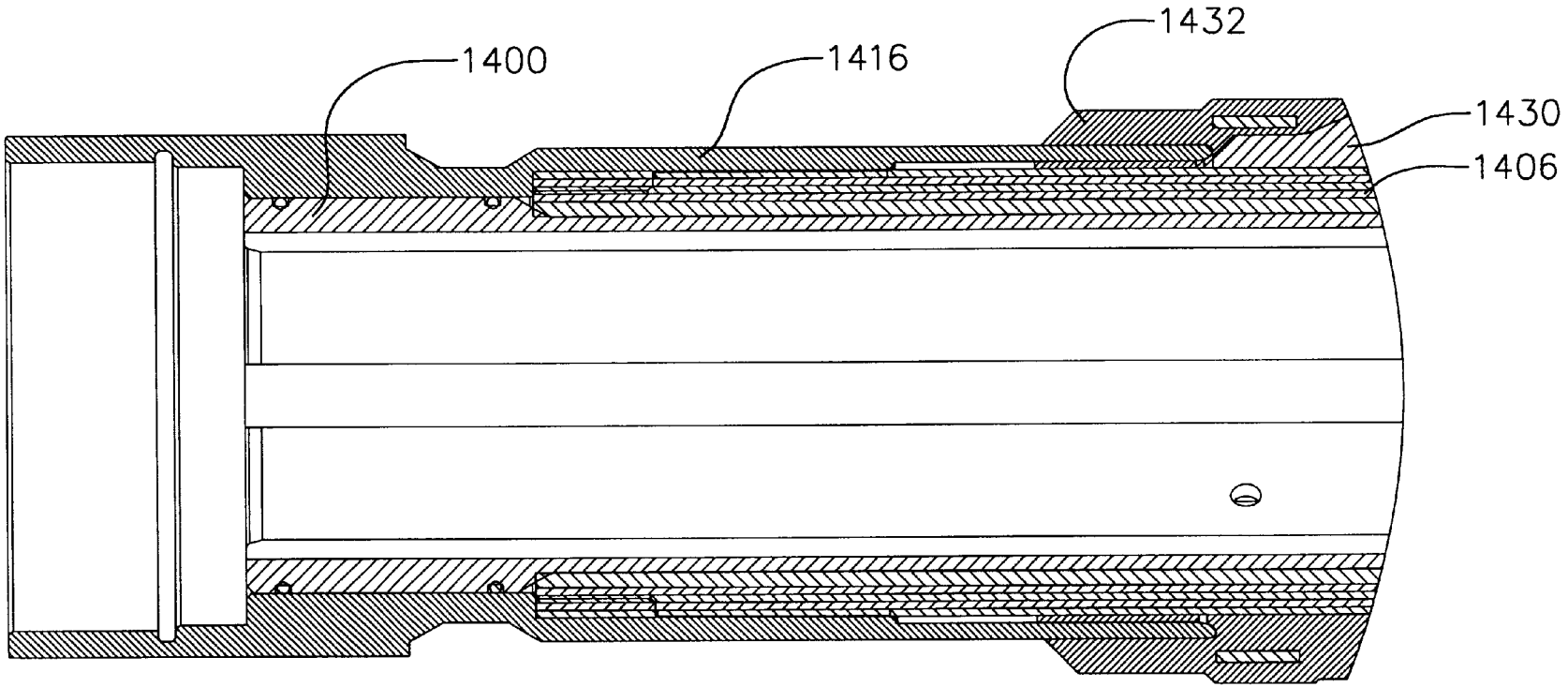
FIG. 90 is an exploded view of the aft end of the aft packerfoot of FIG. 89.
Figure 91:
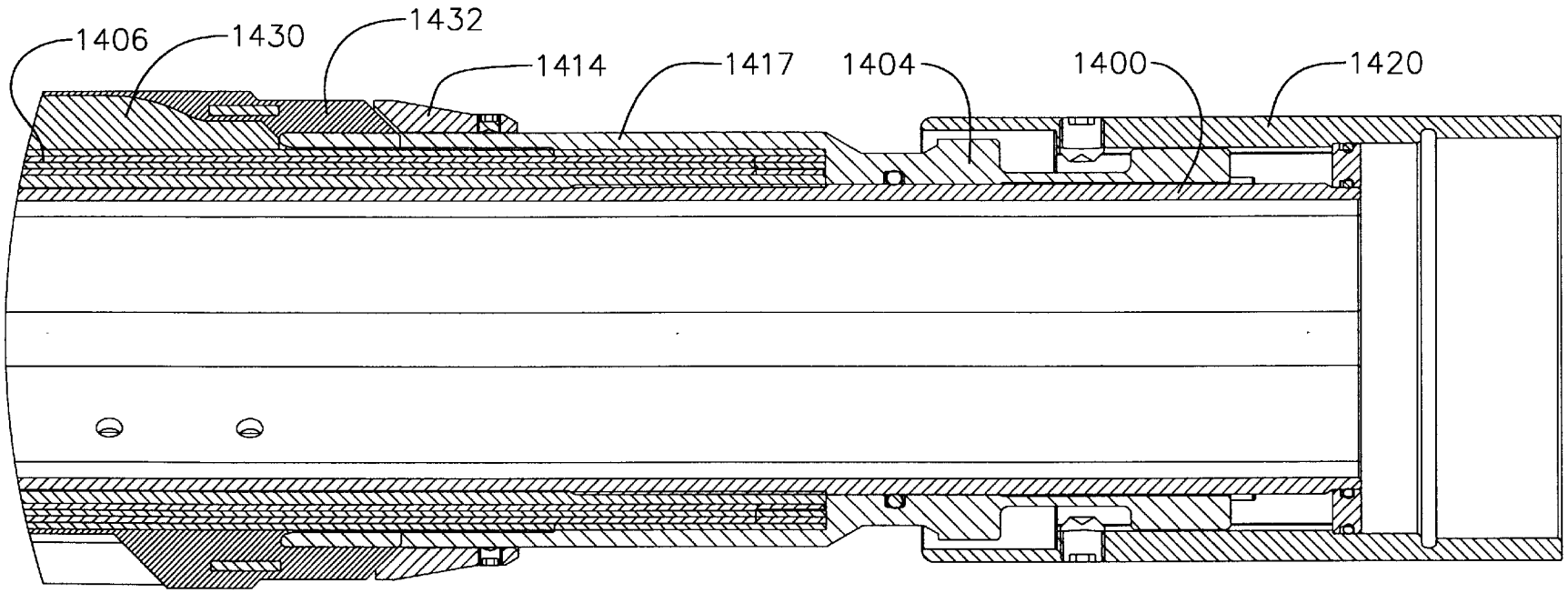
FIG. 91 is an exploded view of the forward end of the aft packerfoot of FIG. 89.

Referring still to FIGS. 55–57, diffuser 1148 (FIGS. 58 and 89) is received in passage 1202, at the forward end of housing 1136. Fluid passing through the diffuser wall enters passage 1238 and flows back toward valve housing 1134 and to failsafe valve 1150. An additional passage 1238A fluidly communicates with passage 1238 via a transverse shift bore. Fluid in passage 1238A exerts an uphole axial force on the failsafe spool and hence on spring 1151 (FIG. 72), to open the valve. Galley 1155 extends forward to upper orifice 1288 of housing 1136, within which relief valve 1152 (FIGS. 73–75) is received. The configuration and operation of diffuser 1148 and the valves of the tool are described below.

Figure 59:
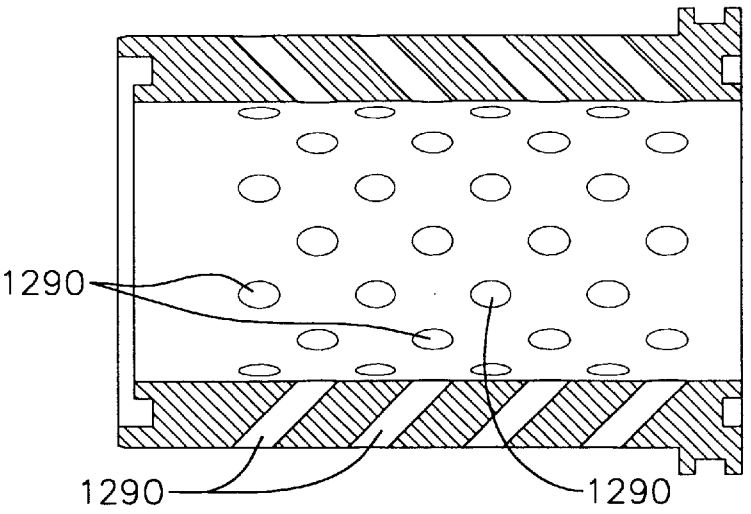
FIG. 59 is a sectional view of the diffuser, taken along line 59—59 of FIG. 58.
Figure 58:
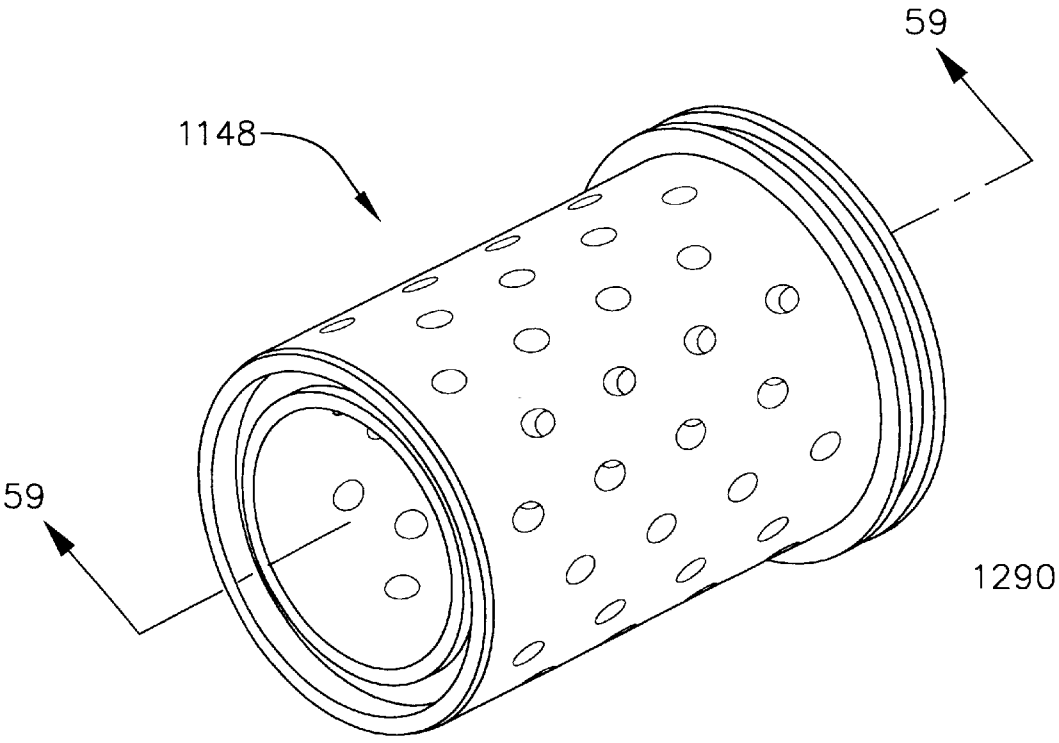
FIG. 58 is a rear perspective view of the diffuser of the EST.
Figure 60:
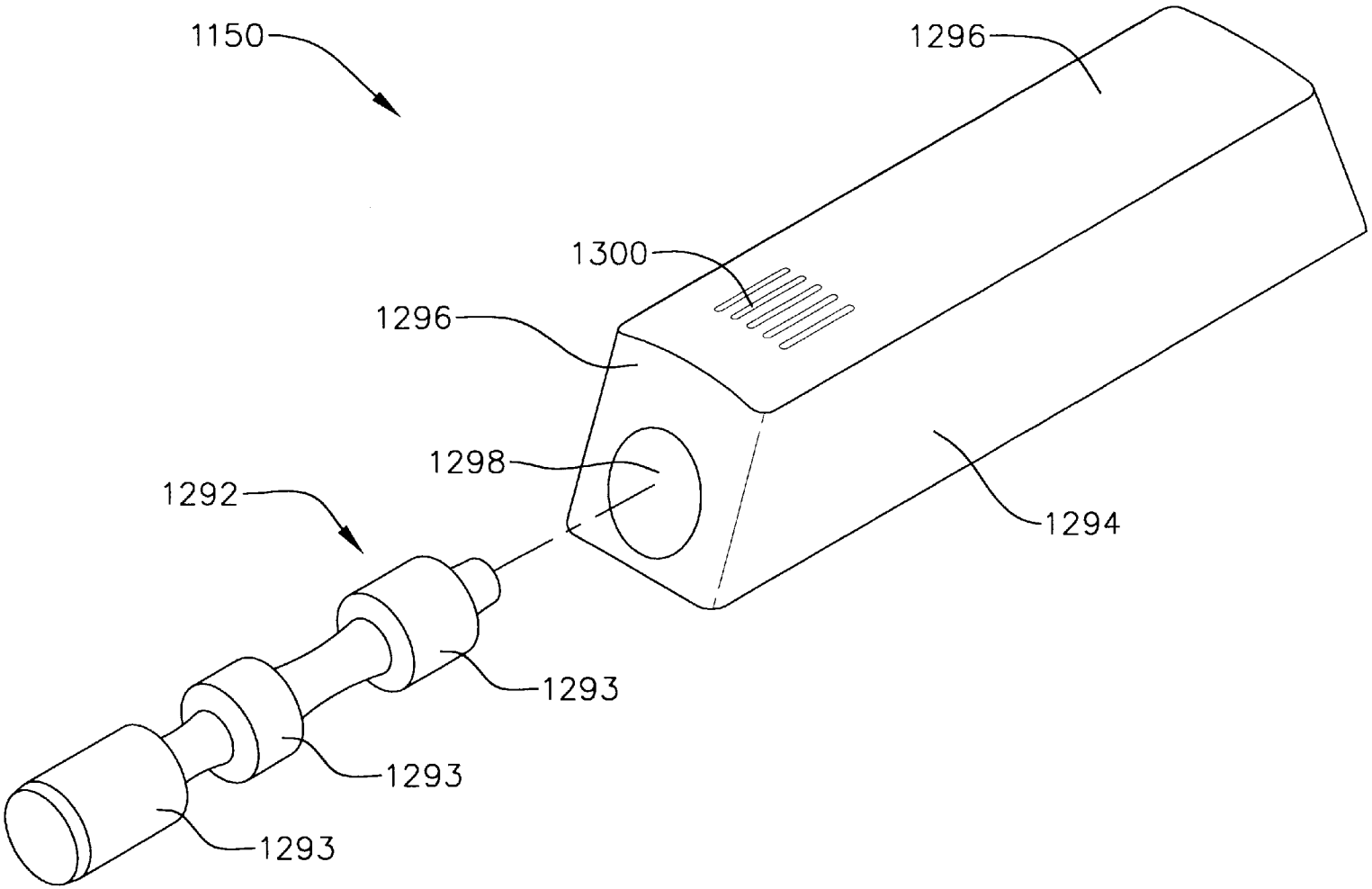
FIG. 60 is a rear perspective view of the failsafe valve spool and failsafe valve body of the EST.
Figure 61:
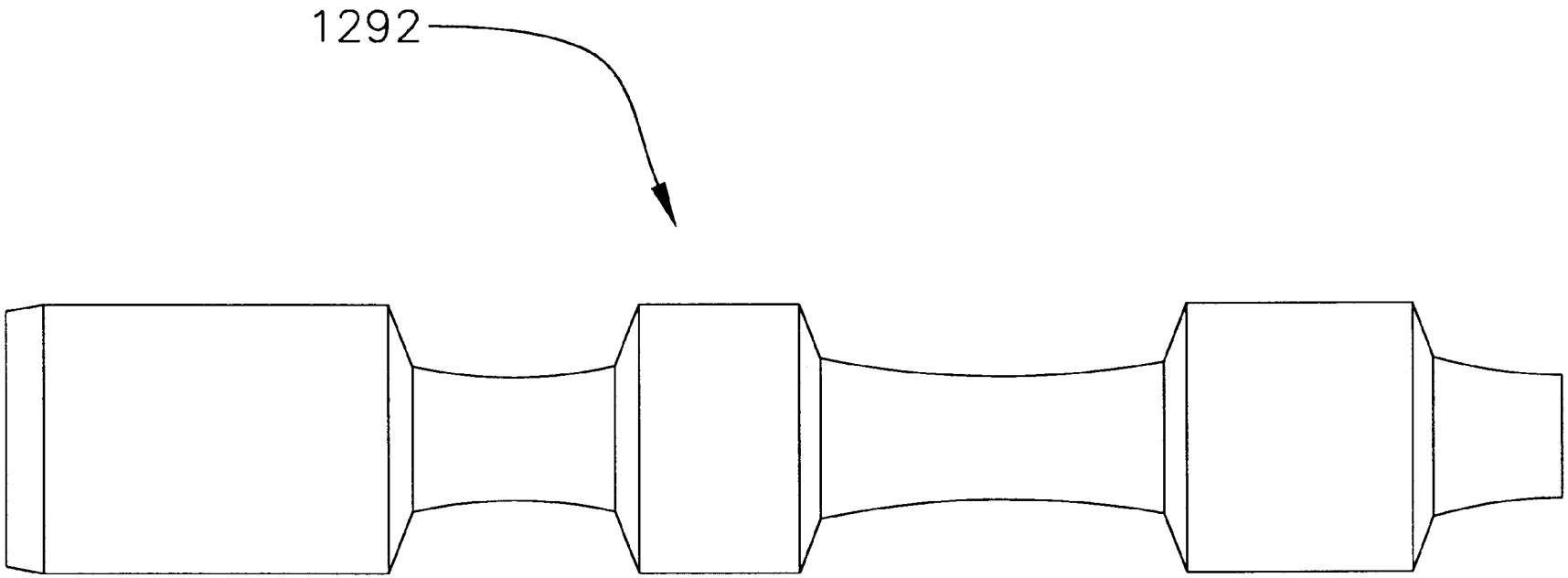
FIG. 61 is a side view of the failsafe valve spool of FIG. 60.
Figure 62:
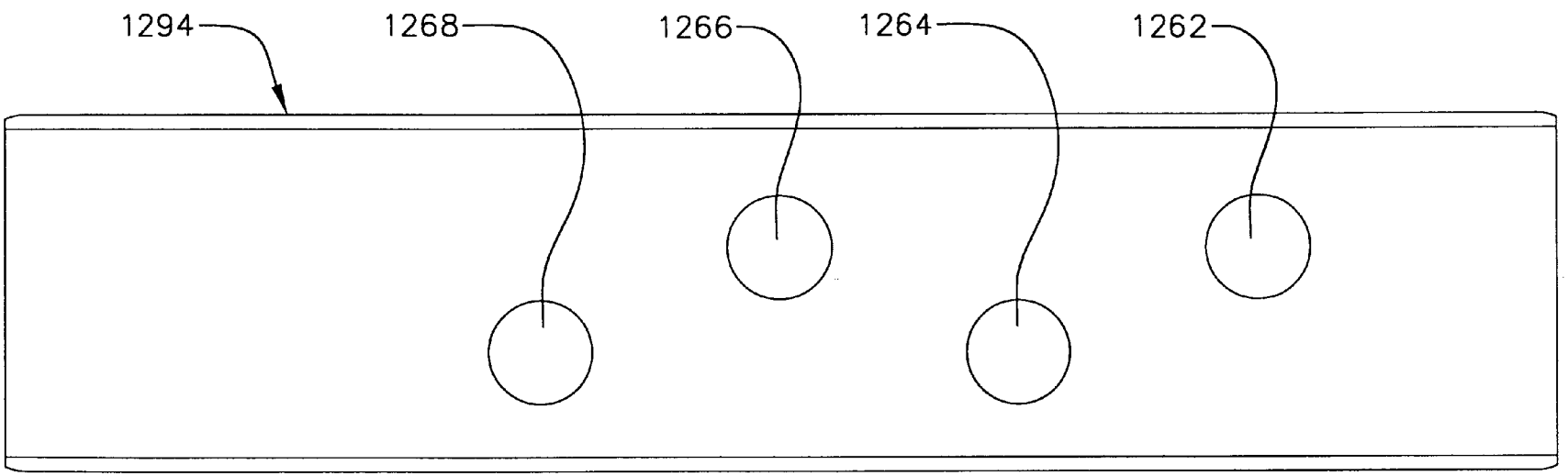
FIG. 62 is a bottom view of the failsafe valve body.

One embodiment of diffuser 1148 is shown in FIGS. 58 and 59. As shown, diffuser 1148 is a cylindrical tube having a flange at its forward end and rearwardly angled holes 1290 in the tube. The majority of the drilling fluid flowing through passage 1202 of forward transition housing 1136 flows through the tube of diffuser 1148 down to the bottom hole assembly. However, some of the fluid flows back uphole through holes 1290 and into passage 1238 which feeds failsafe valve 1150. It is believed that the larger fluid particles will generally not make a reversal in direction, but will be forced downhole by the current. Holes 1290 form an angle of approximately 135° with the flow of fluid, though an angle of at least 110° with the flow of fluid is believed sufficient to reduce blockage. Further, rear angled holes 1290 are sized to restrict the flow of larger fluid particles to valve housing 1134. Preferably, holes 1290 have a diameter of 0.125 inch or less. Those skilled in the art will appreciate that a variety of different types of diffusers or filters may be used, giving due consideration to the goal of preventing larger fluid particles from entering and possibly plugging the valves. Of course, if the valves are configured so that pluggage is not a significant concern, or if the fluid is sufficiently devoid of harmful larger fluid particles, then diffuser 148 may be omitted from the EST.

Referring to FIGS. 60–64, failsafe valve 1150 comprises valve spool 1292 received within valve body 1294. Spool 1292 has segments 1293 of larger diameter. Body 1294 has a central bore 1298 which receives spool 1292, and fluid ports in its lower wall for fluid passages 1262, 1264, 1266, and 1268, described above. The diameter of bore 1298 is such that spool 1292 can be slidably received therein, and so that segments 1293 of spool 1298 can slide against the inner wall of bore 1298 in an effectively fluid-sealing relationship. Central bore 1298 has a slightly enlarged diameter at the axial positions of passages 1264 and 1268. These portions are shown in the figures as regions 1279. Regions 1279 allow entering fluid to move into or out of the valve with less erosion to the valve body or valve spool. Body 294 is sized to fit in a fluid-tight axially slidable manner in failsafe valve recess 1252 in valve housing 1134. Body 1294 has angled end faces 1296 which are compressed between similarly angled portions of valve housing 1134 and forward transition housing 1136 which define the ends of recess 1252. Such compression keeps body 1294 tightly secured to the outer surface of valve housing 1134. Further, a spacer, such as a flat plate, may be provided in recess 1252 between the forward end of valve body 1294 and forward transition housing 1136. The spacer can be sanded to absorb tolerances in construction of such mating parts. In an EST having a diameter of 3.375 inches, ports 1262, 1264, 1266, and 1268 of valve body 1294 have a diameter of preferably 0.1 inches to 0.5 inches, and more preferably of 0.2 inches to 0.25 inches. In the same embodiment, passage 1298 preferably has a diameter of 0.4 inches to 0.5 inches.

Figure 63:
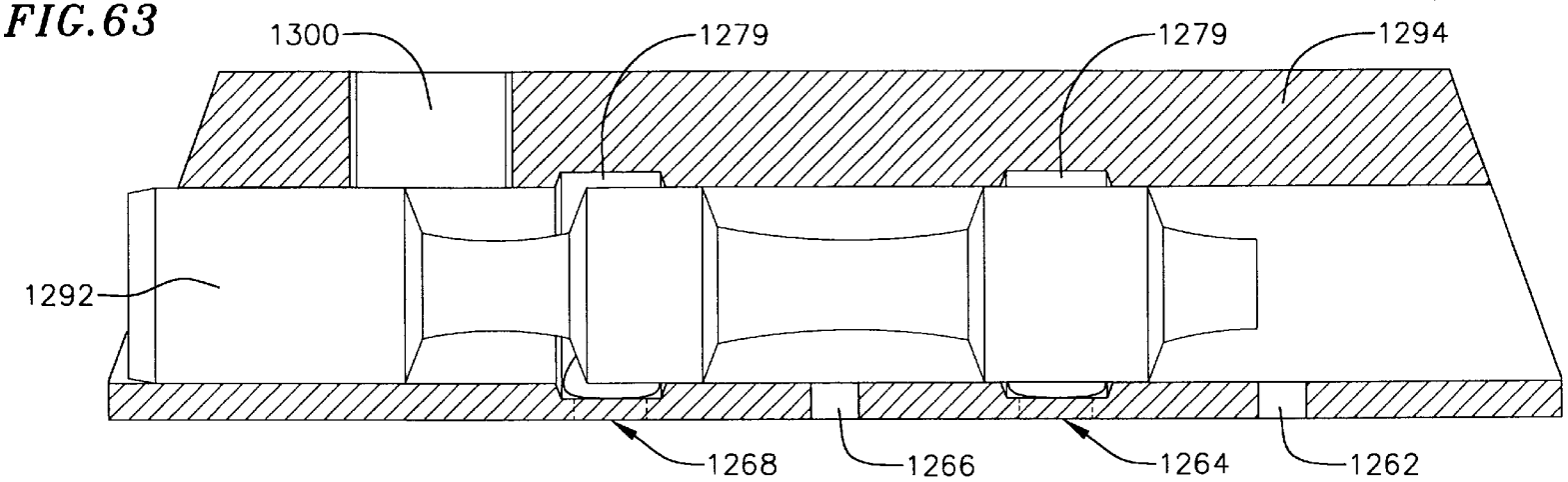
FIG. 63 is a longitudinal sectional view of the failsafe valve in a closed position.
Figure 64:
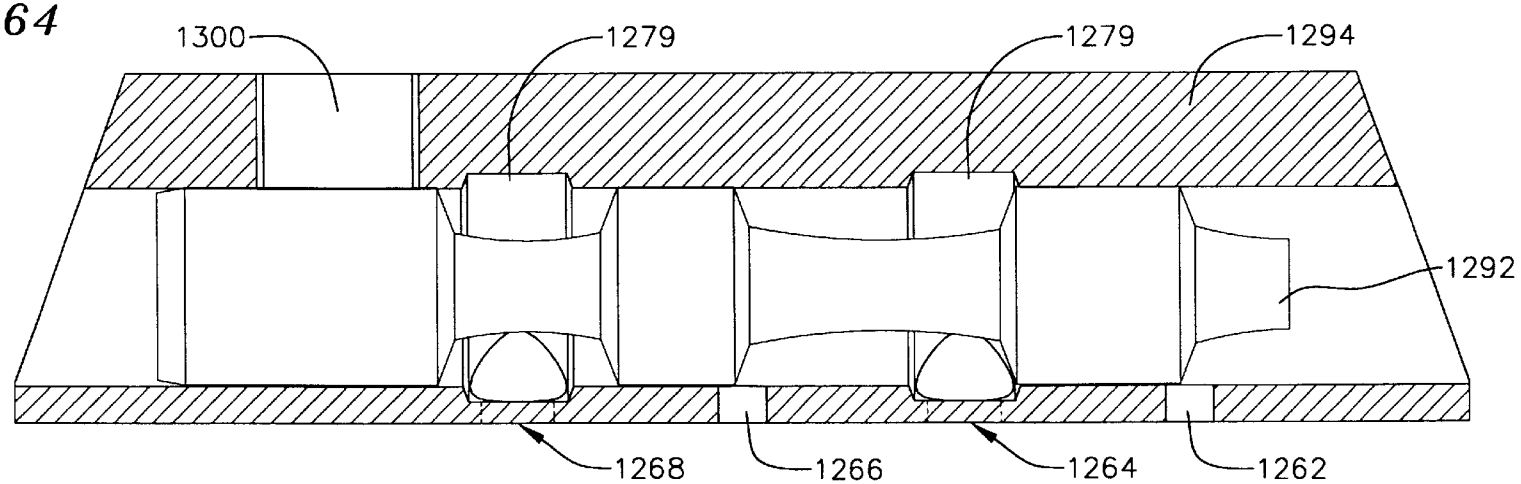
FIG. 64 is a longitudinal sectional view of the failsafe valve in an open position.

Vent 1300 of valve body 1294 permits fluid to be exhausted from passage 1298 to annulus 40. The ports of valve body 1294 fluidly communicate with one another depending upon the position of spool 1292. FIGS. 63 and 64 are longitudinal sectional views of failsafe valve 1150. Note that ports 1264 and 1268 are shown in phantom because these ports do not lie on the central axis of body 1294. Nevertheless, the positions of ports 1264 and 1268 are indicated in the figures. In a closed position, shown in FIG. 63, spool 1292 permits fluid flow from passage 1268 (which communicates with galley 1155) to vent 1300 (which communicates with annulus 40). In an open position, shown in FIG. 64, spool 1292 permits fluid flow from passages 1264 and 1268 (which communicates with galley 1155) to passages 1262 and 1266 (which communicates with diffuser exit 1238).

As mentioned above, failsafe valve 1150 permits fluid to flow into the galley 1155 of valve unit 96. The desired volume flowrate into galley 1155 depends upon the tractor size and activity to be performed, and is summarized in the table below. The below-listed ranges of values are the flowrates (in gallons per minute) through valve 1150 into galley 1155 for milling, drilling, tripping into an open or cased borehole, for various EST diameters. The flowrate into galley 1155 depends upon the dimensions of the failsafe valve body and ports.

| EST Diameter | Milling | Drilling | Tripping |
|---|---|---|---|
| 2.175 inches | 0.003–1 | 0–6 | 8–100 |
| 3.375 inches | 0.006–1 | 0–12 | 8–200 |
| 4.75 inches | 0.06–3 | 0–25 | 8–350 |
| 6.0 inches | 0.6–10 | 0–55 | 10–550 |

If desired, the stroke length of failsafe valve 1150 may be limited to a ⅛ inch stroke (from its closed to open positions), to minimize the burden on relief valve 1152. The failsafe valve spool's stroke is limited by the compression of spring 1151. For an EST having a diameter of 3.375 inches, this stroke results in a maximum volume flowrate of approximately 12 gallons per minute from diffuser exit 1238 to galley 1155, with an average flowrate of approximately 8 gallons per minute. The volume flowrate capacity of failsafe valve 1150 is preferably significantly more than, and preferably twice, that of propulsion valves 1154 and 1156, to assure sufficient flow to operate the tool.

In the illustrated embodiment, propulsion valves 1156 and 1158 are identical, and packerfoot valve 1154 is structurally similar. In particular, as shown in FIGS. 50–55, the locations of the fluid ports of packerfoot valve 1154 are slightly different from those of propulsion valves 1156 and 1158, due to space limitations which limit the positioning of the internal fluid passages of valve housing 1134. However, it will be understood that packerfoot valve 1154 operates in a substantially similar manner to those of propulsion valves 1156 and 1158. Thus, only aft propulsion valve 1156 need be described in detail herein.

Figures 65, 66:
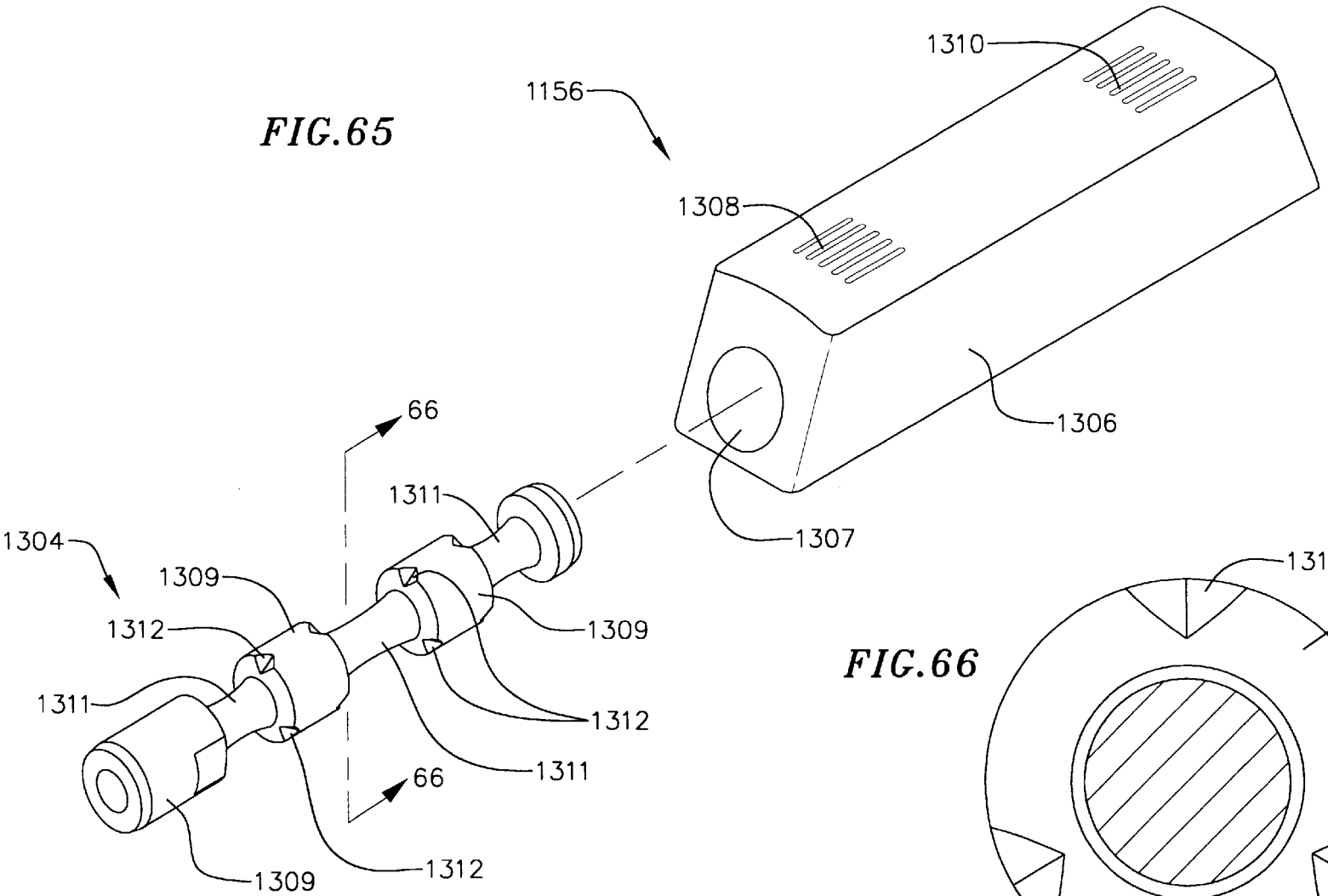
FIG. 65 is a rear perspective view of the aft propulsion valve spool and aft propulsion valve body of the EST.
FIG. 66 is a cross-sectional view of the aft propulsion valve spool, taken along line 66—66 of FIG. 65.

FIGS. 63–69 show aft propulsion valve 1156, which is configured substantially similarly to failsafe valve 1150. Valve 1156 is a 4-way valve comprising spool 1304 and valve body 1306. Spool 1304 has larger diameter segments 1309 and smaller diameter segments 1311. As shown in FIG. 66, segments 1309 include one or more notches 1312 which permit a variable flow restriction between the various flow ports in valve body 1306. Valve body 1306 has a configuration similar to that of failsafe valve body 1294, with the exception that body 1306 has three ports in its lower wall for fluid passages 1276, 1278, and 1280, described above, and two vents 1308 and 1310 which fluidly communicate with annulus 40. A central bore 1307 has a diameter configured to receive spool 1304 so that segments 1309 slide along the inner wall of bore 1307 in an effectively fluid-sealing relationship. Since the positions of the notches 1312 along the circumference of the segments 1309 may or may not be adjacent to the fluid ports in the valve body, bore 1307 preferably has a slightly enlarged diameter at the axial positions of passages 1276 and 1280, so that the ports can communicate with all of the notches. That is, the inner radial surface of the valve body 1306 defining bore 1307 has a larger diameter than the other inner radial surfaces constraining the path of movement of segments 1309 of spool 1304. These enlarged diameter portions are shown in the figures as regions 1279. Valve body 1306 is sized to fit tightly in aft propulsion valve recess 1256 in valve housing 1134. A spacer may also be provided as described above in connection with failsafe valve body 1294.

Figure 67:
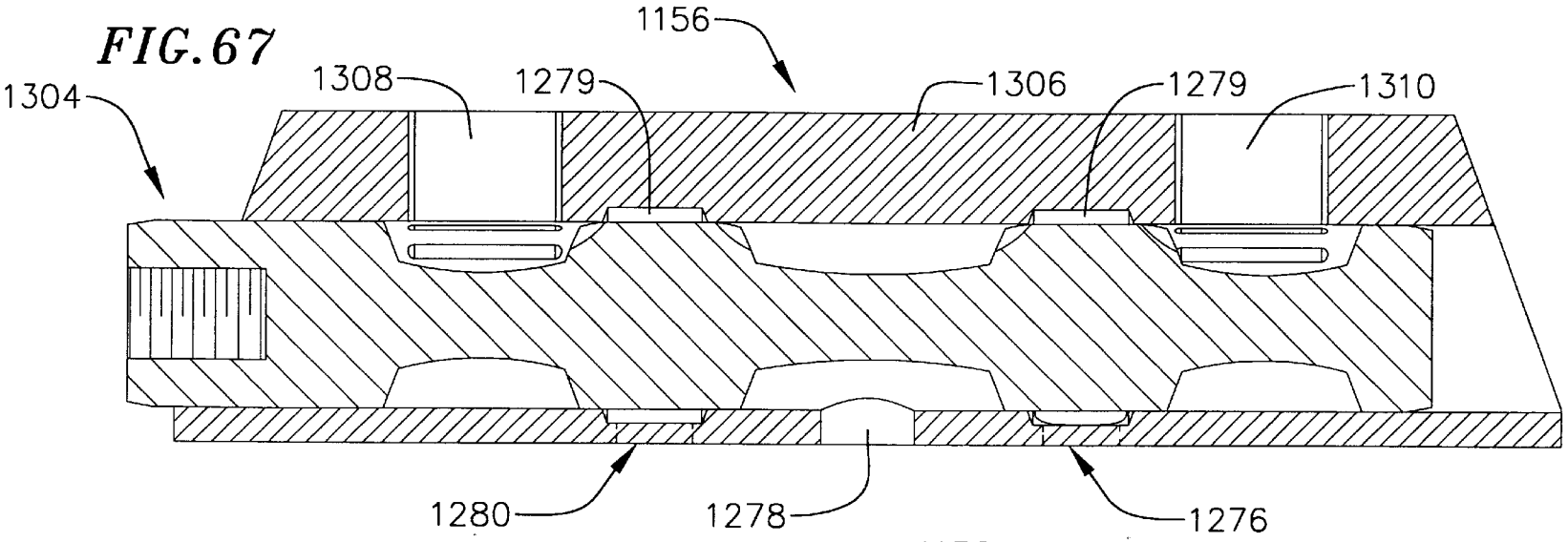
FIG. 67 is a longitudinal sectional view of the aft propulsion valve in a closed position.
Figure 68:
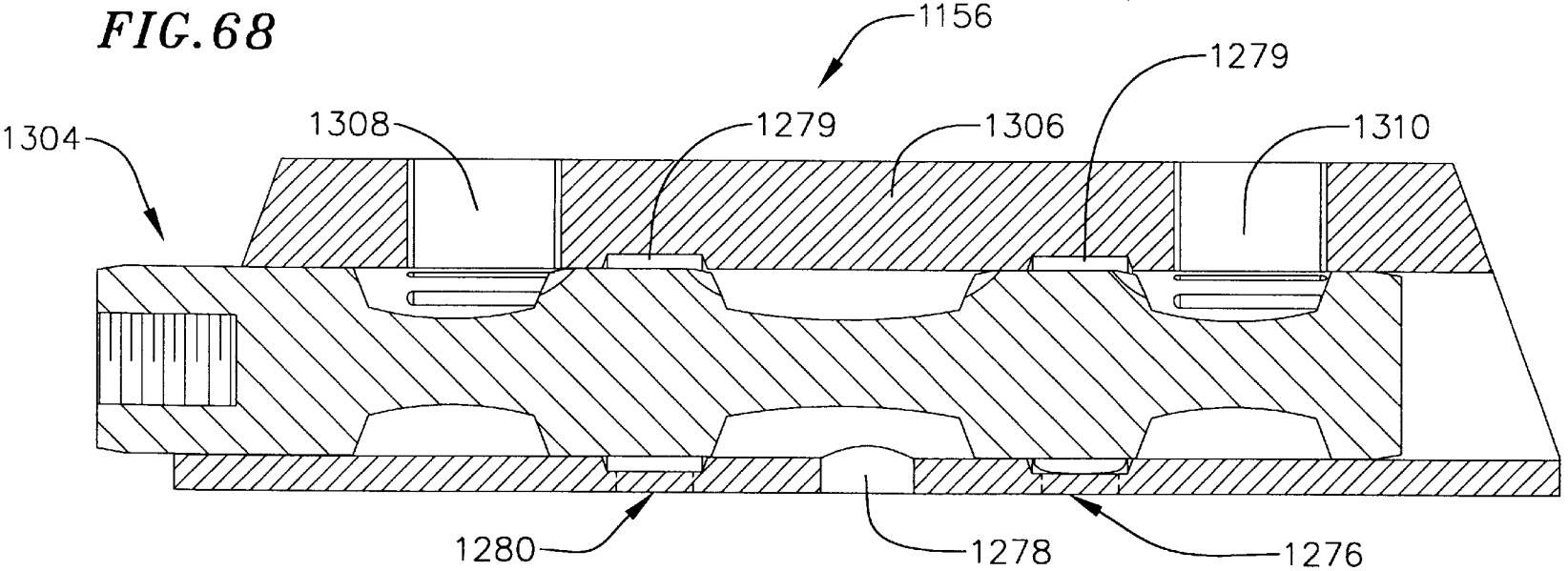
FIG. 68 is a longitudinal sectional view of the aft propulsion valve in a first open position.
Figure 69:
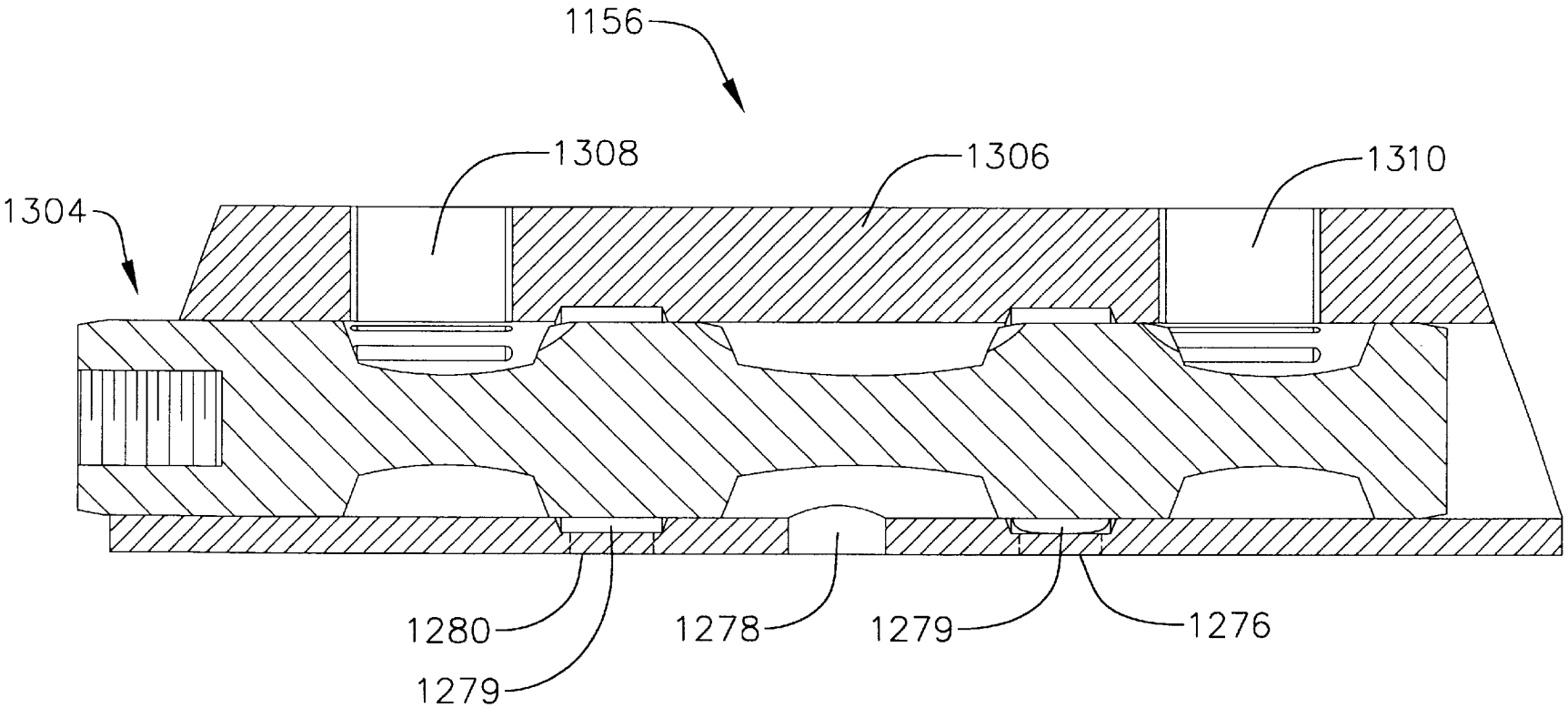
FIG. 69 is a longitudinal sectional view of the aft propulsion valve in a second open position.

FIGS. 67–69 are longitudinal sectional views of the aft propulsion valve 1156. Note that ports 1276 and 1280 are shown in phantom because these ports do not lie on the central axis of valve body 1306. Nevertheless, the positions of ports 1276 and 1280 are indicated in the figures. The ports of body 1306 fluidly communicate with one another depending upon the axial position of spool 1304. In a closed position of aft propulsion valve 1156, shown in FIG. 40, spool 1304 completely restricts fluid flow to and from the aft propulsion cylinders. In another position, shown in FIG. 68, spool 1304 permits fluid flow from passage 1278 (which communicates with galley 1155) to passage 1280 (which communicates with rear chambers 1166 and 1170 of aft propulsion cylinders 1108 and 1110), and from passage 1276 (which communicates with front chambers 1168 and 1172 of cylinders 1108 and 1110) to vent 1310 (which communicates with annulus 40). In this position, valve 1156 supplies hydraulic power for a forward thrust stroke of the aft propulsion cylinders, during which fluid is supplied to rear chambers 1166 and 1170 and exhausted from front chambers 1168 and 1172. In another position, shown in FIG. 69, spool 1304 permits fluid flow from passage 1278 (which communicates with galley 1155) to passage 1276 (which communicates with front chambers 1168 and 1172), and from passage 1280 (which communicates with rear chambers 1166 and 1170) to vent 1308 (which communicates with annulus 40). In this position, valve 1156 supplies hydraulic power for a reset stroke of the aft propulsion cylinders, during which fluid is supplied to front chambers 1168 and 1172 and exhausted from rear chambers 1166 and 1170.

It will be appreciated that the volume flowrate of drilling fluid into aft propulsion cylinders 1108 and 1110 can be precisely controlled by controlling the axial position of valve spool 1304 within valve body 1306. The volume flowrate of fluid through any given fluid port of body 1306 depends upon the extent to which a large diameter segment 1309 of spool 1304 blocks the port.

Figure 70B:
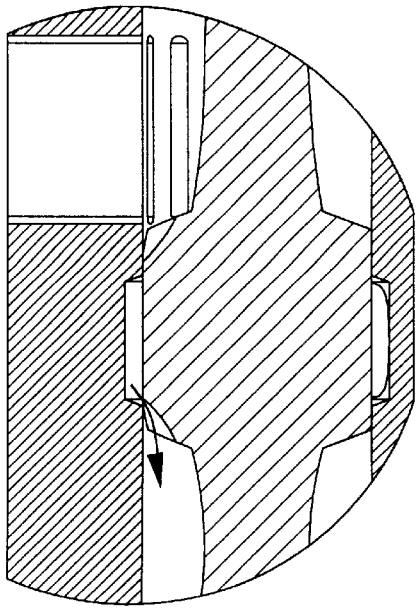
FIGS. 70A–C are exploded longitudinal sectional views of the aft propulsion valve, illustrating different flow-restricting positions of the valve spool.
Figure 70C:
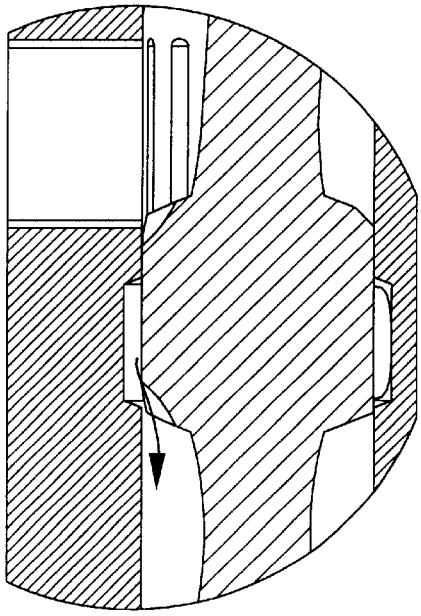
Figure 70A:
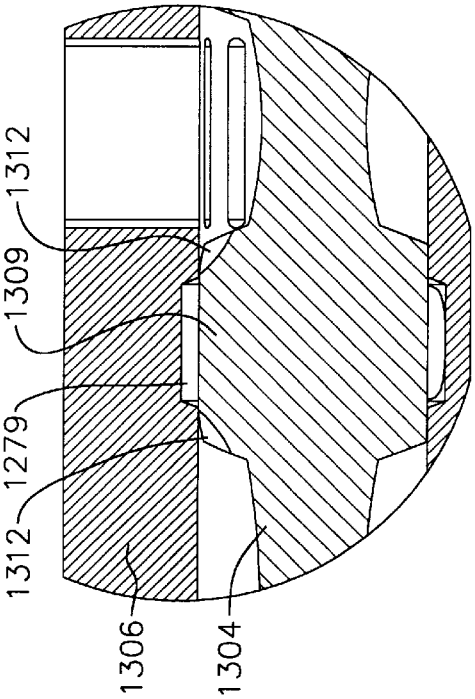

FIGS. 70A–C illustrate this concept. FIG. 70A shows the spool 1304 having a position such that a segment 1309 completely blocks a fluid port of body 1306. In this position, there is no flow through the port. As spool 1304 slides a certain distance in one direction, as shown in FIG. 70B, some fluid flow is permitted through the port via the notches 1312. In other words, segment 1309 permits fluid flow through the port only through the notches. This means that all of the fluid passing through the port passes through the regions defined by notches 1312. The volume flowrate through the port is relatively small in this position, due to the small opening through the notches. In general, the flowrate depends upon the shape, dimensions, and number of the notches 1312. Notches 1312 preferably have a decreasing depth and width as they extend toward the center of the length of the segment 1309. This permits the flow restriction, and hence the volume flowrate, to be very finely regulated as a function of the spool's axial position.

In FIG. 70C, spool 1304 is moved further so that the fluid is free to flow past segment 1309 without necessarily flowing through the notches 1312. In other words, segment 1309 permits fluid flow through the port at least partially outside of the notches. This means that some of the fluid passing through the port does not flow through the regions defined by notches 1312. In this position the flow restriction is significantly decreased, resulting in a greater flowrate through the port. Thus, the valve configuration of the EST permits more precise control over the fluid flowrate to the annular pistons in the propulsion cylinders, and hence the speed and thrust of the tractor.

Figure 105:
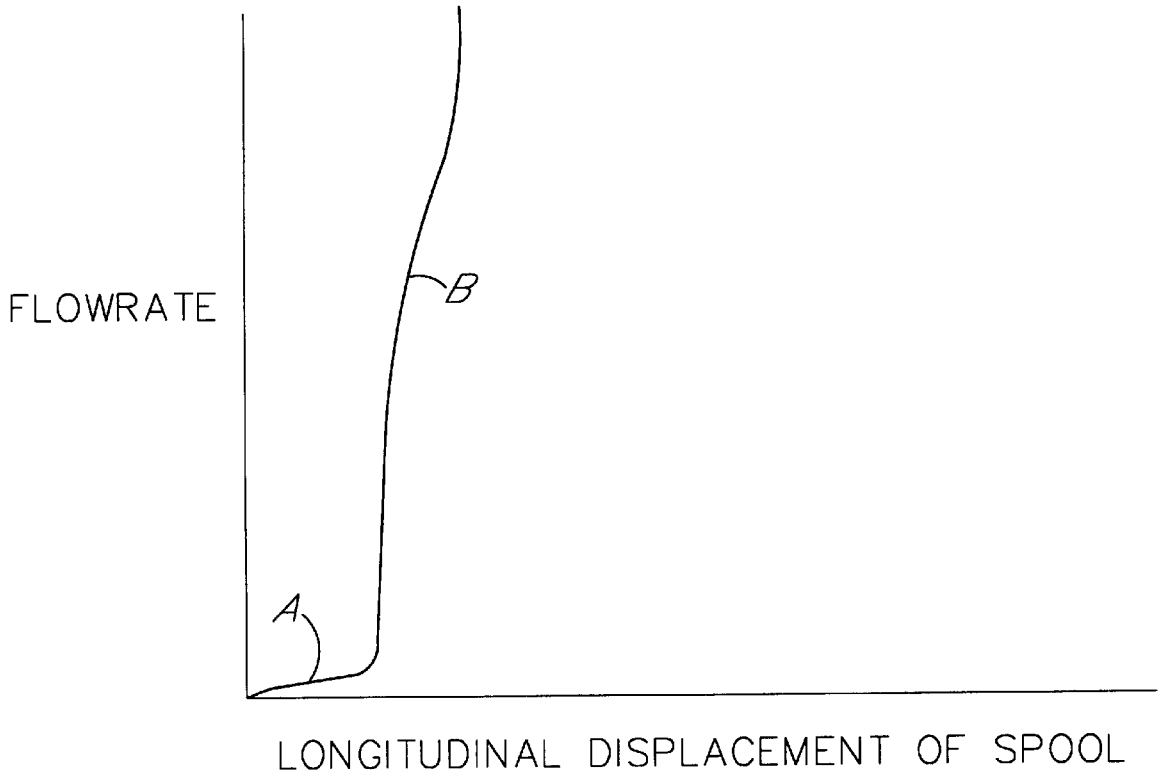
FIG. 105 is a graph illustrating the relationship between longitudinal displacement of a propulsion valve spool of the EST and flowrate of fluid admitted to the propulsion cylinder.

FIG. 105 graphically illustrates how the fluid flowrate to either the rear or front chambers of the propulsion cylinders varies as a function of the axial displacement of the propulsion valve spool. Section A of the curve corresponds to the valve position shown in FIG. 70B, i.e., when the fluid flows only through the notches 1312. Section B corresponds to the valve position shown in FIG. 70C, i.e., when the fluid is free to flow past the edge of the large diameter segment 1309 of the spool. As shown, the flowrate gradually increases in Section A and then increases much more substantially in Section B. Thus, Section A is a region which corresponds to fine-tuned control over speed, thrust, and position of the EST.

Valve spool 1304 preferably includes at least two, advantageously between two and eight, and more preferably three, notches 1312 on the edges of the large diameter segments 1309. As shown in FIG. 106, each notch 106 has an axial length L extending inward from the edge of the segment 1309, a width W at the edge of the segment 1309, and depth D. For an EST having a diameter of 3.375 inches, L is preferably about 0.055–0.070 inches, W is preferably about 0.115–0.150 inches, and D is preferably about 0.058–0.070 inches. For larger sized ESTs, the notch sizes are preferably larger, and/or more notches are provided, so as to produce larger flowrates through the notches. The notch size significantly affects the ability for continuous flow of fluid into the pistons, and hence continuous motion of the tractor at low speeds. In fact, the notches allow significantly improved control over the tractor at low speeds, compared to the prior art. However, some drilling fluids (especially barite muds) have a tendency to stop flowing at low flow rates and bridge shut small channels such as those in these valves. Greater volume of the notches allows more mud to flow before bridging occurs, but also results in less control at lower speeds. As an alternative means of controlling the tractor at very low speeds, the spool can be opened for a specified interval, then closed and reopened in a "dithering" motion, producing nearly continuous low speed of the tractor.

The valve spools can also have alternative configurations. For example, the segments 1309 may have a single region of smaller diameter at their axial ends, to provide an annular flow conduit for the drilling fluid. In other embodiments, the spools stroke length of the propulsion valve spools is preferably limited so that the maximum volume flowrate into the propulsion cylinders is approximately 0–9 gallons per minute. Preferably, the maximum stroke length from the closed position shown in FIG. 67 is 0.25 inches.

Figure 71A:
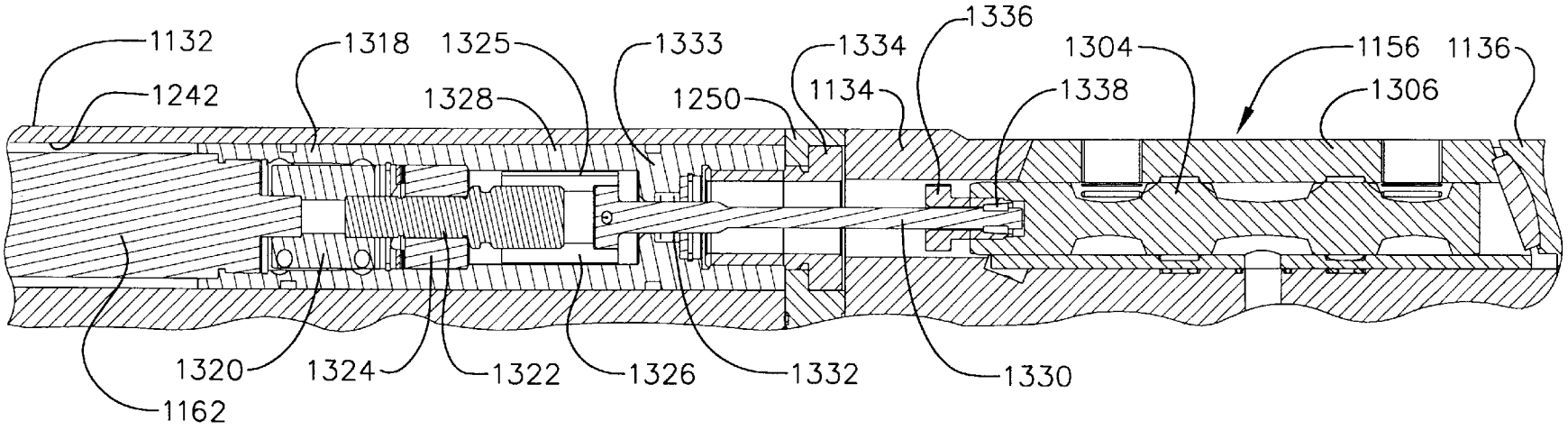
FIG. 71A is a longitudinal partially sectional view of the EST, showing the leadscrew assembly for the aft propulsion valve.

As mentioned above, packerfoot valve 1154 and aft and forward propulsion valves 1156 and 1158 are controlled by motors. In a preferred embodiment, the structural configuration which permits the motors to communicate with the valves is similar for each motorized valve. Thus, only that of aft propulsion valve 1156 is described herein. FIGS. 71A and B illustrate the structural configuration of the EST which permits aft propulsion motor 1162 to control valve 1156. This configuration transforms torque output from the motor into axial translation of valve spool 1304. Motor 1162 is cylindrical and is secured within a tubular leadscrew housing 1318. Motor 1162 and leadscrew housing 1318 reside in bore 1242 of motor housing 1132. The forward end of leadscrew housing 1318 is retained in abutment with motor mount plate 1250 via a retaining bolt 1334 which extends through mount plate 1250 and is threadingly engaged with the internal surface of housing 1318.

Inside leadscrew housing 1318, motor 1162 is coupled to a leadscrew 1322 via motor coupling 1320, so that torque output from the motor causes leadscrew 1322 to rotate. A bearing 1324 is provided to maintain leadscrew 1322 along the center axis of housing 1318, which is aligned with aft propulsion valve spool 1304 in valve housing 1134. Leadscrew 1322 is threadingly engaged with a leadscrew nut 1326. A longitudinal key 1325 on leadscrew nut 1326 engages a longitudinal slot 1328 in leadscrew housing 1318.

This restricts nut 1326 from rotating with respect to leadscrew housing 1318, thereby causing nut 1326 to rotate along the threads of leadscrew 1322. Thus, rotation of leadscrew 1322 causes axial translation of nut 1326 along leadscrew 1322. A stem 1330 is attached to the forward end of nut 1326. Stem 1330 extends forward through annular restriction 1333, which separates oil in motor housing 1132 from drilling fluid in valve housing 1134. The drilling fluid is sealed from the oil via a tee seal 1332 in restriction 1333. The forward end of stem 1330 is attached to valve spool 1304 via a spool bolt 1336 and split retainer 1338. Stem 1330 is preferably relatively thin and flexible so that it can compensate for any misalignment between the stem and the valve spool.

Figure 96:
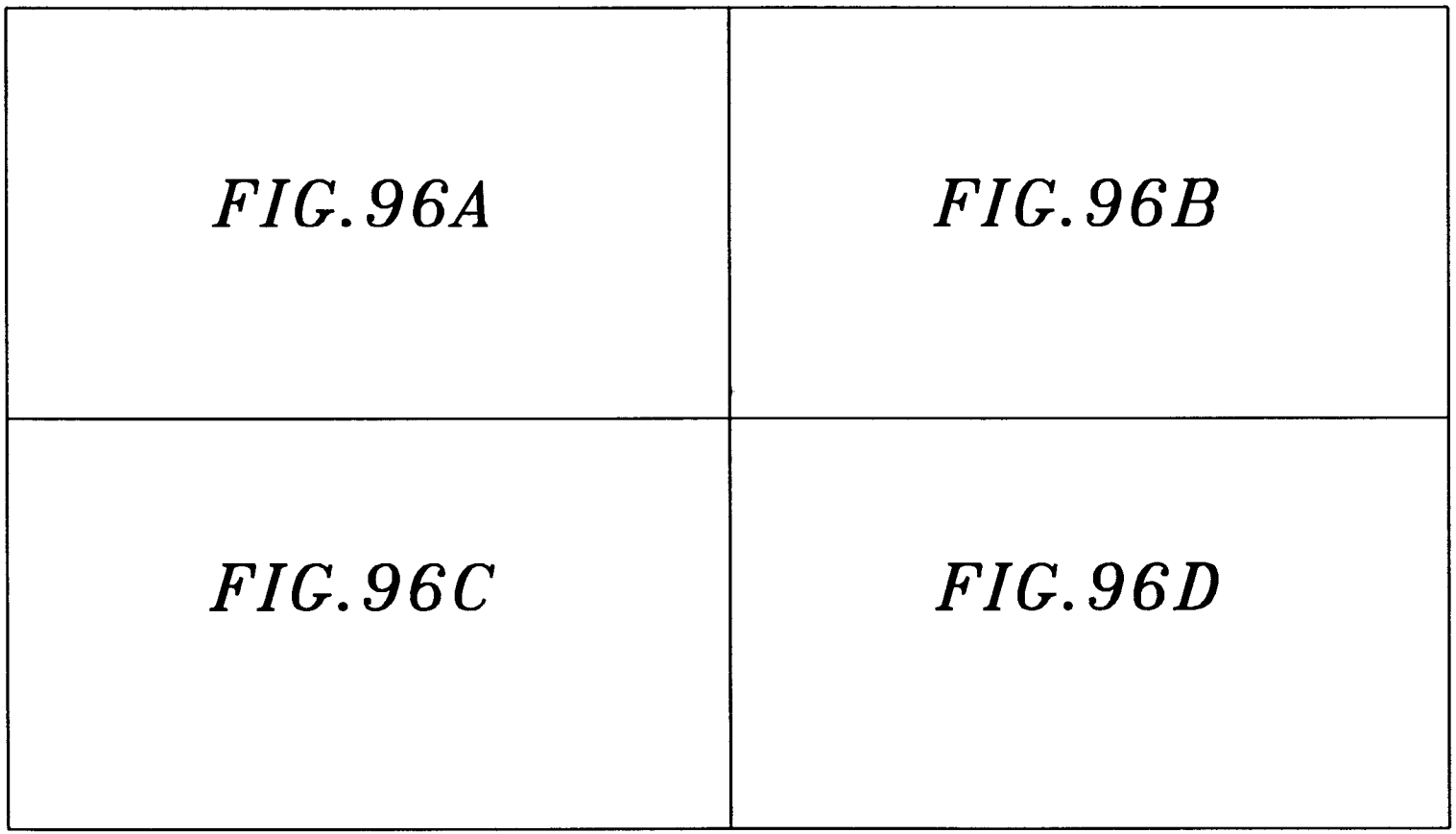
FIG. 96 schematically illustrates the relationship of FIGS. 96A–D.
Figure 96A:
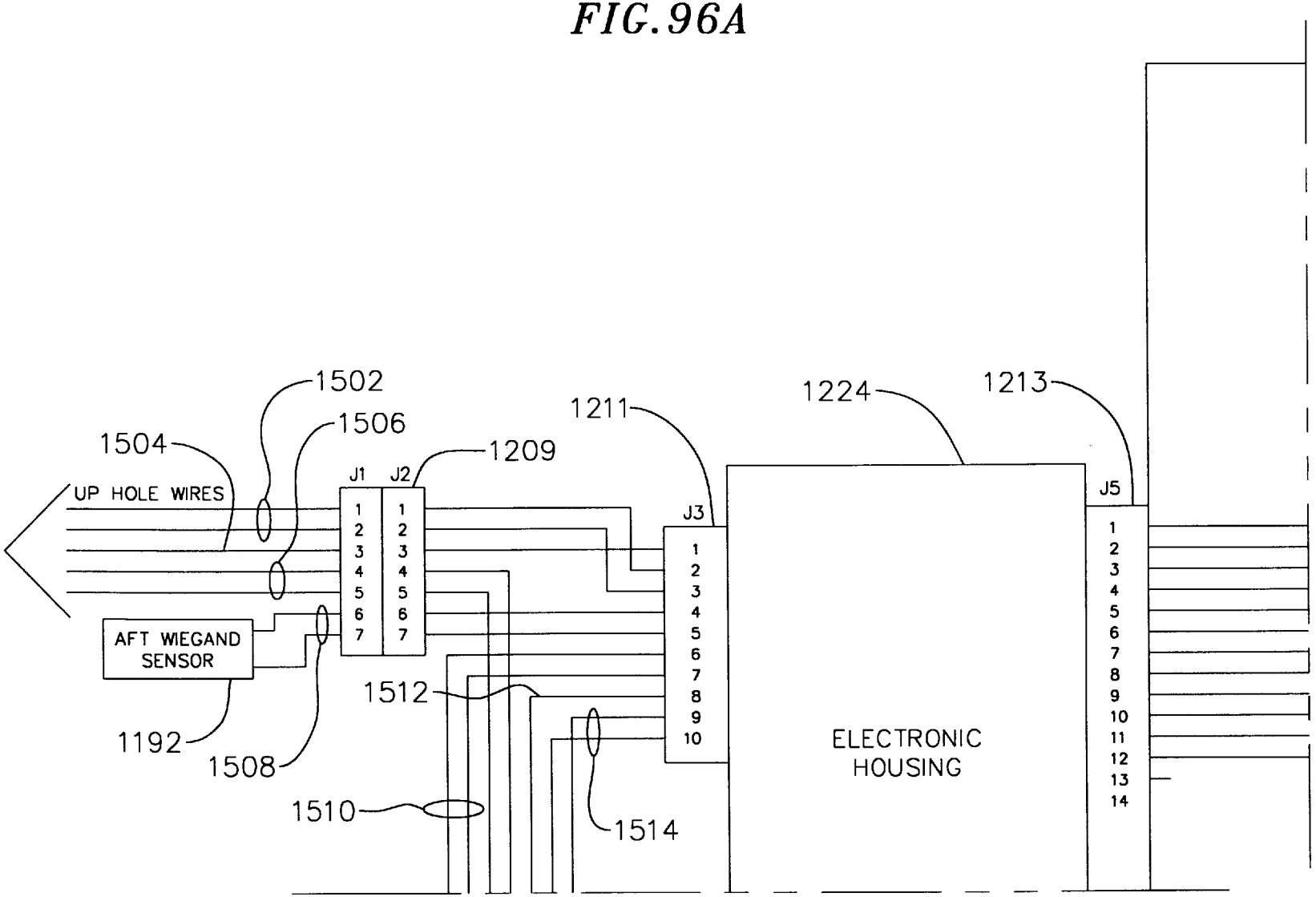
FIGS. 96A–D are a schematic diagram of one embodiment of the electronic configuration of the EST.
Figure 96B:
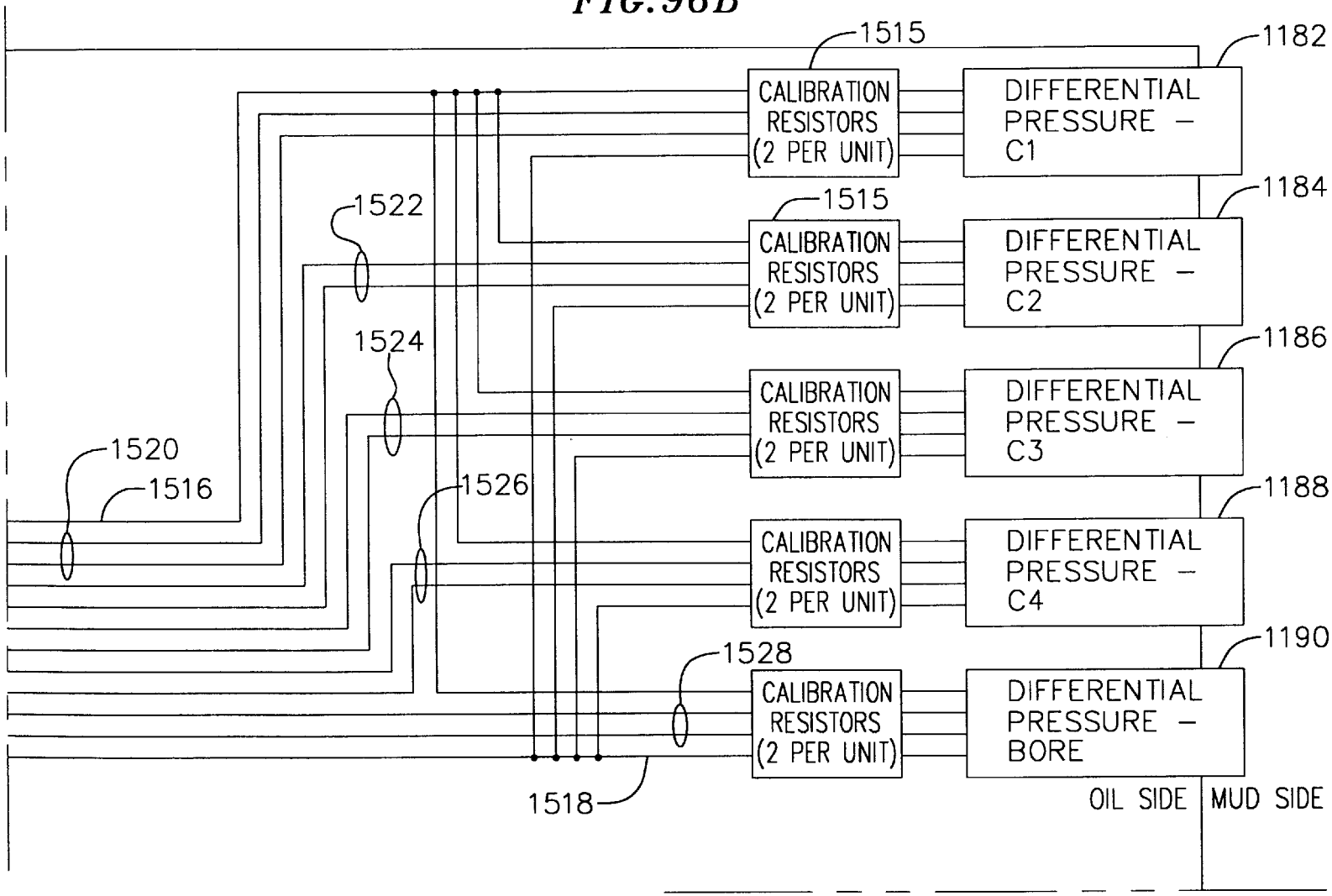
Figure 96C:
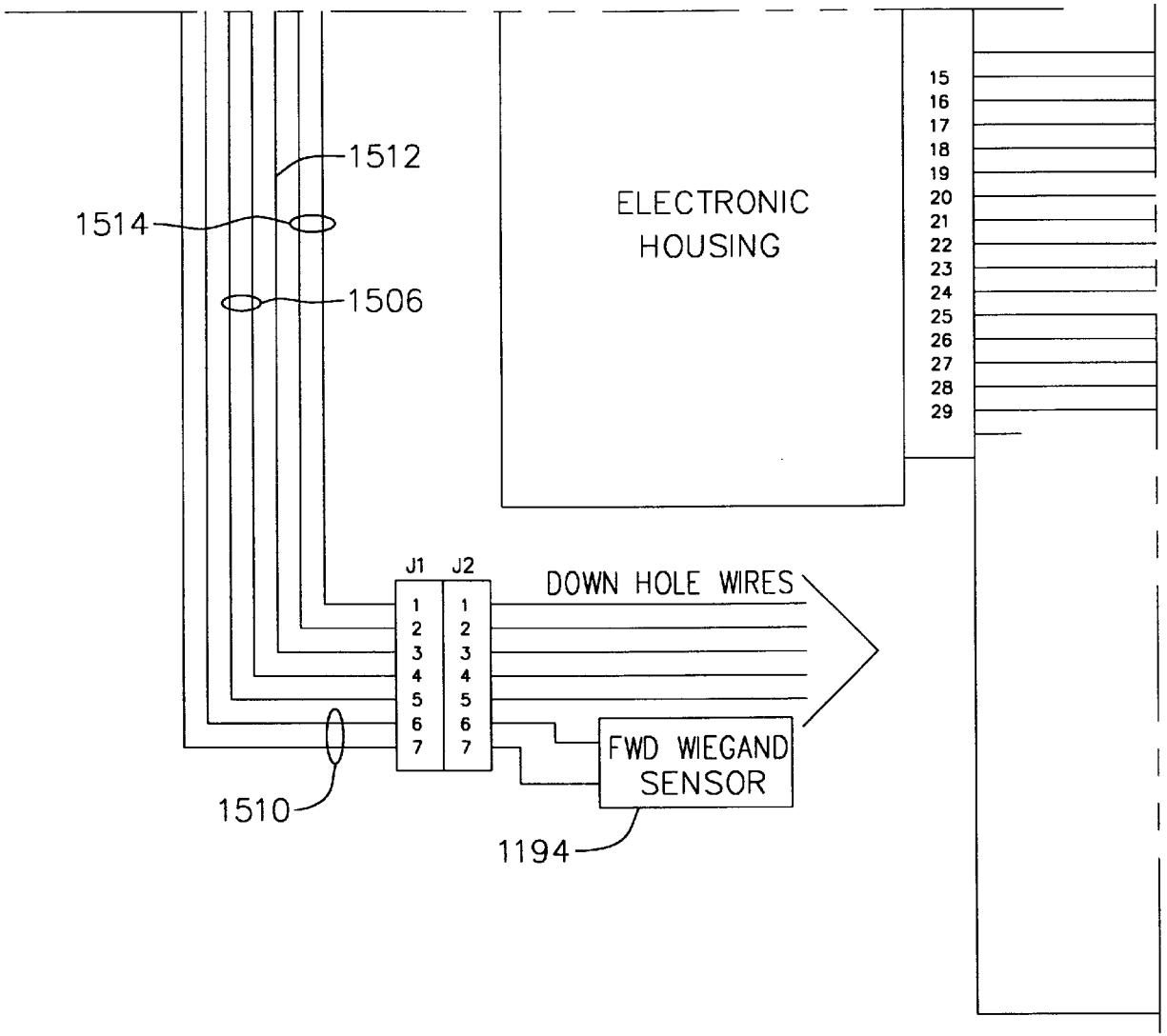
Figure 96D:
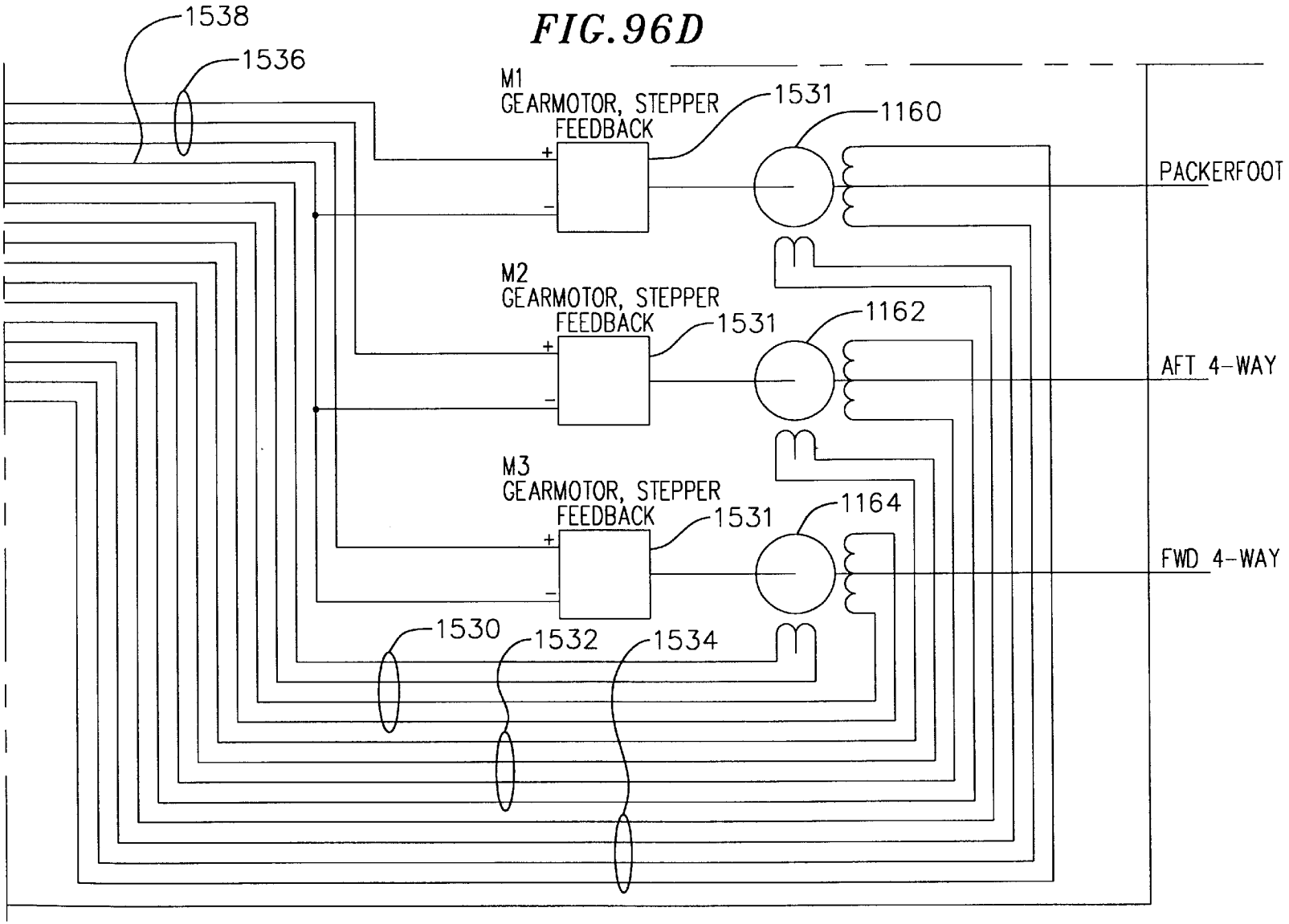

Thus, it can be seen that torque output from the motors is converted into axial translation of the valve spools via leadscrew assemblies as described above. The displacement of the valve spools is monitored by constantly measuring the rotation of the motors. Preferably, rotary accelerometers or potentiometers are built into the motor cartridges to measure the rotation of the motors, as known in the art. The electrical signals from the accelerometers or potentiometers can be transmitted back to logic component 1224 via electrical wires 1536 and 1538 (FIG. 96).

Preferably, motors 1160, 1162, and 1164 are stepper motors, which require fewer wires. Advantageously, stepper motors are brushless. If, in contrast, brush-type motors are used, filaments from the breakdown of the metal brushes may render the oil electrically conductive. Importantly, stepper motors can be instructed to rotate a given number of steps, facilitating precise control of the valves. Each motor cartridge may include a gearbox to generate enough torque and angular velocity to turn the leadscrew at the desired rate. The motor gear box assembly should be able to generate desirably at least 5 pounds, more desirably at least 10 pounds, and even more desirably at least 50 pounds of force and angular velocity of at least 75–180 rpm output. The motors are preferably configured to rotate 12 steps for every complete revolution of the motor output shafts. Further, for an EST having a diameter of 3.375 inches, the motor, gear box, and accelerometer assembly desirably has a diameter no greater than 0.875 inches (and preferably 0.75 inches) and a length no longer than 3.05 inches. A suitable motor is product no. DF7-A sold by CD Astro Intercorp, Inc. of Deerfield, Fla.

In order to optimally control the speed and thrust of the EST, it is desirable to know the relationships between the angular positions of the motor shafts and the flowrates through the valves to the propulsion cylinders. Such relationships depend upon the cross-sectional areas of the flow restrictions acting on the fluid flows through the valves, and thus upon the dimensions of the spools, valve bodies, and fluid ports of the valve bodies. Such relationships also depend upon the thread pitch of the leadscrews. In a preferred embodiment, the leadscrews have about 8–32 threads per inch.

Inside motor housing 1132, bores 1240, 1242, and 1244 contain the motors as well as electrical wires extending rearward to electronics unit 92. For optimal performance, these bores are preferably filled with an electrically nonconductive fluid, to reduce the risk of ineffective electrical transmission through the wires. Also, since the pressure of the motor chambers is preferably equalized to the pressure of annulus 40 via a pressure compensation piston (as described below), such fluid preferably has a relatively low compressibility, to minimize the longitudinal travel of the compensation piston. A preferred fluid is oil, since the compressibility of oil is much less than that of air. At the aft end of motor housing 1132, these bores are fluidly open to the space surrounding pressure transducer manifold 1222. Thus, the outer ends of pressure transducers 1182, 184, 186, 188, and 190 are also exposed to oil.

Figure 72:
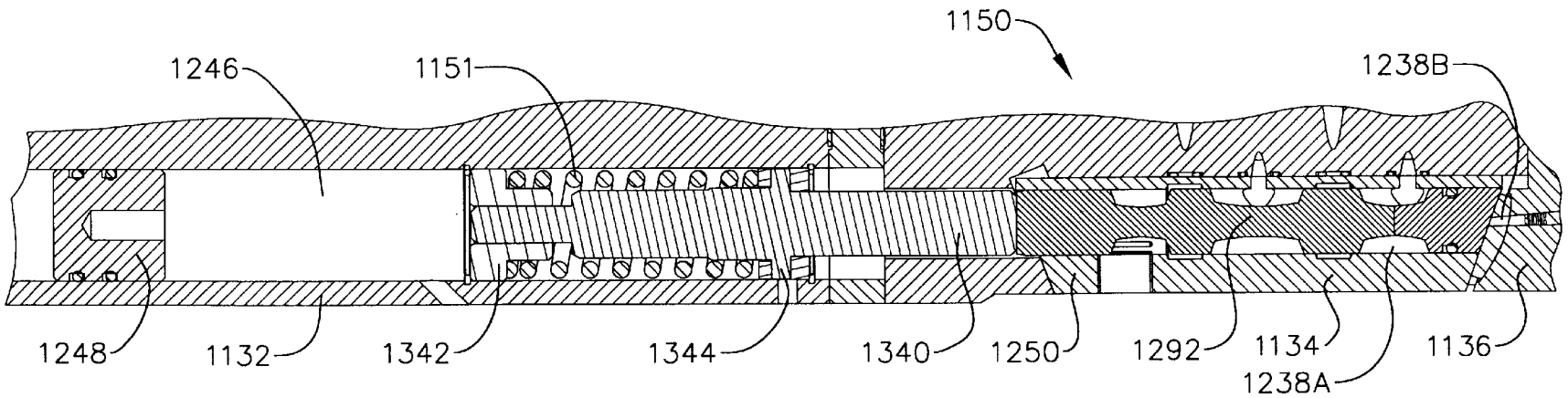
FIG. 72 is a longitudinal partially sectional view of the EST, showing the failsafe valve spring and pressure compensation piston.

FIG. 72 illustrates the assembly and operation of failsafe valve 1150. The aft end of failsafe valve spool 1292 abuts a spring guide 1340 that slides inside passage 1246 within motor housing 1132, motor mount plate 1250, and valve housing 1134. Inside motor housing 1132 passage 1246 has an annular spring stop 1342 which is fixed with respect to housing 1132. Guide 1340 has an annular flange 1344. Failsafe valve spring 1151, preferably a coil spring, resides within passage 1246 so that its ends abut stop 1342 and flange 1344. Fluid within passage 1238A (from the exit of diffuser 1148) exerts an axial force on the forward end of spool 1292, which is countered by spring 1151. As shown, a spacer having a passage 1238B may be provided to absorb tolerances between the mating surfaces of valve housing 1134 and forward transition housing 1136. Passage 1238B fluidly communicates with passage 1238A and with spool passage 1298 of failsafe valve body 1294. When the fluid pressure in passage 1238A exceeds a particular threshold, the spring force is overcome to open failsafe valve 1150 as shown in FIG. 64. Spring 1151 can be carefully chosen to compress at a desired threshold fluid pressure in passage 1238A.

Figure 44:
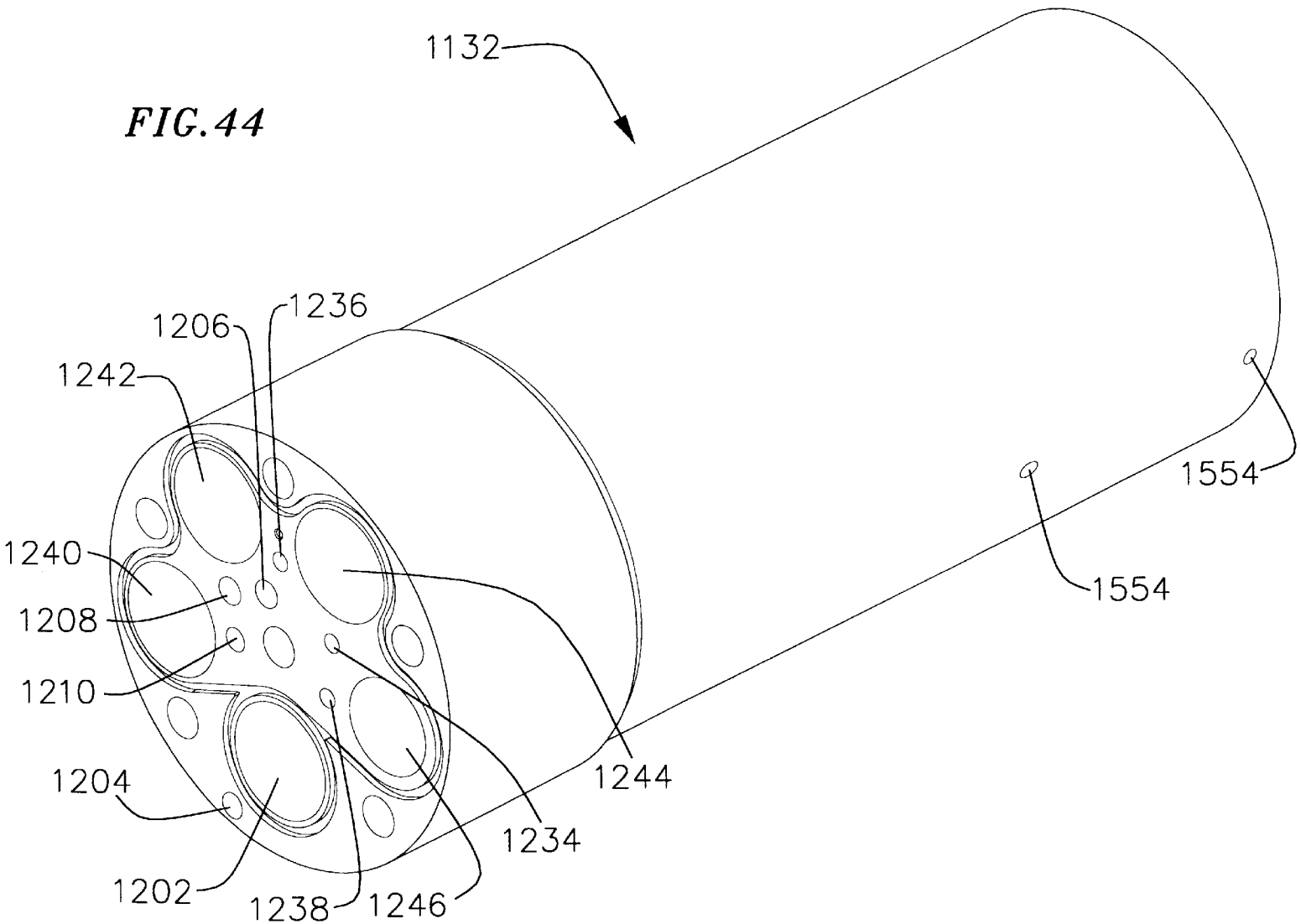
FIG. 44 is a rear perspective view of the motor housing of the EST.
Figure 45:
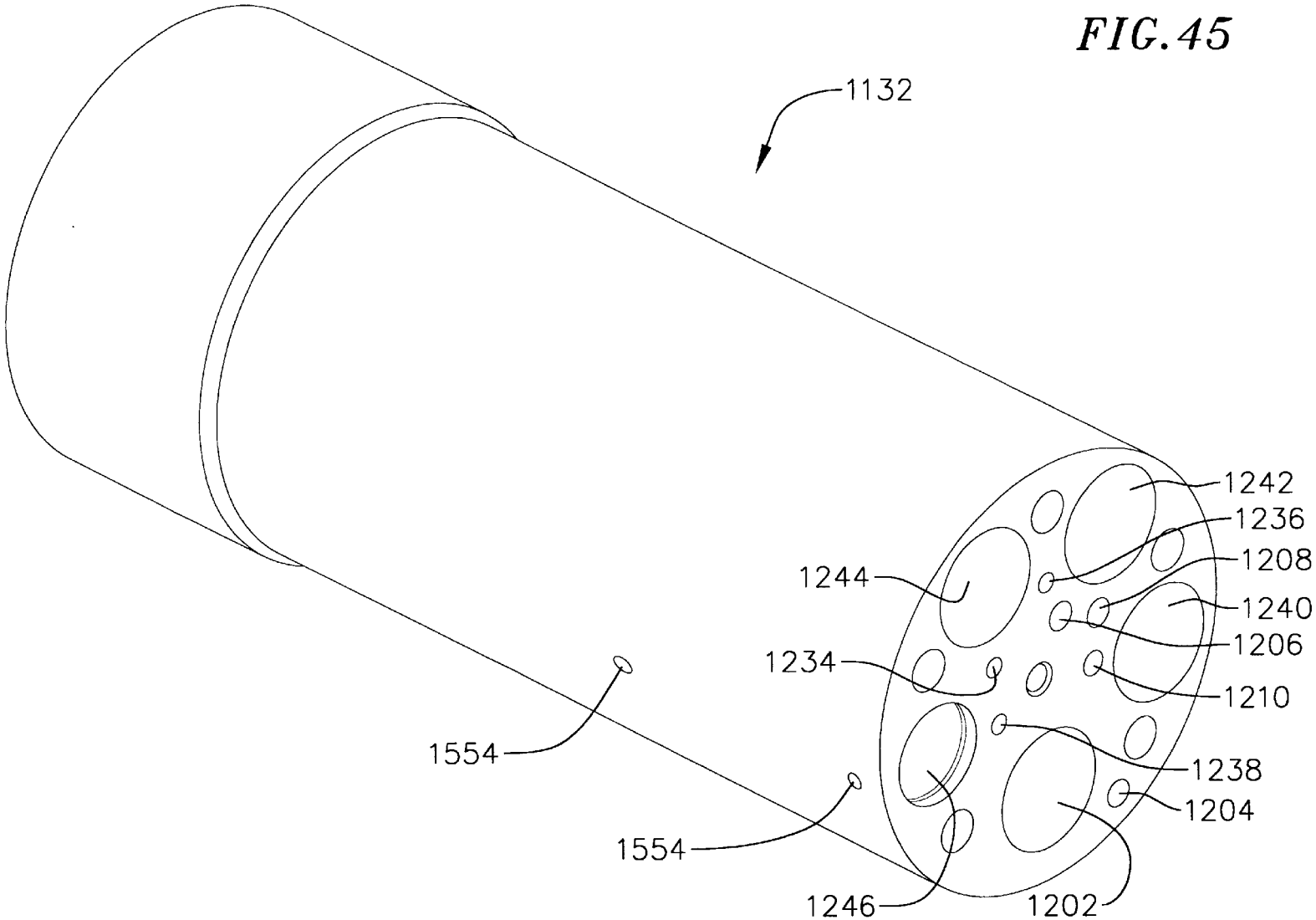
FIG. 45 is a front perspective view of the motor housing of FIG. 44.

When the EST is removed from a borehole, drilling fluid residue is likely to remain within passage 1246 of motor housing 1132. As shown in FIGS. 44–45, a pair of cleaning holes 1554 may be provided which extend into passage 1246. Such holes permit passage 1246 to be cleaned by spraying water through the passage, so that spring 1153 operates properly during use. During use, holes 1554 may be plugged so that the drilling fluid does not escape to annulus 40.

Figure 71B:
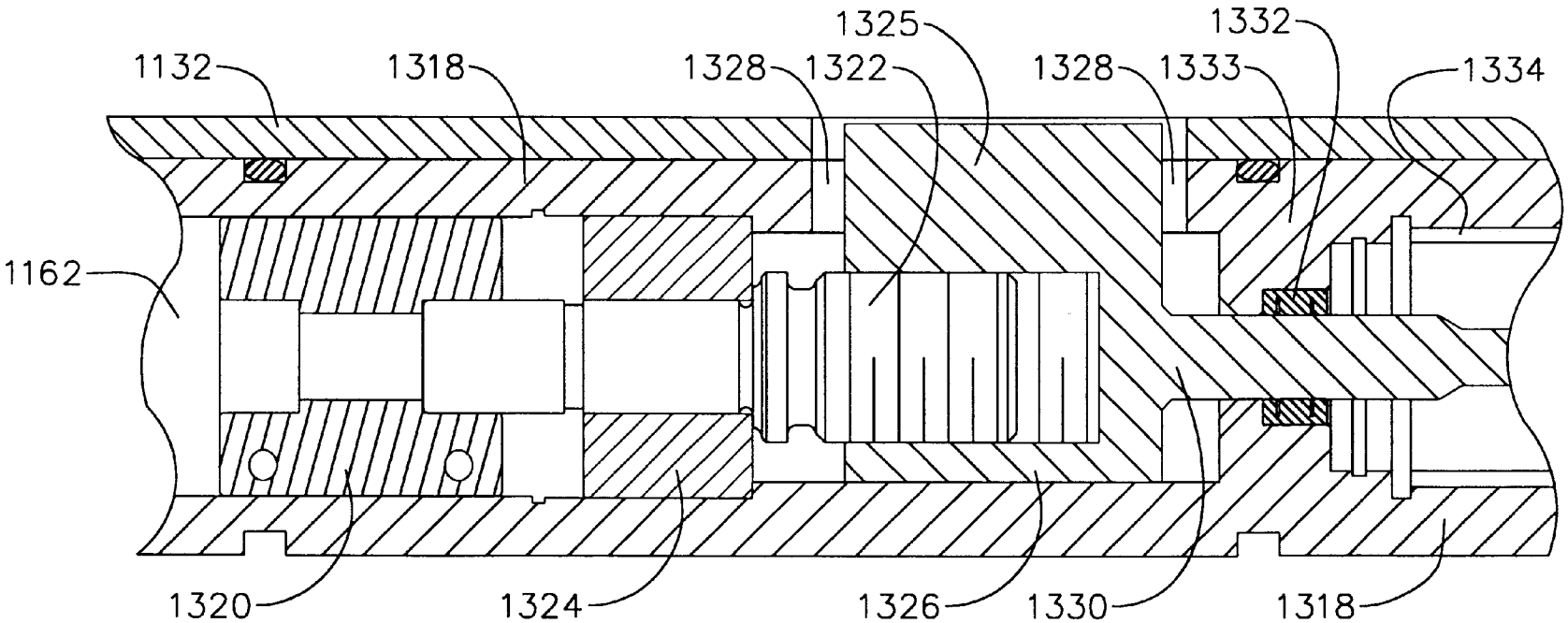
FIG. 71B is an exploded view of the leadscrew assembly of FIG. 71A.

Referring to FIGS. 71A–B, the leadscrew assemblies for the motorized valves contain drilling fluid from annulus 40. Such fluid enters the leadscrew assemblies via the exhaust vents in the valve bodies, and surrounds portions of the valve spools and stems 1330 forward of annular restrictions 1333. As mentioned above, the chambers rearward of restrictions 1333 are filled with oil. In order to move the valve spools, the motors must produce sufficient torque to overcome (1) the pressure difference between the drilling fluid and the oil, and (2) the seal friction caused by tee seals 1332. Since the fluid pressure in annulus 40 can be as high as 16,000 psi, the oil pressure is preferably equalized with the fluid pressure in annulus 40 so that the pressure difference across seals 1332 is zero. Absent such oil pressure compensation, the motors would have to work extremely hard to advance the spools against the high pressure drilling fluid. A significant pressure difference can cause the motors to stall. Further, if the pressure difference across seals 1332 is sufficiently high, the seals would have to be very tight to prevent fluid flow across the seals. However, if the seals were very tight they would hinder and, probably, prevent movement of the stems 1330 and hence the valve spools.

With reference to FIG. 72, a pressure compensation piston 1248 is preferably provided to avoid the above-mentioned problems. Preferably, piston 1248 resides in passage 1246 of motor housing 1132. Piston 1248 seals drilling fluid on its forward end from oil on its aft end, and is configured to slide axially within passage 1246. As the pressure in aimulus 40 increases, piston 1248 slides rearward to equalize the oil pressure with the drilling fluid pressure. Conversely, as the pressure in annulus 40 decreases, piston 1248 slides forward. Advantageously, piston 1248 effectively neutralizes the net longitudinal fluid pressure force acting on each of the valve spools by the drilling fluid and oil. Piston 1248 also creates a zero pressure difference across seals 1332 of the leadscrew assemblies of the valves.

Figure 73:
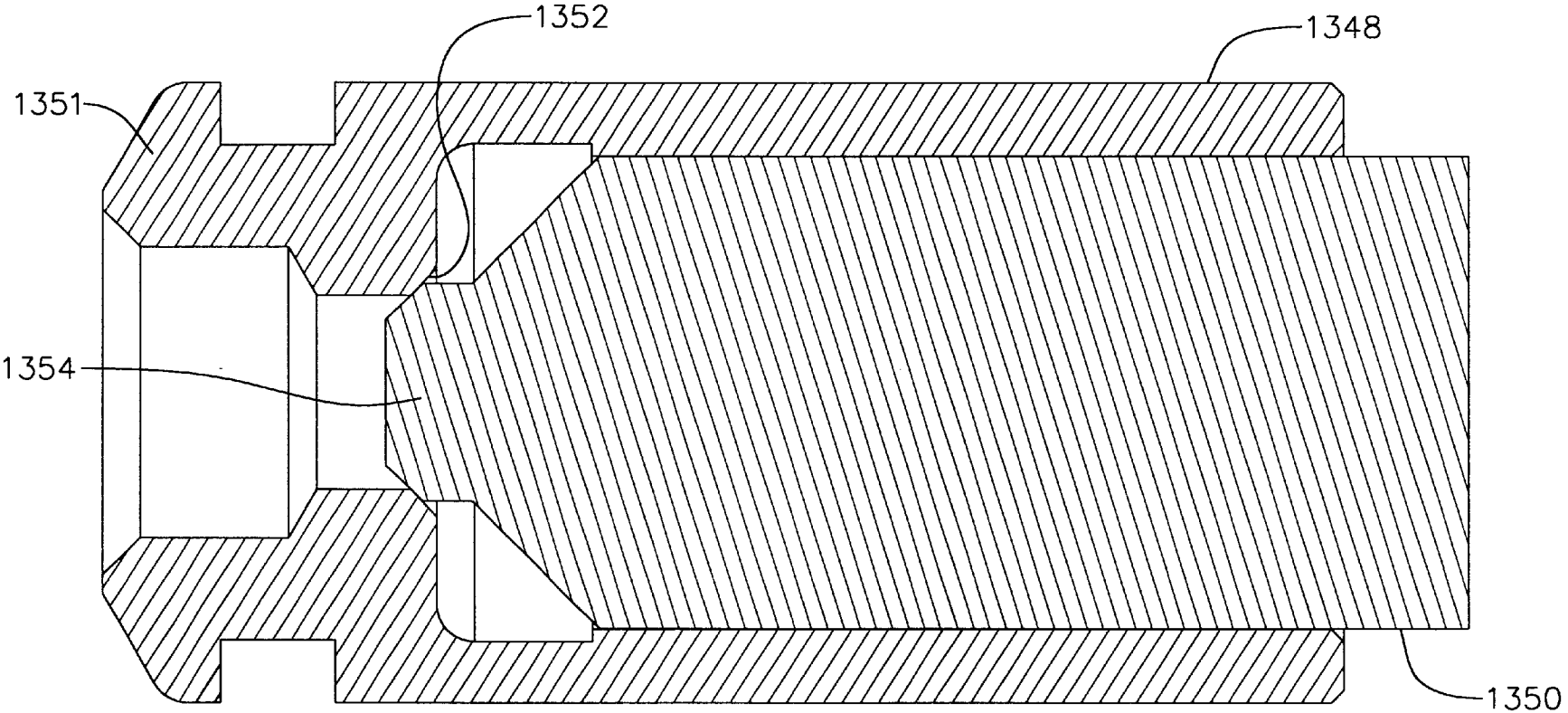
FIG. 73 is a longitudinal sectional view of the relief valve poppet and relief valve body of the EST.
Figure 74:
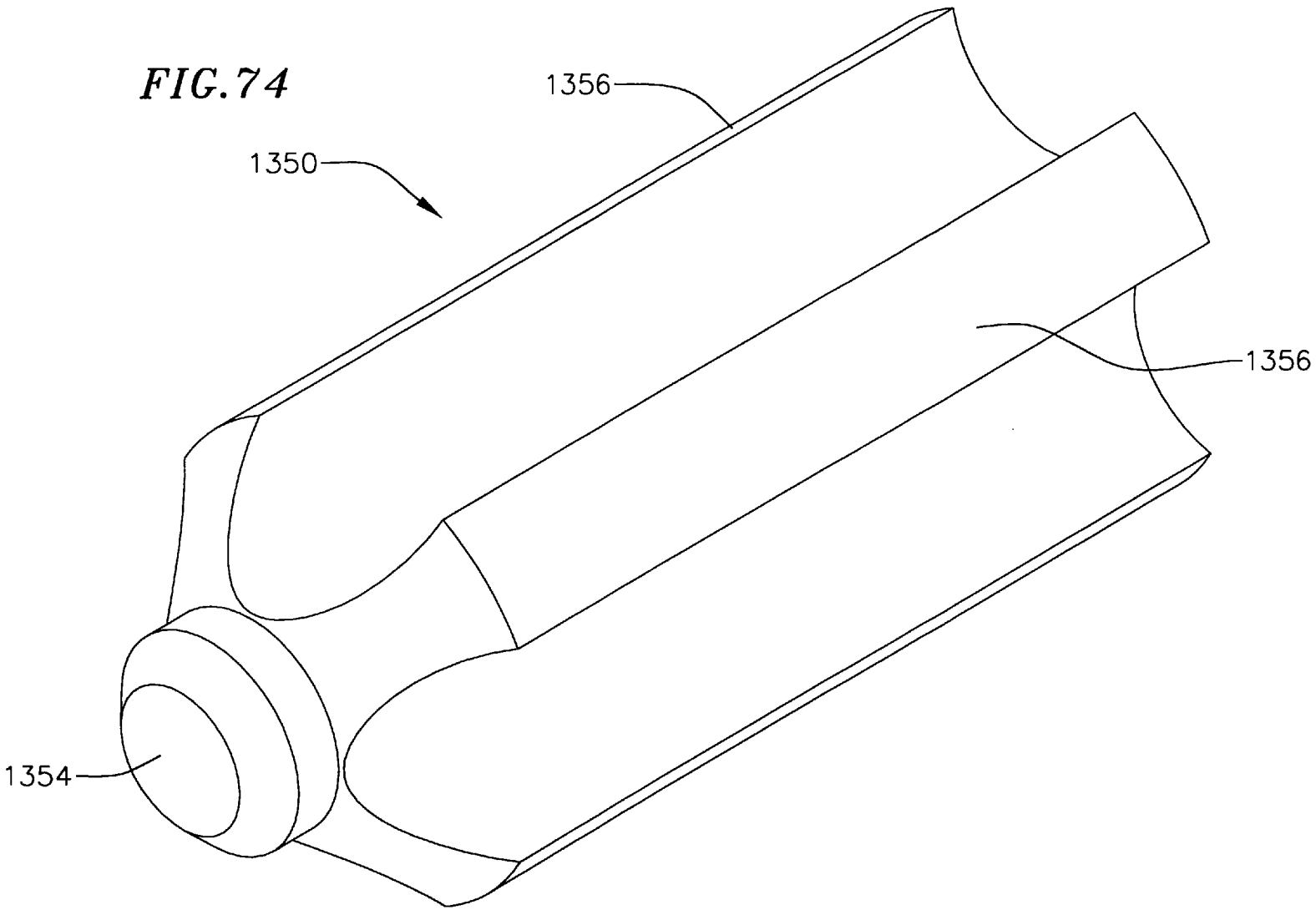
FIG. 74 is a rear perspective view of the relief valve poppet of FIG. 73.
Figure 75:
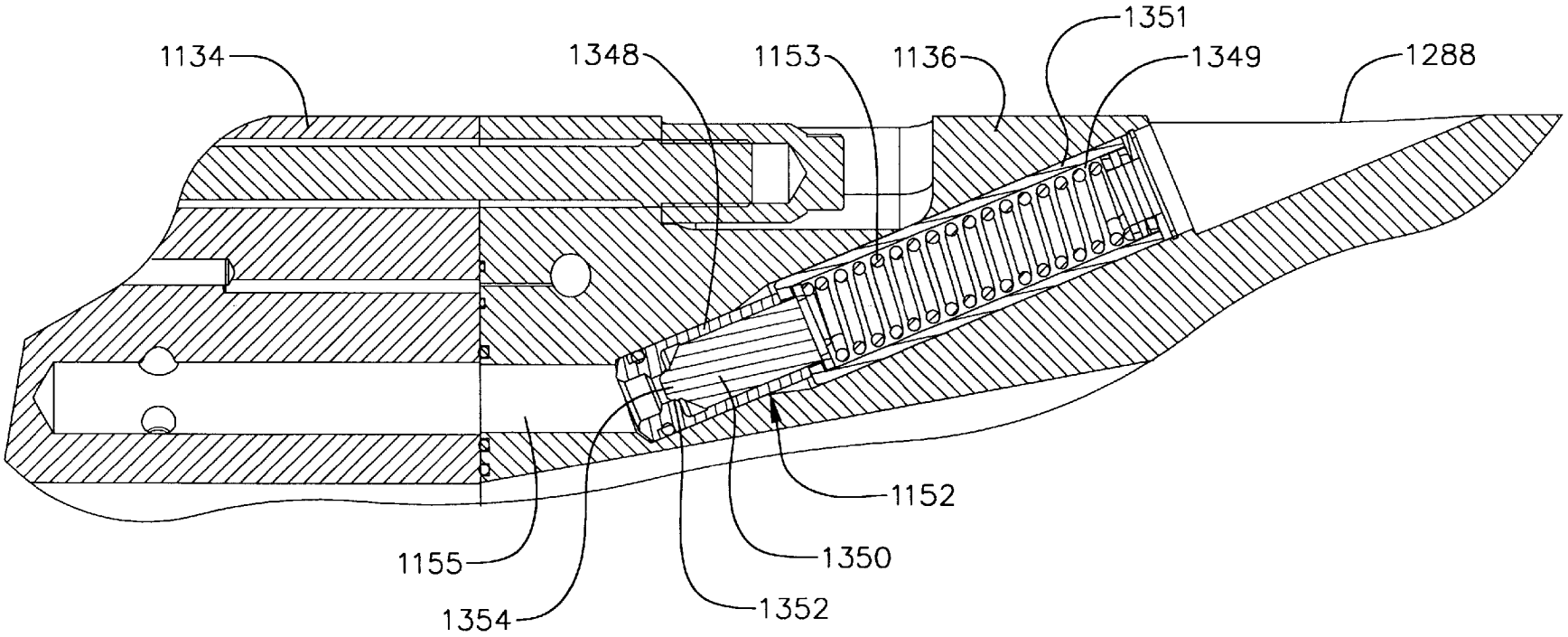
FIG. 75 is a longitudinal sectional view of the EST, showing the relief valve assembly.

FIGS. 73–75 illustrate the configuration and operation of relief valve 1152. Relief valve 1152 comprises a valve body 1348, poppet 1350, and coil spring 1153. Body 1348 is generally tubular and has a nose 1351 and an internal valve seat 1352. Poppet 1350 has a rounded end 1354 configured to abut valve seat 1352 to close the valve. Poppet 1350 also has a plurality of longitudinal ribs 1356 between which fluid may flow out to annulus 40. Inside forward transition housing 1136, relief valve body 1348 resides within a diagonal portion 1349 of galley 1155 which extends to orifice 1288 and out to annulus 40. Body 1348 is tightly and securely received within the aft end of diagonal bore 1349. A tube 1351 resides forward of body 1348. Tube 1351 houses relief valve spring 1153. Poppet 1350 is slidably received within body 1348. The forward end of poppet 1350 abuts the aft end of spring 1153. The forward end of spring 1153 is held by an internal annular flange of tube 1351. In operation, the drilling fluid inside galley 1155 exerts a force on rounded end 1354 of poppet 1350, which is countered by spring 1153. As the fluid pressure rises, the force on end 1354 also rises. If the fluid pressure in galley 1155 exceeds a threshold pressure, the spring force is overcome, forcing end 1354 to unseat from valve seat 1352. This permits fluid from galley 1155 to exhaust out to annulus 40 through bore 1349 and between the ribs 1356 of poppet 1350.

In a preferred embodiment, control assembly 1102 is substantially cylindrical with a diameter of about 3.375 inches and a length of about 46.7 inches. Housings 1130, 1131, 1132, 1134, and 1136 are preferably constructed of a high strength material, to prevent erosion caused by exposure to harsh drilling fluids such as calcium bromide or cesium formate muds. In general, the severity and rate of erosion depends on the velocity of the drilling fluid to which the material is exposed, the solid material within the fluid, and the angle at which the fluid strikes a surface. In operation, the control assembly housings are exposed to drilling mud velocities of 0 to 55 feet per second, with typical mean operating speeds of less than 30 feet per second (except within the valves). Under these conditions, a suitable material for the control assembly housings is Stabaloy, particularly Stabaloy AG 17. In the valves, mud flow velocities can be as high as 150 feet per second. Thus, the valves and valve bodies are preferably formed from an even more erosion-resistant material, such as tungsten carbide, Ferro-Tec (a proprietary steel formed of titanium carbide and available from Alloy Technologies International, Inc. of West Nyack, N.Y.), or similar materials. The housings and valves may be constructed from other materials, giving due consideration to the goal of resisting erosion.

Shaft Assemblies

In a preferred embodiment, the aft and forward shaft assemblies are structurally similar. Thus, only the aft shaft assembly is herein described in detail. FIG. 76 shows the configuration of the aft shaft assembly. Aft packerfoot 1104, flexible connector 1120, cylinder 1108, flexible connector 1122, and cylinder 1110 are connected together end to end and are collectively slidably engaged on aft shaft 1118. Annular pistons 1140 and 1142 are attached to shaft 1118 via bolts secured into bolt holes 1360 and 1362, respectively. O-tings or specialized elastomeric seals may be provided between the pistons and the shaft to prevent flow of fluid under the pistons. Cylinders 1108 and 1110 enclose pistons 1140 and 1142, respectively. The forward and aft ends of each propulsion cylinder are sealed, via tee-seals, O-rings, or otherwise, to prevent the escape of fluid from within the cylinders to annulus 40. Also, seals are provided between the outer surface of the pistons 1140 and 1142 and the inner surface of the cylinders 1108 and 1110 to prevent fluid from flowing between the front and rear chambers of the cylinders.

Connectors 1120 and 1122 may be attached to packerfoot 1104 and cylinders 1108 and 1110 via threaded engagement, to provide high-pressure integrity and avoid using a multiplicity of bolts or screws. Tapers may be provided on the leading edges of connectors 1120 and 1122 and seal cap 1123 attached to the forward end of cylinder 1110. Such tapers help prevent the assembly from getting caught against sharp surfaces such as milled casing passages.

A plurality of elongated rotation restraints 1364 are preferably attached onto shaft 1118, which prevent packerfoot 1104 from rotating with respect to the shaft. Restraints 1364 are preferably equally spaced about the circumference of shaft 1118, and can be attached via bolts as shown. Preferably four restraints 1364 are provided. Packerfoot 1104 is configured to engage the restraints 1364 so as to prevent rotation of the packerfoot with respect to the shaft, as described in greater detail below.

Figures 77, 78, 79, 80, 81:
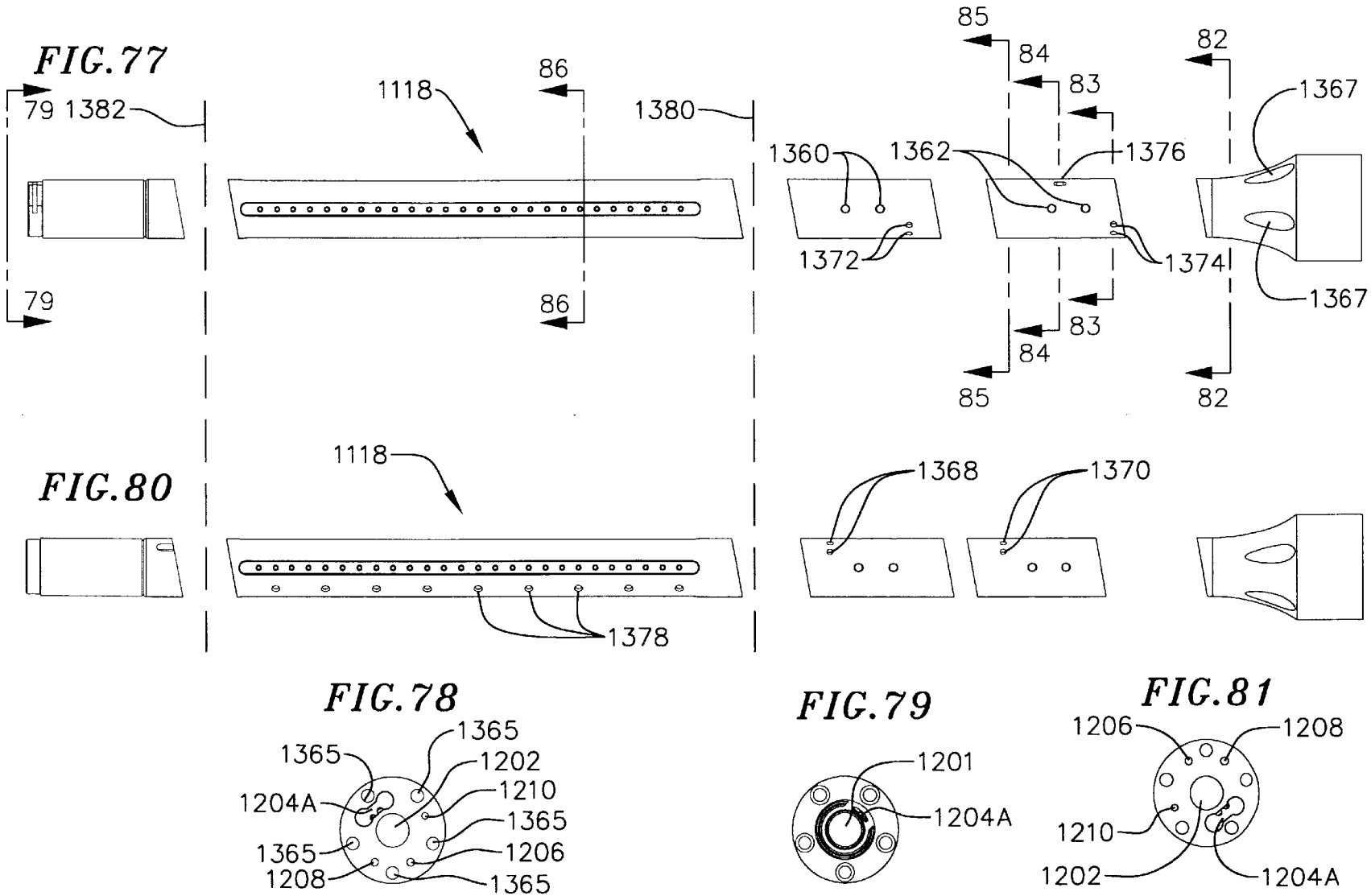
FIG. 77 is a side view of the aft shaft of the EST.
FIG. 78 is a front view of the aft shaft of FIG. 77.
FIG. 79 is a rear view of the aft shaft of FIG. 77.
FIG. 80 is a side view of the aft shaft of FIG. 77, shown rotated 180° about its longitudinal axis.
FIG. 81 is a front view of the aft shaft of FIG. 80.

FIGS. 77–86 illustrate in greater detail the configuration of shaft 1118. At its forward end, shaft 1118 has a flange 1366 which is curved for more even stress distribution. Flange 1366 includes bores for fluid passages 1202, 1206, 1208, and 1210, which align with corresponding bores in aft transition housing 1131. Note that the sizes of these passages may be varied to provide different flowrate and speed capacities of the EST. In addition, a pair of wire passages 1204A is provided, one or both of the passages aligning with wire bore 1204 of housing 1131. Electrical wires 1502, 1504, 1506, and 1508 (FIG. 96), which run up to the surface and, in one embodiment, to a position sensor on piston 1142, reside in passages 1204A. As shown in FIG. 79, only wire passages 1204A and supply passage 1202 extend to the aft end of shaft 1118.

Figure 83:
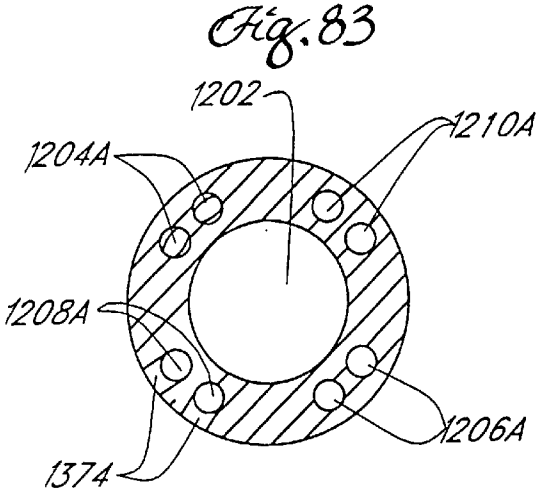
FIG. 83 is a cross-sectional view of the aft shaft, taken along line 83—83 shown in FIGS. 76 and 77.
Figure 82:
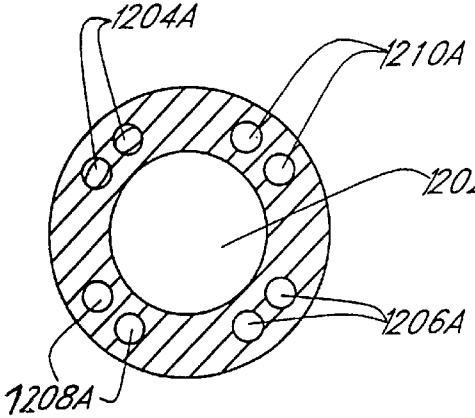
FIG. 82 is a cross-sectional view of the aft shaft, taken along line 82—82 shown in FIGS. 76 and 77.
Figure 85:
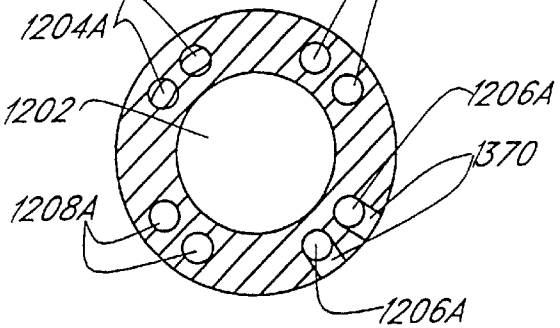
FIG. 85 is a cross-sectional view of the aft shaft, taken along line 85—85 shown in FIGS. 76 and 77.

As shown in FIG. 82, within shaft 1118 fluid passages 1206, 1208, and 1210 each comprise a pair of passages 1206A, 1208A, and 1210A, respectively. Preferably, the passages split into pairs inside of flange 1366. In the illustrated embodiment, pairs of gun-drilled passages are provided instead of single larger passages because larger diameter passages could jeopardize the structural integrity of the shaft. With reference to FIG. 80, passages 1206A deliver fluid to rear chambers 1166 and 1170 of propulsion cylinders 1108 and 1110 via fluid ports 1368 and 1370, respectively. FIG. 85 shows ports 1370 which communicate with rear chamber 1170 of cylinder 1110. These ports are transverse to the longitudinal axis of shaft 1118. Ports 1368 are configured similarly to ports 1370. With reference to FIG. 77, passages 1208A deliver fluid to front chambers 1168 and 1172 of cylinders 1108 and 1110 via fluid ports 1372 and 1374, respectively. Ports 1374 are shown in FIG. 83. Ports 1372 are configured similarly to ports 1374. Passages 1206A and 1208A are provided for the purpose of delivering fluid to the propulsion cylinders. Hence, passages 1206A and 1208A do not extend rearwardly beyond longitudinal position 1380.

Figure 86:
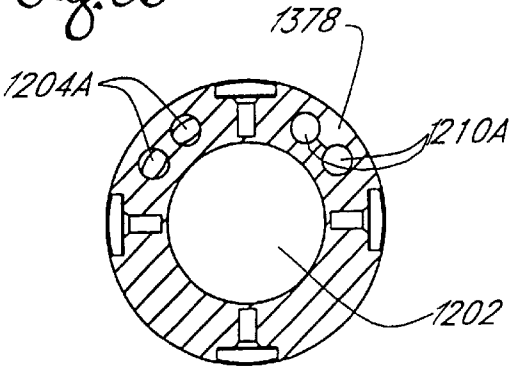
FIG. 86 is a cross-sectional view of the aft shaft, taken along line 86—86 shown in FIGS. 76 and 77.

With reference to FIG. 80, passages 1210A deliver fluid to aft packerfoot 1104, via a plurality of fluid ports 1378. Ports 1378 are preferably arranged linearly along shaft 1118 to provide fluid throughout the interior space of packerfoot 1104. In the preferred embodiment, nine ports 1378 are provided. FIG. 86 shows one of the ports 1378, which fluidly communicates with each of passages 1210A. Since passages 1210A are provided for the purpose of delivering fluid to aft packerfoot 1104, such passages do not extend rearwardly beyond longitudinal position 1382.

Figure 84:
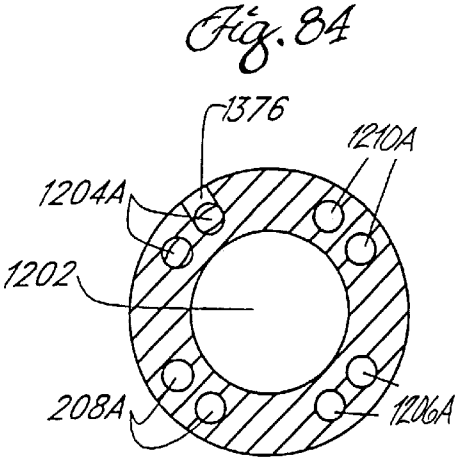
FIG. 84 is a cross-sectional view of the aft shaft, taken along line 84—84 shown in FIGS. 76 and 77.

With reference to FIG. 77, a wire port 1376 is provided in shaft 1118. Port 1376 permits electrical communication between control assembly 1102 and position sensor 1192 (FIGS. 31A–F) on piston 1142. For example, a Wiegand sensor or magnetometer device (described below) may be located on piston 1142. Port 1376 is also shown in FIG. 84.

In a preferred embodiment, some of the components of the EST are formed from a flexible material, so that the overall flexibility of the tool is increased. Also, the components of the tool are preferably non-magnetic, since magnetic materials can interfere with the performance of magnetic displacement sensors. Of course, if magnetic displacement sensors are not used, then magnetic materials are not problematic. A preferred material is copper-beryllium (CuBe) or CuBe alloy, which has trace amounts of nickel and iron. This material is non-magnetic and has high strength and a low tensile modulus. With reference to FIG. 2, shafts 1118 and 1124, propulsion cylinders 1108, 1110, 1112, and 1114, and connectors 1120, 1122, 1126, and 1128 may be formed from CuBe. Pistons 1140 and 1142 may also be formed from CuBe or CuBe alloy. The cylinders are preferably chrome-plated for maximum life of the seals therein.

Figure 100A:
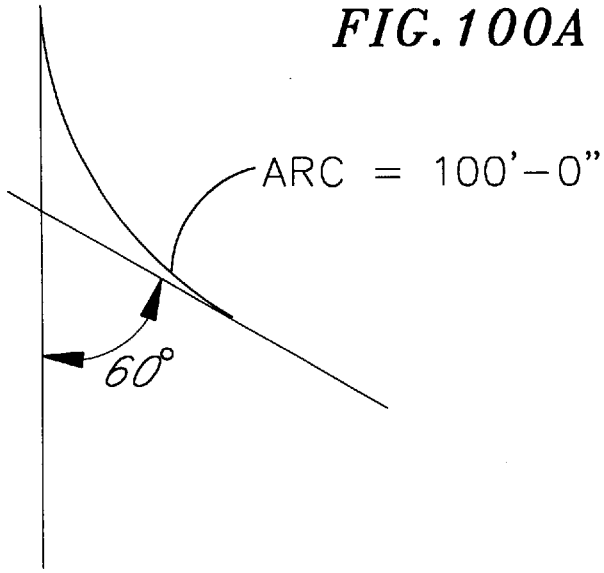
FIG. 100A is a chord illustrating the turning ability of the EST.
Figure 100B:
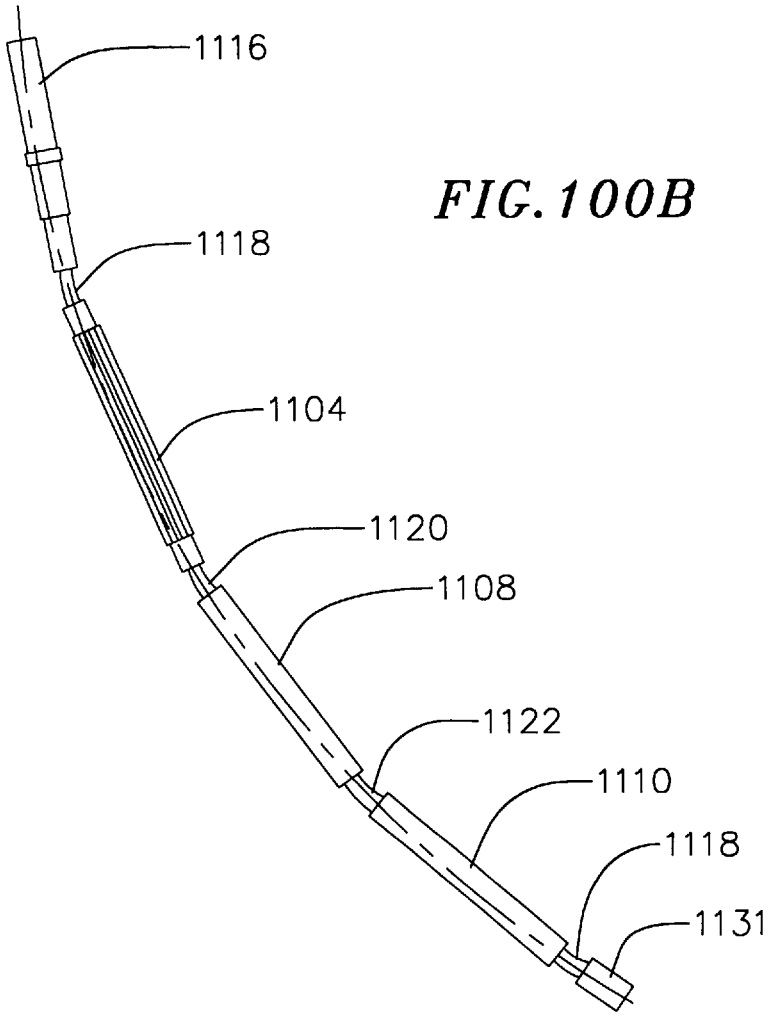
FIG. 100B is a schematic view illustrating the flexing characteristics of the aft shaft assembly of the EST.

In a preferred embodiment, each shaft is about 12 feet long, and the total length of the EST is about 32 feet. Preferably, the propulsion cylinders are about 25.7 inches long and 3.13 inches in diameter. Connectors 1120, 1122, 1126, and 1128 are preferably smaller in diameter than the propulsion cylinders and packerfeet at their center. The connectors desirably have a diameter of no more than 2.75 inches and, preferably, no more than 2.05 inches. This results in regions of the EST that are more flexible than the propulsion cylinders and control assembly 1102. Consequently, most of the flexing of the EST occurs within the connectors and shafts. In one embodiment, the EST can turn up to 60° per 100 feet of drilled arc. FIG. 100A shows an arc curved to schematically illustrate the turning capability of the tool. FIG. 100B schematically shows the flexing of the aft shaft assembly of the EST. The degree of flexing is somewhat exaggerated for clarity. As shown, the flexing is concentrated in aft shaft 1118 and connectors 1120 and 1122.

Figure 95:
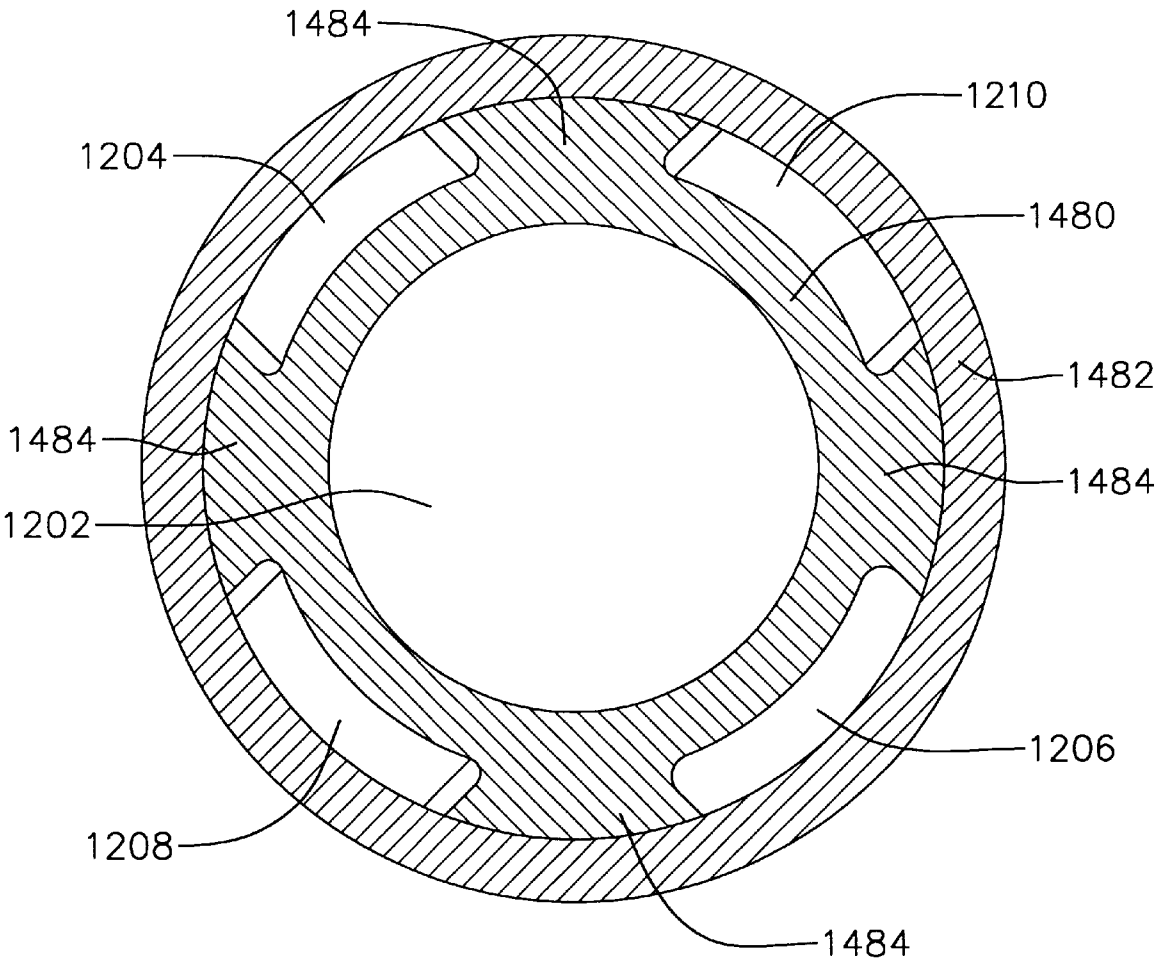
FIG. 95 is a cross-sectional view of a shaft of the EST, formed by diffusion-bonding.

Shafts 1118 and 1124 can be constructed according to several different methods. One method is diffusion bonding, wherein each shaft comprises an inner shaft and an outer shaft, as shown in FIG. 95. Inner shaft 1480 includes a central bore for fluid supply passage 1202, and ribs 1484 along its length. The outer diameter of inner shaft 1480 at the ribs 1484 is equal to the inner diameter of outer shaft 1482, so that inner shaft 1480 fits tightly into outer shaft 1482. Substantially the entire outer surface of ribs 1484 mates with the inner surface of shaft 1482. Longitudinal passages are formed between the shafts. In aft shaft 1118, these are passages 1204 (wires), 1206 (fluid to rear chambers of aft propulsion cylinders), 1208 (fluid to front chambers of aft propulsion cylinders), and 1210 (fluid to aft packerfoot).

The inner and outer shafts 1480 and 1482 may be formed by a co-extrusion process. Shafts 1480 and 1482 are preferably made from CuBe alloy and annealed with a "drill string" temper process (annealing temper and thermal aging) that provides excellent mechanical properties (tensile modulus of 110,000–130,000 psi, and elongation of 8–10% at room temperature). The inner and outer shafts are then diffusion bonded together. Accordingly, the shafts are coated with silver, and the inner shaft is placed inside the outer shaft. The assembly is internally pressurized, externally constrained, and heated to approximately 1500° F. The CuBe shafts expand under heat to form a tight fit. Heat also causes the silver to diffuse into the CuBe material, forming the diffusion bond. Experiments on short pieces of diffusion-bonded shafts have demonstrated pressure integrity within the several passages. Also, experiments with short pieces have demonstrated diffusion bond shear strengths of 42,000 to 49,000 psi.

After the shafts are bonded together, the assembly is electrolitically chrome-plated to increase the life of the seals on the shaft. Special care~is made to minimize the thickness of the chrome to allow both long life and shaft flexibility. The use of diffusion bonding permits the unique geometry shown in FIG. 95, which maximizes fluid flow channel area and simultaneously maximizes the torsional rigidity of the shaft. In a similar diffusion bonding process, the flange portion 1366 (FIGS. 49A–B) can be bonded to the end of the shaft.

Alternatively, other materials and constructions can be used. For example, Monel or titanium alloys can be used with appropriate welding methods. Monel is an acceptable material because of its non-magnetic characteristics. However, Monel's high modulus of elasticity or Young's Modulus tends to restrict turning radius of the tractor to less than 40° per 100 feet of drilled arc. Titanium is an acceptable material because of its non-magnetic characteristics, such as high tensile strength and low Young's modulus (compared to steel). However, titanium welds are known to have relatively short fatigue life when subjected to drilling environments.

In another method of constructing shafts 1118 and 1124, the longitudinal wire and fluid passages are formed by "gun-drilling," a well-known process used for drilling long holes. Advantages of gun-drilling include moderately lower torsional and bending stiffness than the diffusion-bonded embodiment, and lower cost since gun-drilling is a more developed art. When gun-drilling a hole, the maximum length and accuracy of the hole depends upon the hole diameter. The larger the hole diameter, the longer and more accurately the hole can be gun-drilled. However, since the shafts have a relatively small diameter and have numerous internal passages, too great a hole diameter may result in inability of the shafts to withstand operational bending and torsion loads. Thus, in selecting an appropriate hole diameter, the strength of the shaft must be balanced against the ability to gun-drill long, accurate holes.

The shaft desirably has a diameter of 1–3.5 inches and a fluid supply passage of preferably 0.6–1.75 inches in diameter, and more preferably at least 0.99 inches in diameter. In a preferred embodiment of the EST, the shaft diameter is 1.746–1.748 inches, and the diameter of fluid supply passage 1202 is 1 inch. For an EST having a diameter of 3.375 inches, the shafts are designed to survive the stresses resulting from the combined loads of 1000 ft-lbs of torque, pulling-thrusting load up to 6500 pounds, and bending of 60° per 100 feet of travel. Under these constraints, a suitable configuration is shown in FIG. 82, which shows aft shaft 1118. Passages 1204A, 1206A, 1208A, and 1210A comprise pairs of holes substantially equally distanced between the inner surface of passage 1202 and the outer surface of shaft 1118. For each passage, a pair of holes is provided so that the passages have sufficient capacity to accommodate required operational drilling fluid flowrates. This configuration is chosen instead of a single larger hole, because a larger hole may undesirably weaken the shaft. Each hole has a diameter of 0.188 inch. The holes of each individual pair are spaced apart by approximately one hole diameter. For a hole diameter of 0.188 inch, it may not be possible to gun-drill through the entire length of each shaft 1118 and 1124. In that case, each shaft can be made by gun-drilling the holes into two or more shorter shafts and then electron beam (EB) welding them together end to end.

The welded shaft is then preferably thermally annealed to have desired physical properties, which include a tensile modulus of approximately 19,000,000 psi, tensile strength of approximately 110,000–130,000 psi, and elongation of about 8–12%. The shaft can be baked at 1430° F. for 1–8 hours depending upon the desired characteristics. Details of post-weld annealing methods are found in literature about CuBe. After the thermal annealing step, the welded shaft is then finished, machined, ground, and chrome-plated.

Packerfeet

Figures 76A, 76B:
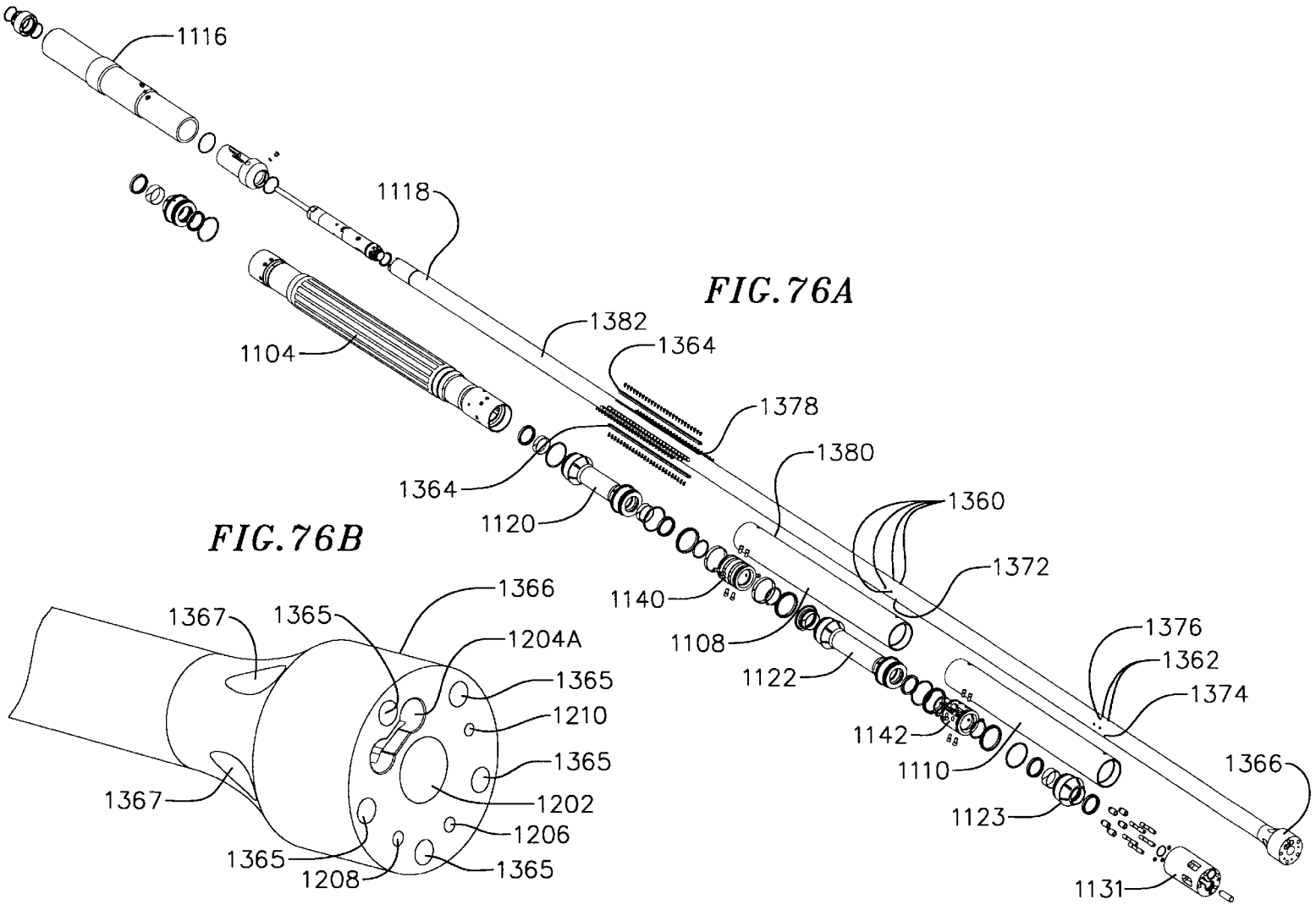
FIG. 76A is a front perspective view of the aft section of the EST, shown disassembled.
FIG. 76B is an exploded view of the forward end of the aft shaft shown in FIG. 76A.

FIGS. 87–91 and 101–102 show one embodiment of aft packerfoot 1104. The major components of packerfoot 1104 comprise a mandrel 1400, bladder assembly 1404, end clamp 1414, and connector 1420. Mandrel 1400 is generally tubular and has internal grooves 1402 sized and configured to slidably engage rotation restraints 1364 on aft shaft 1118 (FIG. 76A). Thus, mandrel 1400 can slide longitudinally, but cannot rotate, with respect to shaft 1118. Bladder assembly 1404 comprises generally rigid tube portions 1416 and 1417 attached to each end of a substantially tubular inflatable engagement bladder 1406. Assembly 1404 generally encloses mandrel 1400. On the aft end of packerfoot 1104, assembly 1404 is secured to mandrel 1400 via eight bolts 1408 received within bolt holes 1410 and 1412 in assembly 1404 and mandrel 1400, respectively. An end clamp 1414 is used as armor to protect the leading edge of the bladder 1406 and is secured via bolts onto end 1417 of assembly 1404. If desired, an additional end clamp can be secured onto end 1416 of assembly 1404 as well. Connector 1420 is secured to mandrel 1400 via eight bolts 1422 received within bolt holes 1424 and 1426. Connector 1420 provides a connection between packerfoot 1104 and flexible connector 1120 (FIG. 76A).

The ends of bladder assembly 1404 are preferably configured to move longitudinally toward each other to enhance radial expansion of bladder 1406 as it is inflated. In the illustrated embodiment, aft end 1416 of assembly 1404 is fixed to mandrel 1400, and forward end 1417 is slidably engaged with segment 1418 of mandrel 1400. This permits forward end 1417 to slide toward aft end 1416 as the packerfoot is inflated, thereby increasing the radial expansion of bladder 1406. The EST's packerfeet are designed to traverse holes up to 10% larger than the drill bit without losing traction. For example, a typical drill bit size, and the associated drilled hole, is 3.75 inches in diameter. A correspondingly sized packerfoot can traverse a 4.1 inch diameter hole. Similarly, a 4.5 -inch diameter hole will be traversed with a packerfoot that has an expansion capability to a minimum of 5.0 inches. Further, the slidable connection of bladder assembly 1404 with segment 1418 tends to prevent the fibers in bladder 1406 from overstraining, since the bladder tends not to stretch as much. Alternatively, the bladder assembly can be configured so that its forward end is fixed to the mandrel and its aft can slide toward the forward end. However, this may cause the bladder to undesirably expand when pulling the tractor upward out of a borehole, which can cause the tractor to "stick" to the borehole walls. Splines 1419 on the forward end of assembly 1404 engage grooves inside connector 1420 so that end 1417 cannot rotate with respect to mandrel 1400.

One or more fluid ports 1428 are provided along a length of mandrel 1400, which communicate with the interior of bladder 1406. Ports 1428 are preferably arranged about the circumference of mandrel 1400, so that fluid is introduced uniformly throughout the bladder interior. Fluid from aft packerfoot passage 1210 reaches bladder 1406 by flowing through ports 1378 in shaft 1118 (FIGS. 80 and 86) to the interior of mandrel 1400, and then through ports 1428 to the interior of bladder 1406. Suitable fluid seals, such as O-rings, are provided at the ends of packerfoot 1104 between mandrel 1400 and bladder assembly 1404 to prevent fluid within the bladder from leaking out to annulus 40.

In a preferred embodiment, bladder 1406 is constructed of high strength fibers and rubber in a special orientation that maximizes strength, radial expansion, and fatigue life. The rubber component may be nitrile butadiene rubber (NBR) or a tetra-fluor-ethylene (TFE) rubber, such as the rubber sold under the trade name AFLAS. NBR is preferred for use with invert muds (muds that have greater diesel oil content by volume than water). AFLAS material is preferred for use with some specialized drilling fluids, such as calcium formate muds. Other additives may be added to the rubber to improve abrasion resistance or reduce hysterisis, such as carbon, oil, plasticizers, and various coatings including bonded Teflon type materials.

High strength fibers are included within the bladder, such as S-glass, E-glass, Kevlar (polyamides), and various graphites. The preferred material is S-glass because of its high strength (530,000 psi) and high elongation (5–6%), resulting in greatly improved fatigue life compared to previous designs. For instance, if the fatigue life criterion for the bladders is that the working strain will remain below approximately 2535% of the ultimate strain of the fibers, previous designs were able to achieve about 7400 cycles of inflation. In contrast, the expected life of the bladders of the present invention under combined loading is estimated to be over 25,000 cycles. Advantageously, more inflation cycles results in increased operational downhole time and lower rig costs.

The fibers are advantageously arranged in multiple layers, a cross-ply pattern. The fibers are preferably oriented at angles of +c~ relative to the longitudinal axis of the tractor, where c~ is preferably between 0° and 45°, more preferably between 7° and 30°, even more preferably between 15° and 20°, and most preferably about 15°. This allows maximal radial expansion without excessive bulging of the bladder into the regions between the packerfoot toes, described below. It also allows optimal fatigue life by the criterion described above.

Figure 87:
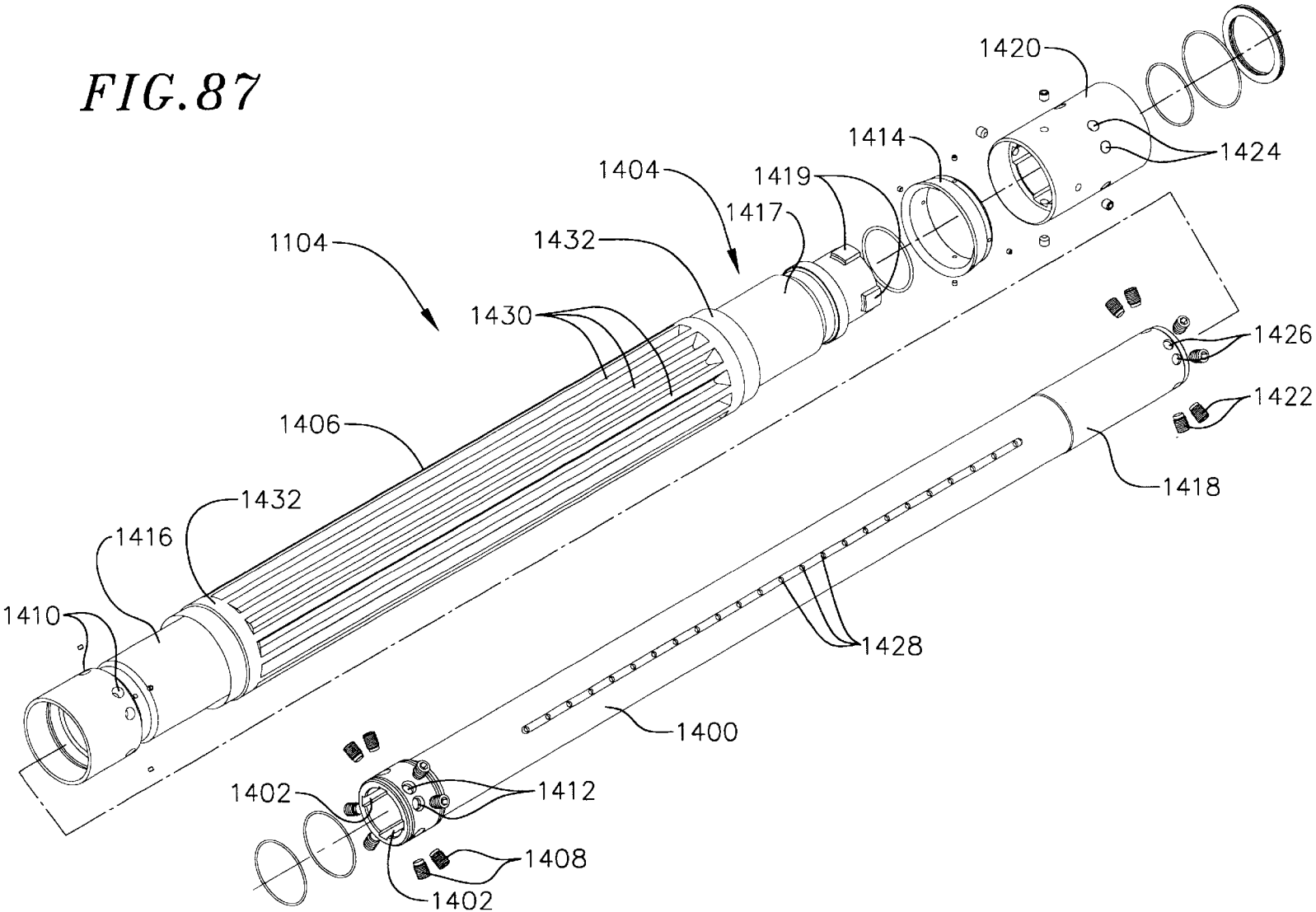
FIG. 87 is a rear perspective view of the aft packerfoot of the EST, shown disassembled.
Figure 88:
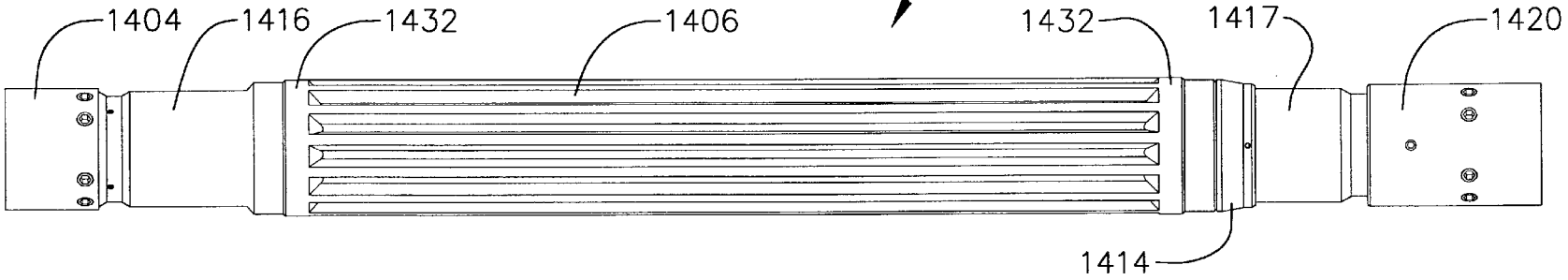
FIG. 88 is a side view of the aft packerfoot of the EST.
Figure 101:
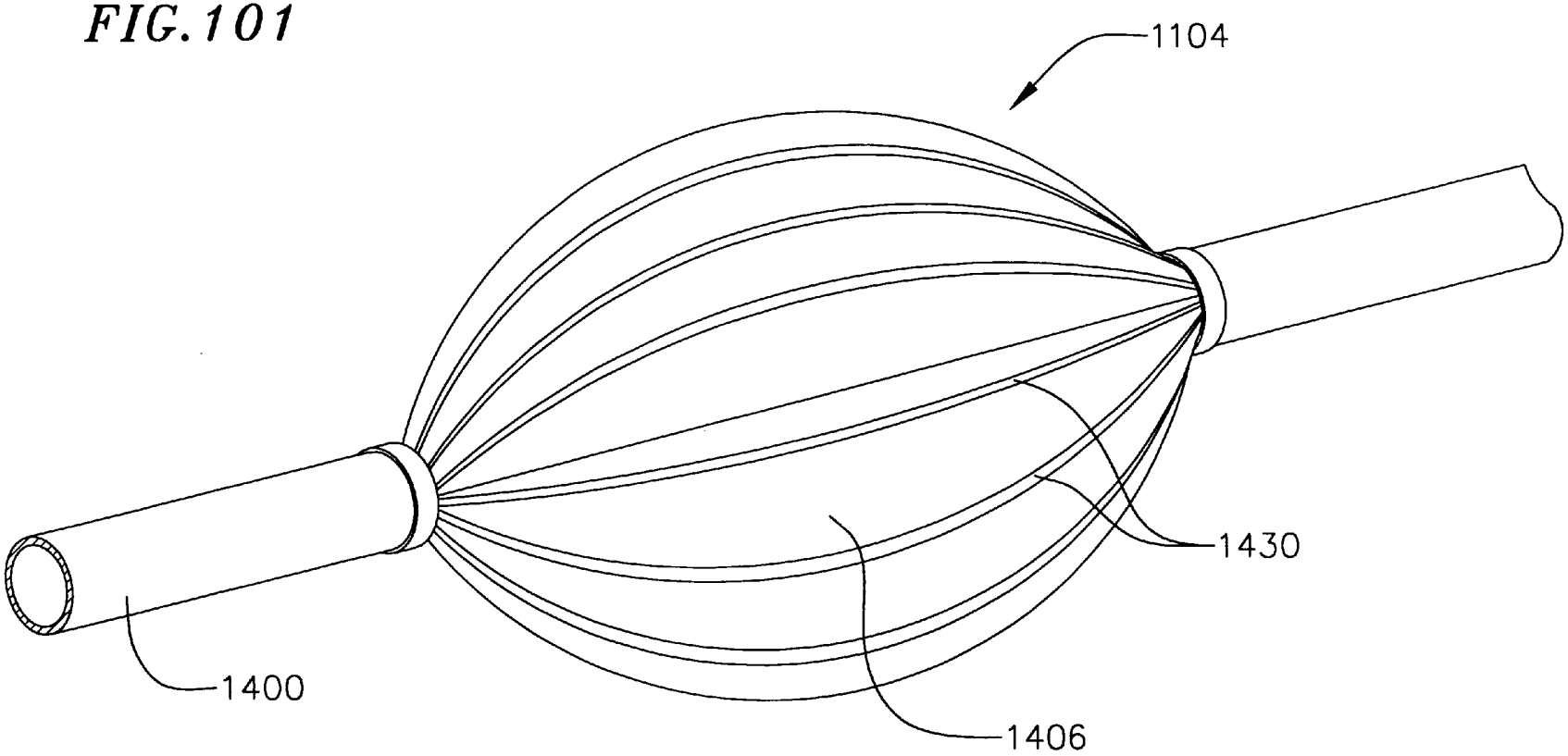
FIG. 101 is a rear perspective view of an inflated packerfoot of the present invention.
Figure 102:
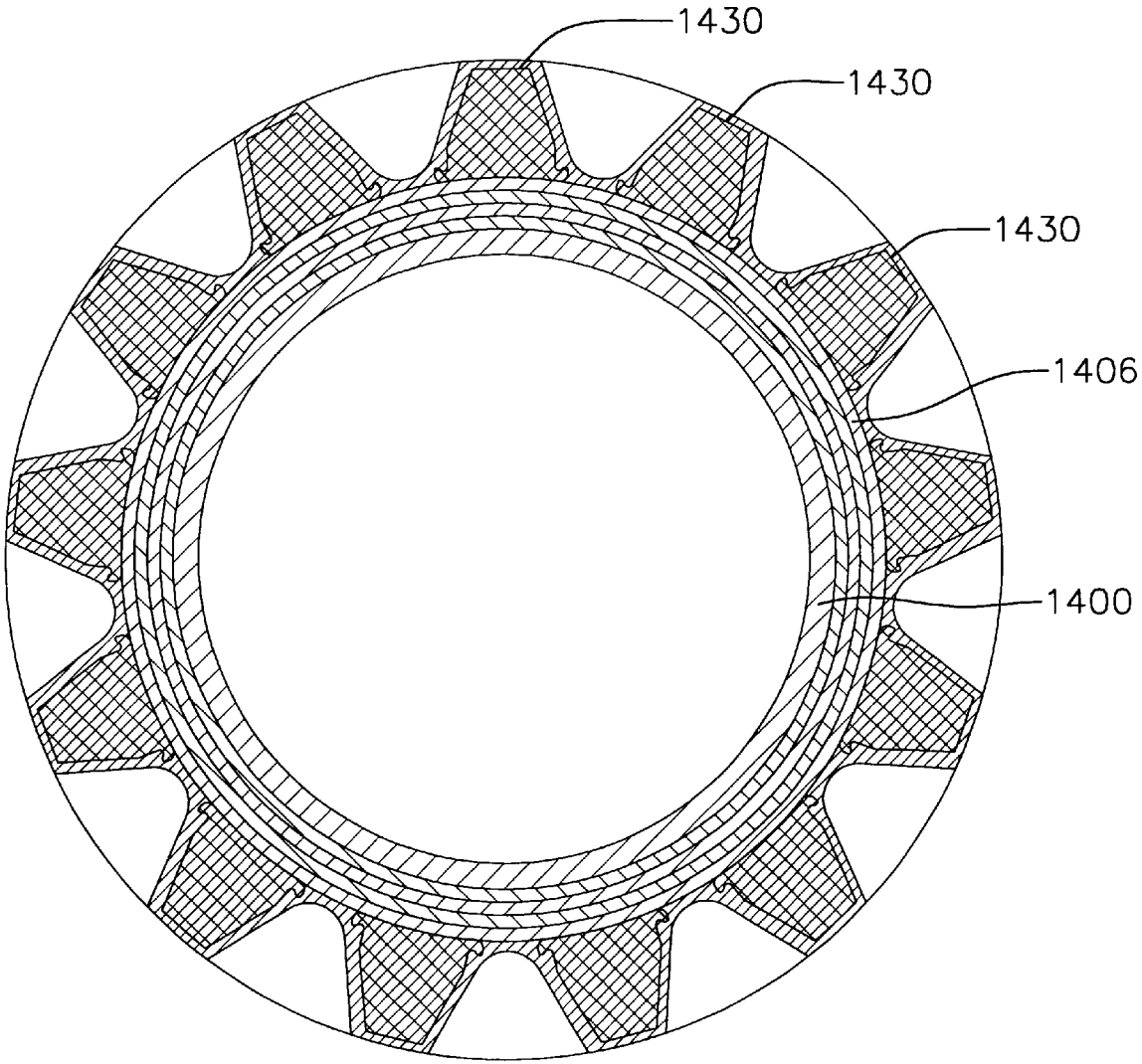
FIG. 102 is a cross-sectional view of a packerfoot of the present invention.

When bladder 1406 is inflated to engage a borehole wall 1042, it is desirable that the bladder not block the uphole return flow of drilling fluid and drill cuttings in annulus 40. To prevent this, elongated toes 1430 are bonded or otherwise attached to the outer surface of the rubber bladder 1406, as shown in FIGS. 87 and 102. Toes 1430 may have a triangular or trapezoidal cross-section and are preferably arranged in a rib-like manner. When the bladder engages the borehole wall, crevices are formed between the toes 1430 and the wall, permitting the flow of drilling fluid and drill cuttings past the packerfoot. Toes 1430 are preferably designed to be (1) sufficiently large to provide traction against the hole wall, (2) sufficiently small in cross-section to maximize uphole return flow of drilling fluid past the packerfoot in annulus 40, (3) appropriately flexible to deform during the inflation of the bladder, and (4) elastic to assist in the expulsion of drilling fluid from the packerfoot during deflation. Preferably, each toe has an outer radial width of 0.1–0.6 inches, and a modulus of elasticity of about 19,000,000. Toes 1430 may be constructed of CuBe alloy. The ends of toes 1430 are secured onto ends 1416 and 1417 of bladder assembly 1404 by bands of material 1432, preferably a high-strength non-magnetic material such as Stabaloy. Bands 1432 prevent toes 1430 from separating from the bladder during unconstrained expansion, thereby preventing formation of "fish-hooks" which could undesirably restrict the extraction of the EST from the borehole. FIG. 101 shows packerfoot 1104 inflated.

A protective shield of plastic or metal may be placed in front of the leading edge of the packerfoot, to channel the annulus fluid flow up onto the inflated packerfoot and thereby protect the leading edge of the bladder from erosion by the fluid and its particulate contents.

FIGS. 92–94 and 103 illustrate an alternative embodiment of an aft packerfoot, referred to herein as a "flextoe packerfoot." Aft and forward flextoe packerfeet can be provided in place of the previously described packerfeet 1104 and 1106. Unlike prior art bladder-type anchors, the flextoe packerfoot of the invention utilizes separate components for radial expansion force and torque transmission of the anchors. In particular, bladders provide force for radial expansion to grip a borehole wall, while "flextoes" transmit torque from the EST body to the borehole. The flextoes comprise beams which elastically bend within a plane parallel to the tractor body the tractor body. Advantageously, the flextoes substantially resist rotation of the body while the packerfoot is engaged with the borehole wall. Other advantages of the flextoe packerfoot include longer fatigue life, greater expansion capability, shorter length, and less operational costs.

The figures show one embodiment of an aft flextoe packerfoot 1440. Since the forward flextoe packerfoot is structurally similar to aft flextoe packerfoot 1440, it is not described herein. The major components of aft flextoe packerfoot 1440 comprise a mandrel 1434, fixed endpiece 1436, two dowel pin assemblies 1438, two jam nuts 1442, shuttle 1444, spline endpiece 1446, spacer tube 1448, connector 1450, four bladders 1452, four bladder covers 1454, and four flextoes 1456.

Figure 92:
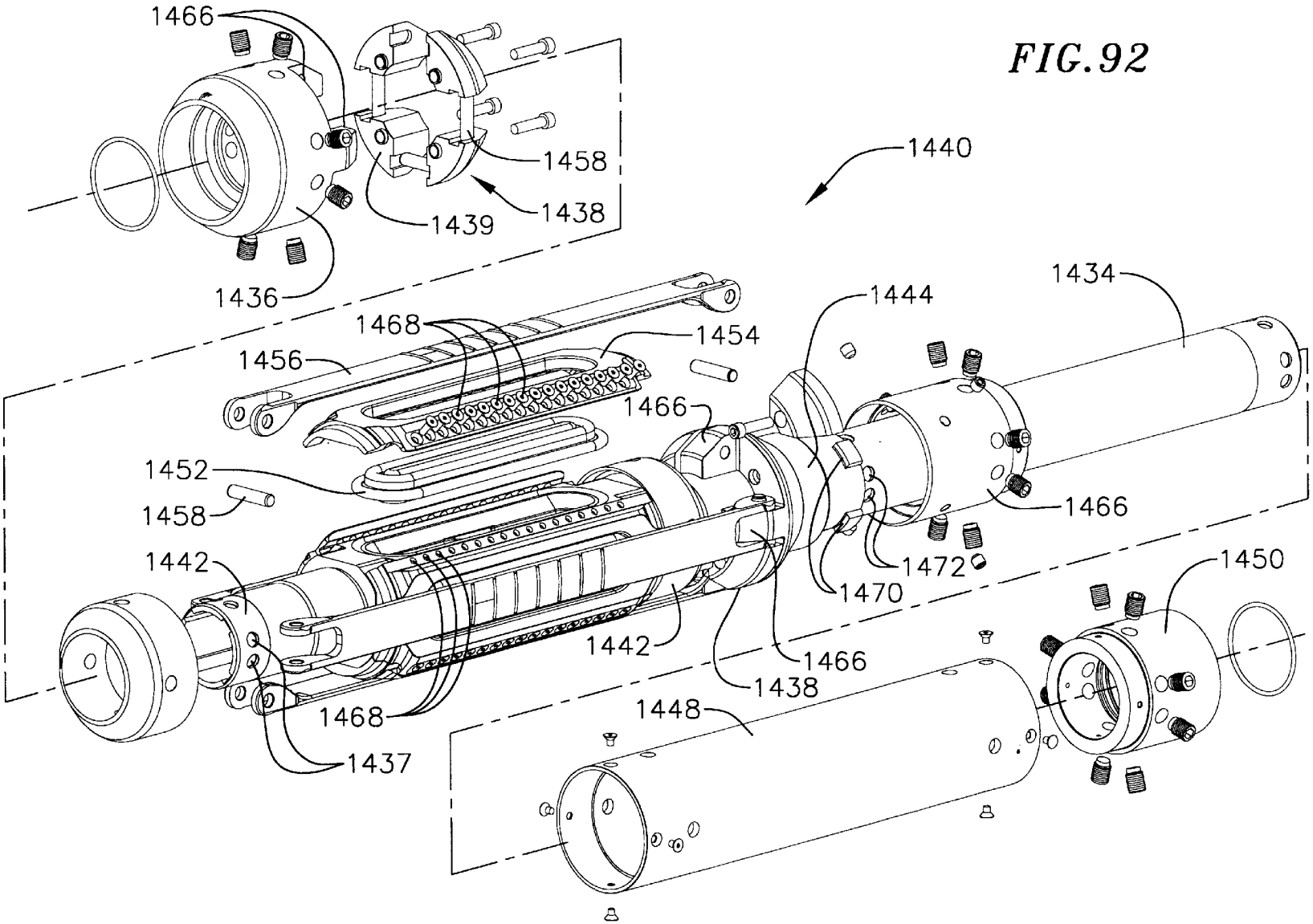
FIG. 92 is a rear perspective view of an aft flextoe packerfoot of the present invention, shown disassembled.
Figure 93:
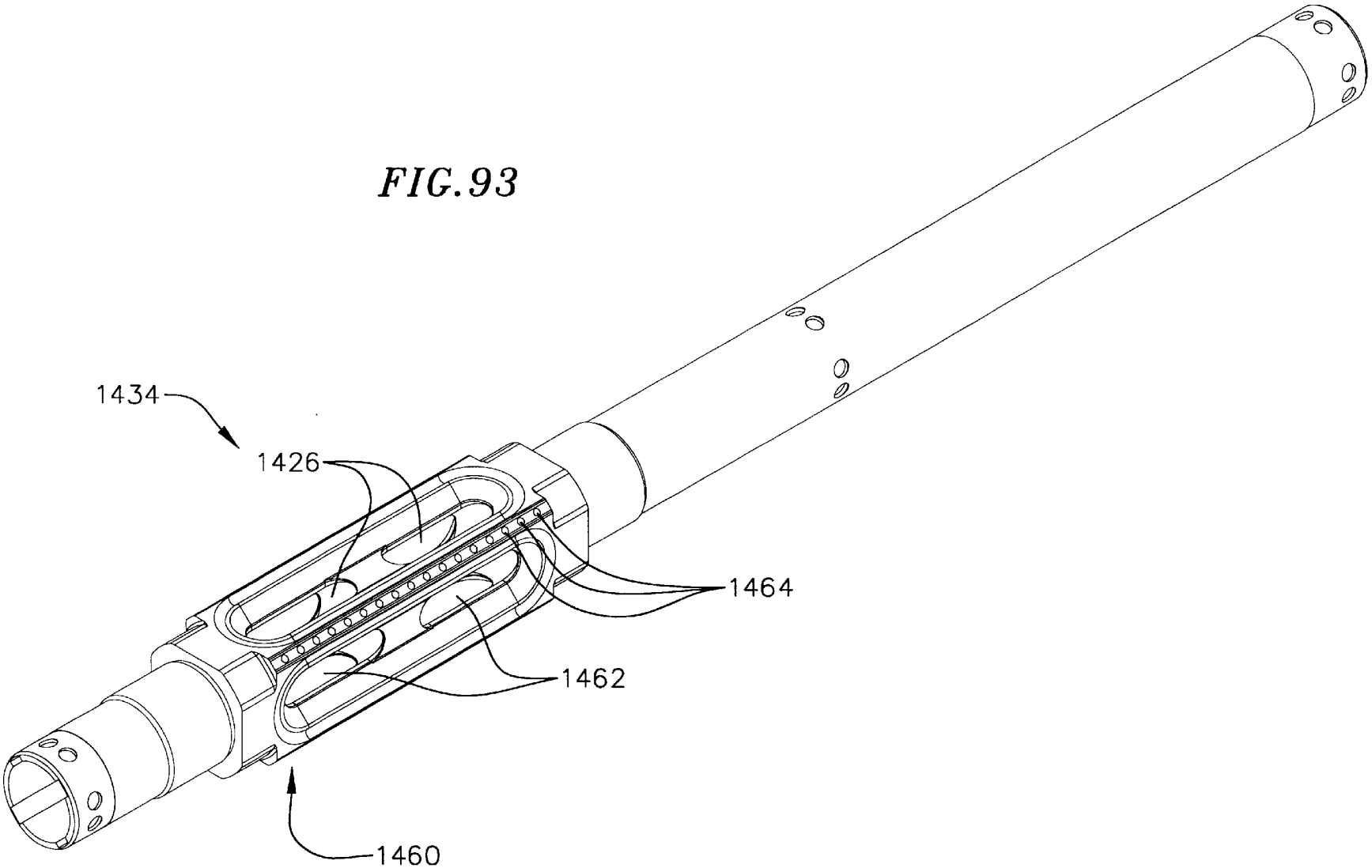
FIG. 93 is a rear perspective view of the mandrel of the flextoe packerfoot of FIG. 92.

With reference to FIG. 93, mandrel 1434 is substantially tubular but has a generally rectangular bladder mounting segment 1460 which includes a plurality of elongated openings 1462 arranged about the sides of segment 1460. In the EST, bladders 1452 are clamped by bladder covers 1454 onto segment 1460 so as to cover and seal shut openings 1462. In operation, fluid is delivered to the interior space of mandrel 1434 via ports 1378 in shaft 1118 (FIGS. 80 and 86) to inflate the bladders. Although four bladders are shown in the drawings, any number of bladders can be provided. In an alternative embodiment, shown in FIG. 103, one continuous bladder 1452 is used. This configuration prevents stress concentrations at the edges of the multiple bladders and allows greater fatigue life of the bladder. Referring to FIG. 92, bladder covers 1454 are mounted onto mandrel 1434 via bolts 1468 which pass through holes on the side edges of covers 1454 and extend into threaded holes 1464 in mandrel 1434. Bolts 1468 fluidly seal bladders 1452 against mandrel 1434, and prevent the bladders from separating from mandrel 1434 due to the fluid pressure inside the bladders. Since the pressure inside the bladders can be as high as 2400 psi, a large number of bolts 1468 are preferably provided to enhance the strength of the seal. In the illustrated embodiment, 17 bolts 1468 are arranged linearly on each side of the covers 1454. Jam nuts 1442 clamp the aft and forward ends of bladder covers 1454 onto mandrel 1434, to fluidly seal the aft and forward ends of the bladders. The individual bladders can easily be replaced by removal of the associated bladder cover 1454, substantially reducing replacement costs and time compared to prior art configurations. Bladder covers 1454 are preferably constructed of CuBe or CuBe alloy.

Figure 103:
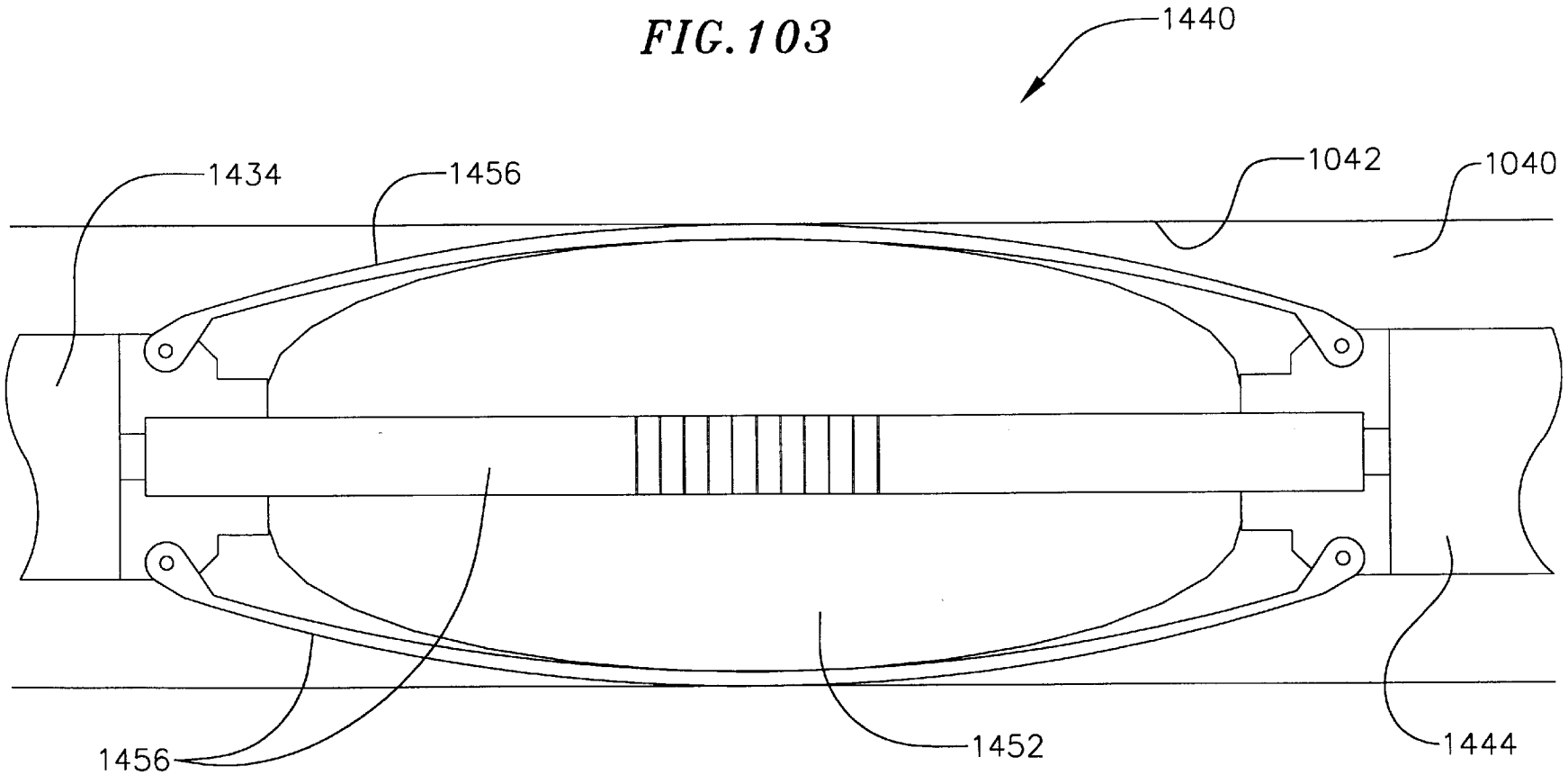
FIG. 103 is a side view of an inflated flextoe packerfoot of the present invention.

Referring to FIG. 92, fixed endpiece 1436 is attached to the aft end of mandrel 1434 via bolts extending into holes 1437. Forward of the bladders, shuttle 1444 is slidably engaged on mandrel 1434. One dowel pin assembly 1438 is mounted onto endpiece 1436, and another assembly 1438 is mounted onto shuttle 1444. In the illustrated embodiment, assemblies 1438 each comprise four dowel pin supports 1439 which support the ends of the dowel pins 1458. The dowel pins hingedly support the ends of flextoes 1456. Endpiece 1436 and shuttle 1444 each have four hinge portions 1466 which have holes that receive the dowel pins 1458. During operation, inflation of the bladders 1452 causes bladder covers 1454 to expand radially. This causes the flextoes 1456 to hinge at pins 1458 and bow outward to engage the borehole wall. FIG. 103 shows an inflated flextoe packerfoot (having a single continuous bladder), with flextoes 1456 gripping borehole wall 1042. Shuttle 1444 is free to slide axially toward fixed endpiece 1436, thereby enhancing radial expansion of the flextoes. Those skilled in the art will understand that either end of the flextoes 1456 can be permitted to slide along mandrel 1434. However, it is preferred that the forward ends of the flextoes be permitted to slide, while the aft ends are fixed to the mandrel. This prevents the slidable end of the flextoes from being axially displaced by the borehole wall during tool removal, which could cause the flextoes to flex outwardly and interfere with removal of the tractor.

Spline end piece 1446 is secured to mandrel 1434 via bolts extending into threaded holes 1472. At the point of attachment, the inner diameter of end piece 1446 is approximately equal to the outer diameter of mandrel 1434. Rear of the point of attachment, the inner diameter of end piece 1446 is slightly larger, so that shuttle 1444 can slide within end piece 1446. End piece 1446 also has longitudinal grooves in its inner diameter, which receive splines 1470 on the outer surface of shuttle 1444. This prevents shuttle 1470, and hence the forward ends of the flextoes 1456, from rotating with respect to mandrel 1434. Thus, since both the forward and aft ends of flextoes 1456 are prevented from rotating with respect to mandrel 1434, the flextoes substantially prevent the tool from rotating or twisting when the packerfoot is engaged with the borehole wall.

In the same manner as described above with regard to mandrel 1400 of packerfoot 1104, mandrel 1434 of flextoe packerfoot 1440 has grooves on its internal surface to slidably engage rotation restraints 1364 on aft shaft 1118. Thus, mandrel 1434 can slide longitudinally, but cannot rotate, with respect to shaft 1118. Restraints 1364 transmit torque from shaft 1118 to a borehole wall 1042. The components of packerfoot 1440 are preferably constructed of a flexible, non-magnetic material such as CuBe. Flextoes 1456 may include roughened outer surfaces for improved traction against a borehole wall.

The spacer tube 1448 is used as an adapter to allow interchangeability of the Flextoe packerfoot 1440 and the previous described packerfoot 1104 (FIG. 87). The connector 1450 is connected to the mandrel via the set screws. Connector 1450 connects packerfoot 1440 with flexible connector 1120 (FIG. 76A) of the EST.

Figure 94:
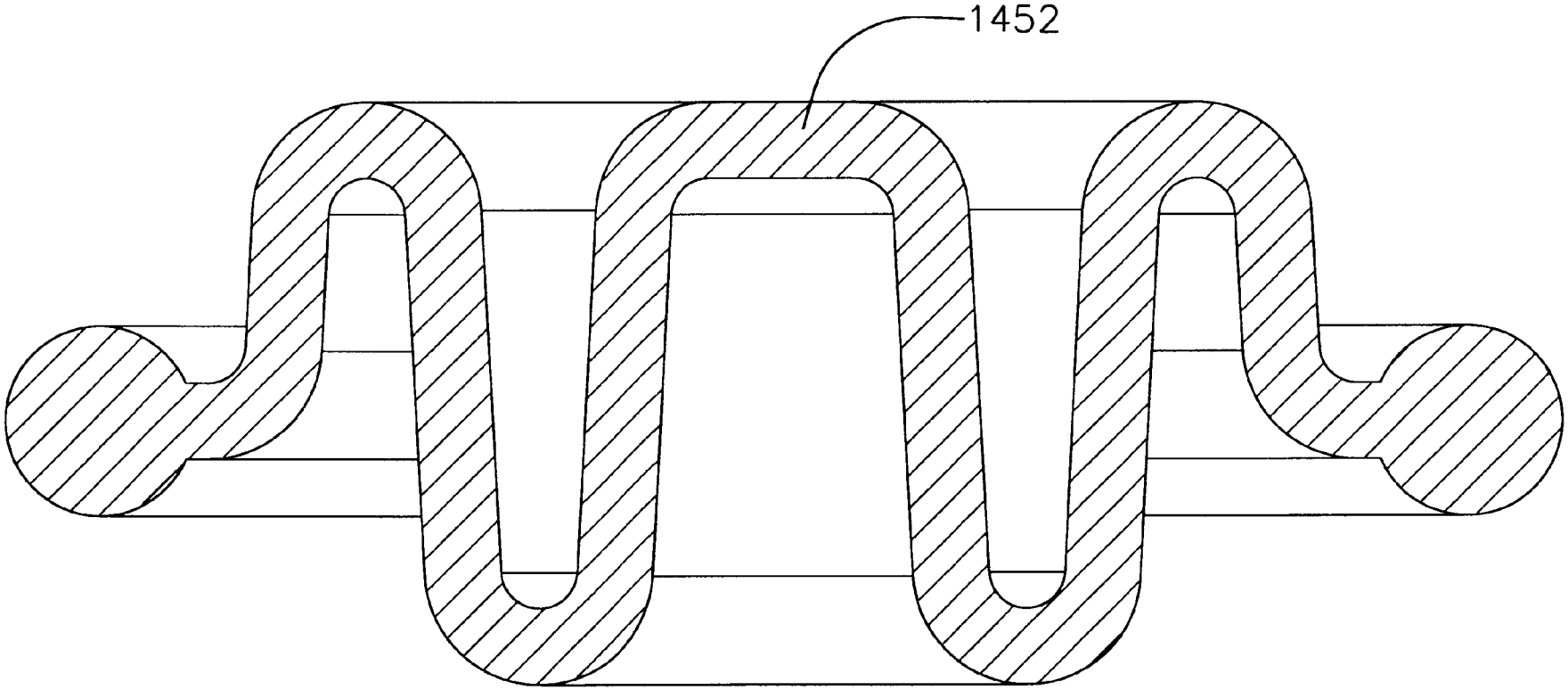
FIG. 94 is a cross-sectional view of the bladder of the flextoe packerfoot of FIG. 92.

FIG. 94 shows the cross-sectional configuration of one of the bladders 1452 utilized in flextoe packerfoot 1440. In its uninflated state, bladder 1452 has a multi-folded configuration as shown. This allows for greater radial expansion when the bladder is inflated, caused by the unfolding of the bladder. Also, the bladders do not stretch as much during use, compared to prior bladders. This results in longer life of the bladders. The bladders are made from fabric reinforced rubber, and may be constructed in several configurations. From the inside to the outside of the bladder, a typical construction is rubber/fiber/rubber/fiber/rubber. Rubber is necessary on the inside to maintain pressure.

Rubber is necessary on the outside to prevent fabric damage by cuttings passing the bladder. The rubber may be NBR or AFLAS (TFE rubber). Suitable fabrics include S-glass, E-glass, Kevlar 29, Kevlar 49, steel fabric (for ESTs not having magnetic sensors), various types of graphite, polyester-polarylate fiber, or metallic fibers. Different fiber reinforcement designs and fabric weights are acceptable. For the illustrated embodiment, the bladder can withstand inflation pressure up to 1500 psi. This inflation strength is achieved with a 400 denier 4-tow by 4-tow basket weave Kevlar 29 fabric. The design includes consideration for fatigue by a maximum strain criterion of 25% of the maximum elongation of the fibers. It has been experimentally determined that a minimum thickness of 0.090 inches of rubber is required on the inner surface to assure pressure integrity.

For both the non-flextoe and flextoe embodiments, the packerfeet are preferably positioned near the extreme ends of the EST, to enhance the tool's ability to traverse underground voids. The packerfeet are preferably about 39 inches long. The metallic parts of the packerfeet are preferably made of CuBe alloy, but other non-magnetic materials can be used.

During use, the packerfeet (all of the above-described embodiments, i.e., FIGS. 60 and 65) can desirably grip an open or cased borehole so as to prevent slippage at high longitudinal and torsional loads. In other words, the normal force of the borehole against each packerfoot must be high enough to prevent slippage, giving due consideration to the coefficient of friction (typically about 0.3). The normal force depends upon the surface area of contact between the packerfoot and the borehole and the pressure inside the packerfoot bladder, which will normally be between 500–1600 psi, and can be as high as 2400 psi. When inflated, the surface area of contact between each packerfoot and the borehole is preferably at least 6 $in^{2,}$ more preferably at least 9 $in^{2,}$ even more preferably at least 13 $in^{2,}$ and most preferably at least 18 $in^{2.}$ Those in the art will understand that fluid seals are preferably provided throughout the EST, to prevent drilling fluid leakage that could render the tool inoperable. For example, the propulsion cylinders and packerfeet are preferably sealed to prevent leakage to annulus 40. Annular pistons 1140, 1142, 1144, and 1146 are preferably sealed to prevent fluid flow between the rear and front chambers of the propulsion cylinders. The interfaces between the various housings of control assembly 1102 and the flanges of shafts 1118 and 1124 are preferably sealed to prevent leakage. Compensation piston 1248 is sealed to fluidly separate the oil in electronics housing 1130 and motor housing 1132 from drilling fluid in annulus 40. Various other seals are also provided throughout the tractor. Suitable seals include rubber O-rings, tee seals, or specialized elastomeric seals. Suitable seal materials include AFLAS or NBR rubber.

Sensors

As mentioned above, the control algorithm for controlling motorized valves 1154, 1156, and 1158 is preferably based at least in part upon (1) pressure signals from pressure transducers 1182, 1184, 1186, 1188, and 1190 (FIGS. 30 and 31A–F), (2) position signals from displacement sensors 1192 and 1194 (FIGS. 31A–F) on the annular pistons inside the aft and forward propulsion cylinders, or (3) both.

The pressure transducers measure differential pressure between the various fluid passages and annulus 40. When pressure information from the above-listed pressure transducers is combined with the differential pressure across the differential pressure sub for the downhole motor, the speed can be controlled between 0.25–2000 feet per hour. That is, the tractor can maintain speeds of 0.25 feet per hour, 2000 feet per hour, and intermediate speeds as well. In a preferred embodiment, such speeds can be maintained for as long as required and, essentially, indefinitely so long as the tractor does not encounter an obstruction which will not permit the tractor to move at such speeds. Differential pressure information is especially useful for control of relatively higher speeds such as those used while tripping into and out of a borehole (250–1000 feet per hour), fast controlled drilling (5–150 feet per hour), and short trips (30–1000 feet per hour). The EST can sustain speeds within all of these ranges. Suitable pressure transducers for the EST are Product No. 095A201A, manufactured and sold by Industrial Sensors and Instruments Incorporated, located in Roundrock, Tex. These pressure transducers are rated for 15000 psi operating pressure and 2500 psid differential pressure.

The position of the annular pistons of the propulsion cylinders can be measured using any of a variety of suitable sensors, including Hall Effect transducers, MIDIM (mirror image differential induction-amplitude magnetometer, sold by Dinsmore Instrument Co., Flint, Mich.) devices, conventional magnetometers, Wiegand sensors, and other magnetic and distance-sensitive devices. If magnetic displacement sensors are used, then the components of the EST are preferably constructed of non-magnetic materials which will not interfere with sensor performance. Suitable materials are CuBe and Stabaloy. Magnetic materials can be used if non-magnetic sensors are utilized.

For example, displacement of aft piston 1142 can be measured by locating a MIDIM in connector 1122 and a small magnetic source in piston 1142. The MIDIM transmits an electrical signal to logic component 1224 which is inversely proportional to the distance between the MIDIM and the magnetic source. As piston 1142 moves toward the MIDIM, the signal increases, thus providing an indication of the relative longitudinal positions of piston 1142 and the MIDIM. Of course, this provides an indication of the relative longitudinal positions of aft packerfoot 1104 and the tractor body, i.e., the shafts and control assembly 1102. In addition, displacement information is easily converted into speed information by measuring displacement at different time intervals.

Another type of displacement sensor which can be used is a Wiegand sensor. In one embodiment, a wheel is provided on one of the annular pistons in a manner such that the wheel rotates as the piston moves axially within one of the propulsion cylinders. The wheel includes two small oppositely charged magnets positioned on opposite sides of the wheel's outer circumference. In other words, the magnets are separated by 180°. The Wiegand sensor senses reversals in polarity of the two magnets, which occurs every time the wheel rotates 180°. For every reversal in polarity, the sensor sends an electric pulse signal to logic component 1224. When piston 1142 moves axially within cylinder 1110, causing the wheel to rotate, the Wiegand sensor transmits a stream of electric pulses for every 180° rotation of the wheel. The position of the piston 1142 with respect to the propulsion cylinder can be determined by monitoring the number of pulses and the direction of piston travel. The position can be calculated from the wheel diameter, since each pulse corresponds to one half of the wheel circumference.

Figures 104A, 104B:
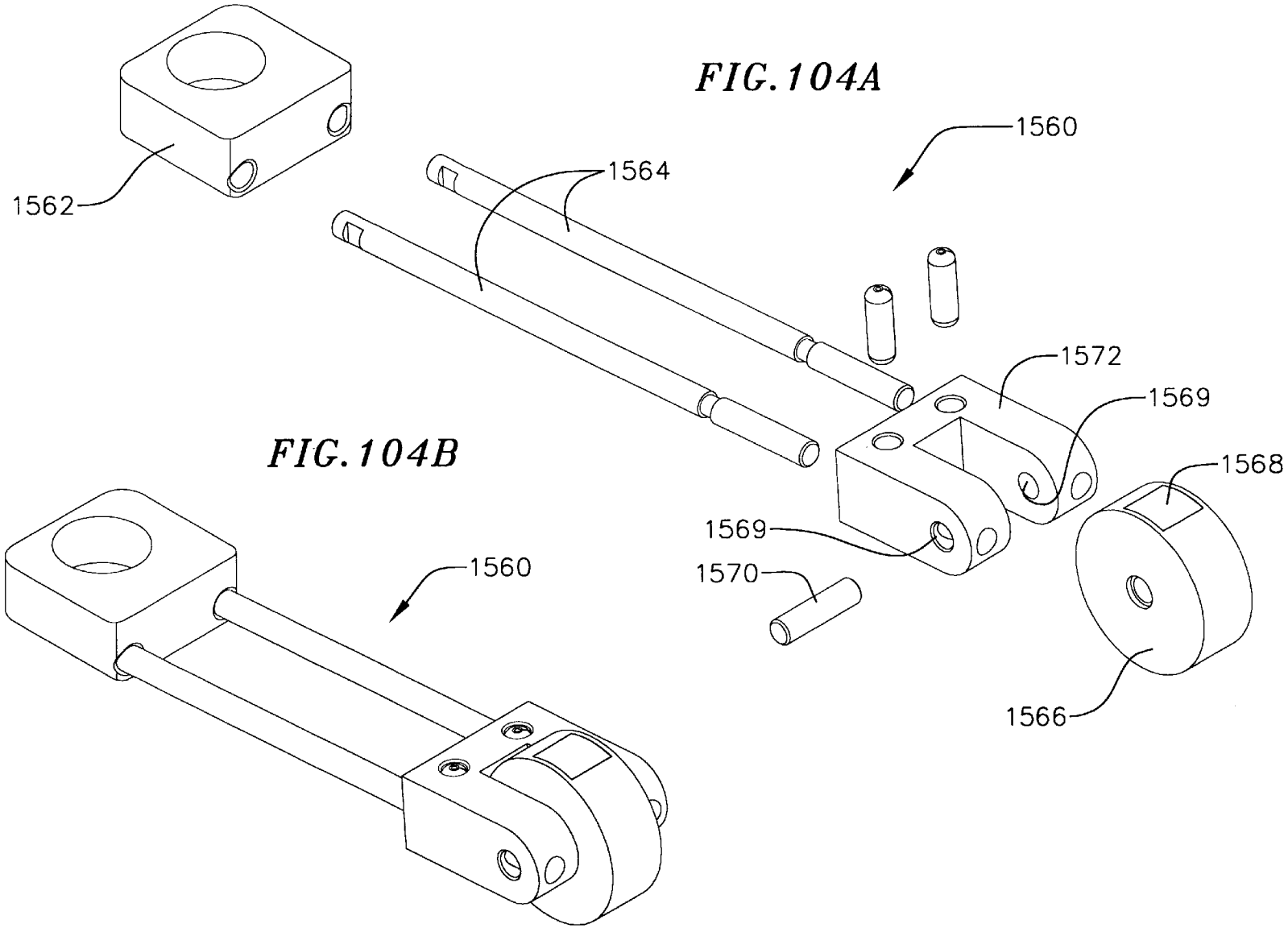
FIG. 104A is a front perspective view of a Wiegand wheel assembly, shown disassembled.
FIG. 104B is a front perspective view of the Wiegand wheel assembly of FIG. 77A, shown assembled.
Figure 104C:
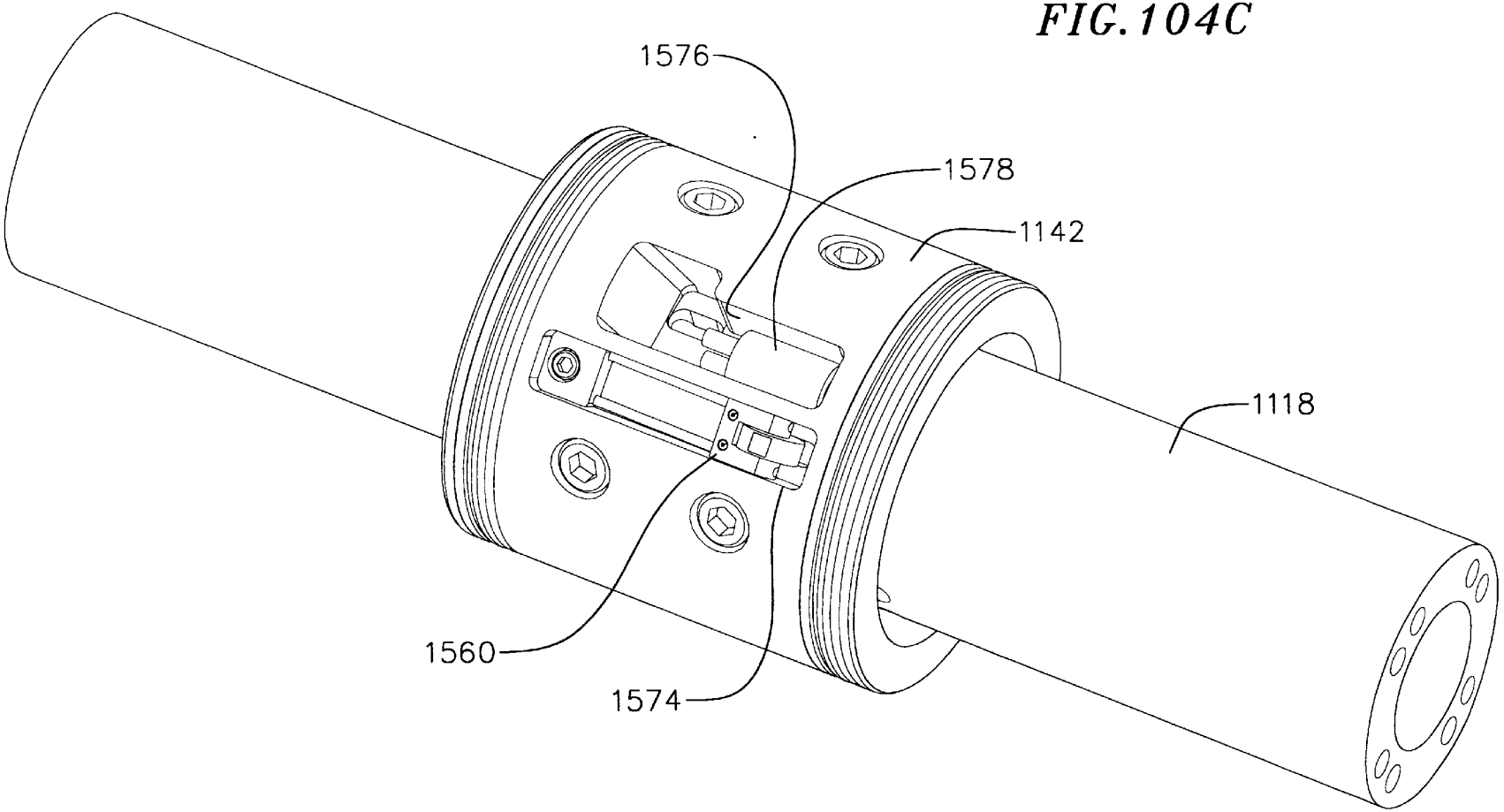
FIG. 104C is front perspective view of a piston having a Wiegand displacement sensor.

FIGS. 104A–C illustrate one embodiment of a Wiegand sensor assembly. As shown, annular piston 1142 includes recesses 1574 and 1576 in its outer surface. Recess 1574 is sized and configured to receive a wheel assembly 1560, shown in FIGS. 104A and 104B. Wheel assembly 1560 comprises a piston attachment member 1562, arms 1564, a wheel holding member 1572, axle 1570, and wheel 1566. Wheel 1566 rotates on axle 1570 which is received within holes 1569 in wheel holding member 1572. Members 1562 and 1572 have holes for receiving arms 1564. Wheel assembly 1560 can be secured within recess 1574 via a screw received within a hole in piston attachment member 1562. Arms 1564 are preferably somewhat flexible to bias wheel 1566 against the inner surface of propulsion cylinder 1110, so that the wheel rotates as piston 1142 moves within cylinder 1110. Wheel 1566 has oppositely charged magnets 1568 separated by 180° about the center of the wheel. Recess 1576 is sized and configured to receive a Wiegand sensor 1578 which senses reversals of polarity of magnets 1568, as described above. The figures do not show the electric wires through which the electric signals flow. Preferably, the wires are twisted to prevent electrical interference from the motors or other components of the EST.

Those skilled in the art will understand that the relevant displacement information can be obtained by measuring the displacement of any desired location on the EST body (shafts 1118, 1124, control assembly 1102) with respect to each of the packerfeet 1104 and 1106. A convenient method is to measure the displacement of the annular pistons (which are fixed to shafts 1118 and 1124) with respect to the propulsion cylinders or connectors (which are fixed with respect to the packerfeet). In one embodiment, the displacement of piston 1142 is measured with respect to connector 1122. Alternatively, the displacement of piston 1142 can be measured with respect to an internal wall of propulsion cylinder 1110 or to control assembly 1102. The same information is obtained by measuring the displacement of piston 1140. Those skilled in the art will understand that it is sufficient to measure the position of only one of pistons 1140 and 1142, and only one of pistons 1144 and 1146, relative to packerfeet 1104 and 1106, respectively.

Electronics Configuration

FIG. 96 illustrates one embodiment of the electronic configuration of the EST. All of the wires shown reside within wire passages described above. As shown, five wires extend uphole to the surface, including two 30 volt power wires 1502, an RS 232 bus wire 1504, and two 1553 bus wires 1506 (MIL-STD-1553). Wires 1502 provide power to the EST for controlling the motors, and electrically communicate with a 1 O-pin connector that plugs into electronics package 1224 of electronics housing 1130. Wire 1504 also communicates with electronics package 1224. Desired EST parameters, such as speed, thrust, position, etc., may be sent from the surface to the EST via wire 1504. Wires 1506 transmit signals downhole to the bottom hole assembly. Commands can be sent from the surface to the bottom hole assembly via wires 1506, such as commands to the motor controlling the drill bit.

A pair of wires 1508 permits electrical communication between electronics package 1224 and the aft displacement sensor, such as a Wiegand sensor as shown. Similarly, a pair of wires 1510 permits communication between package 1224 and the forward displacement sensor as well. Wires 1508 and 1510 transmit position signals from the sensors to package 1224. Another RS 232 bus 1512 extends from package 1224 downhole to communicate with the bottom hole assembly. Wire 1512 transmits signals from downhole sensors, such as weight on bit and differential pressure across the drill bit, to package 1224. Another pair of 30 volt wires 1514 extend from package 1224 downhole to communicate with and provide power to the bottom hole assembly.

A 29 -pin connector 1213 is provided for communication between electronics package 1224 and the motors and pressure transducers of control assembly 1102. The signals from the five pressure transducers may be calibrated by calibration resistors 1515. Alternatively, the calibration resistors may be omitted. Wires 1516 and 1518 and wire pairs 1520, 1522, 1524, 1526, and 1528 are provided for reading electronic pressure signals from the pressure transducers, in a manner known in the art. Wires 1516 and 518 extend to each of the resistors 1515, each of which is connected via four wires to one pressure transducer. Wire pairs 1520, 1522, 1524, 1526, and 1528 extend to the resistors 1515 and pressure transducers.

Wire foursomes 1530, 1532, and 1534 extend to motors 1164, 1162, and 1160, respectively, which are controlled in a manner known to those skilled in the art. Three wires 1536 and a wire 1538 extend to the rotary accelerometers 1531 of the motors for transmitting motor feedback to electronics package 1224 in a manner known to those skilled in the art. In particular, each wire 1536 extends to one accelerometer, for a positive signal. Wire 1538 is a common ground and is connected to all of the accelerometers. In an alternative embodiment, potentiometers may be provided in place of the rotary accelerometers. Note that potentiometers measure the rotary displacement of the motor output.

As mentioned above, a string of multiple tractors can be connected end to end to provide greater overall capability. For example, one tractor may be more suited for tripping, another for drilling, and another for milling. Any number and combination of tractors may be provided. Any number of the tractors may be operating, while others are deactivated. In one embodiment, a set of tractors includes a first tractor configured to move at speeds within 600–2000 feet per hour, a second tractor configured to move at speeds within 10–250 feet per hour, and a third tractor configured to move at speeds within 1–10 feet per hour. On the other hand, by providing multiple processors or a processor capable of processing the motors in parallel, a single tractor of the illustrated EST can move at speeds roughly between 10–750 feet per hour.

Figure 97:
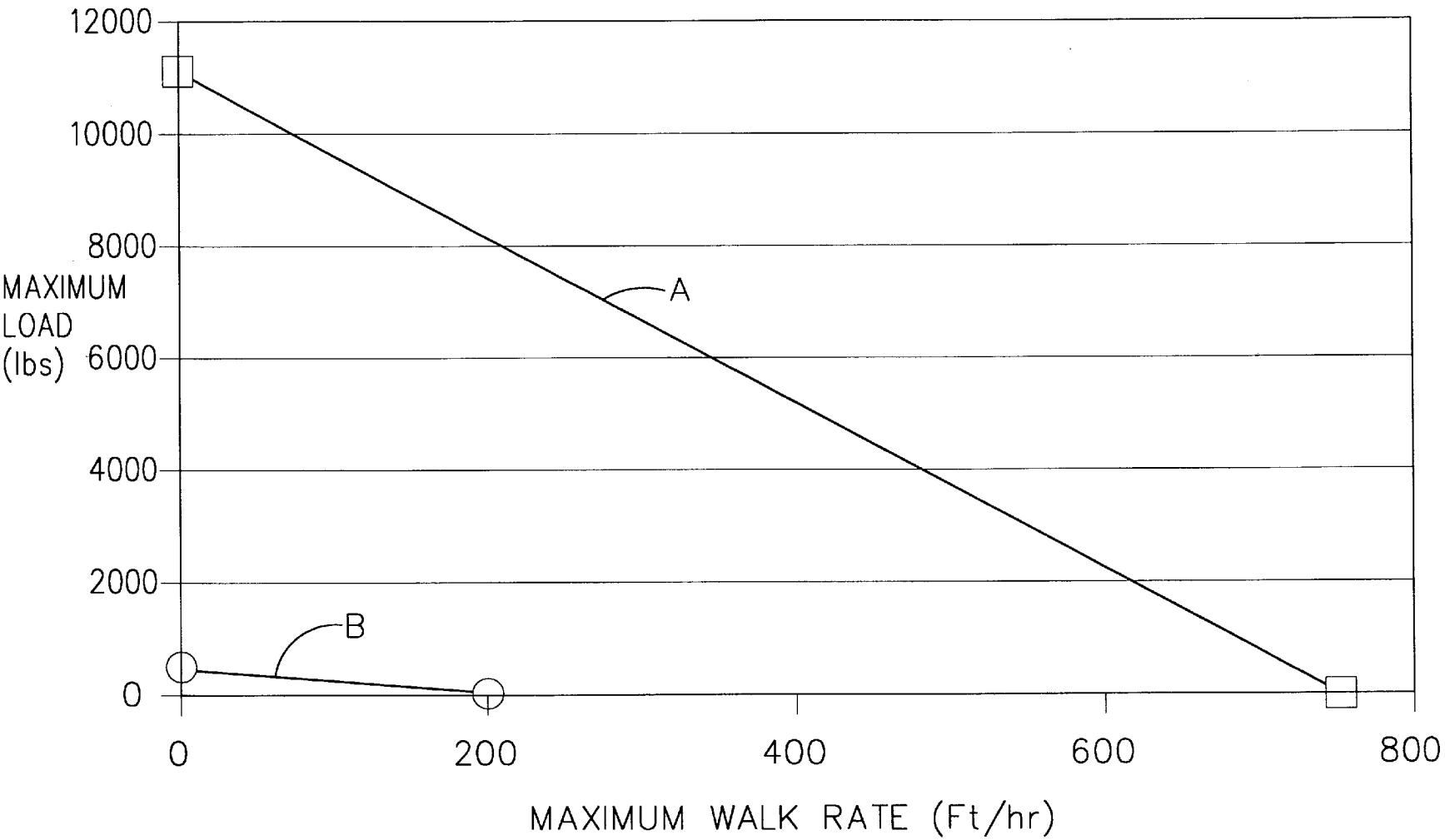
FIG. 97 is a graph illustrating the speed and load-carrying capability range of the EST.
Figure 98:
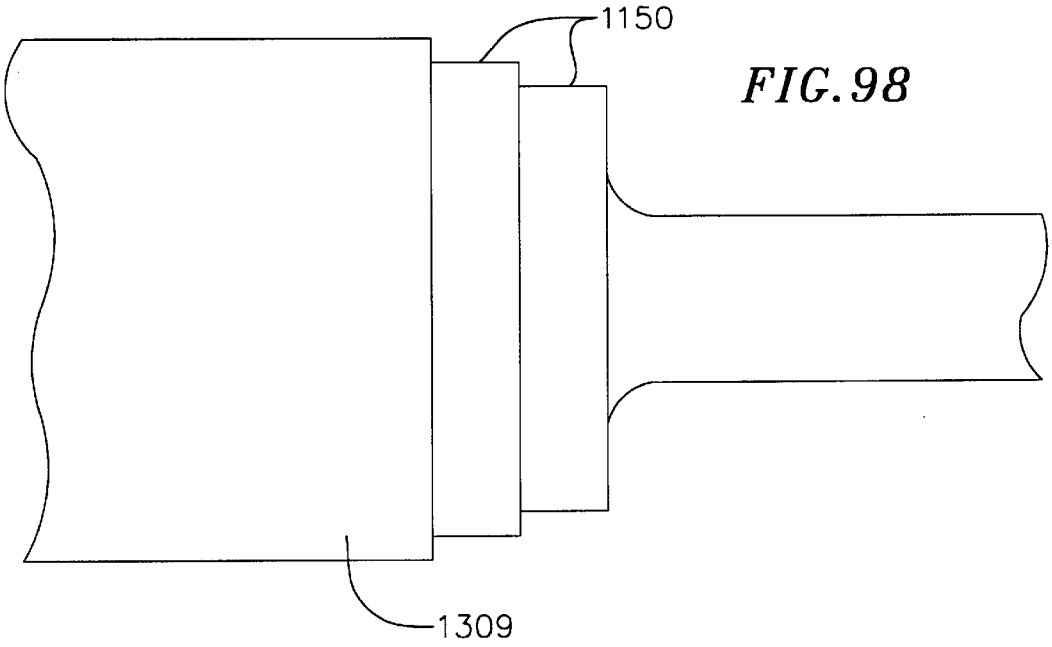
FIG. 98 is an exploded longitudinal sectional view of a stepped valve spool.
Figure 99:
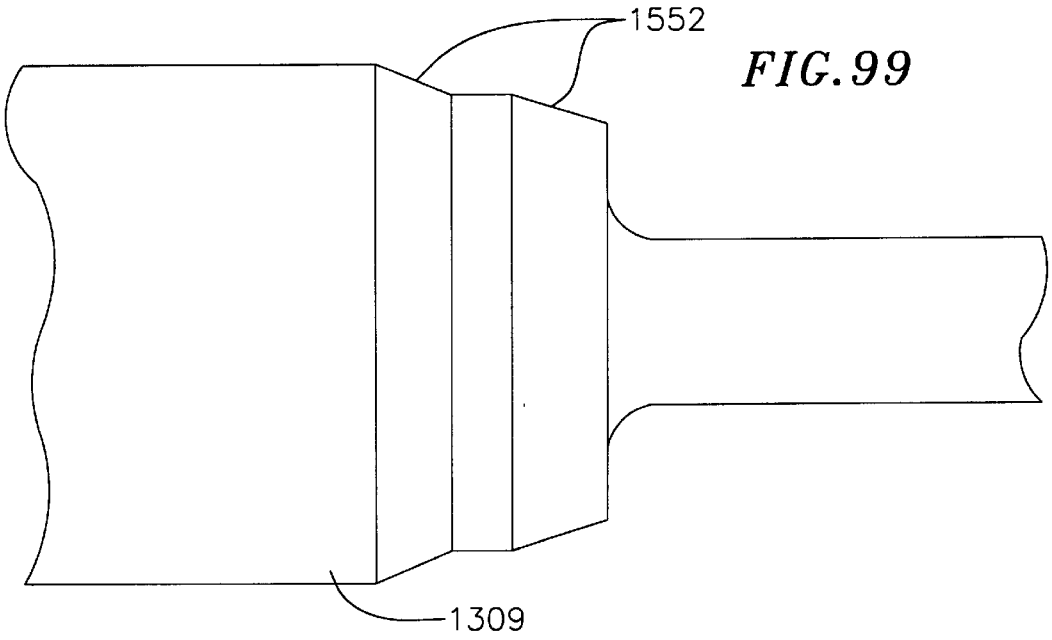
FIG. 99 is an exploded longitudinal sectional view of a stepped tapered valve spool.

FIG. 97 shows the speed performance envelope, as a function of load, of one embodiment of the EST, having a diameter of 3.375 inches. Curve B indicates the performance limits imposed by failsafe valve 1150, and curve A indicates the performance limits imposed by relief valve 1152. Failsafe valve 1150 sets a minimum supply pressure, and hence speed, for tractor operation. Relief valve 1152 sets a maximum supply pressure, and hence speed.

The EST is capable of moving continuously, due to having independently controllable propulsion cylinders and independently inflatable packerfeet.

When drilling a hole, it is desirable to drill continuously as opposed to periodically. Continuous drilling increases bit life and maximizes drilling penetration rates, thus lower drilling costs. It is also desirable to maintain a constant load on the bit. However, the physical mechanics of the drilling process make it difficult to maintain a constant load on the bit. The drill string (coiled tubing) behind the tractor tends to get caught against the hole wall in some portions of the well and then suddenly release, causing large fluctuations in load. Also, the bit may encounter variations in the hardness of the formation through which it is drilling. These and other factors may contribute to create a time-varying load on the tractor. Prior art tractors are not equipped to respond effectively to such load variations, often causing the drill bit to become damaged. This is partly because prior art tractors have their control systems located at the surface. Thus, sensor signals must travel from the tool up to the surface to be processed, and control signals must travel from the surface back down to the tool.

For example, suppose a prior art drilling tool is located 15,000 feet underground. While drilling, the tool may encounter a load variation due to a downhole obstruction such as a hard rock. In order to prevent damage to the drill bit, the tool needs to reduce drilling thrust to an acceptable level or perhaps stop entirely. With the tool control system at the surface, the time required for the tool to communicate the load variation to the control system and for the control system to process the load variation and transmit tool command signals back to the tool would likely be too long to prevent damage to the drill bit.

In contrast, the unique design of the EST permits the tractor to respond very quickly to load variations. This is partly because the EST includes electronic logic components on the tool instead of at the surface, reducing communication time between the logic, sensors, and valves. Thus, the feedback control loop is considerably faster than in prior art tools. The EST can respond to a change of weight on the bit of 100 pounds preferably within 2 seconds, more preferably within 1 second, even more preferably within 0.5 seconds, even more preferably within 0.2 seconds, and most preferably within 0.1 seconds. That is, the weight on the drill bit can preferably be changed at a rate of 100 pounds within 0.1 seconds. If that change is insufficient, the EST can continue to change the weight on the bit at a rate of 100 pounds per 0.1 seconds until a desired control setting is achieved (the differential pressure from the drilling motor is reduced, thus preventing a motor stall). For example, if the weight on the drill bit suddenly surges from 2000 lbs to 3000 lbs due to external conditions, the EST can compensate, i.e. reduce the load on the bit from 3000 lbs to 2000 lbs, in one second.

Typically, the drilling process involves placing casings in boreholes. It is often desirable to mill a hole in the casing to initiate a borehole having a horizontal component. It is also desirable to mill at extremely slow speeds, such as 0.25–4 feet per hour, to prevent sharp ends from forming in the milled casing which can damage drill string components or cause the string to get caught in the milled hole. The unique design of propulsion valves 1156 and 1158 coupled with the use of displacement sensors allows a single EST to mill at speeds less than 1 foot per hour, and more preferably as low as or even less than 0.25 feet per hour. Thus, appropriate milling ranges for an EST are 0.25- . 25 feet per hour, 0.25–10 feet per hour, and 0.25–6 feet per hour with appropriate non-barite drilling fluids.

After milling a hole in the casing, it is frequently desirable to exit the hole at a high angle turn. The EST is equipped with flexible connectors 1120, 1122, 1126, and 1128 between the packerfeet and the propulsion cylinders, and flexible shafts 1118 and 1124. These components have a smaller diameter than the packerfeet, propulsion cylinders, and control assembly, and are formed from a flexible material such as CuBe. Desirably, the connectors and shafts are formed from a material having a modulus of elasticity of preferably at least 29,000,000 psi, and more preferably at least 19,000,000 psi. This results in higher flexibility regions of the EST that act as hinges to allow the tractor to perform high angle turns. In one embodiment, the EST can turn at an angle up to 60° per 100 feet of drilled arc, and can then traverse horizontal distances of up to 25,000–50,000 feet.

The tractor design balances such flexibility against the desirability of having relatively long propulsion cylinders and packerfeet. It is desirable to have longer propulsion cylinders so that the stroke length of the pistons is greater. The stroke length of pistons of an EST having a diameter of 3.375 inches is preferably at least 10–20 inches, and more preferably at least 12 inches. In other embodiments, the stroke length can be as high as 60 inches. It is also desirable to have packerfeet of an appropriate length so that the tool can more effectively engage the inner surface of the borehole. The length of each packerfoot is preferably at least 15 inches, and more preferably at least 40 inches depending upon design type. As the length of the propulsion cylinders and packerfeet increase, the ability of the tool to turn at high angles decreases. The EST achieves the above-described turning capability in a design in which the total length of the propulsion chambers, control assembly, and packerfeet comprises preferably at least 50% of the total length of the EST and, in other design variations, 50%–80%, and more preferably at least 80% of the total length of the EST. Despite such flexibility, a 3.375 inch diameter EST is sufficiently strong to push or pull longitudinal loads preferably as high as 10,500 pounds.

The EST resists torsional compliance, i.e. twisting, about its longitudinal axis. During drilling, the formation exerts a reaction torque through the drill bit and into the EST body. When the aft packerfoot is engaged with the borehole and the forward packerfoot is retracted, the portion of the body forward of the aft packerfoot twists slightly. Subsequently, when the forward packerfoot becomes engaged with the borehole and the aft packerfoot is deflated, the portion of the body to the aft of the forward packerfoot tends to untwist. This causes the drill string to gradually become twisted. This also causes the body to gradually rotate about its longitudinal axis. The tool direction sensors must continuously account for such rotation. Compared to prior art tractors, the EST body is advantageously configured to significantly limit such twisting. Preferably, the shaft diameter is at least 1.75 inches and the control assembly diameter is at least 3.375 inches, for this configuration. When such an EST is subjected to a torsional load as high as 500 ft-lbs about its longitudinal axis, the shafts and control assembly twist preferably less than 5° per step of the tractor. Advantageously, the above-mentioned problems are substantially prevented or minimized. Further, the EST design includes a non-rotational engagement of the packerfeet and shafts, via rotation restraints 1364 (FIG. 76A). This prevents torque from being transferred to the drill string, which would cause the drill string to rotate. Also, the flextoe packerfeet of the EST provide improved transmission of torque to the borehole wall, via the flextoes.

When initiating further drilling at the bottom of a borehole, it is desirable to "tag bottom," before drilling. Tagging bottom involves moving at an extremely slow speed when approaching the end of the borehole, and reducing the speed to zero at the moment the drill bit reaches the end of the formation. This facilitates smooth starting of the drill bit, resulting in longer bit life, fewer trips to replace the bit, and hence lower drilling costs. The EST has superior speed control and can reverse direction to allow efficient tagging of the bottom and starting the bit. Typically, the EST will move at near maximum speed up to the last 50 feet before the bottom of the hole. Once within 50 feet, the EST speed is desirably reduced to about 12 feet per hour until within about 10 feet of the bottom. Then the speed is reduced to minimum. The tractor is then reversed and moved backward 1–2 feet, and then slowly moved forward.

When drilling horizontal holes, the cuttings from the bit can settle on the bottom of the hole. Such cuttings must be periodically be swept out by circulating drilling fluid close to the cutting beds. The EST has the capability of reversing direction and walking backward, dragging the bit whose nozzles sweep the cuttings back out.

As fluid moves through a hole, the hole wall tends to deteriorate and become larger. The EST's packerfeet are designed to traverse holes up to 10% larger than the drill bit without losing traction.

The gripper or packerfoot embodiments described previously are useful in the drilling tractor component of this invention, although improvements also can be made. These include: (1) use of improved materials for the expandable bladder which comprises substituting fiberglass filaments such as S-glass (Asahi) for the nylon reinforcing fibers; (2) extending the length of the attachments at the ends of the bladder from about four inches to about fourteen inches on each end; and (3) addition of a toe strap for holding the packer toes circumferentially in place.

We claim:

1. A long reach rotary drilling assembly for drilling a bore in an underground formation, the assembly including an elongated rotary drill pipe extending from the surface through the bore; a drill bit mounted at a forward end of the drill pipe for drilling the bore through the formation; a 3-D steering tool secured to the drill pipe for making inclination angle adjustments and azimuth angle adjustments at the drill bit during steering, including an onboard telemetry section to receive inclination angle and azimuth angle commands together with actual inclination angle and azimuth angle feedback signals during steering for use in controlling steering of the drill bit along a desired course; the 3-D steering tool comprising a rotary section and a flex section; in which the flex section includes an elongated drive shaft coupled to the drill bit and adapted to be rotatably driven for rotating the drill bit, the drive shaft being bendable laterally to define a deflection angle thereof, and a deflection actuator coupled to the drive shaft, the deflection actuator comprising a deflection housing surrounding the drive shaft and having a longitudinal axis and an elongated deflection piston movable in the deflection housing for applying a lateral bending force to the drive shaft for bending a wall section of the drive shaft away from the axis of the deflection housing while opposite end sections of the drive shaft are constrained by the housing for making changes in the deflection angle of the drive shaft which is transmitted to the drill bit as an inclination angle steering adjustment; in which the rotary section is coupled to the deflection actuator and includes a rotator actuator for transmitting a rotational force to the deflection actuator to rotate the deflection piston to thereby change the rotational angle at which the lateral bending force is applied to the drive shaft which is transmitted to the drill bit as an azimuth angle steering adjustment; and in which the telemetry section includes sensors for measuring the inclination angles and the azimuth angles of the steering tool while drilling, input signals proportional to the desired inclination angle and azimuth angle of the steering tool, and a feedback loop for processing measured and desired inclination angle and azimuth angle command signals for controlling operation of the deflection actuator for making inclination angle steering adjustments and for controlling operation of the rotary actuator for making azimuth angle steering adjustments; and a drilling tractor secured to the drill pipe, the tractor comprising a body, a gripper secured to the body, including a gripper portion having a first position which limits movement of the gripper portion relative to the inner surface of the bore and having a second position in which the gripper portion permits relative movement between the gripper portion and the inner surface of the bore, a propulsion assembly for selectively continuously pulling and thrusting the body with respect to the gripper portion in the first position, and an onboard controller for controlling thrust or pull or speed of the tractor in the bore, the tractor applying force to the drill bit for drilling the bore along the desired course the direction of which is controlled by the steering tool, rotary torque for driving the drill bit transmitted from the surface through the drill pipe and structural components of the 3-D steering tool and the drilling tractor.

2. Apparatus according to claim 1 in which the telemetry section for the 3-D steering tool comprises mud pulse telemetry, and in which the propulsion assembly for the tractor comprises mud pulse telemetry for regulating pressure and/or flow of fluid within the tractor.

3. Apparatus according to claim 1 in which the telemetry section for the 3-D steering tool comprises an integral electrical wire telemetry system, and in which signals to the onboard controller for the tractor are delivered via the integral electrical wire telemetry system.

4. Apparatus according to claim 1 including a measurement-while-drilling tool for providing drill bit positional information to the controls for the steering tool.

5. Apparatus according to claim 1 in which the drilling tractor comprises:

a tractor body having a plurality of thrust receiving portions;

at least one valve on said tractor body positioned along at least one of a plurality of fluid flow paths between a source of fluid and said thrust receiving portions;

a plurality of grippers, each of said plurality of grippers being longitudinally movably engaged with said body, each of said plurality of grippers having an actuated position in which said gripper limits movement of said gripper relative to an inner surface of said borehole and a retracted position in which said gripper permits substantially free relative movement of said gripper relative to said inner surface, said plurality of grippers, said plurality of thrust receiving portions and said valves being configured such said tractor can propel itself at a sustained rate of less than 50 feet per hour and at a sustained rate of greater than 100 feet per hour.

6. Apparatus according to claim 1 in which the drilling tractor comprises:

a tractor body having a thrust-receiving portion having a rear surface and a front surface;

a spool valve comprising:

a valve body having a spool passage defining a spool axis, said valve body having fluid ports which communicate with said spool passage; and an elongated spool received within said spool passage and movable along said spool axis to control flowrates along fluid flow paths through said fluid ports and said spool passage, said spool having a first position range in which said valve permits fluid flow from a fluid source to said rear surface of said thrust-receiving portion and blocks fluid flow to said front surface, the flowrate of said fluid flow to said rear surface varying depending upon the position of said spool within said first position range, said fluid flow to said rear surface delivering downhole thrust to said body, the magnitude of said downhole thrust depending on the flowrate of said fluid flow to said rear surface, said spool having a second position range in which said valve permits fluid flow from said fluid source to said front surface of said thrust-receiving portion and blocks fluid flow to said rear surface, the flowrate of said fluid flow to said front surface varying depending upon the position of said spool within said second position range, said fluid flow to said front surface delivering uphole thrust to said body, the magnitude of said uphole thrust depending on the flowrate of said fluid flow to said front surface;

a motor on said tractor body;

a coupler connecting said motor and said spool so that operation of said motor causes said spool to move along said spool axis; and a gripper longitudinally movably engaged with said tractor body, said gripper having an actuated position in which said gripper limits movement of said gripper relative to an inner surface of said borehole and a retracted position in which said gripper permits substantially free relative movement of said gripper relative to said inner surface;

wherein said motor is operable to move said spool along said spool axis sufficiently fast to alter the net thrust received by said thrust-receiving portion by 100 pounds within 2 seconds.

7. Apparatus according to claim 6, wherein said sensors include a first pressure sensor configured to measure fluid pressure on said rear side of said thrust-receiving portion of said tractor body, and a second pressure sensor configured to measure fluid pressure on said front side of said thrust-receiving portion.

8. Apparatus according to claim 6, wherein said sensors include a displacement sensor configured to measure the position of said thrust-receiving portion with respect to said gripper.

9. Apparatus according to claim 6, wherein said sensors include a rotary accelerometer configured to measure the angular velocity of said output shaft.

10. Apparatus according to claim 6, wherein said sensors include a potentiometer configured to measure the rotational position of said output shaft.

11. Apparatus according to claim 1, in which the drilling tractor comprises:

a body;

a valve on said body, said valve being positioned along a fluid flow path from a source of a first fluid to a thrust-receiving portion of said body, said valve being movable generally along a valve axis, said valve having a first position in which said valve completely blocks fluid flow along said flow path and a second position in which said valve permits fluid flow along said flow path; a motor on said body;

a coupler connecting said motor and said valve so that operation of said motor causes said valve to move along said valve axis; and a pressure compensation piston exposed on a first side to said first fluid and on a second side to a second fluid, said first and second fluids being fluidly separate, said piston configured to move in response to pressure forces from said first and second fluids so as to effectively equalize the pressure of said first and second fluids;

wherein said valve is exposed to said first fluid, said motor being exposed to said second fluid.

12. Apparatus according to claim 1, in which the drilling tractor comprises:

an elongated body configured to pull equipment within said borehole, said equipment exerting a longitudinal load on said body;

a gripper longitudinally movably engaged with said body, said gripper having an actuated position in which said gripper limits movement between said gripper and an inner surface of said borehole, and a retracted position in which said gripper permits substantially free relative movement between said gripper and said inner surface; and a propulsion system on said body for propelling said body through said borehole while said gripper is in said actuated position;

wherein said body is sufficiently flexible such that said tractor can turn up to 80° per 100 feet of travel, while said longitudinal load is at least 50–30,000 pounds.

13. Apparatus according to claim 12, wherein said body is sufficiently flexible such that said tractor can turn up to 45° per 100 feet of travel, while said longitudinal load is at least 50–30,000 pounds.

14. Apparatus according to claim 12, wherein said body is sufficiently flexible such that said tractor can turn up to 600 per 100 feet of travel, while said longitudinal load is at least 50–30,000 pounds.

15. Apparatus according to claim 1, including a set of two or more connected tractors for moving within the borehole, comprising a logic component and said tractors, each of said tractors comprising:

an elongated tractor body having first and second thrust-receiving portions, each thrust receiving portion having a first surface and a second surface generally opposing said first surface;

a first gripper longitudinally movable with respect to said first thrust-receiving portion, said first gripper having an actuated position in which said first gripper limits movement of said first gripper relative to an inner surface of said borehole and a retracted position in which said first gripper permits substantially free relative movement between said first gripper and said inner surface;

a second gripper longitudinally movable with respect to said second thrust-receiving portion, said second gripper having an actuated position in which said second gripper limits movement of said second gripper relative to said inner surface and a retracted position in which said second gripper permits substantially free relative movement between said second gripper and said inner surface;

one or more valves on said tractor body controlling:

a first flowrate, said first flowrate being the flowrate of fluid flowing to and imparting thrust to said first surface of said first thrust-receiving portion;

a second flowrate, said second flowrate being the flowrate of fluid flowing to and providing thrust to said second surface of said first thrust-receiving portion;

a third flowrate, said third flowrate being the flowrate of fluid flowing to and providing thrust to said first surface of said second thrust-receiving portion;

a fourth flowrate, said fourth flowrate being the flowrate of fluid flowing to and providing thrust to said second surface of said second thrust-receiving portion;

actuation and retraction of said first gripper; and actuation and retraction of said second gripper; and wherein said logic component controls said valves of said tractors so as to actuate and retract one or more of said first grippers simultaneously, and also to actuate and retract one or more of said second grippers simultaneously.

16. Apparatus according to claim 15, wherein each of said tractors includes sensors on said tractor body, said sensors comprising one or more of:

position sensors sensing the positions of said thrust-receiving portions with respect to said grippers;

pressure sensors sensing the pressures of said first, second, third, and fourth flowrates; and one of rotary accelerometers or potentiometers sensing the output of said motors;

wherein said sensors are configured to transmit electronic signals to said logic component.

17. A long reach drilling assembly for drilling a bore in an underground formation, the assembly including an elongated conduit extending from the surface through the bore; a drill bit mounted at a forward end of the conduit for drilling the bore through the formation; a 3-D steering tool secured to the conduit for making directional adjustments at the drill for use in controlling steering of the drill bit along a desired course; and a drilling tractor secured to the conduit, the tractor comprising a body, a gripper secured to the body, including a gripper portion having a first position which limits movement of the gripper portion relative to the inner surface of the bore and a second position in which the gripper portion permits relative movement between the gripper portion and the inner surface of the bore, a propulsion assembly for selectively continuously pulling and thrusting the body with respect to the gripper portion in the first position, and an onboard controller for controlling thrust to pull or speed of the tractor in the bore, the tractor applying force to the drill bit for drilling the bore along the desired course the direction of which is controlled by the steering tool; and in which the 3-D steering tool comprises an integrated telemetry section, rotary section and flex section; in which the flex section includes an elongated drive shaft coupled to the drill bit and adapted to be rotatably driven for rotating the drill bit, the drive shaft being bendable laterally to define a deflection angle thereof, and a deflection actuator coupled to the drive shaft, the deflection actuator comprising a deflection housing surrounding the drive shaft and having a longitudinal axis and an elongated deflection piston movable in the deflection housing for applying a lateral bending force to the drive shaft for making changes in the deflection angle of the drive shaft which is transmitted to the drill bit as an inclination angle steering adjustment; in which the rotary section is coupled to the actuator and includes a rotator actuator for transmitting a rotational force to the deflection actuator to rotate the deflection piston to thereby change the rotational angle at which the lateral bending force is applied to the drive shaft which is transmitted to the drill bit as an azimuth angle steering adjustment; and in which the telemetry section includes sensors for measuring the inclination angles and the azimuth angles of the steering tool while drilling, input signals proportional to the desired inclination angle and azimuth angle of the steering tool, and a feedback loop for processing measured and desired inclination angle and azimuth angle command signals for controlling operation of the deflection actuator for making inclination angle steering adjustments and for controlling operation of the rotary actuator for making azimuth angle steering adjustments.

18. Apparatus according to claim 17 in which the deflection actuator comprises an elongated deflection housing surrounding the drive shaft, and an elongated hydraulically operated piston in the deflection housing for applying a bending force distributed lengthwise along the drive shaft for flexing the drive shaft to change inclination angle at the drill bit.

19. Apparatus according to claim 18 in which the rotator actuator is coupled to the deflection housing and includes a linear piston movable in proportion to a desired change in azimuth angle and a helical gear arrangement on the deflection housing coupled to the linear piston and rotatable in response to piston travel to rotate the deflection housing to change azimuth angle at the drill bit.

20. Apparatus according to claim 17 in which the hydraulically powered bending force is applied to the deflection piston by drilling mud taken from an annulus between the conduit and the borehole.

21. Apparatus according to claim 17 in which the deflection actuator applies the bending force to the drive shaft while the rotator actuator applies the rotational force to the drive shaft for making simultaneous adjustments in inclination angle and azimuth angle.

22. Apparatus according to claim 17 in which the feedback loop comprises a closed loop controller including a comparator for receiving the measured and desired inclination angle and azimuth angle command signals for producing inclination and azimuth error signals for making the steering adjustments.

23. Apparatus according to claim 17 in which the telemetry section comprises an onboard mud pulse telemetry section for receiving desired inclination and azimuth angle signals from the surface and utilizing mud pulse controls for operating the deflection actuator and rotator actuator from drilling mud taken from an annulus between the conduit and the borehole.

24. Apparatus according to claim 23 which the mud pulse telemetry section provides open loop control to the deflection actuator and the rotator actuator, and in which electrical controls provide closed loop control to the actuators.

25. A long reach drilling assembly for moving within a borehole, comprising:

an elongated rotary drill pipe extending from the surface through the bore; a drill bit mounted at a forward end of the drill pipe for drilling the bore through the formation; a 3-D steering tool secured to the drill pipe for making inclination angle adjustments and azimuth angle adjustments at the drill bit during steering, including an onboard telemetry section to receive inclination angle and azimuth angle commands together with actual inclination angle and azimuth angle feedback signals during steering for use in controlling steering of the drill bit along a desired course; the steering tool including a rotary section and a flex section; in which the flex section includes an elongated drive shaft coupled to the drill bit and adapted to be rotatably driven for rotating the drill bit, the drive shaft being bendable laterally to define a deflection angle thereof, and a deflection actuator coupled to the drive shaft, the deflection actuator comprising a deflection housing surrounding the drive shaft and having a longitudinal axis and an elongated deflection piston movable in the deflection housing for applying a lateral bending force to the drive shaft for bending a wall section of the drive shaft away from the axis of the deflection housing while opposite end sections of the drive shaft are constrained by the housing for making changes in the deflection angle of the drive shaft which is transmitted to the drill bit as an inclination angle steering adjustment; in which the rotary section is coupled to the deflection actuator and includes a rotator actuator for transmitting a rotational force to the deflection actuator to rotate the deflection piston to thereby change the rotational angle at which the lateral bending force is applied to the drive shaft which is transmitted to the drill bit as an azimuth angle steering adjustment; and in which the telemetry section includes sensors for measuring the inclination angles and the azimuth angles of the steering tool while drilling, input signals proportional to the desired inclination angle and azimuth angle of the steering tool, and a feedback loop for processing measured and desired inclination angle and azimuth angle command signals for controlling operation of the deflection actuator for making inclination angle steering adjustments and for controlling operation of the rotary actuator for making azimuth angle steering adjustments;

a tractor body sized and shaped to move within the borehole;

a valve on said tractor body, said valve positioned along a flowpath between a source of fluid and a thrust-receiving portion of said body, said valve comprising: a fluid port; and a flow restrictor having a first position in which said restrictor completely blocks fluid flow through said fluid port, a range of second positions in which said restrictor permits a first level of fluid flow through said fluid port, a third position in which said restrictor permits a second level of fluid flow through said fluid port, said second level of fluid flow being greater than said first level of fluid flow; a motor on said tractor body; and a coupler connecting said motor and said flow restrictor, such that movement of said motor causes said restrictor to move between said first position, said range of second positions, and said third position, said restrictor being movable by said motor such that the net thrust received by said thrust receiving portion can be altered by 100 pounds within 0.5 seconds.

26. A long reach rotary drilling assembly for drilling a bore in an underground formation, the assembly including an elongated rotary drill pipe extending from the surface through the bore; a drill bit mounted at a forward end of the rotary drill pipe for drilling the bore through the formation; a 3-D steering tool secured to the drill pipe for making inclination angle adjustments and azimuth angle adjustments at the drill bit during steering, including an onboard steering control section to receive inclination angle and azimuth angle commands together with actual inclination angle and azimuth angle feedback signals during steering for use in controlling steering of the drill bit along a desired course; the steering tool having a rotary section and a flex section; in which the flex section includes an elongated drive shaft coupled to the drill bit and adapted to be rotatably driven for rotating the drill bit, the drive shaft being bendable laterally to define a deflection angle thereof, and a deflection actuator coupled to the drive shaft, the deflection actuator comprising a deflection housing surrounding the drive shaft and having a longitudinal axis and an elongated deflection piston movable in the deflection housing for applying a lateral bending force to the drive shaft for bending a wall section of the drive shaft away from the axis of the deflection housing while opposite end sections of the drive shaft are constrained by the housing for making changes in the deflection angle of the drive shaft which is transmitted to the drill bit as an inclination angle steering adjustment; in which the rotary section is coupled to the deflection actuator and includes a rotator actuator for transmitting a rotational force to the deflection actuator to rotate the deflection piston to thereby change the rotational angle at which the lateral bending force is applied to the drive shaft which is transmitted to the drill bit as an azimuth angle steering adjustment; and in which the telemetry section includes sensors for measuring the inclination angles and the azimuth angles of the steering tool while drilling, input signals proportional to the desired inclination angle and azimuth angle of the steering tool, and a feedback loop for processing measured and desired inclination angle and azimuth angle command signals for controlling operation of the deflection actuator for making inclination angle steering adjustments and for controlling operation of the rotary actuator for making azimuth angle steering adjustments; a drilling tractor secured to the rotary drill pipe, the tractor comprising a body, a gripper secured to the body, including a gripper portion having a first position which limits movement of the gripper portions relative to the inner surface of the bore and having a second position in which the gripper portion permits relative movement between the gripper portion and the inner surface of the bore, a propulsion assembly for selectively continuously pulling and thrusting the body with respect to the gripper portion in the first position, and an onboard controller for controlling thrust or pull or speed of the tractor in the bore; and a measurement-while-drilling device for providing drill bit positional information for the steering tool control section, the tractor applying force to the drill bit for drilling the bore along the desired course the direction of which is controlled by the steering tool, rotary torque for driving the drill bit transmitted from the surface through the drill pipe and structural components of the measurement-while-drilling device, the 3-D steering tool and the drilling tractor.

27. Apparatus according to claim 26 in which the control section for the 3-D steering tool comprises mud pulse telemetry, and in which the propulsion assembly for the tractor comprises mud pulse telemetry for regulating pressure and/or flow of fluid within the tractor.

28. Apparatus according to claim 27 in which the control section for the 3-D steering tool comprises an integral electrical wire telemetry system, and in which the signals to the onboard controller for the tractor are delivered via an integral wire electrical telemetry system.

29. Apparatus according to claim 27 in which the rotary drill pipe includes a weight-on-bit sensor for use in controlling force applied to the drill bit by the tractor.

30. A long reach rotary drilling assembly for drilling a bore in an underground formation, the assembly including an elongated rotary drill pipe made from a composite material which includes a structural component comprised of a non-metallic material, the composite drill pipe extending from the surface through the bore; a drill bit mounted at a forward end of the drill pipe for drilling the bore through the formation; a 3-D steering tool secured to the drill pipe for making inclination angle adjustments and azimuth angle adjustments at the drill bit during steering, including an onboard telemetry section to receive inclination angle and azimuth angle commands together with actual inclination angle and azimuth angle feedback signals during steering for use in controlling steering of the drill bit along a desired course; the steering tool having a flex section which includes an elongated drive shaft coupled to the drill bit and adapted to be rotatably driven for rotating the drill bit, the drive shaft being bendable laterally to define a deflection angle thereof, and a deflection actuator coupled to the drive shaft, the deflection actuator comprising a deflection housing surrounding the drive shaft and having a longitudinal axis and an elongated deflection piston movable in the deflection housing for applying a lateral bending force to the drive shaft for bending a wall section of the drive shaft away from the axis of the deflection housing while opposite end sections of the drive shaft are constrained by the housing for making changes in the deflection angle of the drive shaft which is transmitted to the drill bit as an inclination angle steering adjustment; in which the steering tool includes a deflection actuator which includes a rotator actuator for transmitting a rotational force to the deflection actuator to rotate the deflection piston to thereby change the rotational angle at which the lateral bending force is applied to the drive shaft which is transmitted to the drill bit as an azimuth angle steering adjustment; and in which the telemetry section includes sensors for measuring the inclination angles and the azimuth angles of the steering tool while drilling, input signals proportional to the desired inclination angle and azimuth angle of the steering tool, and a feedback loop for processing measured and desired inclination angle and azimuth angle command signals for controlling operation of the deflection actuator for making inclination angle steering adjustments and for controlling operation of the rotary actuator for making azimuth angle steering adjustments; and a drilling tractor secured to the drill pipe, the tractor comprising a body, a gripper secured to the body, including a gripper portion having a first position which limits movement of the gripper portion relative to the inner surface of the bore and having a second position in which the gripper portion permits relative movement between the gripper portion and the inner surface of the bore, a propulsion assembly for selectively continuously pulling and thrusting the body with respect to the gripper portion in the first position, and an onboard controller for controlling thrust or pull or speed of the tractor in the bore, the tractor applying force to the drill bit for drilling the bore along the desired course the direction of which is controlled by the steering tool, and in which rotational torque for driving the drill bit is delivered by the composite drill pipe and internal structural components of the 3-D steering tool and the drilling tractor.

31. Apparatus according to claim 30 in which hardwire electrical power and communication lines are integrated into the composite drill pipe for use in communicating control information to and from the 3-D steering tool and the tractor.

32. Apparatus according to claim 31 in which the telemetry section for the 3-D steering tool comprises an electrical wire telemetry system, and in which the signals to the onboard controller for the tractor are delivered via an integral electrical wire telemetry system.

33. Apparatus according to claim 30 in which the drill pipe includes a measurement-while-drilling tool for providing drill bit positional information to the controls for the steering tool.

34. Apparatus according to claim 30 in which the composite rotary drill pipe is in multiple sections with wet stab connectors for mechanically and electrically connecting the sections together.

35. Apparatus according to claim 30 in which the composite rotary drill pipe comprises layers of polymeric filament material impregnated with a resinous matrix.

36. A long reach drilling assembly for drilling a bore in an underground formation, the assembly including an elongated rotary drill pipe assembled in sections and extending from the surface through the bore; a drill bit mounted at a forward end of the drill pipe for drilling the bore through the formation; a 3-D steering tool secured to the drill pipe for making inclination angle adjustments and azimuth angle adjustments at the drill bit during steering, including an onboard telemetry section to receive inclination angle and azimuth angle signals together with actual inclination angle and azimuth angle feedback signals during steering for use in controlling steering of the drill bit along a desired course via the telemetry section signals transmitted by integral electrical wire connections contained in the assembled sections of conduit; in which the steering tool includes a flex section having an elongated drive shaft coupled to the drill bit and adapted to be rotatably driven for rotating the drill bit, the drive shaft being bendable laterally to define a deflection angle thereof, and a deflection actuator coupled to the drive shaft, the deflection actuator comprising a deflection housing surrounding the drive shaft and having a longitudinal axis and an elongated deflection piston movable in the deflection housing for applying a lateral bending force to the drive shaft for bending a wall section of the drive shaft away from the axis of the deflection housing while opposite end sections of the drive shaft are constrained by the housing for making changes in the deflection angle of the drive shaft which is transmitted to the drill bit as an inclination angle steering adjustment; in which the steering tool includes a rotary section coupled to the deflection actuator and includes a rotator actuator for transmitting a rotational force to the deflection actuator to rotate the deflection piston to thereby change the rotational angle at which the lateral bending force is applied to the drive shaft which is transmitted to the drill bit as an azimuth angle steering adjustment; and in which the telemetry section includes sensors for measuring the inclination angles and the azimuth angles of the steering tool while drilling, input signals proportional to the desired inclination angle and azimuth angle of the steering tool, and a feedback loop for processing measured and desired inclination angle and azimuth angle command signals for controlling operation of the deflection actuator for making inclination angle steering adjustments and for controlling operation of the rotary actuator for making azimuth angle steering adjustments; and a drilling tractor secured to the drill pipe, the tractor comprising a body, a gripper secured to the body, including a gripper portion having a first position which limits movement of the gripper portion relative to the inner surface of the bore and having a second position in which the gripper portion permits relative movement between the gripper portion and the inner surface of the bore, a propulsion assembly for selectively continuously pulling and thrusting the body with respect to the gripper portion in the first position, and an onboard controller for controlling thrust or pull or speed of the tractor in the bore via signals transmitted by integral wire connections in the assembled sections of conduit, the tractor applying force to the drill bit for drilling the bore along the desired course the direction of which is controlled by the steering tool.

37. Apparatus according to claim 36 in which the drill pipe carries a measurement-while-drilling tool for providing drill bit positional information to the controls for the steering tool.

38. Apparatus according to claim 36 in which the sections of conduit are mechanically and electrically connected together by tool joints with wet stab connectors.

39. A long reach drilling assembly for drilling a bore in an underground formation, the assembly including an elongated conduit extending from the surface through the bore; a drill bit mounted at a forward end of the conduit for drilling the bore through the formation in the absence of a downhole motor; a 3-D steering tool secured to the conduit for making inclination angle adjustments and azimuth angle adjustments at the drill bit during steering, including an onboard telemetry section to receive the inclination angle and steering angle commands together with actual inclination angle and azimuth angle feedback signals during steering for use in controlling steering of the drill bit along a desired course; in which the steering tool includes a flex section having an elongated drive shaft coupled to the drill bit and adapted to be rotatably driven for rotating the drill bit, the drive shaft being bendable laterally to define a deflection angle thereof, and a deflection actuator coupled to the drive shaft, the deflection actuator comprising a deflection housing surrounding the drive shaft and having a longitudinal axis and an elongated deflection piston movable in the deflection housing for applying a lateral bending force to the drive shaft for a wall section of the drive shaft away from the axis of the deflection housing while opposite end sections of the drive shaft are constrained by the housing for making changes in the deflection angle of the drive shaft which is transmitted to the drill bit as an inclination angle steering adjustment; in which the steering tool includes a rotary section coupled to the deflection actuator and includes a rotator actuator for transmitting a rotational force to the deflection actuator to rotate the deflection piston to thereby change the rotational angle at which the lateral bending force is applied to the drive shaft which is transmitted to the drill bit as an azimuth angle steering adjustment; and in which the telemetry section includes sensors for measuring the inclination angles and the azimuth angles of the steering tool while drilling, input signals proportional to the desired inclination angle and azimuth angle of the steering tool, and a feedback loop for processing measured and desired inclination angle and azimuth angle command signals for controlling operation of the deflection actuator for making inclination angle steering adjustments and for controlling operation of the rotary actuator for making azimuth angle steering adjustments; a drilling tractor secured to the conduit, the tractor comprising a body, a gripper secured to the body, including a gripper portion having a first position which limits movement of the gripper portion relative to the inner surface of the bore and a second position in which the gripper portion permits relative movement between the gripper portion and the inner surface of the bore, a propulsion assembly for selectively continuously pulling and thrusting the body with respect to the gripper portion in the first position, and an onboard controller for controlling thrust or pull or speed of the tractor in the bore; a measurement-while-drilling device for providing drill bit positional information for the steering tool telemetry section; and a weight-on-bit sensor for measuring thrust-of-tractor for use in the tractor controller, the tractor applying force to the drill bit for drilling the bore along the desired course the direction of which is controlled by the steering tool.

40. A long reach drilling assembly for drilling a bore in an underground formation, the assembly including an elongated conduit extending through the bore; a drill bit mounted at a forward end of the conduit for drilling the bore through the formation in the absence of a downhole motor; a 3-D steering tool carried on the conduit for making positional changes in three dimensions to steer the drill bit along a desired three-dimensional course, the 3-D steering tool including an onboard closed-loop feedback steering controller for receiving input positional commands and position-related feedback signals for turning the steering tool in response to changes in position-related commands; the 3-D steering tool comprising a rotary section and a flex section; in which the flex section includes an elongated drive shaft coupled to the drill bit and adapted to be rotatably driven for rotating the drill bit, the drive shaft being bendable laterally to define a deflection angle thereof, and a deflection actuator coupled to the drive shaft, the deflection actuator comprising a deflection housing surrounding the drive shaft and having a longitudinal axis and an elongated deflection piston movable in the deflection housing for applying a lateral bending force to the drive shaft for bending a wall section of the drive shaft away from the axis of the deflection housing while opposite end sections of the drive shaft are constrained by the housing for making changes in the deflection angle of the drive shaft which is transmitted to the drill bit as an inclination angle steering adjustment; in which the rotary section is coupled to the deflection actuator and includes a rotator actuator for transmitting a rotational force to the deflection actuator to rotate the deflection piston to thereby change the rotational angle at which the lateral bending force is applied to the drive shaft which is transmitted to the drill bit as an azimuth angle steering adjustment; and in which the telemetry section includes sensors for measuring the inclination angles and the azimuth angles of the steering tool while drilling, input signals proportional to the desired inclination angle and azimuth angle of the steering tool, and a feedback loop for processing measured and desired inclination angle and azimuth angle command signals for controlling operation of the deflection actuator for making inclination angle steering adjustments and for controlling operation of the rotary actuator for making azimuth angle steering adjustments; a measurement-while-drilling device for locating drill bit position and orientation in the bore to produce feedback signals sent to the steering tool controller; and a drilling tractor carried on the conduit for selectively applying force to the drill bit when needed to move the drill bit faster in the direction controlled by the steering tool.

41. A long reach rotary drilling assembly for drilling a bore in an underground formation, the assembly including an elongated rotary drill pipe extending from the surface through the bore; a drill bit mounted at a forward end of the drill pipe for drilling the bore through the formation; a 3-D steering tool secured to the drill pipe for making inclination angle adjustments and azimuth angle adjustments at the drill bit during steering, including an onboard telemetry section to receive inclination angle and azimuth angle commands together with actual inclination angle and azimuth angle feedback signals during steering for use in controlling steering of the drill bit along a desired course; and a drilling tractor secured to the drill pipe, the tractor comprising a body, a gripper secured to the body, including a gripper portion having a first position which limits movement of the gripper portion relative to the inner surface of the bore and having a second position in which the gripper portion permits relative movement between the gripper portion and the inner surface of the bore, a propulsion assembly for selectively continuously pulling and thrusting the body with respect to the gripper portion in the first position, and an onboard controller for controlling thrust or pull or speed of the tractor in the bore, the tractor applying force to the drill bit for drilling the bore along the desired course the direction of which is controlled by the steering tool, rotary torque for driving the drill bit transmitted from the surface through the drill pipe and structural components of the 3-D steering tool and the drilling tractor;

in which the drilling tractor comprises:

a tractor body having a plurality of thrust receiving portions;

at least one valve on said tractor body positioned along at least one of a plurality of fluid flow paths between a source of fluid and said thrust receiving portions; and a plurality of grippers, each of said plurality of grippers being longitudinally movably engaged with said body, each of said plurality of grippers having an actuated position in which said gripper limits movement of said gripper relative to an inner surface of said borehole and a retracted position in which said gripper permits substantially free relative movement of said gripper relative to said inner surface, said plurality of grippers, said plurality of thrust receiving portions and said valves being configured such said tractor can propel itself at a sustained rate of less than 50 feet per hour and at a sustained rate of greater than 100 feet per hour.

42. A long reach rotary drilling assembly for drilling a bore in an underground formation, the assembly including an elongated rotary drill pipe extending from the surface through the bore; a drill bit mounted at a forward end of the drill pipe for drilling the bore through the formation; a 3-D steering tool secured to the drill pipe for making inclination angle adjustments and azimuth angle adjustments at the drill bit during steering, including an onboard telemetry section to receive inclination angle and azimuth angle commands together with actual inclination angle and azimuth angle feedback signals during steering for use in controlling steering of the drill bit along a desired course; and a drilling tractor secured to the drill pipe, the tractor comprising a body, a gripper secured to the body, including a gripper portion having a first position which limits movement of the gripper portion relative to the inner surface of the bore and having a second position in which the gripper portion permits relative movement between the gripper portion and the inner surface of the bore, a propulsion assembly for selectively continuously pulling and thrusting the body with respect to the gripper portion in the first position, and an onboard controller for controlling thrust or pull or speed of the tractor in the bore, the tractor applying force to the drill bit for drilling the bore along the desired course the direction of which is controlled by the steering tool, rotary torque for driving the drill bit transmitted from the surface through the drill pipe and structural components of the 3-D steering tool and the drilling tractor;

in which the drilling tractor comprises:

a tractor body having a thrust-receiving portion having a rear surface and a front surface;

a spool valve comprising:

a valve body having a spool passage defining a spool axis, said valve body having fluid ports which communicate with said spool passage; and an elongated spool received within said spool passage and movable along said spool axis to control flowrates along fluid flow paths through said fluid ports and said spool passage, said spool having a first position range in which said valve permits fluid flow from a fluid source to said rear surface of said thrust-receiving portion and blocks fluid flow to said front surface, the flowrate of said fluid flow to said rear surface varying depending upon the position of said spool within said first position range, said fluid flow to said rear surface delivering downhole thrust to said body, the magnitude of said downhole thrust depending on the flowrate of said fluid flow to said rear surface, said spool having a second position range in which said valve permits fluid flow from said fluid source to said front surface of said thrust-receiving portion and blocks fluid flow to said rear surface, the flowrate of said fluid flow to said front surface varying depending upon the position of said spool within said second position range, said fluid flow to said front surface delivering uphole thrust to said body, the magnitude of said uphole thrust depending on the flowrate of said fluid flow to said front surface;

a motor on said tractor body;

a coupler connecting said motor and said spool so that operation of said motor causes said spool to move along said spool axis; and a gripper longitudinally movably engaged with said tractor body, said gripper having an actuated position in which said gripper limits movement of said gripper relative to an inner surface of said borehole and a retracted position in which said gripper permits substantially free relative movement of said gripper relative to said inner surface;

wherein said motor is operable to move said spool along said spool axis sufficiently fast to alter the net thrust received by said thrust-receiving portion by 100 pounds within 2 seconds.

43. Apparatus according to claim 42, further comprising:

one or more sensors on said tractor body, configured to generate electrical feedback signals which describe one or more of fluid pressure in said tractor, the position of said tractor body with respect to said gripper, longitudinal load exerted on said tractor body by equipment external to said tractor or by inner walls of said borehole, and the rotational position of an output shaft of said motor, said output shaft controlling the position of said spool along said spool axis; and an electronic logic component on said tractor body, configured to receive and process said electrical feedback signals, said logic component configured to transmit electrical command signals to said motor;

wherein said motor is configured to be controlled by said electrical command signals, said command signals controlling the position of said spool.

44. A long reach rotary drilling assembly for drilling a bore in an underground formation, the assembly including an elongated rotary drill pipe extending from the surface through the bore; a drill bit mounted at a forward end of the drill pipe for drilling the bore through the formation; a 3-D steering tool secured to the drill pipe for making inclination angle adjustments and azimuth angle adjustments at the drill bit during steering, including an onboard telemetry section to receive inclination angle and azimuth angle commands together with actual inclination angle and azimuth angle feedback signals during steering for use in controlling steering of the drill bit along a desired course; and a drilling tractor secured to the drill pipe, the tractor comprising a body, a gripper secured to the body, including a gripper portion having a first position which limits movement of the gripper portion relative to the inner surface of the bore and having a second position in which the gripper portion permits relative movement between the gripper portion and the inner surface of the bore, a propulsion assembly for selectively continuously pulling and thrusting the body with respect to the gripper portion in the first position, and an onboard controller for controlling thrust or pull or speed of the tractor in the bore, the tractor applying force to the drill bit for drilling the bore along the desired course the direction of which is controlled by the steering tool, rotary torque for driving the drill bit transmitted from the surface through the drill pipe and structural components of the 3-D steering tool and the drilling tractor;

in which the drilling tractor comprises:

a body;

a valve on said body, said valve being positioned along a fluid flow path from a source of a first fluid to a thrust-receiving portion of said body, said valve being movable generally along a valve axis, said valve having a first position in which said valve completely blocks fluid flow along said flow path and a second position in which said valve permits fluid flow along said flow path; a motor on said body;

a coupler connecting said motor and said valve so that operation of said motor causes said valve to move along said valve axis; and a pressure compensation piston exposed on a first side to said first fluid and on a second side to a second fluid, said first and second fluids being fluidly separate, said piston configured to move in response to pressure forces from said first and second fluids so as to effectively equalize the pressure of said first and second fluids;

wherein said valve is exposed to said first fluid, said motor being exposed to said second fluid.

45. A long reach rotary drilling assembly for drilling a bore in an underground formation, the assembly including an elongated rotary drill pipe extending from the surface through the bore; a drill bit mounted at a forward end of the drill pipe for drilling the bore through the formation; a 3-D steering tool secured to the drill pipe for making inclination angle adjustments and azimuth angle adjustments at the drill bit during steering, including an onboard telemetry section to receive inclination angle and azimuth angle commands together with actual inclination angle and azimuth angle feedback signals during steering for use in controlling steering of the drill bit along a desired course; and a drilling tractor secured to the drill pipe, the tractor comprising a body, a gripper secured to the body, including a gripper portion having a first position which limits movement of the gripper portion relative to the inner surface of the bore and having a second position in which the gripper portion permits relative movement between the gripper portion and the inner surface of the bore, a propulsion assembly for selectively continuously pulling and thrusting the body with respect to the gripper portion in the first position, and an onboard controller for controlling thrust or pull or speed of the tractor in the bore, the tractor applying force to the drill bit for drilling the bore along the desired course the direction of which is controlled by the steering tool, rotary torque for driving the drill bit transmitted from the surface through the drill pipe and structural components of the 3-D steering tool and the drilling tractor;

in which the drilling tractor comprises:

an elongated body configured to pull equipment within said borehole, said equipment exerting a longitudinal load on said body;

a gripper longitudinally movably engaged with said body, said gripper having an actuated position in which said gripper limits movement between said gripper and an inner surface of said borehole, and a retracted position in which said gripper permits substantially free relative movement between said gripper and said inner surface; and a propulsion system on said body for propelling said body through said borehole while said gripper is in said actuated position;

wherein said body is sufficiently flexible such that said tractor can turn up to 80° per 100 feet of travel, while said longitudinal load is at least 50–30,000 pounds.

46. A long reach rotary drilling assembly for drilling a bore in an underground formation, the assembly including an elongated rotary drill pipe extending from the surface through the bore; a drill bit mounted at a forward end of the drill pipe for drilling the bore through the formation; a 3-D steering tool secured to the drill pipe for making inclination angle adjustments and azimuth angle adjustments at the drill bit during steering, including an onboard telemetry section to receive inclination angle and azimuth angle commands together with actual inclination angle and azimuth angle feedback signals during steering for use in controlling steering of the drill bit along a desired course; and a drilling tractor secured to the drill pipe, the tractor comprising a body, a gripper secured to the body, including a gripper portion having a first position which limits movement of the gripper portion relative to the inner surface of the bore and having a second position in which the gripper portion permits relative movement between the gripper portion and the inner surface of the bore, a propulsion assembly for selectively continuously pulling and thrusting the body with respect to the gripper portion in the first position, and an onboard controller for controlling thrust or pull or speed of the tractor in the bore, the tractor applying force to the drill bit for drilling the bore along the desired course the direction of which is controlled by the steering tool, rotary torque for driving the drill bit transmitted from the surface through the drill pipe and structural components of the 3-D steering tool and the drilling tractor;

including a set of two or more connected tractors for moving within the borehole, comprising a logic component and said tractors, each of said tractors comprising: grippers simultaneously, and also to actuate and retract one or more of said second grippers simultaneously.

47. Apparatus according to claim 46, wherein said valves are controlled by motors, said logic component configured to transmit electronic command signals to said motors, said motors being controlled by said electronic command signals.

48. Apparatus according to claim 46, wherein said logic component resides within one of said tractors.

* * * * *